US009530286B2

(12) United States Patent
Tanimura et al.

(10) Patent No.: US 9,530,286 B2
(45) Date of Patent: Dec. 27, 2016

(54) REEL DEVICE FOR A GAMING MACHINE

(71) Applicants: Universal Entertainment Corporation, Tokyo (JP); Aruze Gaming America, Inc., Las Vegas, NV (US)

(72) Inventors: Tatsuhiko Tanimura, Tokyo (JP); Noritoshi Kukita, Tokyo (JP); Hiroatsu Ike, Tokyo (JP); Yoshitomo Sasaki, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 0 days.

(21) Appl. No.: 14/720,596

(22) Filed: May 22, 2015

(65) Prior Publication Data

US 2015/0317869 A1 Nov. 5, 2015

Related U.S. Application Data

(63) Continuation of application No. 14/283,644, filed on May 21, 2014, now Pat. No. 9,053,614, which is a (Continued)

(30) Foreign Application Priority Data

Nov. 2, 2010 (JP) ..... 2010-246875
Aug. 24, 2011 (JP) ..... 2011-182566

(51) Int. Cl.
*G07F 17/32* (2006.01)
*G07F 17/34* (2006.01)

(52) U.S. Cl.
CPC ..... *G07F 17/34* (2013.01); *G07F 17/3209* (2013.01); *G07F 17/3213* (2013.01); (Continued)

(58) Field of Classification Search
CPC .. G07F 17/32; G07F 17/3202; G07F 17/3213; G07F 17/34; G07F 17/3216
See application file for complete search history.

(56) References Cited

U.S. PATENT DOCUMENTS 3,684,290 A 8/1972 Wayne
4,071,246 A 1/1978 Hooker
(Continued)

FOREIGN PATENT DOCUMENTS

AU 2005200185 A1 8/2005
EP 1557803 A2 7/2005
(Continued)

OTHER PUBLICATIONS

Machine Translation of JP 2003-225342A Published Aug. 12, 2003.*
Office Action dated Sep. 24, 2015 in Japanese patent application No. 2011-182566.

*Primary Examiner* — Dmitry Suhol
*Assistant Examiner* — David Duffy
(74) *Attorney, Agent, or Firm* — Sheppard, Mullin, Richter & Hampton LLP

(57) ABSTRACT

A gaming machine includes: a reel having an outer circumferential surface on which symbols are lined up; a reel driving mechanism which rotates the reel to rearrange the symbols; a magnet which is provided in the reel driving mechanism to change an external magnetic field in accordance with the rotation of the reel; a magnetic force detecting mechanism which detects a magnetic force of the external magnetic field so as to output a magnetic force detection signal; a reel setting unit by which the magnetic force detection signal and arrangement positions of the symbols are associated with one another; and a reel drive control unit which controls the reel driving mechanism so that the symbols are rearranged in a predetermined arrange- (Continued)

ment based on the magnetic force detection signal and the arrangement positions of the symbols.

5 Claims, 77 Drawing Sheets

Related U.S. Application Data continuation of application No. 13/284,190, filed on Oct. 28, 2011, now Pat. No. 8,764,549.

(52) U.S. Cl.
CPC ..... *G07F 17/3216* (2013.01); *G07F 17/3223* (2013.01); *G07F 17/3288* (2013.01)

(56) References Cited

U.S. PATENT DOCUMENTS

| | | | | |
|---|---|---|---|---|
| 4,660,833 | A | 4/1987 | Dickinson et al. | |
| 4,911,449 | A | 3/1990 | Dickinson et al. | |
| 5,058,893 | A | 10/1991 | Dickinson et al. | |
| 5,683,296 | A | 11/1997 | Rasmussen | |
| 5,839,957 | A | 11/1998 | Schneider et al. | |
| 5,863,249 | A | 1/1999 | Inoue | |
| 5,938,196 | A | 8/1999 | Antoja | |
| 5,938,529 | A | 8/1999 | Rodesch et al. | |
| 6,942,571 | B1 | 9/2005 | McAllister et al. | |
| 7,030,608 | B2 | 4/2006 | Kawashima et al. | |
| 8,277,304 | B1 | 10/2012 | Rasmussen et al. | |
| 2005/0159210 | A1 | 7/2005 | Satoh | |
| 2006/0028203 | A1 | 2/2006 | Kawashima et al. | |
| 2007/0008707 | A1 * | 1/2007 | Coutu ..... | H05K 7/2049 361/800 |
| 2008/0305847 | A1 | 12/2008 | Okada | |
| 2009/0191940 | A1 | 7/2009 | Yoshizawa | |
| 2011/0059787 | A1 | 3/2011 | Crossman et al. | |
| 2012/0115568 | A1 | 5/2012 | Fujisawa et al. | |
| 2012/0115569 | A1 | 5/2012 | Fujisawa et al. | |

FOREIGN PATENT DOCUMENTS

| | | | | |
|---|---|---|---|---|
| JP | 2003225342 | A | * | 8/2003 |
| JP | 2004097835 | A | | 4/2004 |
| JP | 2005204745 | A | | 8/2005 |
| JP | 2005-318758 | A | | 11/2005 |
| JP | 2006047227 | A | | 2/2006 |
| JP | 2006223349 | A | * | 8/2006 |
| JP | 2010104408 | A | * | 5/2010 |

* cited by examiner

| CODE NUMBER | FIRST SYMBOL COLUMN SYMBOL |
|---|---|
| 00 | JACKPOT 7 |
| 01 | PLUM |
| 02 | ORANGE |
| 03 | PLUM |
| 04 | ORANGE |
| 05 | PLUM |
| 06 | ORANGE |
| 07 | PLUM |
| 08 | BLUE 7 |
| 09 | CHERRY |
| 10 | ORANGE |
| 11 | BELL |
| 12 | ORANGE |
| 13 | STRAWBERRY |
| 14 | BLUE 7 |
| 15 | ORANGE |
| 16 | APPLE |
| 17 | PLUM |
| 18 | ORANGE |
| 19 | PLUM |
| 20 | BLUE 7 |
| 21 | CHERRY |

BUTTON LAYOUT

FIG.42

| | FIRST SYMBOL COLUMN | SECOND SYMBOL COLUMN | THIRD SYMBOL COLUMN | FOURTH SYMBOL COLUMN | FIFTH SYMBOL COLUMN |
|---|---|---|---|---|---|
| CODE NUMBER | SYMBOL | SYMBOL | SYMBOL | SYMBOL | SYMBOL |
| 00 | JACKPOT 7 | JACKPOT 7 | JACKPOT 7 | JACKPOT 7 | JACKPOT 7 |
| 01 | PLUM | BELL | CHERRY | ORANGE | APPLE |
| 02 | ORANGE | APPLE | ORANGE | PLUM | ORANGE |
| 03 | PLUM | BELL | APPLE | STRAWBERRY | BELL |
| 04 | ORANGE | CHERRY | ORANGE | BELL | PLUM |
| 05 | PLUM | ORANGE | PLUM | PLUM | BLUE 7 |
| 06 | ORANGE | PLUM | ORANGE | APPLE | ORANGE |
| 07 | PLUM | CHERRY | PLUM | BLUE 7 | APPLE |
| 08 | BLUE 7 | BELL | ORANGE | PLUM | PLUM |
| 09 | CHERRY | APPLE | PLUM | ORANGE | BELL |
| 10 | ORANGE | BELL | ORANGE | BELL | CHERRY |
| 11 | BELL | STRAWBERRY | PLUM | ORANGE | PLUM |
| 12 | ORANGE | PLUM | BELL | PLUM | BELL |
| 13 | STRAWBERRY | BLUE 7 | STRAWBERRY | CHERRY | ORANGE |
| 14 | BLUE 7 | BELL | BLUE 7 | APPLE | APPLE |
| 15 | ORANGE | APPLE | BELL | STRAWBERRY | PLUM |
| 16 | APPLE | BELL | CHERRY | CHERRY | CHERRY |
| 17 | PLUM | STRAWBERRY | PLUM | BELL | ORANGE |
| 18 | ORANGE | PLUM | ORANGE | PLUM | BELL |
| 19 | PLUM | CHERRY | PLUM | ORANGE | ORANGE |
| 20 | BLUE 7 | BELL | ORANGE | CHERRY | PLUM |
| 21 | CHERRY | APPLE | PLUM | PLUM | STRAWBERRY |

FIG.43

PAYOUT CONTROL TABLE

| WINNING COMBINATION | BASE GAME |
|---|---|
| PLUM | 5 |
| ORANGE | 8 |
| BELL | 10 |
| CHERRY | 20 |
| STRAWBERRY | 30 |
| BLUE 7 | 40 |

FIG.44

FREE GAME QUANTITY TABLE

| ACCUMULATED POINTS | NUMBER OF FREE GAMES TO BE PLAYED |
|---|---|
| 0 | 10 |
| 1 | 20 |
| 2 | 40 |
| 3 | 60 |
| 4 | 80 |
| 5 | 100 |
| 6 | 120 |
| 7 | 140 |
| 8 | 160 |
| 9 | 180 |
| 10 | 200 |

FIG.45

REEL SETTING TABLE

| | FIRST SYMBOL COLUMN | DETECTED MAGNETIC FORCE |
|---|---|---|
| CODE NUMBER | SYMBOL | |
| 00 | JACKPOT 7 | NU0(SD0) |
| | | NU1 |
| 01 | PLUM | ⋮ |
| 02 | ORANGE | |
| 03 | PLUM | |
| 04 | ORANGE | NU126 |
| | | NU127 |
| 05 | PLUM | NU128 |
| | | ND127 |
| 06 | ORANGE | ND126 |
| 07 | PLUM | ⋮ |
| 08 | BLUE 7 | ND78 |
| 09 | CHERRY | ⋮ |
| 10 | ORANGE | ND1 |
| | | ND0 |
| 11 | BELL | SU1 |
| | | SU2 |
| 12 | ORANGE | ⋮ |
| 13 | STRAWBERRY | |
| 14 | BLUE 7 | |
| 15 | ORANGE | |
| 16 | APPLE | SU127 |
| | | SU128 |
| 17 | PLUM | SD127 |
| | | SD126 |
| 18 | ORANGE | ⋮ |
| 19 | PLUM | |
| 20 | BLUE 7 | |
| 21 | CHERRY | SD1 |
| | | SD0(NU0) |

OPERATION INSTRUCTION SIGNAL

DETECTED MAGNETIC FORCE TABLE

| DETECTED MAGNETIC FORCE | MAGNETIC FORCE | |
|---|---|---|
| | SOUTH POLE | NORTH POLE |
| NU0(SD0) | | |
| NU1 | | |
| ⋮ | | |
| NU126 | | |
| NU127 | | |
| NU128 | | |
| ND127 | | |
| ND126 | | |
| ⋮ | | |
| ND78 | | |
| ⋮ | | |
| ND1 | | |
| ND0 | | |
| SU1 | | |
| SU2 | | |
| ⋮ | | |
| SU127 | | |
| SU128 | | |
| SD127 | | |
| SD126 | | |
| ⋮ | | |
| SD1 | | |
| SD0(NU0) | | |
| NU1 | | |
| ⋮ | | |
| NU126 | | |
| NU127 | | |
| NU128 | | |
| ND127 | | |
| ND126 | | |
| ⋮ | | |

| CODE NUMBER | FIRST SYMBOL COLUMN SYMBOL |
|---|---|
| 00 | JACKPOT 7 |
| 01 | PLUM |
| 02 | ORANGE |
| 03 | PLUM |
| 04 | ORANGE |
| 05 | PLUM |
| 06 | ORANGE |
| 07 | PLUM |
| 08 | BLUE 7 |
| 09 | CHERRY |
| 10 | ORANGE |
| 11 | BELL |
| 12 | ORANGE |
| 13 | STRAWBERRY |
| 14 | BLUE 7 |
| 15 | ORANGE |
| 16 | APPLE |
| 17 | PLUM |
| 18 | ORANGE |
| 19 | PLUM |
| 20 | BLUE 7 |
| 21 | CHERRY |

FIG.55

| FIELD | CALCULATION FORMULA | ITEM VALUE | SYMBOL DATA | | | | |
|---|---|---|---|---|---|---|---|
| REEL NUMBER | | 1 | | | | | |
| NUMBER OF SYMBOLS N | | 22 | | | | | |
| CODE NUMBER | | | 00 | 01 | 02 | | 21 |
| NUMBER OF PULSES IN CYCLE EP | | 200 | | | | | |
| NUMBER OF PULSES FOR EACH SYMBOL UP | EP/N | 18 | | | | | |
| SYMBOL BOUNDARY VALUE Pn | WHEN n=N-1<br>Pn=UPn × n<br>WHEN n=N<br>Pn=EP | | 18 | 36 | 54 | --------- | 180 |
| SYMBOL CENTER VALUE SPn | SPn≒Pn-Upn/2 | | 9 | 27 | 45 | | 171 |
| CORRECTION PULSE VALUE AP | WHEN THE ROTATIONAL DIRECTION IS POSITIVE<br>AP=AP<br>WHEN THE ROTATIONAL DIRECTION IS NEGATIVE<br>AP=EP-AP | 70 | | | | | |
| CORRECTION SYMBOL CENTER VALUE ASPn | ASPn=SPn+AP | | 79 | 97 | 115 | | 241 |

| CODE NUMBER | FIRST SYMBOL COLUMN SYMBOL |
|---|---|
| 00 | JACKPOT 7 |
| 01 | PLUM |
| 02 | ORANGE |
| 03 | PLUM |
| 04 | ORANGE |
| 05 | PLUM |
| 06 | ORANGE |
| 07 | PLUM |
| 08 | BLUE 7 |
| 09 | CHERRY |
| 10 | ORANGE |
| 11 | BELL |
| 12 | ORANGE |
| 13 | STRAWBERRY |
| 14 | BLUE 7 |
| 15 | ORANGE |
| 16 | APPLE |
| 17 | PLUM |
| 18 | ORANGE |
| 19 | PLUM |
| 20 | BLUE 7 |
| 21 | CHERRY |

FIG.60

ILLUMINATION MODE SETTING TABLE

| FIELD | GRADATION 〈YES:1〉 〈NO :0〉 | FLICKERING FLICKERING INTERVAL: 0～5 | LIGHT AMOUNT LIGHT AMOUNT LEVEL: 5～16 | MOVEMENT 〈YES:1〉 〈NO :0〉 〈INTERLOCKING:2〉 |
|---|---|---|---|---|
| REEL POSITIVE ROTATION | 1 | 3 | 13 | 1 |
| REEL NEGATIVE ROTATION | 0 | 1 | 10 | 0 |
| REEL ROTATION SPEED | — | — | — | 2 |
| REEL ROTATION STOP | 0 | 0 | 8 | 0 |
| BONUS WIN | 1 | 5 | 15 | 1 |
| COMMON GAME WIN | 0 | 4 | 15 | 1 |
| LOSE | 0 | 0 | 8 | 0 |
| RIICHI | 1 | 5 | 14 | 1 |
| COMMON GAME WINNING | 0 | 0 | 15 | 1 |
| COMMON GAME LOSING | 0 | 0 | 12 | 0 |

| CODE NUMBER | FIRST SYMBOL COLUMN シンボル |
|---|---|
| 00 | JACKPOT 7 |
| 01 | PLUM |
| 02 | ORANGE |
| 03 | PLUM |
| 04 | ORANGE |
| 05 | PLUM |
| 06 | ORANGE |
| 07 | PLUM |
| 08 | BLUE 7 |
| 09 | CHERRY |
| 10 | ORANGE |
| 11 | BELL |
| 12 | ORANGE |
| 13 | STRAWBERRY |
| 14 | BLUE 7 |
| 15 | ORANGE |
| 16 | APPLE |
| 17 | PLUM |
| 18 | ORANGE |
| 19 | PLUM |
| 20 | BLUE 7 |
| 21 | CHERRY |

FIG.66

REEL SETTING TABLE

| | FIRST SYMBOL COLUMN | DETECTED MAGNETIC FORCE |
|---|---|---|
| CODE NUMBER | SYMBOL | |
| 00 | JACKPOT7 | NU27-NU35 |
| 01 | PLUM | NU36-NU44 |
| 02 | ORANGE | NU45-ND46 |
| 03 | PLUM | ND45-ND37 |
| 04 | ORANGE | ND36-ND28 |
| 05 | PLUM | ND27-ND19 |
| 06 | ORANGE | ND18 |
| | | ND17 |
| | | ND16 |
| | | ND15 |
| | | ND14 |
| | | ND13 |
| | | ND12 |
| | | ND11 |
| | | ND10 |
| 07 | PLUM7 | ND9 |
| | | ND8 |
| | | ND7 |
| | | ND6 |
| | | ND5 |
| | | ND4 |
| | | ND3 |
| | | ND2 |
| | | ND1 |
| | | ND0 |
| 08 | BLUE7 | SU1-SU9 |
| 09 | CHERRY | SU10-SU18 |
| 10 | ORANGE | SU19-SU27 |
| 11 | BELL | SU28-SU36 |
| 12 | ORANGE | SU37-SU45 |
| 13 | STRAWBERRY | SU46-SD45 |
| 14 | BLUE7 | SD44-SD36 |
| 15 | ORANGE | SD35-SD27 |
| 16 | APPLE | SD26-SD18 |
| 17 | PLUM | SD17-SD9 |
| 18 | ORANGE | SD8-SD1 |
| 19 | PLUM | NU0-NU8 |
| 20 | BLUE7 | NU9-NU17 |
| 21 | CHERRY | NU18-NU26 |

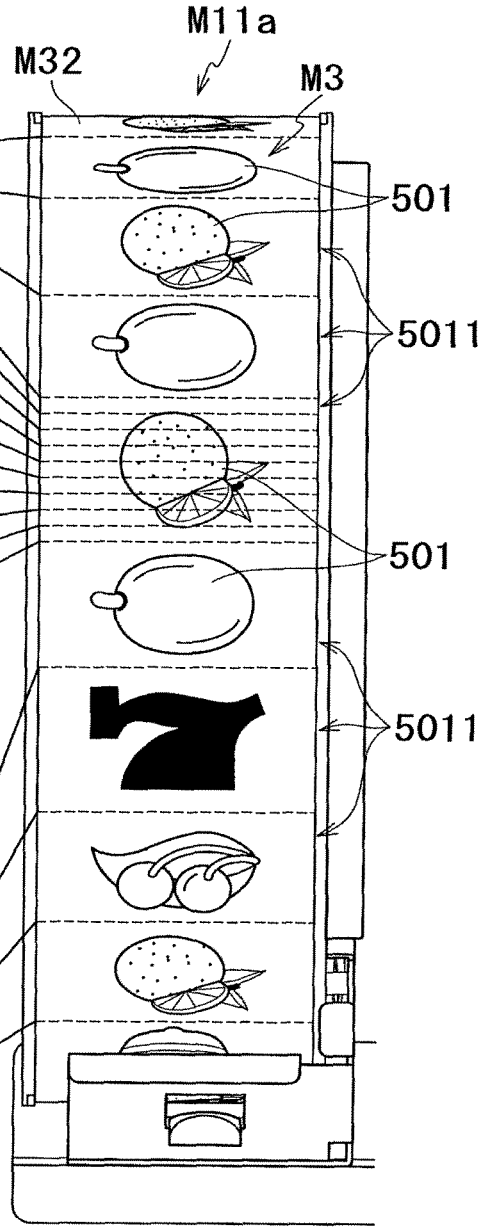

| CODE NUMBER | FIRST SYMBOL COLUMN SYMBOL |
|---|---|
| 00 | JACKPOT 7 |
| 01 | PLUM |
| 02 | ORANGE |
| 03 | PLUM |
| 04 | ORANGE |
| 05 | PLUM |
| 06 | ORANGE |
| 07 | PLUM |
| 08 | BLUE 7 |
| 09 | CHERRY |
| 10 | ORANGE |
| 11 | BELL |
| 12 | ORANGE |
| 13 | STRAWBERRY |
| 14 | BLUE 7 |
| 15 | ORANGE |
| 16 | APPLE |
| 17 | PLUM |
| 18 | ORANGE |
| 19 | PLUM |
| 20 | BLUE 7 |
| 21 | CHERRY |

REEL SETTING TABLE

| | FIRST SYMBOL COLUMN | DETECTED MAGNETIC FORCE |
|---|---|---|
| CODE NUMBER | SYMBOL | |
| 00 | JACKPOT 7 | NU27–NU35 |
| 01 | PLUM | NU36–NU44 |
| 02 | ORANGE | NU45–ND46 |
| 03 | PLUM | ND45–ND37 |
| 04 | ORANGE | ND36–ND28 |
| 05 | PLUM | ND27–ND19 |
| 06 | ORANGE | ND18–ND10 |
| 07 | PLUM | ND9–ND0 |
| 08 | BLUE 7 | SU1–SU9 |
| 09 | CHERRY | SU10–SU18 |
| 10 | ORANGE | SU19–SU27 |
| 11 | BELL | SU28–SU36 |
| 12 | ORANGE | SU37–SU45 |
| 13 | STRAWBERRY | SU46–SD45 |
| 14 | BLUE 7 | SD44–SD36 |
| 15 | ORANGE | SD35–SD27 |
| 16 | APPLE | SD26–SD18 |
| 17 | PLUM | SD17–SD9 |
| 18 | ORANGE | SD8–SD1 |
| 19 | PLUM | NU0–NU8 |
| 20 | BLUE 7 | NU9–NU17 |
| 21 | CHERRY | NU18–NU26 |

REEL DEVICE FOR A GAMING MACHINE

CROSS REFERENCE TO RELATED APPLICATION

This application is a continuation of U.S. application Ser. No. 14/283,644, filed on May 21, 2014, which is a continuation of U.S. application Ser. No. 13/284,190, filed on Oct. 28, 2011, now issued as U.S. Pat. No. 8,764,549 on Jul. 1, 2014, which claims priority from Japanese Patent Application No. 2010-246875 which was filed on Nov. 2, 2010, and Japanese Patent Application No. 2011-182566 which was filed on Aug. 24, 2011, the disclosures of which are herein incorporated by reference in their entirety.

BACKGROUND OF THE INVENTION

1. Field of the Invention

The present invention relates to a gaming machine executing a slot game whose result is determined in accordance with a combination of symbols, and a reel device thereof.

2. Description of Related Art

A gaming machine executing a slot game determines a result of the game based on a combination of rearranged symbols. As a method for rearranging symbols, there is a mechanical reel method of mechanically moving and stopping symbols. A gaming machine adopting a conventional mechanical reel method has a reel device which includes reels each having an outer circumferential surface on which symbols are lined up, a reel driving mechanism which rotates the reels, and a home position detecting mechanism which detects the home position of each reel. For example, the home position detecting mechanism detects positions of components including the home position of a reel in such a way that plural different protrusions are formed on the inner circumference of a disc which rotates with the reel, and these protrusions are detected by a sensor (Specification of published U.S. patent application No. 2005/0159210, Specification of Australian patent application No. 2005200185, Specification of published European patent application No. 1557803A2, and Japanese Unexamined Patent Publication No. 2005-204745). As such, the gaming machine can rearrange symbols to form a predetermined combination based on the rotation angles of the reels, by determining the relation between the reel and the symbols with reference to the home position.

However, the conventional arrangement above requires, when symbols are lined up on the outer circumferential surface of a reel, the determination of the position of each symbol with respect to a predetermined position (home position) of the reel, in order to determine the positional relation between the reel and the symbols. As such, the conventional arrangement requires the player to concentrate on the determination of the position of each symbol, and hence lining up the symbols on the reel would weigh heavily on the player.

An object of the present invention is to provide a gaming machine which is capable of reducing the burden of lining up symbols on a reel and a reel device thereof.

SUMMARY OF THE INVENTION

According to the first aspect of the invention, a gaming machine includes: a reel having an outer circumferential surface on which symbols are lined up; a reel driving mechanism which rotates the reel to rearrange the symbols; a magnet which is provided in the reel driving mechanism to change an external magnetic field in accordance with the rotation of the reel; a magnetic force detecting mechanism which detects a magnetic force of the external magnetic field so as to output a magnetic force detection signal; a reel setting unit by which the magnetic force detection signal and arrangement positions of the symbols are associated with one another; and a reel drive control unit which controls the reel driving mechanism so that the symbols are rearranged in a predetermined arrangement based on the magnetic force detection signal and the arrangement positions of the symbols.

According to the arrangement above, it is possible to indirectly detect the arrangement positions of the symbols based on the magnetic force detection signal even if the arrangement positions of the symbols are not directly detected by a sensor or the like, because the magnetic force detection signal obtained by detecting the magnetic force of the external magnetic field changing in accordance with the rotation of the reel is associated with the arrangement positions of the symbols. Since this makes it possible to specify the symbols on the reel even if the positional relation between the symbols and the reel is not set in advance, the symbols can be rearranged at predetermined positions. As a result, when the symbols are to be lined up on the outer circumferential surface of the reel, the workload required to line up the symbols at predetermined positions (home position) on the reel is reduced as compared to cases where the symbols are lined up while their positions are determined one by one.

The gaming machine according to the first aspect may further include an external control unit which outputs an operation instruction signal in response to an external operation, the reel setting unit setting the magnetic force detection signal, which is detected at the timing of the output of the operation instruction signal, as a home position of the reel.

According to the arrangement above, since the external operation unit outputs an operation instruction signal in response to an external operation, the positioning of the symbols with respect the home position of the reel only requires the operator to operate the reel setting unit when the symbols are in a predetermined arrangement, while visually checking the arrangement of the symbols. As such, it is possible to easily start the operation to set the positional relation between the symbols and the reel, by an operation of the reel setting unit.

The magnet of the first aspect may be disc-shaped, have a rotation center coaxial with the rotational axis of the reel, and have north and south poles which are symmetrical with each other about the rotation center.

According to the arrangement above, since the magnet has north and south poles which are symmetrical with each other about the rotational center, changes in the external magnetic field in accordance with the rotation of the magnet in line with the rotation of the reel form a sine curve. This makes it possible to easily realize changes in the external magnetic field.

According to the first aspect, a reel device includes: a reel having an outer circumferential surface on which symbols are lined up; a reel driving mechanism which rotates the reel to rearrange the symbols; a magnet which is provided in the reel driving mechanism to change an external magnetic field in accordance with the rotation of the reel; a magnetic force detecting mechanism which detects a magnetic force of the external magnetic field so as to output a magnetic force detection signal; and a reel setting unit by which the magnetic force detection signal and arrangement positions of the symbols are associated with one another.

According to the arrangement above, it is possible to indirectly detect the arrangement positions of the symbols based on the magnetic force detection signal even if the arrangement positions of the symbols are not directly detected by a sensor or the like, because the magnetic force detection signal obtained by detecting the magnetic force of the external magnetic field changing in accordance with the rotation of the reel is associated with the arrangement positions of the symbols. Since this makes it possible to specify the symbols on the reel even if the positional relation between the symbols and the reel is not set in advance, the symbols can be rearranged at predetermined positions. As a result, when the symbols are to be lined up on the outer circumferential surface of the reel, the workload required to line up the symbols at predetermined positions (home position) on the reel is reduced as compared to cases where the symbols are lined up while their positions are determined one by one.

According to the second aspect of the invention, a gaming machine includes: a reel having an outer circumferential surface on which symbols are lined up; a reel driving mechanism which rearranges the symbols by rotating the reel; a reel angle detection mechanism which outputs a position pulse signal each time the reel rotates for a predetermined angle and a home position pulse signal for one rotation of the reel; a reel setting unit by which the home position pulse signal and the arrangement positions of the symbols are associated with one another by means of a correction pulse value based on the position pulse signal; and a reel drive control unit which controls the reel driving mechanism so that the symbols are rearranged in a predetermined arrangement based on the magnetic force detection signal and the arrangement positions of the symbols.

According to the arrangement above, by associating the home position pulse signal with the arrangement positions of the symbols by using the correction pulse value generated based on the position pulse signal output in units of the predetermined angle, the slot machine can indirectly detect the arrangement positions of the symbols based on the home position pulse signal, the correction pulse value, and the phase difference pulse signal, even if the arrangement positions of the symbols are not directly detected by a sensor or the like. For this reason, even if the positional relation between the symbols and the reel is not determined in advance, the symbols arranged on the reel are specified, with the result that the symbols are rearranged in the predetermined arrangement. As a result, it is possible to reduce the workload required for lining up the symbols on the outer circumferential surface of the reel, as compared to the case where the symbols are lined up while the positions thereof are determined based on a predetermined position (home position) of the reel.

The gaming machine according to the second aspect may further include an external operation unit which outputs a operation instruction signal in response to an external operation, the reel setting unit starting the counting o position pulse signals at the timing of the output of the operation instruction signal, and the value when the counting is stopped at the timing of the output of the home position pulse signal being set as the correction pulse value.

According to the arrangement above, since the external operation unit outputs an operation instruction signal in response to an external operation, the operation to arrange a symbol at the predetermined position (home position) on the reel only requires the operator to operate the external operation unit when the symbols are in a predetermined arrangement, while visually checking the arrangement of the symbols. As such, it is possible to easily start the operation to set the positional relation between the symbols and the reel, by an operation of the external operation unit.

The second aspect may be arranged so that, the reel angle detection mechanism outputs phase difference pulse signal indicating whether the rotation of the reel is positive or negative, the reel setting unit detects the rotational direction, positive or negative, of the reel by the phase difference pulse signal, and the phase difference pulse signals in the positive rotation is canceled out with the phase difference pulse signals in the negative rotation, when the phase difference pulse signals are counted.

According to the arrangement above, it is possible to precisely obtain the correction pulse values even if the reel does not rotate in one direction, by cancelling out the phase difference pulse signals in the positive rotation with the phase difference pulse signals in the negative rotation.

The reel angle detection mechanism according to the second aspect may include an encoder unit which has a reel-interlocked shaft connected to the rotation center of the reel and a signal output unit which outputs the position pulse signal, the home position pulse signal, and the phase difference pulse signal by magnetically detecting the rotation of the reel-interlocked shaft.

According to the arrangement above, since signals such as the home position pulse signal reel are easily obtained as the reel-interlocked shaft is connected to the rotation center of the encoder unit, the setting of the positional relation between the symbols and the reel and the rearrangement of the symbols in the predetermined arrangement are easily realized.

The gaming machine according to the second aspect may further include reel home position detecting mechanism which detects the home position of the reel and malfunction detection unit which detects a malfunction of the reel angle detection mechanism based on the relation between the home position of the reel and the home position pulse signal.

According to this arrangement, it is possible to prevent a malfunction that the reel drive control unit cannot rearrange the symbols in a predetermined arrangement from occurring, by detecting a malfunction of the reel angle detection mechanism.

According to the second aspect, a reel device includes a reel having an outer circumferential surface on which the symbols are lined up, a reel driving mechanism which rearranges the symbols by rotating the reel, a reel angle detection mechanism which outputs a position pulse signal each time the reel rotates for a predetermined angle and a home position pulse signal for one rotation of the reel, and a reel setting unit by which the home position pulse signal and the arrangement positions of the symbols are associated with one another by means of a correction pulse value based on the position pulse signal.

According to this arrangement, by associating the home position pulse signal with the arrangement positions of the symbols by using the correction pulse value generated based on the position pulse signal output in units of the predetermined angle, the slot machine can indirectly detect the arrangement positions of the symbols based on the home position pulse signal, the correction pulse value, and the phase difference pulse signal, even if the arrangement positions of the symbols are not directly detected by a sensor or the like. For this reason, even if the positional relation between the symbols and the reel is not determined in advance, the symbols lined up on the reel are specified, with the result that the symbols are rearranged in the predetermined arrangement. As a result, it is possible to reduce the workload required for lining up the symbols on the outer circumferential surface of the reel, as compared to the case where the symbols are lined up while the positions thereof are determined based on a predetermined position (home position) of the reel.

According to the third aspect, a gaming machine includes a reel having an outer circumferential surface on which the symbols are lined up, a reel driving mechanism which rearranges the symbols by rotating the reel, a reel angle detection mechanism which outputs a position pulse signal each time the reel rotates for a predetermined angle and a home position pulse signal for one rotation of the reel, a reel setting unit by which the home position pulse signal and the arrangement positions of the symbols are associated with one another by means of a correction pulse value based on the position pulse signal, and a reel drive control unit which controls the reel driving mechanism so that the symbols are rearranged in a predetermined arrangement based on the magnetic force detection signal and the arrangement positions of the symbols.

According to the arrangement above, by associating the home position pulse signal with the arrangement positions of the symbols by using the correction pulse value generated based on the position pulse signal output in units of the predetermined angle, the slot machine can indirectly detect the arrangement positions of the symbols based on the home position pulse signal, the correction pulse value, and the phase difference pulse signal, even if the arrangement positions of the symbols are not directly detected by a sensor or the like. For this reason, even if the positional relation between the symbols and the reel is not determined in advance, the symbols arranged on the reel are specified, with the result that the symbols are rearranged in the predetermined arrangement. As a result, it is possible to reduce the workload required for lining up the symbols on the outer circumferential surface of the reel, as compared to the case where the symbols are lined up while the positions thereof are determined based on a predetermined position (home position) of the reel.

According to the third aspect, the gaming machine may further include an external operation unit which outputs a operation instruction signal in response to an external operation, the reel setting unit starting the counting o position pulse signals at the timing of the output of the operation instruction signal, and the value when the counting is stopped at the timing of the output of the home position pulse signal being set as the correction pulse value.

According to the arrangement above, since the external operation unit outputs an operation instruction signal in response to an external operation, the operation to arrange a symbol at the predetermined position (home position) on the reel only requires the operator to operate the external operation unit when the symbols are in a predetermined arrangement, while visually checking the arrangement of the symbols. As such, it is possible to easily start the operation to set the positional relation between the symbols and the reel, by an operation of the external operation unit.

The third aspect may be arranged so that, the reel angle detection mechanism outputs phase difference pulse signal indicating whether the rotation of the reel is positive or negative, the reel setting unit detects the rotational direction, positive or negative, of the reel by the phase difference pulse signal, and the phase difference pulse signals in the positive rotation is canceled out with the phase difference pulse signals in the negative rotation, when the phase difference pulse signals are counted.

According to the arrangement above, it is possible to precisely obtain the correction pulse values even if the reel does not rotate in one direction, by cancelling out the phase difference pulse signals in the positive rotation with the phase difference pulse signals in the negative rotation.

The reel angle detection mechanism according to the third aspect may include an encoder unit which has a reel-interlocked shaft connected to the rotation center of the reel and a signal output unit which outputs the position pulse signal, the home position pulse signal, and the phase difference pulse signal by magnetically detecting the rotation of the reel-interlocked shaft.

According to the arrangement above, since signals such as the home position pulse signal reel are easily obtained as the reel-interlocked shaft is connected to the rotation center of the encoder unit, the setting of the positional relation between the symbols and the reel and the rearrangement of the symbols in the predetermined arrangement are easily realized.

The gaming machine according to the third aspect may further include reel home position detecting mechanism which detects the home position of the reel and malfunction detection unit which detects a malfunction of the reel angle detection mechanism based on the relation between the home position of the reel and the home position pulse signal.

According to this arrangement, it is possible to prevent a malfunction that the reel drive control unit cannot rearrange the symbols in a predetermined arrangement from occurring, by detecting a malfunction of the reel angle detection mechanism.

According to the third aspect, a reel device includes a reel having an outer circumferential surface on which the symbols are lined up, a reel driving mechanism which rearranges the symbols by rotating the reel, a reel angle detection mechanism which outputs a position pulse signal each time the reel rotates for a predetermined angle and a home position pulse signal for one rotation of the reel, and a reel setting unit by which the home position pulse signal and the arrangement positions of the symbols are associated with one another by means of a correction pulse value based on the position pulse signal.

According to this arrangement, by associating the home position pulse signal with the arrangement positions of the symbols by using the correction pulse value generated based on the position pulse signal output in units of the predetermined angle, the slot machine can indirectly detect the arrangement positions of the symbols based on the home position pulse signal, the correction pulse value, and the phase difference pulse signal, even if the arrangement positions of the symbols are not directly detected by a sensor or the like. For this reason, even if the positional relation between the symbols and the reel is not determined in advance, the symbols arranged on the reel are specified, with the result that the symbols are rearranged in the predetermined arrangement. As a result, it is possible to reduce the workload required for lining up the symbols on the outer circumferential surface of the reel, as compared to the case where the symbols are lined up while the positions thereof are determined based on a predetermined position (home position) of the reel.

According to the fourth aspect, a reel device includes an annular reel band (reel) on which symbols are lined up and reel frame (reel) having a outer circumferential surface on which the reel band is provided, the reel frame including drive-side reel frame supporting one end of the reel band, a driven-side reel frame supporting the other end of the reel band, a frame connecting member connecting the outer circumferences of the drive-side reel frame and the driven-side reel frame with each other, and reel driving mechanism which rotates the drive-side reel frame so as to rearrange the symbols.

According to the arrangement above, since the reel is arranged so that the reel frame is constructed by connecting the drive-side reel frame with the driven-side reel frame by the frame connecting member, the width of the reel frame, i.e., the width of the reel having the reel frame and the reel band is easily changeable only by changing the length of the frame connecting member.

According to the fourth aspect, each of the drive-side reel frame and the driven-side reel frame may have reel band fitting portion which is fitted with an end portion of the reel band.

According to the arrangement above, during the construction of the reel frame by connecting the drive-side reel frame with the driven-side reel frame by the frame connecting member, the reel band is easily attached to the reel frame by sandwiching the end portions of the reel band from the respective sides by the reel band fitting portions of the drive-side reel frame and the driven-side reel frame.

The reel band fitting portion according to the fourth aspect may be formed to fit to the whole circumference of the reel band.

According to the arrangement above, as the reel frame supports the whole circumference of the reel band, the shape of the reel band is more properly maintained by the reel frame.

The frame connecting member according to the fourth aspect may be disposed to be able to support the bottom surface of the reel band.

This arrangement further ensures the shape of the reel band to be properly maintained by the reel frame.

According to the fifth aspect, a gaming machine includes a reel having a reel band which is arranged to be able to transmit illumination light and on which symbols are lined up, a reel driving mechanism which rearranges the symbols by rotating the reel, a backlight apparatus which emits illumination light from the inner circumference side of the reel toward the reel band to allow the illumination light having passed through the reel band to be visible from the outside, and a backlight control unit which controls the emission states (light amount, color, emission interval, emission timings, or the like) of the illumination light emitted from the backlight apparatus. The backlight apparatus is provided with a plurality of illumination light sources which are in parallel to the width directions and the longitudinal directions of the reel band and can change the amount of illumination light stepwise, and the backlight control unit is individually controllable the illumination light sources.

Since the emission states of the illumination light are individually controllable at each light source, the effects and the freedom of the effects are enhanced by using the illumination light.

The backlight control unit according to the fifth aspect may individually controllable the illumination light source so that the emission states of the illumination light correspond to the rotation of the reel.

According to the arrangement above, as the emission states of the illumination light correspond to the rotation of the reel, the freedom of the effects during the rotation of the reel is enhanced.

The backlight control unit according to the fifth aspect may control the illumination light sources to increase or decrease the light amounts stepwise from the inside to the outside of the reel band in the width directions and the longitudinal directions.

According to the arrangement above, by the stepwise increase or decrease in the light amounts, it is possible to produce gradation effects for the symbols and the reel band through which the illumination light passes.

The backlight control unit according to the fifth aspect may control the emission states of the illumination light sources in accordance with the rotational direction of the reel.

This makes it possible to produce effects in accordance with the rotational direction of the reel.

The backlight control unit according to the fifth aspect may control the illumination light sources so that the direction of increase or decrease in the light amounts is changed in accordance with the rotational direction of the reel.

This makes it possible to produce an effect in accordance with the rotational direction of the reel.

The backlight control unit according to the fifth aspect may control the illumination light sources so that the speed of increase or decrease in the light amounts is changed in accordance with the rotation speed of the reel.

This makes it possible to produce effects in accordance with the rate of rotation of the reel.

The backlight control unit according to the fifth aspect may control the emission states of the illumination light sources in accordance with a combination of the rearranged symbols.

This makes it possible to produce effects in accordance with combinations of rearranged symbols.

According to the sixth aspect of the invention, a reel device includes a reel having an outer circumferential surface on which symbols are lined up, a reel driving mechanism which rearranges the symbols by rotating the reel, and an effect-light emitter emitting a plurality of sets of effect light to be visible from the outside.

This makes it possible to enhance the effects and the freedom of the effects during the rotation of the reel and the rearrangement of the symbols.

According to the sixth aspect, the gaming machine includes a reel having an outer circumferential surface on which symbols are lined up, a reel driving mechanism which rearranges the symbols by rotating the reel, a reel device having an effect-light emitter emitting a plurality of sets of effect light to be visible from the outside, and the gaming machine further includes a reel effect control unit which controls the emission states (light amount, color, emission interval, emission timings, or the like) of the illumination light emitted from the reel device. The effect-light emitter is disposed along at least the longitudinal directions of the reel band and has a plurality of effect light sources each of which can change the light amount of effect light stepwise, and the reel effect control unit can control each effect light source to change the emission states of the effect light in accordance with the rotation of the reel.

This makes it possible to enhance the effects and the freedom of the effects during the rotation of the reel and the rearrangement of the symbols.

The reel effect control unit according to the sixth aspect may control the emission states of the illumination light sources in accordance with the rotation of the reel.

This makes it possible to produce effects in accordance with the rotation of the reel.

The reel effect control unit according to the sixth aspect may control the illumination light sources so that the direction of increase or decrease in the light amounts is changed in accordance with the rotational direction of the reel.

This makes it possible to produce effects in accordance with the rotation of the reel.

The reel effect control unit according to the sixth aspect may control the illumination light sources so that the rate of increase or decrease in the light amounts is changed in accordance with the rotation speed of the reel.

This makes it possible to produce effects in accordance with the rotation speed of the reel.

The reel effect control unit according to the sixth aspect may control the emission states of the illumination light sources in accordance with a combination of the rearranged symbols.

This makes it possible to produce effects in accordance with combinations of rearranged symbols.

According to the seventh aspect, a reel device includes reel having an outer circumferential surface on which symbols are lined up and reel driving mechanism which rotates the reel so as to rearrange the symbols. The reel has blade mechanism which causes air to flow in accordance with the rotation of the reel, and the reel driving mechanism has reel motor which exerts a rotational force to the reel and a heat sink which dissipates heat by enlarging the size of the surface of the reel motor.

According to the arrangement above, the reel motor is cooled without needing any dedicated electrical lines.

According to the seventh aspect, the reel may include an annular reel band on which symbols are lined up and a reel frame having the blade mechanism on the inner circumference side.

According to the arrangement above, the blade mechanism is attached to the inner circumference side of the reel frame, and hence a function of cooling the reel motor is implemented without requiring upsizing.

The reel frame according to the seventh aspect includes drive-side reel frame supporting one end of the reel band, driven-side reel frame supporting the other end of the reel band, and reel supporting member which is connected to the drive-side reel frame and receives a rotational force from the reel driving mechanism, the blade mechanism having a plurality of plate portions provided on the reel supporting member to flow air forward or backward in the direction toward the reel driving mechanism.

According to the arrangement above, the reel driving mechanism is efficiently cooled.

According to the eighth aspect of the invention, a reel device includes reel unit which rearranges symbols by rotating a reel having an outer circumferential surface on which the symbols are lined up and reel unit supporting mechanism which detachably support the reel unit, and the reel unit supporting mechanism includes a reel unit supporting plate attachable to the cabinet of the gaming machine and sliding-supporting mechanism which is provided on the reel unit supporting plate and supports the reel unit to be slidable toward the front surface side of the cabinet.

According tot arrangement above, when the reel unit supporting plate is attached to the cabinet of the gaming machine, the reel unit is detached or attached from or to the sliding-supporting mechanism only by sliding the reel unit with respect to the reel unit supporting plate, with the result that steps such as screwing, which have conventionally been required, are unnecessary.

The reel unit according to the eighth aspect may include a first connector of electric wires, and the reel unit supporting plate may have a second connector which is detachable to the first connector by the sliding movement of the reel unit.

According to the arrangement above, since it is possible to detach the connectors from each other by only sliding the reel unit with respect to the reel unit supporting plate, operations to attach or detach the reel unit to or from the cabinet are simplified.

According to the eighth aspect of the invention, a reel device includes an annular reel band (reel) on which symbols are lined up and which is able to transmit illumination light, a reel frame (reel) which has an outer circumferential surface having the reel band thereon and is able to transmit the illumination light, a backlight apparatus which emits illumination light from the inner circumference side of the reel band toward the reel band to allow the illumination light having passed through the reel band to be visible from the outside, a reel driving mechanism which rearranges the symbols by rotating the reel frame, a reel angle detection mechanism which outputs a position pulse signal each time the reel rotates for a predetermined angle and a home position pulse signal for one rotation of the reel, and a reel setting unit by which the home position pulse signal and the arrangement positions of the symbols are associated with one another by means of a correction pulse value based on the position pulse signal.

According to the arrangement above, since the symbols are rearranged in the predetermined arrangement by rotating the reel frame without requiring the detection of the home position of the reel frame, it is possible to adopt a reel frame which completely transmits illumination light, i.e. no component blocks the illumination light. Since this prevents the illumination light having passes through the reel band and the reel frame from being blocked when the symbols are rearranged by rotating the reel frame, it is possible to enhance the freedom of the effects by the illumination light.

According to the eighth aspect of the invention, a gaming machine includes: a reel device including a reel having a reel band (reel) which is arranged to be able to transmit illumination light and on which symbols are lined up, a reel frame (reel) which has an outer circumferential surface having the reel band thereon and is able to transmit the illumination light, a backlight apparatus which emits illumination light from the inner circumference side of the reel band toward the reel band to allow the illumination light having passed through the reel band to be visible from the outside, a reel driving mechanism which rearranges the symbols by rotating the reel frame, a reel angle detection mechanism which outputs a position pulse signal each time the reel rotates for a predetermined angle and a home position pulse signal for one rotation of the reel, and a reel setting unit by which the home position pulse signal and the arrangement positions of the symbols are associated with one another by means of a correction pulse value based on the position pulse signal; and a backlight control unit which controls the emission states (light amount, color, emission interval, emission timings, or the like) of the illumination light emitted from the backlight apparatus, the backlight apparatus is provided with a plurality of illumination light sources which are in parallel to the width directions and the longitudinal directions of the reel band and can change the amount of illumination light stepwise, and the backlight control unit is individually controllable the illumination light sources.

Since the emission states of the illumination light are individually controllable at each light source, the effects and the freedom of the effects are enhanced by using the illumination light.

The gaming machine according to the eighth aspect may further include an effect-light emitter which is provided on a side surface of the reel frame to emit a plurality of sets of effect light to be visible from the outside.

This further enhances the effects and the freedom of the effects during the rotation of the reel and the rearrangement of the symbols.

According to the ninth aspect of the invention, a reel device includes a reel band arranged to be able to transmit illumination light, reel in which symbols are lined up on the reel band, a reel supporting mechanism supporting the reel, and a backlight apparatus which emits illumination light from the inner circumference side of the reel toward the reel band to allow the illumination light having passed through the reel band to be visible from the outside, and the backlight apparatus includes a backlight board which has an illumination light source emitting the illumination light and is provided to oppose the reel band, a backlight board case supporting the backlight board, and a board case supporting member provided in the reel supporting mechanism to detachably support the backlight board case.

According to the arrangement above, the backlight board case supporting the backlight board is arranged to be detachable to the board case support member. Therefore, when, for example, it is necessary to change the size of the backlight board in accordance with a change in the reel width of the reel band, a size change in accordance with the change in the reel width is achieved only by changing the backlight board and the board case supporting member, without changing the entirety of the backlight apparatus. In other words, the backlight apparatus allows an operation of changing the size of the backlight board to be easily done in a short time.

The backlight board case according to the ninth aspect may include a plate portion which is provided at one edge in the reel width directions to extensively contact the board case supporting member and a tooth portion which is elastic and protrudes from the plate portion toward the board case supporting member, and the board case supporting member includes a fitting portion which slidably fits the edge portions of the plate portion when the plate portion extensively contact the fitting portion and a fitting hole with which the tooth portion is fitted when the plate portion is fitted with the fitting portion.

According to the arrangement above, the edge portions of the plate portion are slidably fitted with the fitting portion when the plate portion extensively contacts, and the backlight board case is connected to the board case supporting member by the fitting portion and the fitting hole as the tooth portion of the plate portion is fitted with the fitting hole. Furthermore, the backlight board case is detached from the board case supporting member when a force elastically deforming the tooth portion is applied to the backlight board case. As a result, the backlight board case is easily detachable from the board case supporting member.

According to the tenth aspect of the invention, a gaming machine includes: a reel having an outer circumferential surface on which symbols are lined up; a reel home position detecting mechanism which detects a home position of the reel; a reel driving mechanism which rotates the reel to rearrange the symbols; a reel drive control unit which controls the reel driving mechanism so that the reel is rotated and stopped at a desired rotational angle based on the reel home position; a magnet which is provided in the reel driving mechanism to change an external magnetic field by the rotation of the reel; a magnetic force detecting mechanism which detects a magnetic force of the external magnetic field so as to output a magnetic force detection signal; a reel setting unit which associates the magnetic force detection signal with arrangement positions of the symbols; and a stop position detection unit which detects stop positions of the rearranged symbols, based on the magnetic force detection signal output from the magnetic force detecting mechanism in accordance with the rotation of the reel and the magnetic force detection signal associated with the arrangement positions of the symbols by the reel setting unit.

According to the arrangement above, because the magnetic force detection signals obtained by detecting the magnetic force of the external magnetic field changing in accordance with the rotation of the reel are associated with the arrangement positions of the symbols, it is possible to indirectly detect the arrangement positions of the symbols based on the magnetic force detection signals, even if the arrangement positions of the symbols are not directly detected by a sensor or the like. With this, the stop positions of the rearranged symbols are detected based on the magnetic force detection signals associated with the arrangement positions of the symbols and the magnetic force detection signals which are detected real time by the magnetic force detecting mechanism. In connection with the above, the external magnetic field of the magnet used for detecting the stop positions of the symbols is an analog value which continuously changes between the north pole and the south pole. For this reason, as compared to the conventional mechanical detection, the stop positions are easily and precisely detected on account of high resolution. As a result, it is possible, for example, to control the reel with an effect such that the reel is finely rotated and stopped with a rotational angle of not passing the reel home position of the reel.

According to the arrangement above, furthermore, even if the positional relationship between the symbols and the reel home position is not determined in advance, it is possible to set, by specifying the relation between the symbols and the magnetic detection force signals, the positional relationship between the symbols lined up on the reel and the reel home position based on the magnetic force detection signals and the reel home position. As a result, it is possible to reduce the workload required for lining up the symbols on the outer circumferential surface of the reel, as compared to the case where the symbols are lined up while the positions thereof are determined based on a predetermined position (home position) of the reel.

The gaming machine according to the tenth aspect may further include: a difference detection unit which detects a difference between stop positions of the symbols when the reel is stopped at the rotational angle based on the reel home position and the stop positions of the symbols detected by the stop position detection unit; and a rotational angle correction unit which is capable of controlling the reel driving mechanism so that the rotational angle of the reel with which the difference is canceled.

According to this arrangement, each time the reel stops, the difference between the stop positions of the symbols based on the reel home position and the stop positions of the symbols based on the magnetic force detection signals is detected and the rotational angle of the reel is adjusted to cancel the difference. In this regard, when the positional relationship between the symbols and the reel home position is changed for some reason, it has conventionally been impossible to correct this change in the positional relationship until the reel home position of the reel is detected. According to the arrangement above, each time the reel stops or when the reel stops under a predetermined condition, it is possible to carry out the reel control with an effect, for example, such that the reel is finely rotated and stopped with a rotational angle of not passing the reel home position of the reel.

The magnetic force detecting mechanism according to the tenth aspect may output the magnetic force detection signal plural times in arrangement areas of the symbols, when the reel rotates.

According to this arrangement, the position detection by each magnetic force detection signal is possible at plural positions of the arrangement area of the symbol, and hence even a small deviation of the symbol in the arrangement area is detectable and correctable.

The gaming machine of the tenth aspect may be arranged so that the reel setting unit has a reel setting table in which arrangement positions of the symbols and detected magnetic forces of the magnetic force detection signal varying in the arrangement areas of the symbols in a rotational direction of the reel are associated with one another, the stop position detection unit detects the stop positions with reference to a detected magnetic force of the magnetic force detection signal output from the magnetic force detecting mechanism in accordance with the rotation of the reel and the detected magnetic forces in the reel setting table.

According to this arrangement, the position detection by each magnetic force detection signal is possible at plural positions of the arrangement area of the symbol, by using a simple arrangement using the reel setting table, and hence even a small deviation of the symbol in the arrangement area is detectable and correctable.

BRIEF DESCRIPTION OF THE DRAWINGS

FIG. 42 is an explanatory drawing of a data table showing symbols and code numbers of the symbols.

FIG. 43 is an explanatory drawing of a data table of a payout control table.

FIG. 44 is an explanatory drawing of a data table of a free game quantity table.

FIG. 45 illustrates the relationship between a reel setting table and a detected magnetic force table.

FIG. 55 illustrates a reel setting table.

FIG. 60 illustrates an illumination mode setting table.

FIG. 66 illustrates the relationship between the reel setting table and the arrangement areas.

DESCRIPTION OF THE PREFERRED EMBODIMENTS

First Embodiment

Gaming Machine Overview

Figure 1:
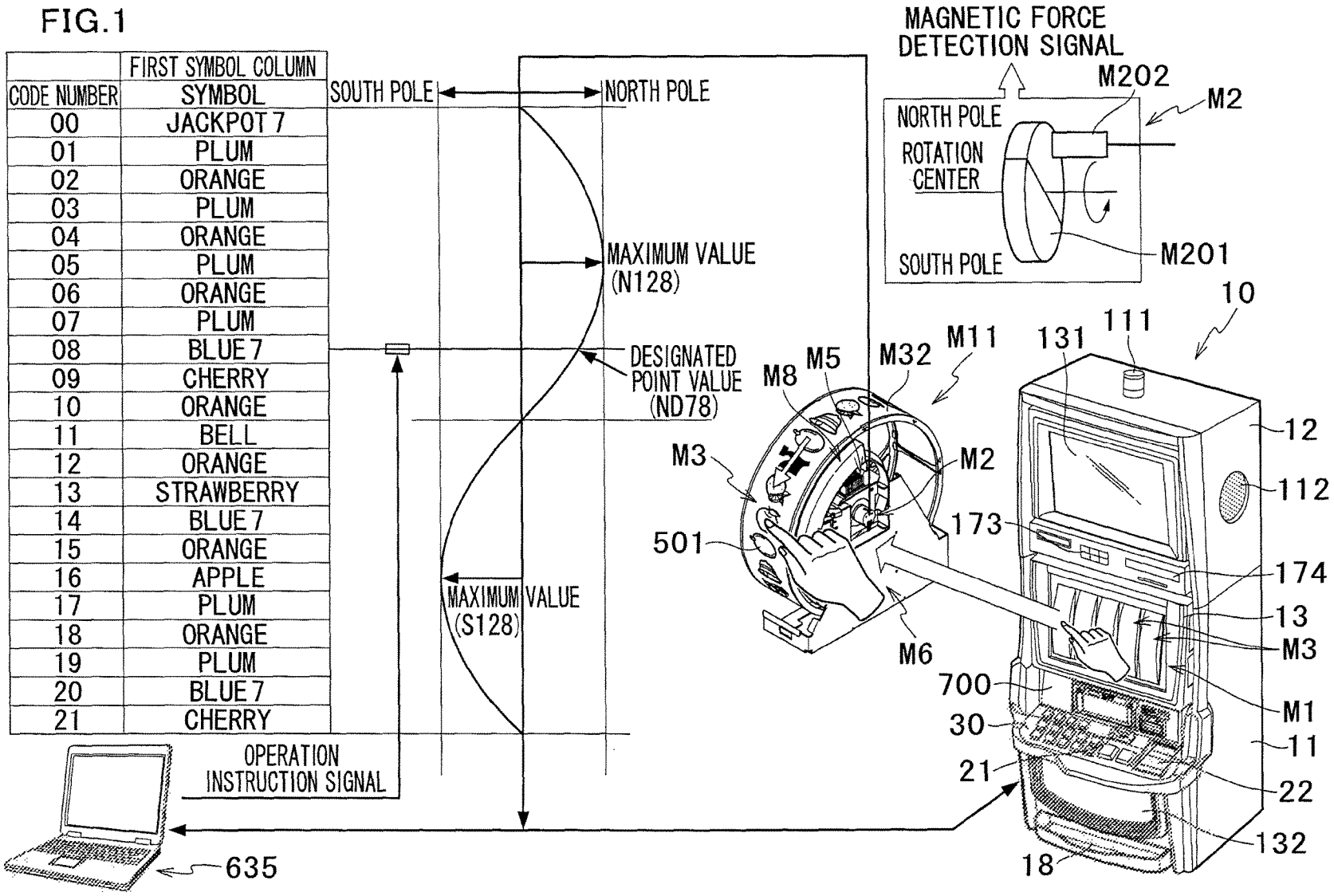
FIG. 1 is an explanatory drawing showing a method of setting a reel of a gaming machine.

A gaming machine of First Embodiment has, as shown in FIG. 1, slot machines 10 each rearranging symbols 501 based on the magnetic force of an external magnetic field which changes in accordance with the rotation of a reel M3. It is noted that although the gaming machine described below is a multiplayer-type having a plurality of slot machines 10, the gaming machine may be a single slot machine 10 for a single player.

The slot machine 10 includes a mechanical-type reel device M1 by which the magnetic force of an external magnetic field, which changes in accordance with the rotation of the reel M3, and the positions of symbols 501 are associated with one another so as to make it possible to rearrange the symbols 501 by solely using the magnetic force of the external magnetic field changing in accordance with the rotation of the reel M3.

Figure 2:
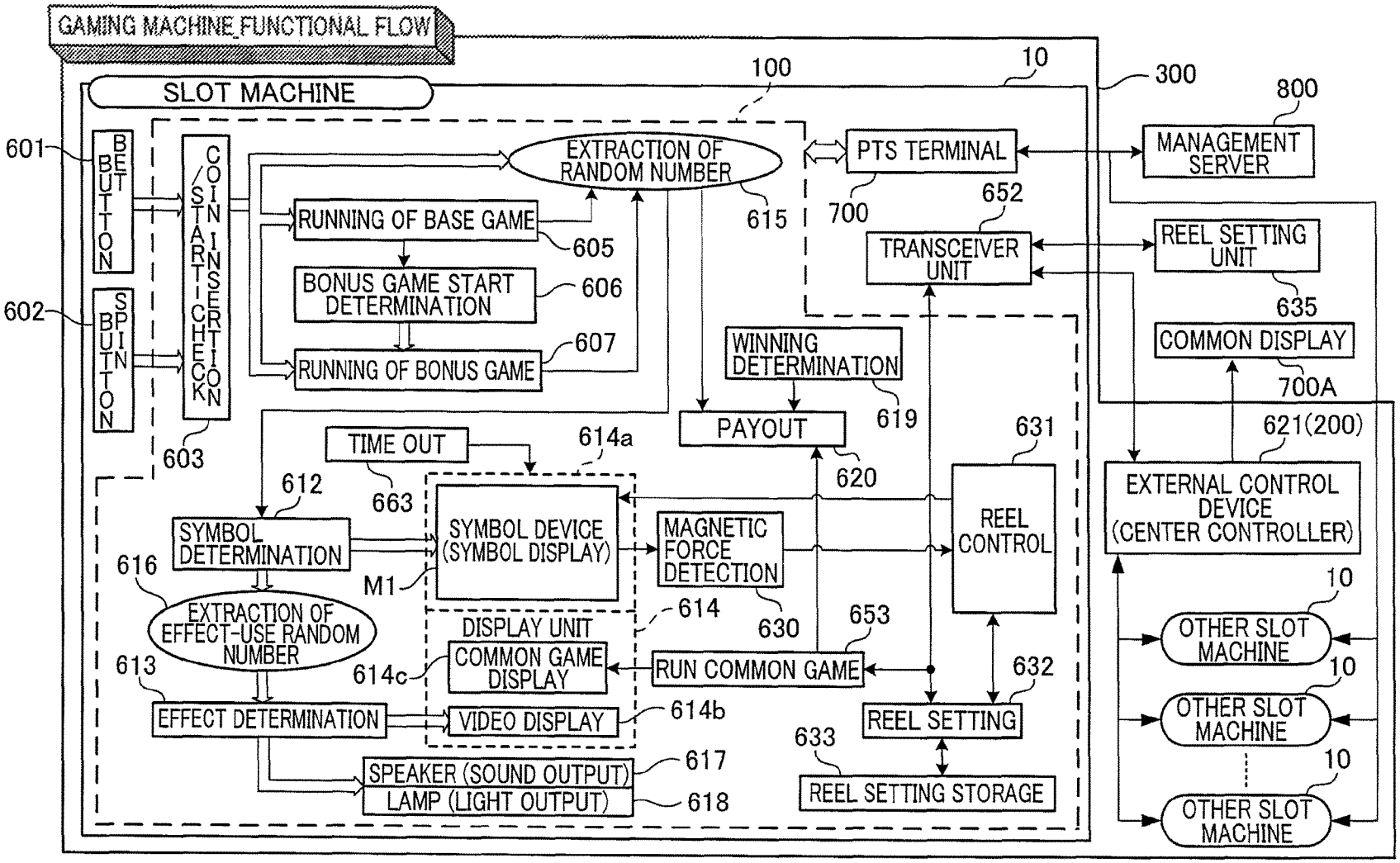
FIG. 2 is an explanatory diagram of a functional flow of the gaming machine.

More specifically, the slot machine 10 includes the reel device M1 having the reel M3 and a reel control unit 631 which controls the reel device M1 and is shown in FIG. 2. The reel device M1 includes the reel M3 having an outer circumferential surface on which symbols 501 are lined up, a reel driving mechanism M5 which rearranges the symbols 501 by rotating the reel M3, a magnet M201 which is provided in the reel driving mechanism M5 to change the external magnetic field in accordance with the rotation of the reel M3, a magnetic force detecting mechanism M202 which detects the magnetic force of the external magnetic field so as to output a magnetic force detection signal, and a reel setting unit (reel setting section 632 in FIG. 2) which associates the magnetic force detection signal with the position of each symbol 501.

Furthermore, the reel control unit 631 shown in FIG. 2 has, as a reel drive control unit, a function to control the reel driving mechanism M5 so that the symbols 501 are rearranged in a predetermined arrangement based on the magnetic force detection signal and the arrangement positions of the symbols 501.

With this, the slot machine 10 can indirectly detect the arrangement positions of the symbols 501 based on the magnetic force detection signal even if the arrangement positions of the symbols 501 are not directly detected by a sensor or the like, because the magnetic force detection signal obtained by detecting the magnetic force of the external magnetic field changing in accordance with the rotation of the reel M3 is associated with the arrangement positions of the symbols 501. Since this makes it possible to specify the symbols 501 on the reel M3 even if the positional relation between the symbols 501 and the reel M3 is not set in advance, the symbols 501 can be rearranged at predetermined positions. As a result, when the symbols 501 are to be lined up on the outer circumferential surface of the reel M3, the workload required to line up the symbols 501 at predetermined positions (home position) on the reel M3 is reduced as compared to cases where the symbols are lined up while their positions are determined one by one.

The slot machines 10 each arranged as above are, as shown in FIG. 2, provided in a multiplayer-type gaming machine 300. This gaming machine 300 is arranged so that a plurality of the slot machines 10 each of which is a gaming terminal having the reel device M1 are connected to a center controller 200 to be able to exchange data with the center controller 200. The gaming machine 300 allows each slot machine 10 to run a base game such as a slot game and synchronizes the slot machines 10 with each other to run a common game.

Further, the slot machines 10 are connected to the center controller 200 via wires or wirelessly, and a unit of a bet amount may be a national or regional currency such as dollar, yen, and Euro, or a game point passable only at a hall where the gaming machine 300 is installed or an industry related to the gaming machine 300.

More specifically, the gaming machine 300 includes the slot machines 10 and the center controller 200. The slot machines 10 each have an input device which accepts an external input, and a terminal controller which runs the base game and which is programmed to execute various steps in order to run a common game executed at more than one of the slot machines 10. The center controller 200 is connected in communication with the slot machines 10 and is programmed to execute various steps.

The terminal controller of the gaming machine 300 is arranged to be able to execute at least a first process in which a base game is run in response to a start command input to the input device, a second process in which a common game is run in response to a game start command from the center controller 200, and a third process in which a game result of the common game is determined based on game result information from the center controller 200.

It is noted that the "common game" is a sub game different from the main game of the gaming machine 300, and is run along with the base game or run while the base game is stopped. Examples of the common game include craps, baseball, and soccer.

The center controller 200 of the gaming machine 300 is arranged to be able to execute at least a first process in which a game start command is output at a predetermined timing to a slot machine 10 which satisfies a game running condition, a second process in which the game result of the common game is determined, and a third process in which the game result determined in the second process is output, as game result information, serially to the slot machines 10.

The "game running condition" above is a condition with which a player is qualified to play the common game. Examples of this condition are a case where the accumulated value of the bet amount on the base game is not lower than the minimum bet amount or a case where the game repeat count of the base game is not lower than the minimum bet frequency. It is noted that a player is allowed to satisfy the "game running condition" immediately before the common game starts. For example, when the game running condition is not satisfied because the accumulated value of the bet amount of the base game is lower than the minimum bet amount, the game running condition may be satisfied immediately before the common game starts, by paying the difference between the minimum bet amount and the accumulated value of the bet amount or paying a predetermined condition satisfying amount. In the meanwhile, when the number of base games played is not enough, the game running condition may be satisfied by paying an amount corresponding to the required number of games or paying a predetermined condition satisfying amount.

In addition to the above, the predetermined timing at which the game start command is output is a timing at which the common game start condition is established in one of the slot machines 10. This "common game start condition" is, for example, an accumulated value of bet amount information or an accumulated value of a game repeat count of base game. It is also noted that, while the present embodiment deals with the gaming machine 300 in which the center controller 200 is provided along with the slot machines 10, the present invention is not limited to this arrangement. The gaming machine 300 may be arranged so that one or more slot machine 10 has the function of the center controller 200 and the slot machines 10 are connected with each other to be able to exchange data therebetween.

Note that the "slot machine 10" is a type of gaming terminals in the gaming machine 300. The present embodiment is described using slot machines 10 as an example of gaming terminals; however, the present invention is not limited to this. The present invention may adopt a model which has a terminal controller capable of independently running some base game.

The "base game" is run by the slot machine 10 in the present embodiment. The base game is a slot game of rearranging symbols 501. The base game, however, is not limited to the slot game. The base game may be any types of games on condition that it is independently run by a gaming terminal such as the slot machine 10.

The rearrangement of the symbols 501 in the slot game is carried out on the reel device M1 (symbol display unit). The slot game includes processes of: running a base game on condition that a game value is bet, in which base game the symbols 501 are rearranged on the reel device M1, and awarding a base payout according to the symbols 501 rearranged; when the symbols 501 are rearranged on a predetermined condition, running a bonus game where the symbols 501 are rearranged under such a condition that a payout rate thereof is greater than that of the base game, and awarding a bonus payout according to the symbols 501 rearranged; and when a rescue start condition is met, running a rescue process.

The number and type of "symbols 501" are not particularly limited as long as they are rearranged on the reel device M1. It is also noted that "symbol 501" is a superordinate concept of "specific symbol" and "base symbol". "Specific symbol" is used in addition to "base symbol", if necessary. For example, "specific symbol" includes "wild symbol" and "trigger symbol". This "wild symbol" is a symbol which can be used as a substitute for any types of symbols 501. The "trigger symbol" is a symbol functioning as a trigger to start at least the running of a bonus game. An example of the trigger symbol in the present embodiment is "BLUE 7". The trigger symbol may be a trigger to increase the number of specific symbols in a bonus game, i.e., to increase at least one type of specific symbols, "trigger symbol" and "wild symbol". Furthermore, "trigger symbol" may be a trigger to increase the game repeat count of bonus game when a bonus game is run.

The "game value" is a coin, a bill, or electronic information equivalent thereto. Non-limiting examples of the game value of the present invention include game media such as medals, tokens, electronic money, and tickets. A non-limiting example of the tickets includes a later-described barcoded ticket.

The "bonus game" is synonymous for "feature game". While the present embodiment describes the bonus game as a game in which the free game is repeated, any types of games may be run as the bonus game on condition that its gaming state is advantageous over the gaming state of the base game. Furthermore, another bonus game may be additionally employed on condition that the gaming state is advantageous over the base game for the player. For example, in the bonus game, various states such as a state in which a larger amount of game values than in the base game is obtainable, a state in which the probability of obtaining a game value is higher than in the base game, and a state in which the amount of consumed game values is smaller than in the base game may be realized independently or in combination.

The "free game" is a game which can be run with a smaller amount of game values than in the base game. The smaller bet amount includes a case where the bet amount is zero. For this reason, the "free game" may be a game which is run without requiring betting of a game value and awards game values in accordance with rearranged symbols 501. In other words, the "free game" may be a game which starts without requiring consumption of game values. On the other hand, the "base game" is run on condition that a game value is bet, and award game values in accordance with rearranged symbols 501. In other words, the "base game" is a game which starts with the presumption of the consumption of a game value.

The term "rearrangement" means that the arrangement of the symbols 501 is dismissed and then the symbols 501 are arranged again. The term "arrangement" means a state in which a player is able to visually recognize the symbols 501.

The phrase "base payout based on the rearranged symbols 501" means a base payout corresponding to a rearranged winning combination. The phrase "bonus payout based on the rearranged symbols 501" means a bonus payout corresponding to a rearranged winning combination. Furthermore, the term "winning combination" indicates that a winning is established.

Examples of a "condition in which a payout rate is higher than in the base game" includes the running of a free game and the running of a game in which the number of wild symbols or trigger symbols is increased or a replaced symbol table is used. In the base game, a rescue process may be executed when a rescue start condition is established.

Examples of the rescue process include: running a free game, running a game in which the number of wild symbols or trigger symbols is increased or a replaced symbol table is used, and awarding an insurance payout.

Examples of the "rescue start condition" include a state in which the base game is excessively repeated, i.e., the base game is repeated a predetermined number or more times and a state in which the total amount of the obtained payout is excessively small, i.e., the base payout and the bonus payout that a single player obtained as a result of playing a game a predetermined number or more times are not higher than a predetermined value. The "rescue process" is a process for rescuing players. Examples of the rescue process include the running of a free game, the running of a game in which the number of wild symbols or trigger symbols is increased or a replaced symbol table is used, and the awarding of an insurance payout.

In addition to the above, the gaming machine 300 includes a common display 700 which is installed to be visible from the operating positions of all slot machines 10. The center controller 200 may cause the common display 700A to display states until the common game start condition is established. It is noted that the "operating position" is the eye-level position of the player at each slot machine 10. The gaming machine 300 arranged in this way allows each player to estimate the waiting time until the common game starts, by displaying on the common display 700A the states until the common game start condition is established.

(Functional Flow of Gaming Machine 300: Slot Machine)

The gaming machine 300 having the above structure has slot machines 10 and an external controller 621 (center controller 200) connected to the slot machines 10 so as to allow data communication therebetween. The external controller 621 are connected to the slot machines 10 installed in the hall so that data communication is possible therebetween.

The slot machine 10 has a BET button 601, a spin button 602, and a display 614, and also has a game controller 100 which controls these components. The BET button 601 and the spin button 602 are input devices. The slot machine 10 further has a transceiver unit 652 which allows data communication with the external controller 621.

The BET button 601 has a function to receive a bet amount from a player. The spin button 602 has a function to receive an instruction from a player to start a game such as the base game. The display 614 has a function to display still images such as various symbols 501, numbers, and marks and moving images such as effect images. The display 614 has a symbol display region 614*a*, a video display region 614*b*, and a common game display region 614*c*.

The symbol display region 614*a* has the reel device M1 and displays the symbols 501 of FIG. 1. The video display region 614*b* displays various types of effect image information executed during the game, as moving images or still images. The common game display region 614*c* displays a common game such as a jackpot game.

The game controller 100 includes: a coin insertion/start-check unit 603; a base game running unit 605; a bonus game start determination unit 606; a bonus game running unit 607; a random number extraction unit 615; a symbol determination unit 612; an effect-use random number extraction unit 616; an effect determination unit 613; a speaker unit 617; a lamp unit 618; a winning determination unit 619; and a payout unit 620.

The base game running unit 605 has a function to run a base game when the BET button 601 is pressed. The bonus game start determination unit 606 determines whether to run a bonus game based on the combination of the symbols 501 rearranged in the base game. That is to say, the bonus game start determination unit 606 determines that a bonus game is awarded when the trigger symbols are rearranged in a predetermined condition, and shifts the process to the bonus game running unit 607 so that the bonus game is run from the next unit game.

Note that the "unit game" starts from a time of receiving a bet and includes a series of operations and continues until a win or loss is resulted. For example, a unit game of the base game includes a single bet time to receive a bet, a single game time to rearrange stopped symbols 501, and a single payout time of a payout process to award a payout. The unit game in the base game is referred to as a unit base game.

The bonus game running unit 607 has a function of running the bonus game which repeats a free game for a plurality of times, merely in response to an operation on the spin button 602.

The symbol determination unit 612 has functions of: determining symbols 501 to be rearranged based on a random number given from the random number extraction unit 615; rearranging the determined symbols 501 in the symbol display region 614*a* of the display 614; outputting information on rearrangement of the rearranged symbols 501 to the winning determination unit 619; and outputting an effect designation signal to the effect-use random number extraction unit 616, based on the rearrangement of the symbols 501.

The effect-use random number extraction unit 616 has functions of sampling an effect-use random number when receiving an effect instruction signal from the symbol determination unit 612 and outputting the effect-use random number to the effect determination unit 613. The effect determination unit 613 has functions of: determining an effect by using the effect-use random number; outputting video information on the determined effect in the video display region 614*b* of the display 614; and outputting audio and illumination information on the determined effect to the speaker unit 617 and the lamp unit 618.

The winning determination unit 619 has functions of determining whether a winning is achieved when rearrangement information of the symbols 501 rearranged on the display 614, calculating a payout amount based on a winning combination when it is determined that a winning is achieved, and outputting a payout signal based on the payout amount to the payout unit 620. The payout unit 620 has a function of paying out game values to the player in the form of coins, medals, and credits. The payout unit 620 has another function of adding credit data, which corresponds to the credits paid out, to credit data which is stored in an IC card 500 inserted into a later-descried PTS terminal 700.

In addition to the above, the game controller 100 includes an unillustrated storage unit which stores various types of bet amount data. The storage unit is a storage device which stores data in a rewritable manner, such as a hard disc and a memory.

The game controller 100 further has a common game running unit 653. The common game running unit 653 has functions of: outputting bet amount information to the external controller 621 for each unit base game, the bet amount information being based on a bet amount placed as a bet on a base game; running a common game in response to a game start command from the external controller 621; and accepting a bet input through the bet button unit 601 when the bet input corresponds to common game bet amount data indicating a bet amount bettable on the common game.

In addition to the above, the game controller 100 is connected to the PTS terminal 700. This PTS terminal 700 is a unit in which an LCD 719, microphones 704 and 705, and human body detecting cameras 712 and 713 are integrated, and has a function to, for example, produce an effect of a game by exchanging data with the game controller 100. In particular, the PTS terminal 700 has a card insertion slot 706 to receive an IC card 500. With this, a player can operate the slot machine 10 with the credits on an IC card 500, by inserting the IC card 500 into the card insertion slot 706. The mechanical structure of the PTS terminal 700 will be detailed later.

In addition to the above, the game controller 100 updates the credits displayed on the display 614 when receiving credit data from the PTS terminal 700. Furthermore, the game controller 100 outputs settled credit data to the PTS terminal 700 when the game is settled.

The PTS terminal 700 of each of the slot machines 10 constituting the gaming machine 300 is connected in communication with a management server 800, which performs central management of image downloading, IC cards 500, and credits.

In addition to the above, the slot machine 10 is arranged to be connectable with a reel setting unit 635 via the transceiver unit 652. The reel setting unit 635 functions as an external operation unit which outputs an operation instruction signal in response to an external operation. Examples of the reel setting unit 635 include a dedicated setting unit and a personal computer shown in FIG. 1.

For example, when the reel setting unit 635 is a personal computer, an operation instruction signal is output when, for example, a particular key such as the enter key is pressed. As such, an operator who sets the reel device M1 can output the operation instruction signal by pressing a key, while checking the operating procedure displayed on the display of the personal computer.

Alternatively, the reel setting unit 635 may be a reel setting accepting unit such as an USB memory detachable to the transceiver unit 652 and an operation button such as the BET button 601 of the slot machine 10. In this case, the slot machine 10 starts to function as a part of the reel setting unit 635 when the reel setting accepting unit is connected to the transceiver unit 652. An operator who sets the reel device M1 can output an operation instruction signal by pressing an operation button, while checking the operation procedure displayed in, for example, the video display region 614*b* of the display 614 of the slot machine 10.

In addition to the above, the slot machine 10 has the reel control unit 631, the reel setting section 632, a reel setting storage unit 633, and a magnetic force detection unit 630. The magnetic force detection unit 630 has a function to output a magnetic force detection signal when the magnetic force of an external magnetic field is detected. The reel setting storage unit 633 stores various types of data required for setting the reel, such as the detected magnetic forces which are indicated by the magnetic force detection signals and are successively detected in accordance with the rotation of the reel M3. The reel control unit 631 has a function of controlling the reel device M1 so that the symbols 501 are rearranged in a predetermined arrangement based on the magnetic force detection signal and the arrangement positions of the symbol 501.

The reel setting section 632 has a function of associating the magnetic force detection signals with the arrangement positions of the symbol 501. More specifically, the reel setting section 632 has a function to obtain, at a timing to output the operation instruction signal, the detected magnetic force indicated by the magnetic force detection signal as a magnetic force at a reel home position. With this, since the operation instruction signal is output in response to an external operation, the operation to arrange a predetermined symbol 501 at the predetermined position (home position) on the reel M3 only requires the operator to operate the reel setting unit 635 when the symbols are in a predetermined arrangement, while visually checking the arrangement of the symbols 501. As such, the reel setting section 632 makes it possible to easily start the operation to set the positional relation between the symbols 501 and the reel M3, by an operation of the reel setting unit 635.

(Functional Flow of Gaming Machine 300: External Controller)

The gaming machine 300 structured as above is connected to the external controller 621. The external controller 621 has a function of remotely controlling and monitoring the operation of each slot machine 10 and changes in game setting values. Furthermore, the external controller 621 has a function of determining the common game start condition for each gaming terminal, and running the common game at a plurality of slot machines 10 when a result satisfying the common game start condition is achieved in any one of the gaming terminals.

Figure 3:
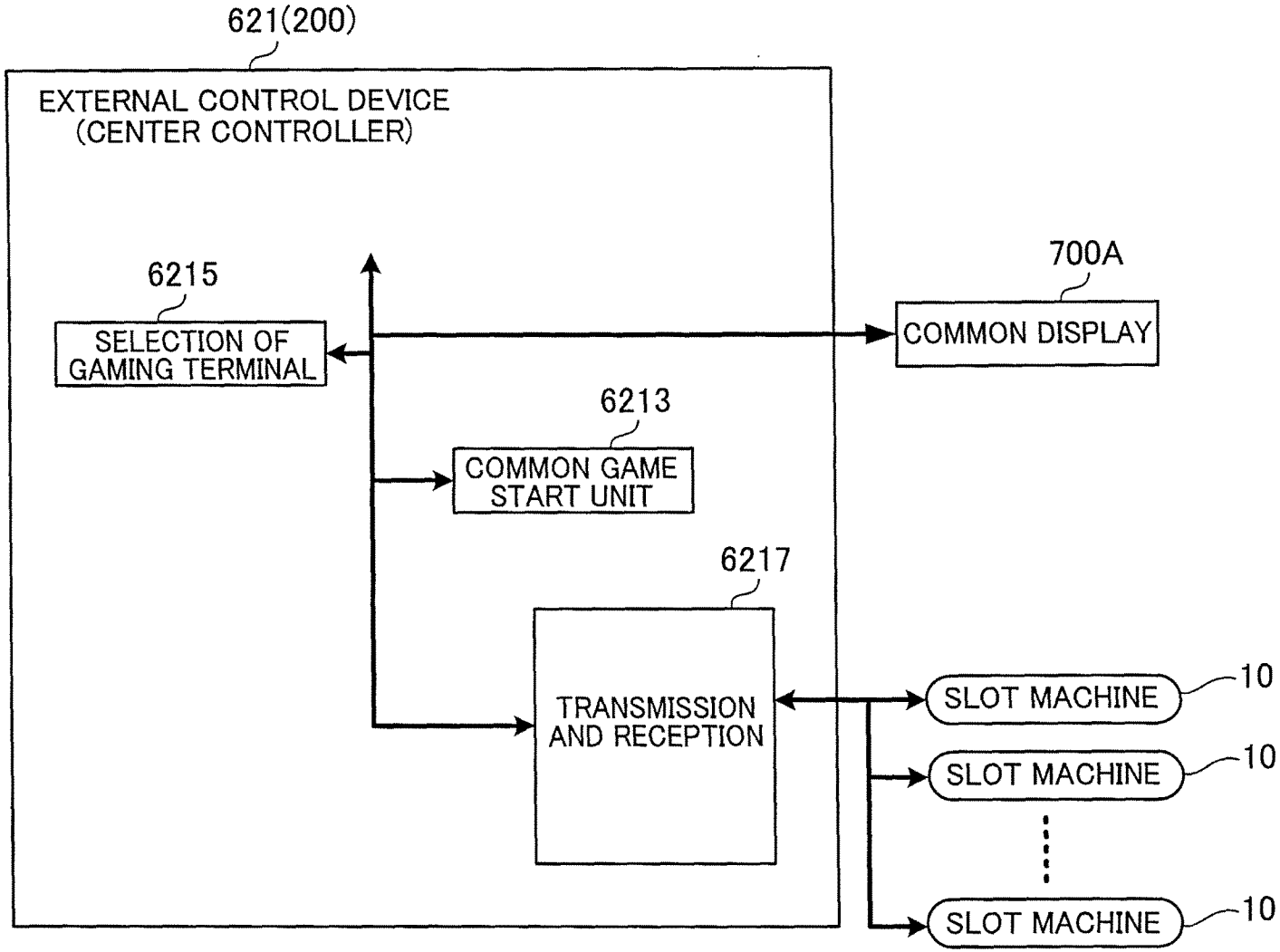
FIG. 3 is an explanatory diagram of a functional flow of the gaming machine.

More specifically, as shown in FIG. 3, the external controller 621 has a common game start unit 6213, a gaming terminal selection unit 6215, and a transceiver unit 6217. The common game start unit 6213 has functions of: determining whether the common game start condition is established, based on information of accumulated bet amounts transmitted from each slot machine 10 in each unit base game; outputting a game start command to the slot machines 10; and displaying on the common display 700A a screen showing states until the common game start condition is established.

Note that the determination of whether the common game start condition is established is made based on the information of accumulated bet amounts, as well as all the accumulated values which increase according to repetition of the unit base games. For example, the number of base games, the time spent in playing the base game, or the like may be used as the accumulated value.

In addition to the above, the common game start unit 6213 has a function of outputting a game start command to a slot machine 10 in which the accumulated value which increases as the base game is repeated satisfies the game running condition. In this way, the common game start unit 6213 does not qualify a slot machine 10 whose accumulated value is less than the minimum setting value to participate in the common game. This motivates the player to proactively repeat base games.

In addition to the above, the common game start unit 6213 has a function of monitoring a non-input time during which the start operation is not carried out, and outputting the game start command to a slot machines 10 other than slot machines 10 whose non-input time is equal to or longer than a timeout period. Thus, the common game start unit 6213 is capable of determining that no player is present at a slot machine 10 where no base game is run for a period of time equal to or longer than the timeout period, thus preventing such a slot machine 10 from running the common game.

The gaming terminal selection unit 6215 has a function of selecting a specific slot machine 10 from among the slot machines 10, and outputting a common game start command signal to the specific slot machine 10. The transceiver unit 6217 has a function of enabling data communication with the slot machines 10.

(Entire Structure of Game System)

The following describes a game system 350 having the gaming machine 300 with the above structure.

Figure 4:
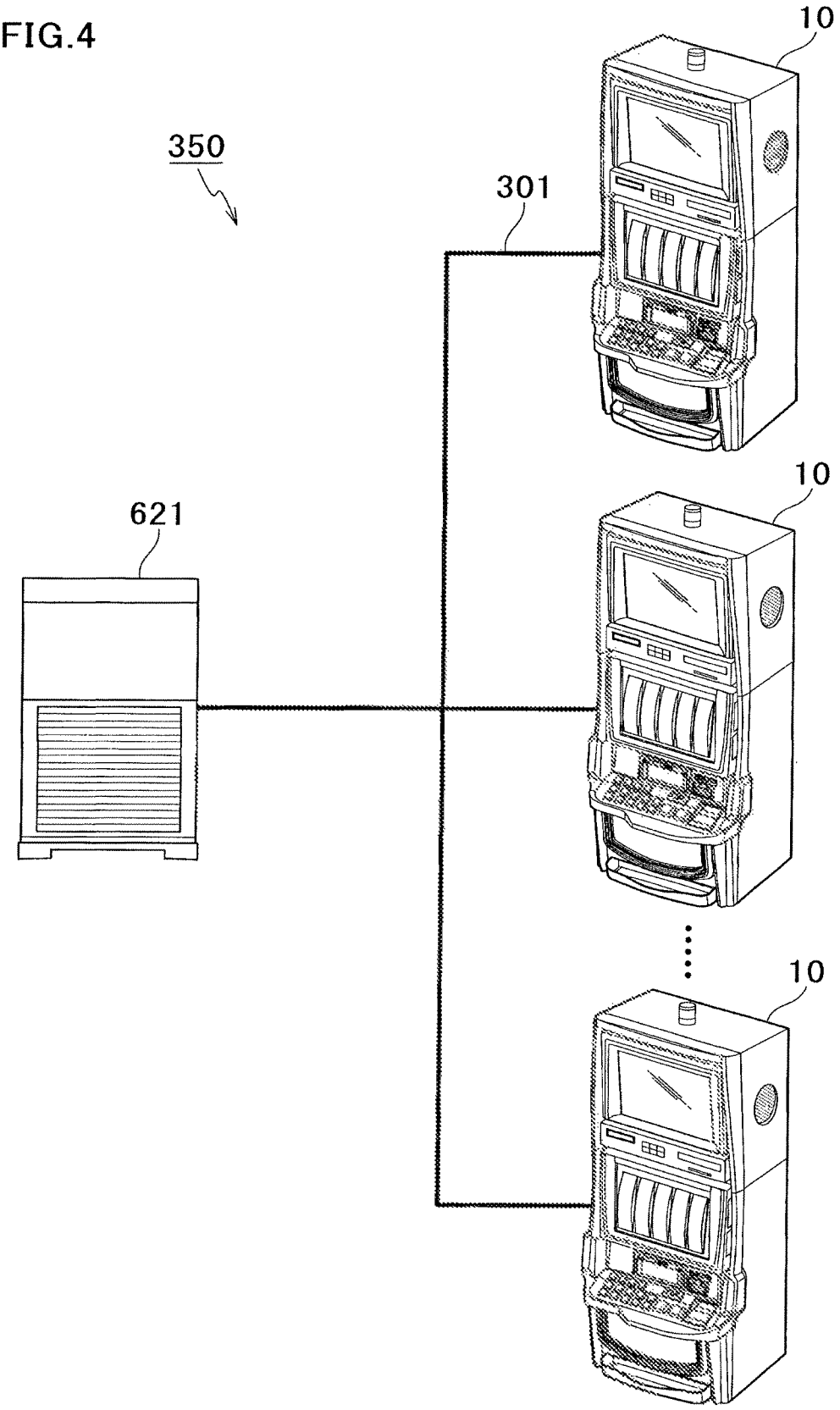
FIG. 4 is a perspective view of an entire gaming machine.

As shown in FIG. 4, the game system 350 includes a plurality of slot machines 10, and an external controller 621 which is connected to the slot machines 10 through communication lines 301.

The external controller 621 controls the slot machines 10. In the present embodiment, the external controller 621 is a so-called hall server installed in a gaming facility having a plurality of slot machines 10. Each slot machine 10 is provided with a unique identification number, so that the external controller 621 identifies which slot machine 10 sends data thereto, by this identification number. The identification number is also used to specify the destination of data, when the external controller 621 sends data to a slot machine 10.

The game system 350 may be constructed in a single gaming facility such as a casino where various types of games is playable, or constructed between a plurality of gaming facilities. When constructed in a single gaming facility, a game system 350 may be constructed for each floor or section of the gaming facility. The communication lines 301 may be embodied as wires or wireless communication. Examples of the communication lines 301 include dedicated lines and switched lines.

Figure 5:
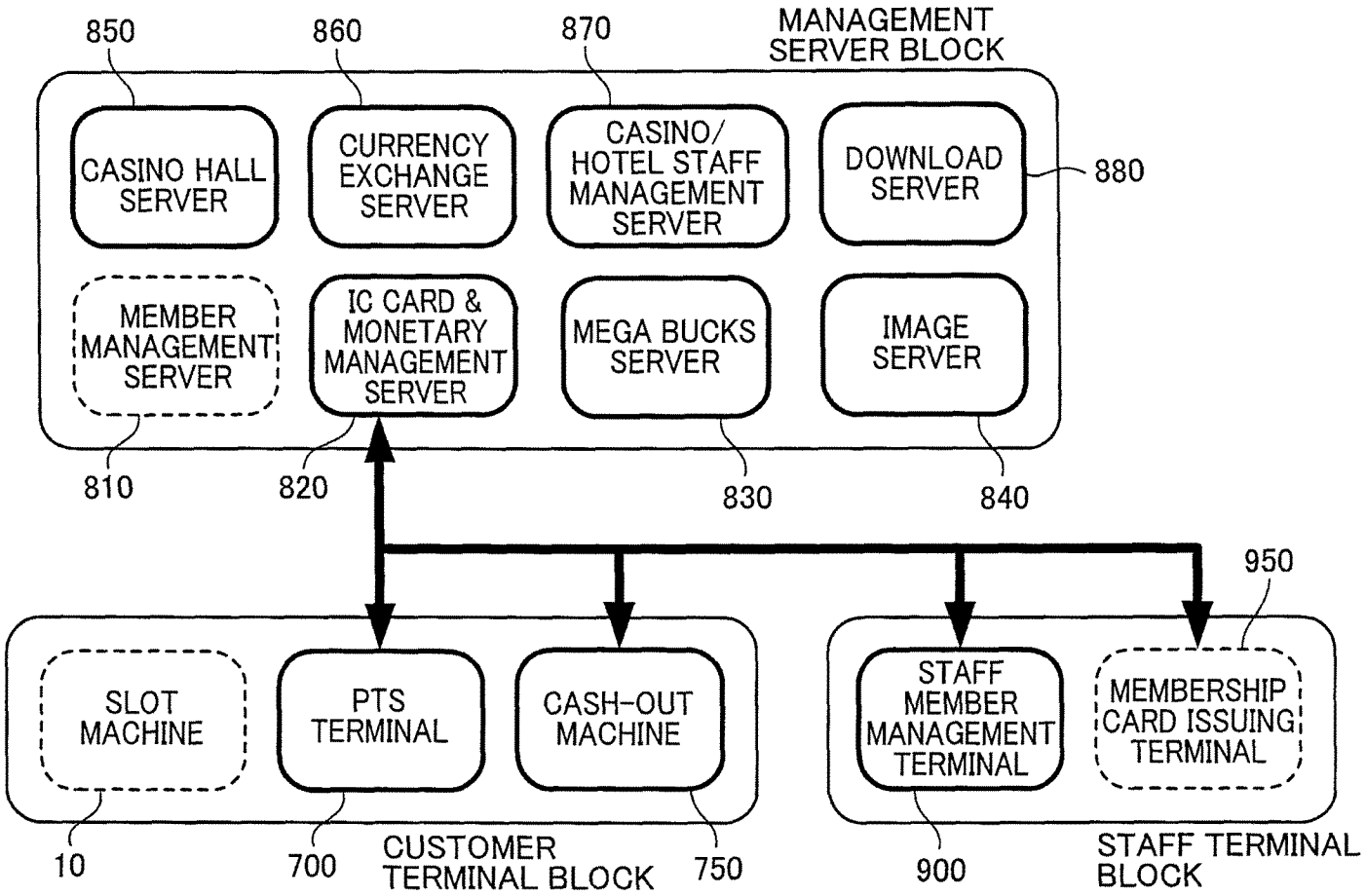
FIG. 5 is a block diagram of a game system.

As shown in FIG. 5, the game system is roughly divided into three blocks; a management server block, a customer terminal block, and a staff terminal block. The management server block has a casino hall server 850, a currency exchange server 860, a casino/hotel staff management server 870, and a download server 880.

The casino hall server 850 manages the entirety of the casino hall where the slot machines 10 are installed. The currency exchange server 860 generates currency exchange rate data based on currency exchange information or the like. The casino/hotel staff management server 870 manages the staff of the casino hall and/or the staff of hotels associated with the casino hall. The download server 880 downloads latest information such as game-related information and news and notifies the players of the information through the PTS terminal 700 of each slot machine 10.

Further, the management server block has a member management server 810, an IC card & monetary management server 820, a mega bucks server 830, and an image server 840.

The member management server 810 manages information such as member information of players of the slot machines 10. The IC card & monetary management server 820 manages the IC cards 500 used in the slot machines 10. More specifically, the IC card & monetary management server 820 stores broken number cash data in association with identification codes and outputs the broken number cash data to the PTS terminal 700. Furthermore, the IC card & monetary management server 820 generates and manages data such as denominated rate data. The mega bucks server 830 manages a mega bucks game in which, for example, the to total sum of bets on the slot machines 10 installed in a plurality of casino halls is paid out. The image server 840 downloads, for example, latest images such as game related images and news images and shows such images the players of the slot machines 10 through the PTS terminals 700.

The customer terminal block includes the slot machines 10, the PTS terminals 700, and a settlement unit 750. The PTS terminal 700 is attachable to the slot machine 10 and is able to mutually communicate with the management server 800. The settlement unit 750 carries out a settlement operation by exchanging the cash data on a player's IC card 500 into cash or stores coins and bills in an IC card 500 as cash data.

The staff terminal block has a staff management terminal 900 and a member card issuing terminal 950. The staff management terminal 900 is a terminal by which the staff of the casino hall manages the slot machines 10. In particular, in the present embodiment, the staff of the casino hall checks if the number of IC cards 500 stored in the PTS terminal 700 is excessive or in short. The member card issuing terminal 950 is a terminal by which a player in the casino hall issues a member card.

(PTS Terminal 700)

Figure 6:
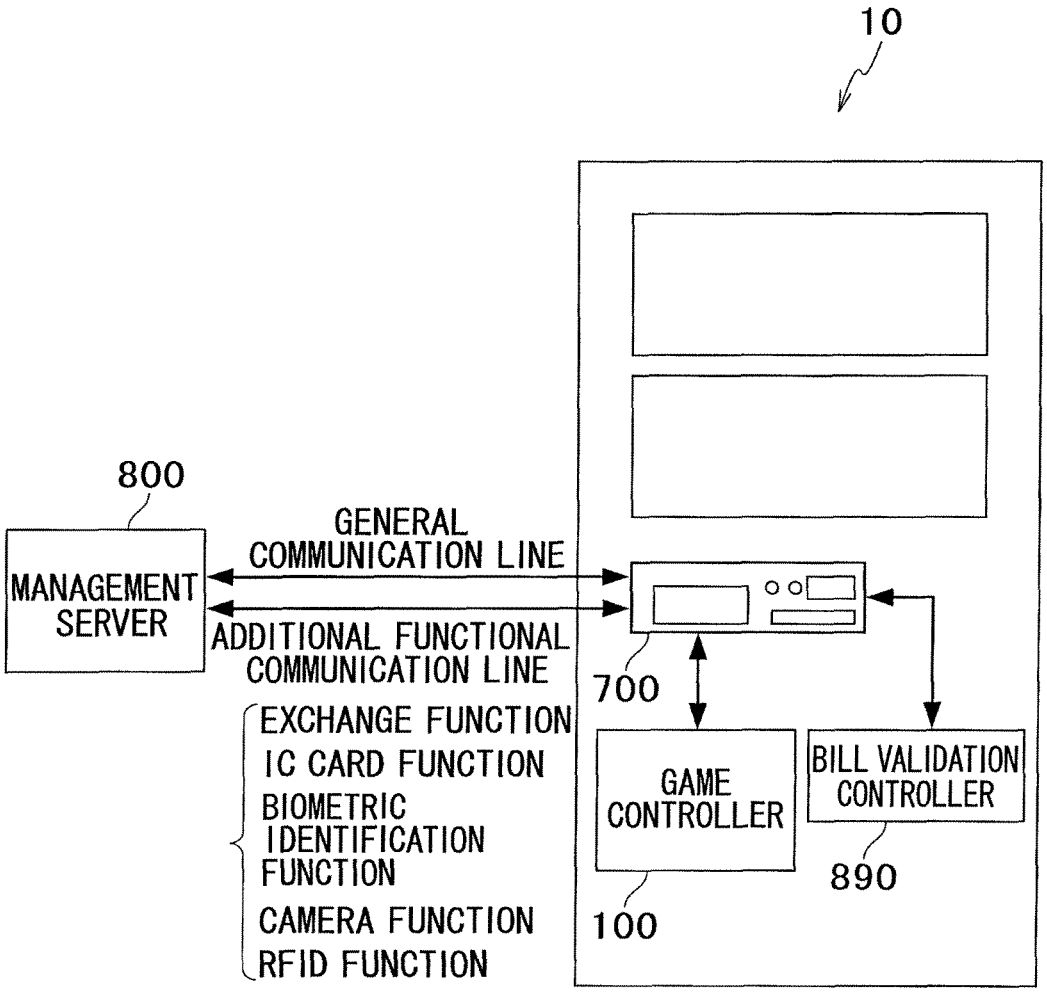
FIG. 6 is a block diagram of a PTS system.

As shown in FIG. 6, the PTS terminals 700 are integrated in a PTS system. Each PTS terminal 700 provided to a slot machine 10 is connected in communication with the game controller 100 and a bill validation controller 890 of the slot machine 10.

The PTS terminal 700 updates the audio and visual effects of the games and the credit data, through communications with the game controller 100. Furthermore, the PTS terminal 700 transmits credit data required for settlement, when communicating with the bill validation controller 890.

The PTS terminal 700 is arranged to be able to communicate with the management server 800. The PTS terminal 700 communicates with the management server 800 through the two lines: a general communication line and an additional functional communication line.

Through the general communication line, the PTS terminal 700 executes communication concerning exchange of data such as cash data, identification code data, and member information of players. On the other hand, through the additional functional communication line, the PTS terminal 700 executes communication concerning exchange of information concerning newly-added functions. In the present embodiment, through the additional functional communication line, the PTS terminal 700 executes communication related to an exchange function, and IC card function, a biometric identification function, a camera function, a RFID (Radio Frequency Identification) function which is for executing an individual identification function with radio wave.

(Mechanical Structure of Slot Machine)

Figure 7:
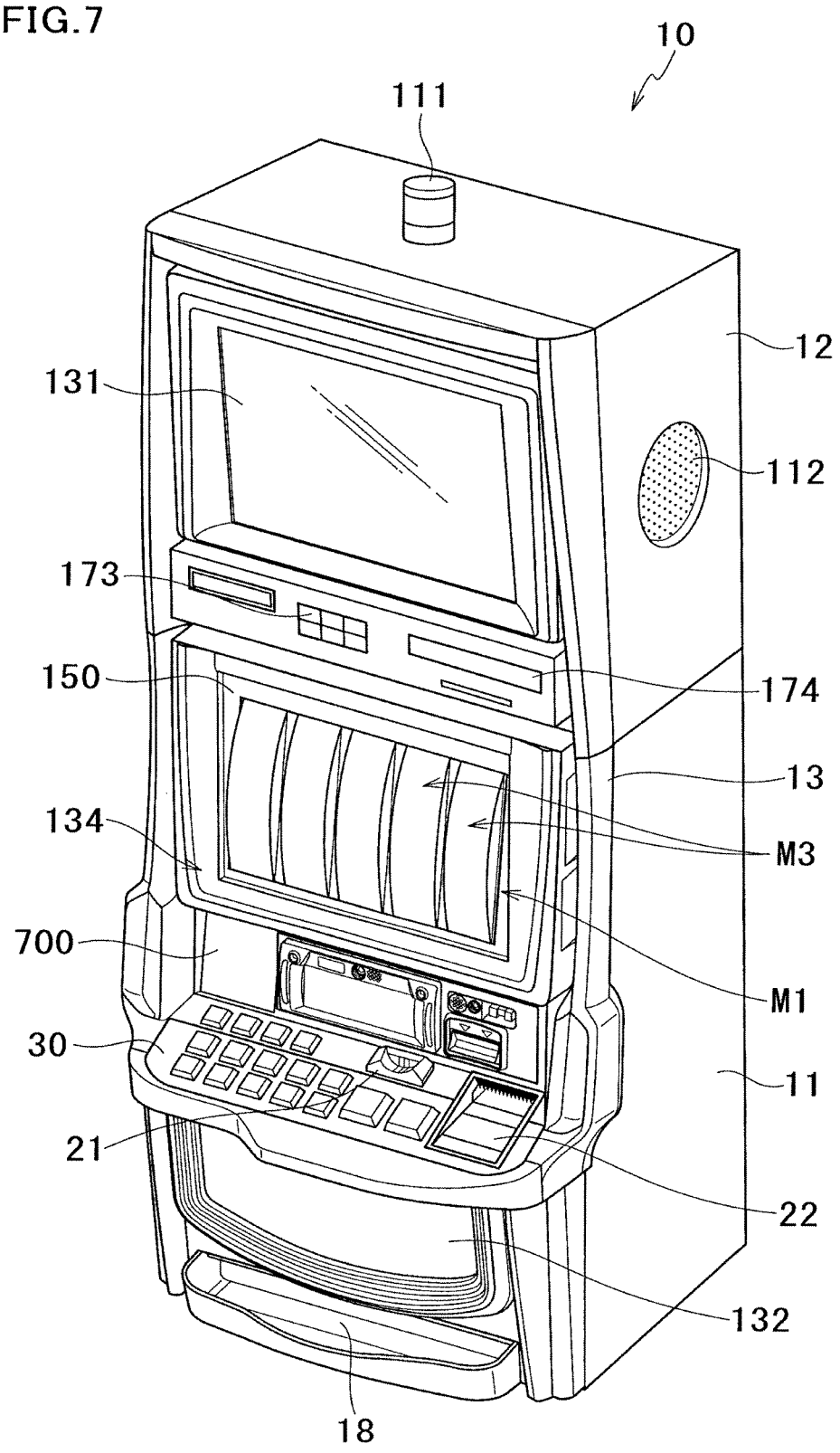
FIG. 7 is a perspective view of a slot machine in the gaming machine.

The following describes an entire structure of a slot machine 10 with reference to FIG. 7.

In the slot machines 10, coins, bills, or electronic information equivalent thereto are used as game media. In particular, the present embodiment uses credit-related data stored in the IC card 500, such as cash data.

The slot machine 10 has a cabinet 11, a top box 12 provided above the cabinet 11, and a main door 13 provided on the front face of the cabinet 11.

The main door 13 is provided with the reel device M1. On the front surface of the reel device M1 is provided a reel cover 134. This reel cover 134 has a transparent liquid crystal panel and a transparent panel. The reel cover 134 may additionally have a touch panel. At the central portion of the reel cover 134 is provided a display window 150. The display window 150 allows 20 symbols 501 forming five columns and four rows to be visually recognizable from the outside. The four symbols 501 of each column are parts of a group of symbols lined up on the outer circumferential surfaces of the reels M3. Each reel M3 rearranges the symbols 501 in such a way that four symbols 501 are moved upward and downward while changing the speed and the vertically moved symbols 501 are then stopped.

At the left and right edges of the display window 150, payline occurrence columns are provided in a symmetrical manner on the left and right. The left payline occurrence column on the left side when viewed from the player has 25 payline occurrence parts. The right payline occurrence column on the right side when viewed from the player has 25 payline occurrence parts.

The left payline occurrence parts form pairs with the respective right payline occurrence parts. From the left payline occurrence parts to the right payline occurrence parts paired with the left payline occurrence parts, paylines are defined in advance. There are 25 paylines.

Each payline is activated when the left and right payline occurrence parts are connected with each other. In other cases, the paylines are inactive. The number of activated paylines is determined based on a bet amount. When the bet amount is maximum, i.e., MAXBET, the maximum number of, i.e. 25 paylines are activated. An activated payline allows the symbols 501 to establish various types of winning combinations. Details of the winning combinations will be described later.

While the present embodiment deals with a case where the slot machine 10 has a mechanical-reel-type reel device M1, the slot machine 10 of the present invention may simultaneously employ both the mechanical type and a video-reel type using pseudo reels. Furthermore, the reel cover 134 may be provided with a touch panel. Such a touch panel allows the player to input various instructions. An input signal is transmitted from the touch panel to the main CPU 71.

Below the reel device M1 is provided a control panel 30. In addition to various buttons, the control panel 30 has a coin entry 21 which accepts coins into the cabinet 11, and a bill entry 22.

Figure 8:
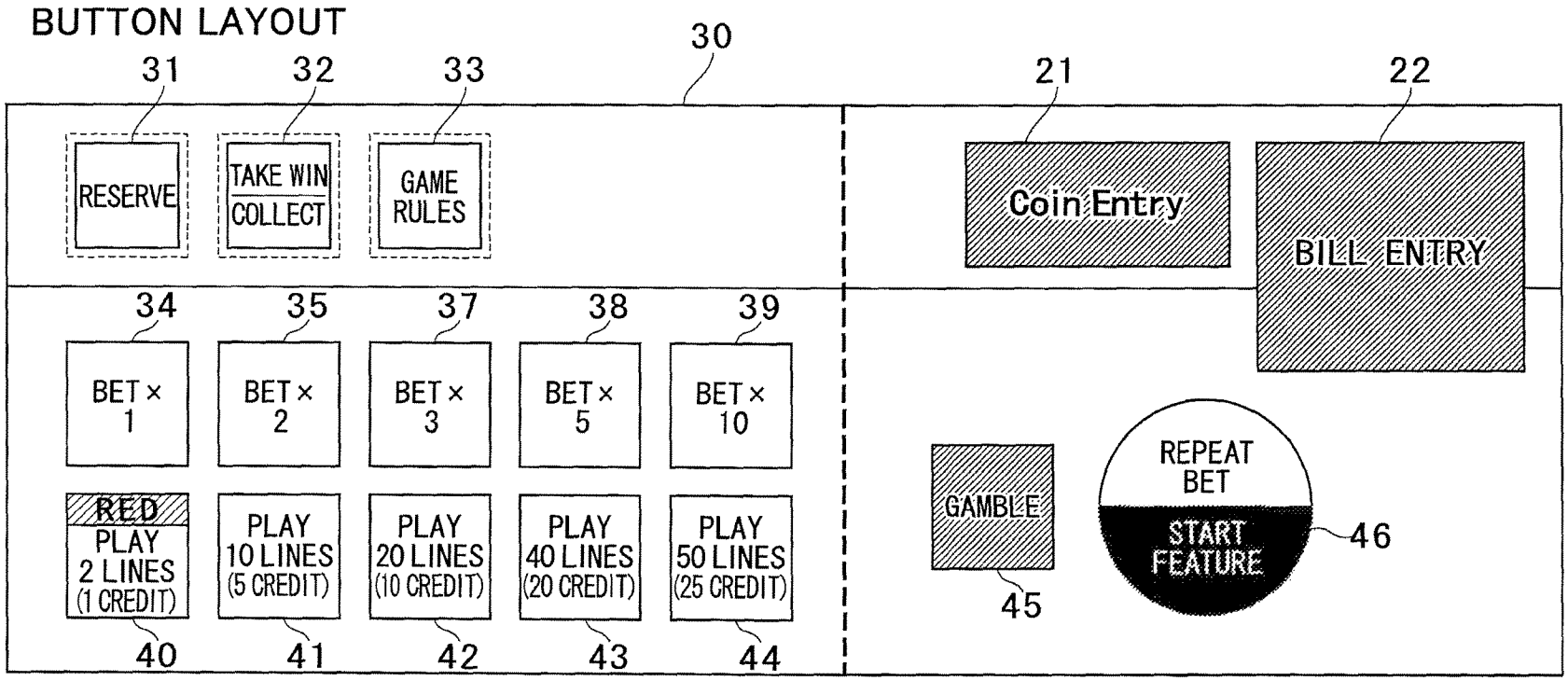
FIG. 8 is an explanatory diagram of a button layout of a control panel.

Specifically, as shown in FIG. 8, the control panel 30 has a reserve button 31, a collect button 32, and a game rule button 33 to an upper left region thereof. The control panel 30 further includes a 1-bet button 34, a 2-bet button 35, a 3-bet button 37, a 5-bet button 38, and a 10-bet button 39 to a middle left region thereof. Moreover, the control panel 30 further includes a play-2-lines button 40, a play-10-lines button 41, a play-20-lines button 42, a play-40-lines button 43, and a MAX-lines button 44 provided to a lower left region thereof.

Further, the control panel 30 has the coin entry 21 and the bill entry 22 in an upper right region thereof, and a gamble button 45 and a start button 46 in a lower right region thereof.

The reserve button 31 is an operation button used when the player leaves the machine or asks a staff person of the gaming facility for currency exchange. The collect button 32 is a so-called settlement button used to add credit data regarding credits obtained in various games to the credit data stored in an IC card 500 inserted into the PTS terminal 700. The game rule button 33 is pressed when it is unclear how to play a game, for example. When the game rule button 33 is pressed, various types of help information are displayed on a later-described upper image display panel 131.

The 1-BET button 34 is a button by which a single credit of player's credits is bet on each activated payline, when pressed once. The 2-BET button 35 is used to start a game with two credits on each activated payline. The 3-BET button 37 is used to start a game with three credits on each activated payline. The 5-BET button 38 is a button to start a game with five credits on each activated payline. The 10-BET button 39 is a button to start a game with ten credits on each activated payline. As such, by pressing the 1-BET button 34, the 2-BET button 35, the 3-BET button 37, the 5-BET button 38, or the 10-BET button 39, the number of credits bet on each activated payline is determined.

The play-2-lines button 40 is pressed to activate paylines. The number of activated paylines is two when this button is pressed. The play-10-lines button 41 is pressed to activate paylines. The number of activated paylines is ten when this button is pressed. The play-20-lines button 42 is pressed to activate paylines. The number of activated paylines is twenty when this button is pressed. The play-40-lines button 43 is pressed to activate paylines. The number of activated paylines is forty when this button is pressed. Furthermore, the MAX-lines button 44 is pressed to activate paylines. The number of activated paylines is the maximum fifty when this button is pressed.

The gamble button 45 is an operation button pressed for shifting from the bonus game to a gamble game or the like after the bonus game has ended. The gamble game is a game played by consuming obtained credits.

The start button 46 is used to start the scroll of the symbols 501. This start button 46 is also used for starting the bonus game and adding a payout obtained in the bonus game to the credits. The coin entry 21 receives coins into the cabinet 11. The bill entry 22 identifies the validity of bills and receives only genuine bills into the cabinet 11.

As shown in FIG. 7, on a lower front face of the main door 13, that is, below the control panel 30 is a coin receiving slot 18 for inserting coins, and a belly glass 132 with a character related to the slot machine 10 shown thereon.

On the front surface of the top box 12 is provided the upper image display panel 131. The upper image display panel 131 is a liquid crystal panel and constitutes a display. The upper image display panel 131 displays images concerning effects and images showing instructions and rules concerning games. Furthermore, the top box 12 has a speaker 112 and a lamp 111. In the slot machine 10, effects are produced by display images and outputting sound and light.

Below the upper image display panel 131 are provided a data displayer 174 and a keypad 173. The data displayer 174 is constituted by a fluorescent display, an LED, and the like. The data displayer 174 displays membership data read our from the IC card 500 inserted into the PTS terminal 700, and data input by the player through the keypad 173, for example. The keypad 173 is provided for data input.

(Mechanical Structure of the PTS Terminal)

Figure 9:
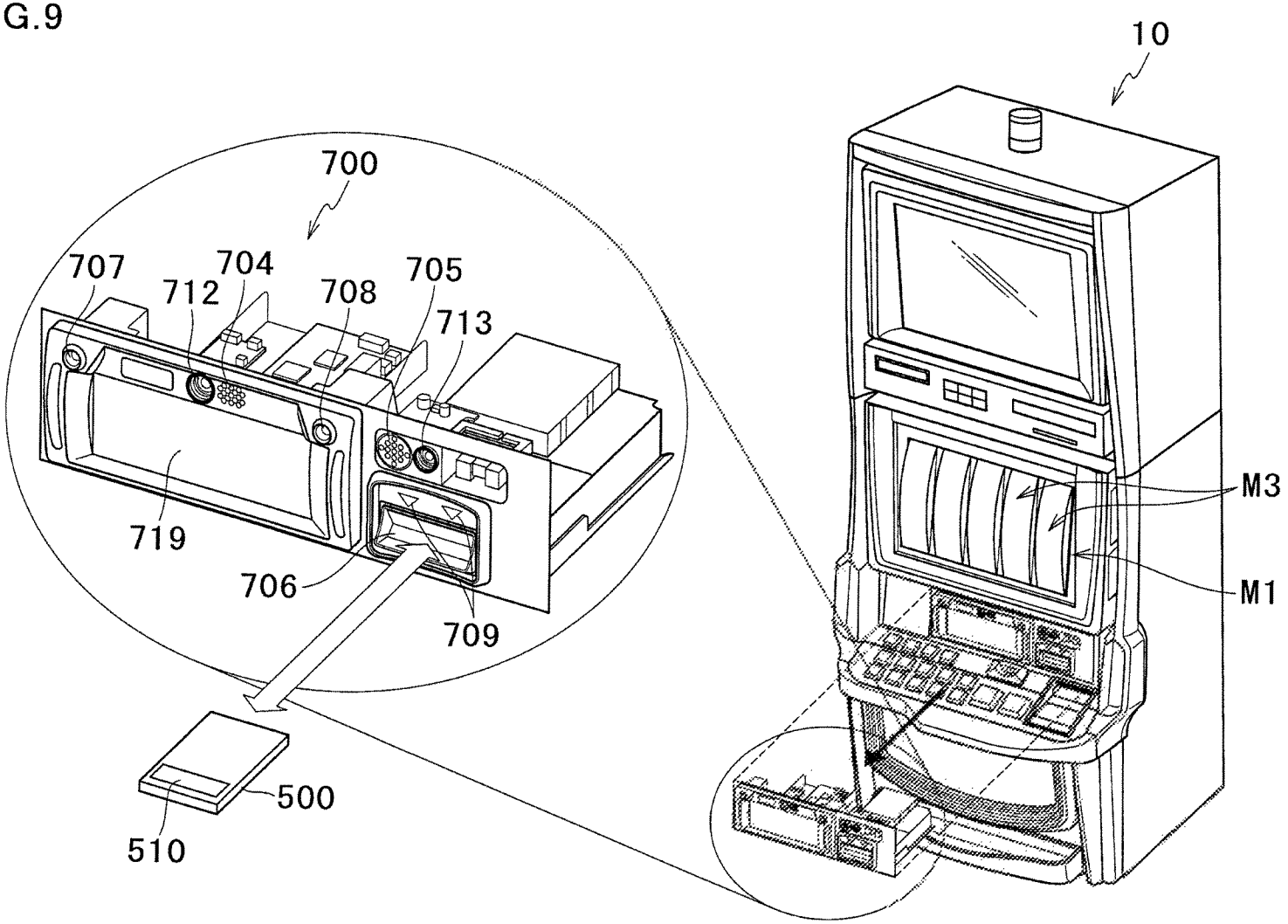
FIG. 9 is a magnified perspective view of a PTS terminal.

Between the reel device M1 and the control panel 30, the PTS terminal 700 is attached. The PTS terminal 700 is, as shown in FIG. 9, provided with a LCD 719. The LCD 719 is provided at the central portion of the PTS terminal 700, and displays an effect image for producing effects of games, for example.

Provided to an upper portion of the PTS terminal 700 is human body detecting cameras 712 and 713, microphones 704 and 705, and bass reflex speakers 707 and 708.

The human body detecting cameras 712 and 713 detect the presence of a player by the camera function and output a signal to a later described unit controller 730. The microphones 704 and 705 allow the player to play a game with his/her voice and authenticate the player by audio recognition. The speakers 707 and 708 produce audio effects of games and warns the player of not to forget to take the IC card 500 off by sound. Furthermore, the speakers 707 and 708 also output warning sound when an inserted IC card 500 is not authenticated. It is noted that the speakers 707 and 708 do not occupy a large space because they are installed so that stereophonic sound is output forward (toward the player) from the back of the LCD 719 through a duct.

In addition to the above, the PTS terminal 700 is provided with a LED 709 and a card insertion slot 706. The LED 709 emits a plurality of colors of light to notify the remaining number of the IC cards 500 stored in a later-described card stacker 714. More specifically, the LED 709 emits yellow light when the remaining number of the IC card 500 is 5 or less, emits blue light when the remaining number is 6 to 24, and emits green light when the remaining number is 25 or more. When the remaining number of the IC cards 500 is 0 or 30, the LED 709 emits gray light and the game in operation is stopped. Therefore, when the LED 709 emits, for example, yellow light, the staff of the casino hall promptly recognizes that the remaining number of the IC card 500 is small, and fills new IC cards 500. On the other hand, when the LED 709 emits, for example green light, the staff of the casino hall promptly recognizes that the number of the IC cards 500 is maximum, and removes the IC cards 500. To fill new IC cards 500, the IC cards 500 uniquely associated with each staff member are inserted through the card insertion slot 706. On the other hand, to remove the IC cards 500, a staff member inserts a so-called replacement card through the card insertion slot 706, with the result that ten IC cards 500 are discharged along with the replacement card. Accordingly, staff members are not required to confirm the number of IC cards 500 left in the slot machine 10 on the management server, or actually open the main door 13 of the slot machine 10 to confirm the number of IC cards 500 left. This improves the security of the casino hall.

The card insertion slot 706 has a mechanism to allow the IC cards 500 to be inserted and removed. Each IC card 500 is inserted so that the display portion 510 faces up and away from the card insertion slot 706. Furthermore, while the IC card 500 is entirely housed in the slot machine when the player is playing a game, the IC card 500 is discharged so that its display portion 510 is exposed, when settlement is carried out. This allows the player to conform the credit-related data such as updated cash data. Alternatively, each IC card 500 may be stored so that the card is not completely covered and the display portion 510 is exposed, even when the player is playing a game. This allows the player to always recognize the update of the credits in the game. When the human body detecting cameras 712 and 713 detect no player when the credits are settled, the IC card 500 is drawn into the terminal and stored in the card stacker 714. With this, even if a player who recognizes by the display unit 514 that the number of remaining credits is small left the slot machine while deliberately not taking the IC card 500 off, the IC card 500 is not left inserted for a long time. Note that in the present embodiment, that card stacker 714 is capable of holding up to 30 IC cards 500.

As described above, the PTS terminal 700 of the present embodiment is a single unit formed by combining various devices having the microphone function, camera function, speaker function, display function, or the like, and does not therefore require a large space. This makes it possible to resolve a problem that it is impossible to install both the speakers and the LCD to face the player because each function is embodied by a single device.

(Reel Device M1)

Figure 10:
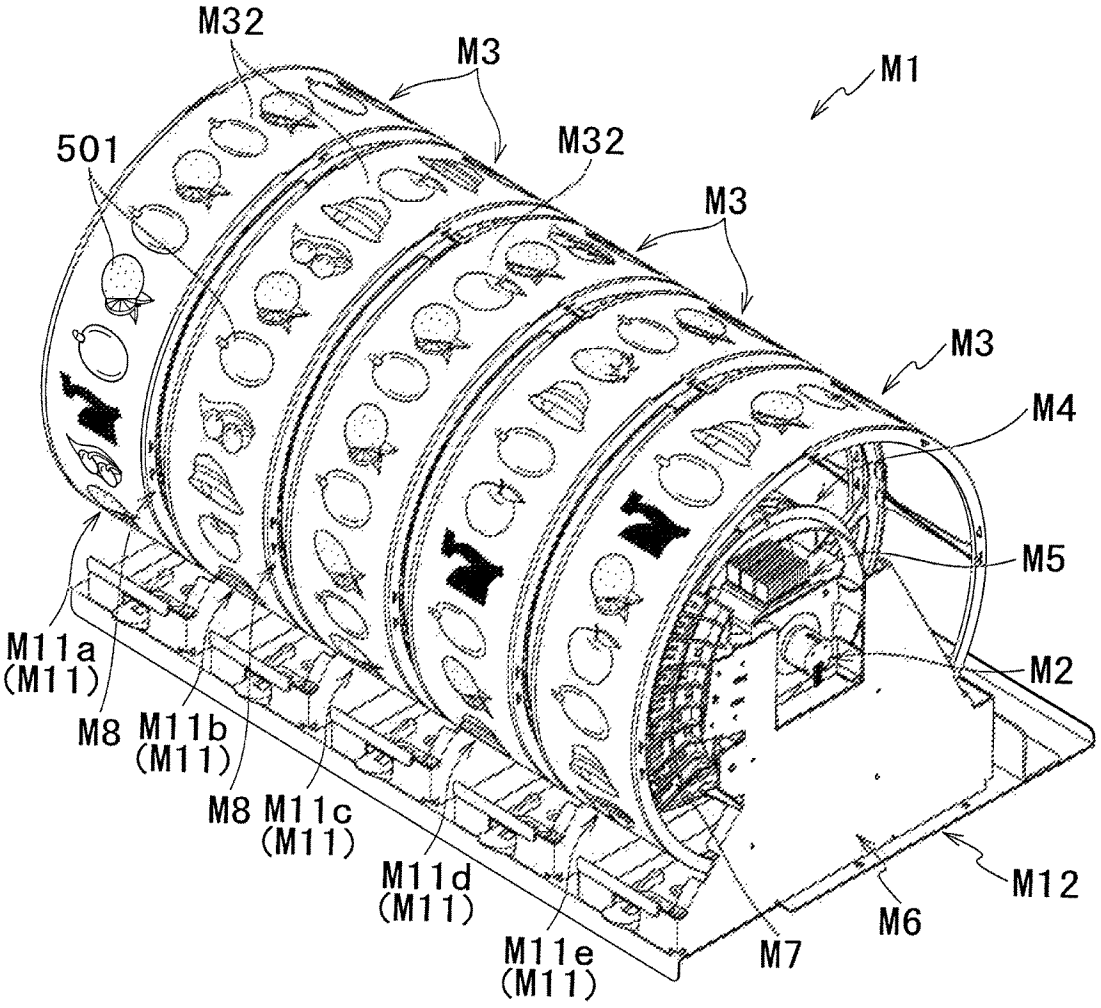
FIG. 10 is a perspective view of the reel device.
Figure 11:
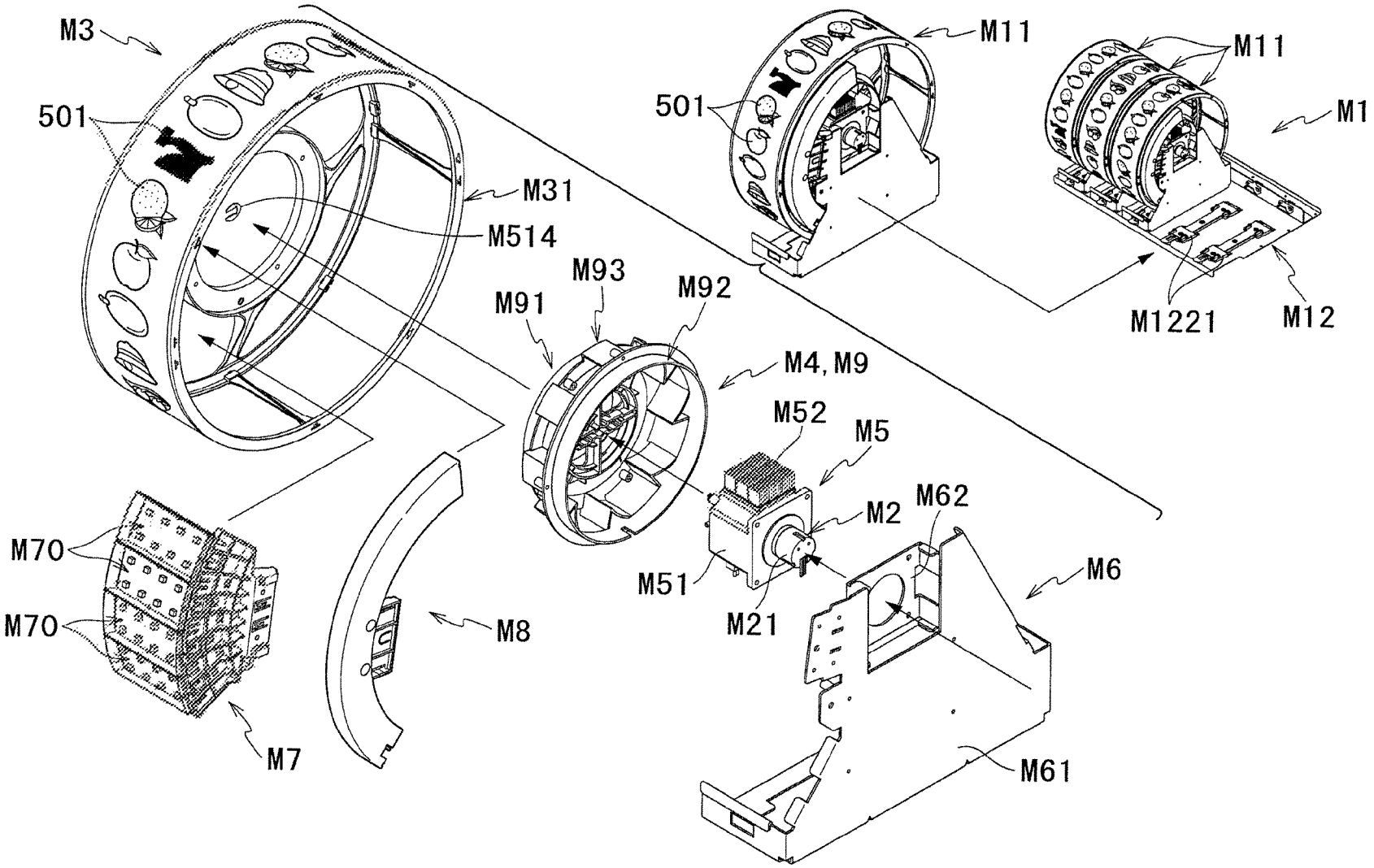
FIG. 11 is an exploded perspective view of the reel device.

The reel device M1 of the slot machine 10 includes, as shown in FIG. 10 and FIG. 11, reel units M11 each of which rotates the reel M3 having the outer circumferential surface on which the symbols 501 are lined up so as to rearrange the symbols 501 and a reel unit supporting mechanism M12 which detachably supports the reel units M11. Hereinafter, the positions of the reel units M11 are specified as, from the left to right when viewed from the front, first to fifth reel units M11*a* to M11*e*.

(Reel Unit Supporting Mechanism M12)

Figure 12:
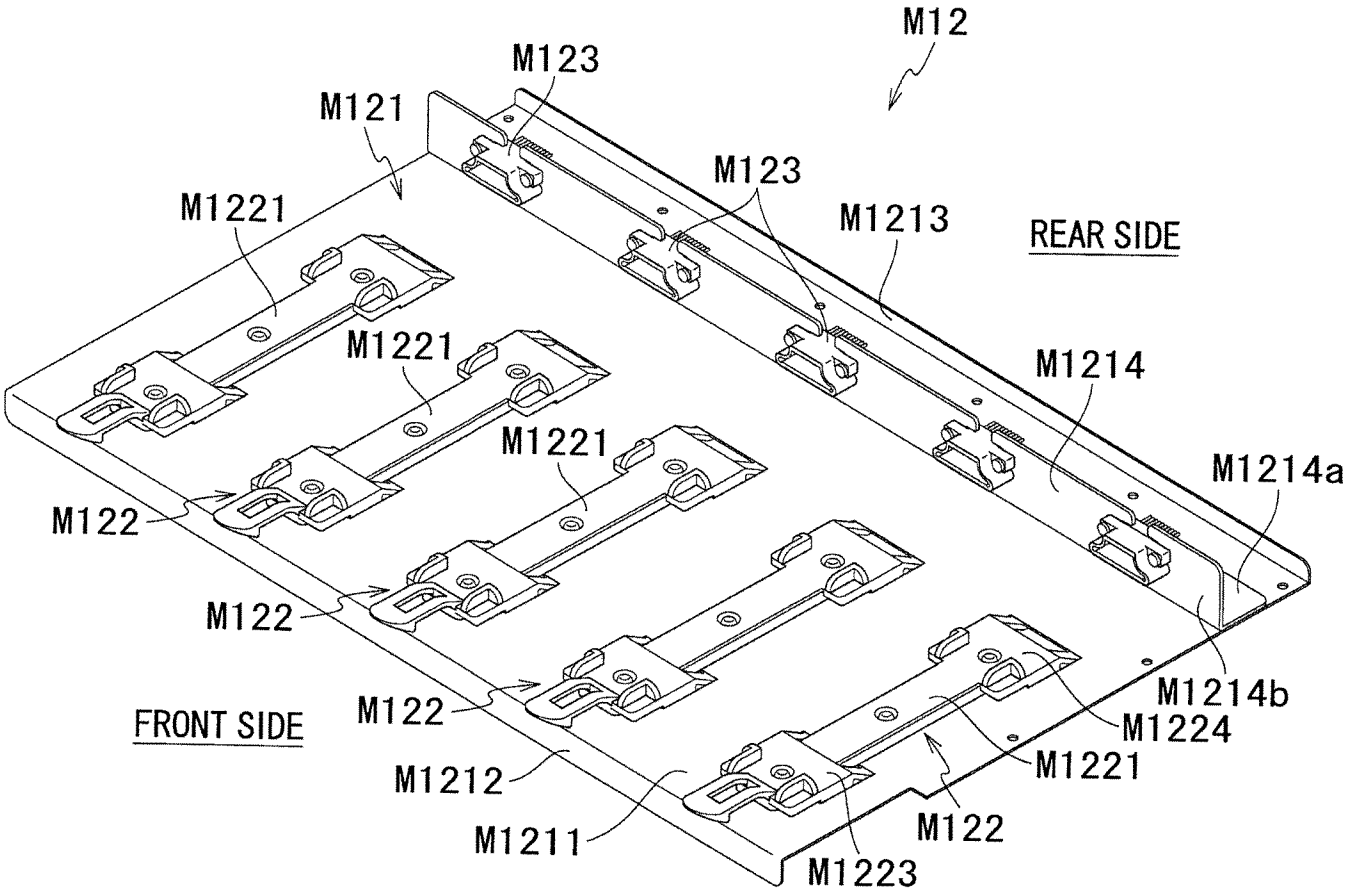
FIG. 12 is a perspective view of a reel unit supporting mechanism.

The reel unit supporting mechanism M12 includes, as shown in FIG. 12, a reel unit supporting plate M121 arranged to be attachable to the cabinet 11 of the slot machine 10 and a sliding-supporting mechanism M122 which is provided on the reel unit supporting plate M121 to support the reel units M11 to be slidable toward the front surface of the cabinet 11. As such, when the reel unit supporting plate M121 is attached to the cabinet 11 of the gaming machine 10, the reel units M11 are detached or attached from or to the sliding-supporting mechanism M122 only by sliding the reel units M11 with respect to the reel unit supporting plate M121, with the result that steps such as screwing, which have conventionally been required, are unnecessary.

(Reel Unit Supporting Mechanism M12: Reel Unit Supporting Plate M121)

More specifically, the reel unit supporting mechanism M12 has a flat reel unit supporting plate M121. The reel unit supporting plate M121 has a horizontal rectangular flat plate portion M1211, a front curved portion M1212 which is curved downward from the front edge of the flat plate portion M1211, and a rear curved portion M1213 which is curved upward from the rear edge of the flat plate portion M1211. The front curved portion M1212 and the rear curved portion M1213 restrain the reel unit supporting plate M121 from deforming against the weight of the supported reel units M11.

The "front edge" indicates an edge on the front side of the slot machine 10. On the other hand, the "rear edge" indicates an edge on the rear side of the slot machine 10. In the present embodiment, on the basis of the position of the slot machine 10, a side where the player plays games in this slot machine 10 is referred to as the front side, front ward, and the front surface side, whereas the other side is referred to as the rear side. Furthermore, the direction in which the player faces the slot machine 10 is referred to as a front-rear direction, whereas the horizontal direction orthogonal to the front-rear direction is referred to as a left-right direction.

Figure 13:
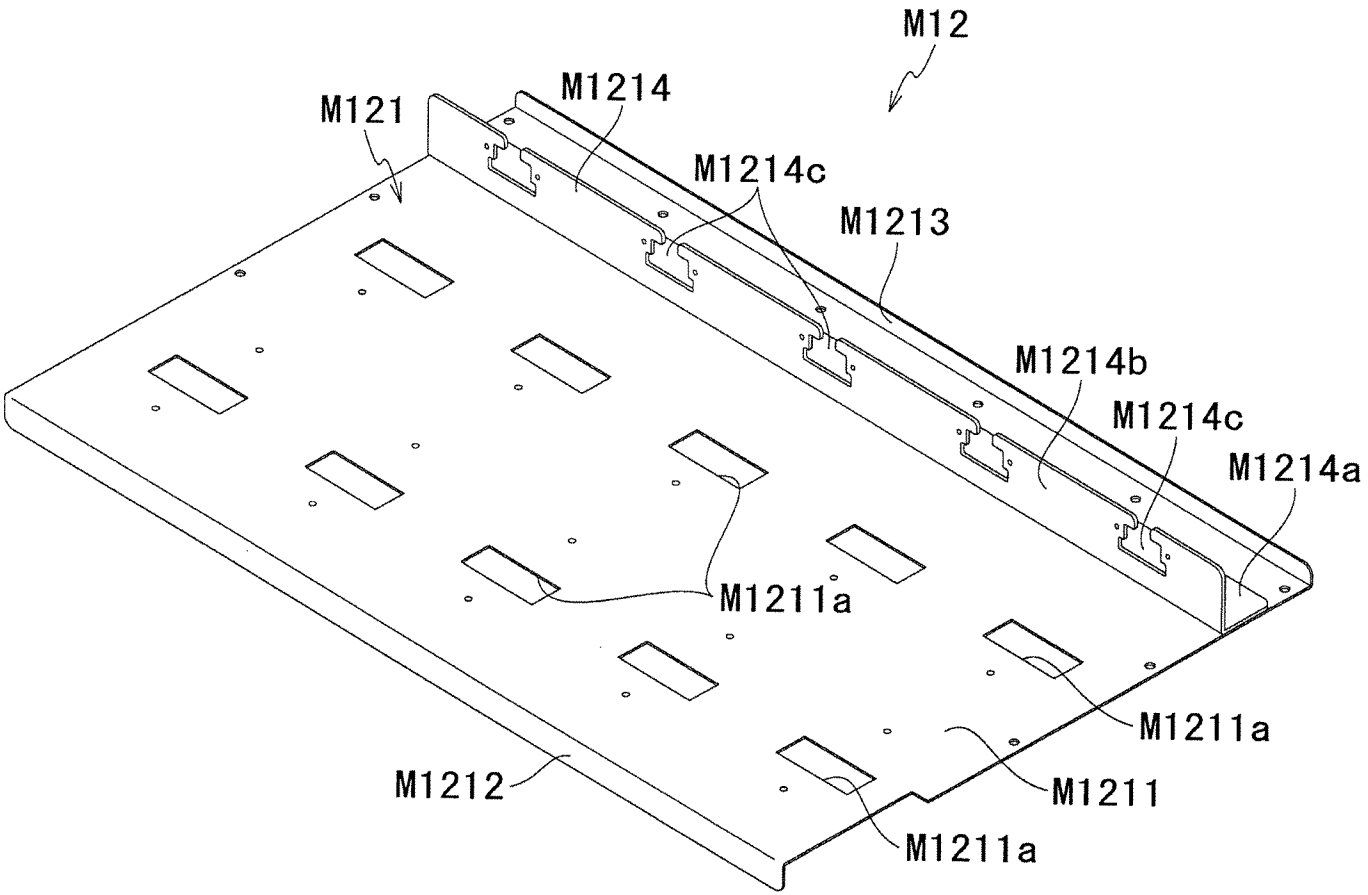
FIG. 13 is a perspective view of a reel unit supporting mechanism.

As shown in FIG. 13, on the upper surface of the flat plate portion M1211, a connector support member M1214 is provided to extend in the left-right directions (width directions). This connector support member M1214 is L-shaped in vertical cross section in the front-rear directions, and has a crosswise portion M1214*a* connected to the flat plate portion M1211 and a vertical portion M1214*b* provided to be orthogonal to the crosswise portion M1214*a*. The vertical portion M1214*b* has connector fitting holes M1214*c*. The number of the connector fitting holes M1214*c* corresponds to the number of the reel units M11. The connector fitting holes M1214*c* are formed so that the center of the reel device M11 in the width directions opposes the center of the connector fitting hole M1214*c* in the width directions, when the reel device M11 is attached to the reel unit supporting plate M121.

The flat plate portion M1211 is further provided with fixing holes M1211*a*. Two fixing holes M1211*a* are formed in front of each respective connector fitting hole M1214*c* to be close to and far from the hole M1214*c*, respectively. In other words, the fixing holes M1211*a* form a 2×5 matrix on the flat plate portion M1211. The fixing holes M1211*a* constitute parts of a later-described sliding-supporting mechanism M122, and allow a sliding-supporting component M1221 shown in FIG. 12 to be attached to the reel unit supporting plate M121.

Figure 14:
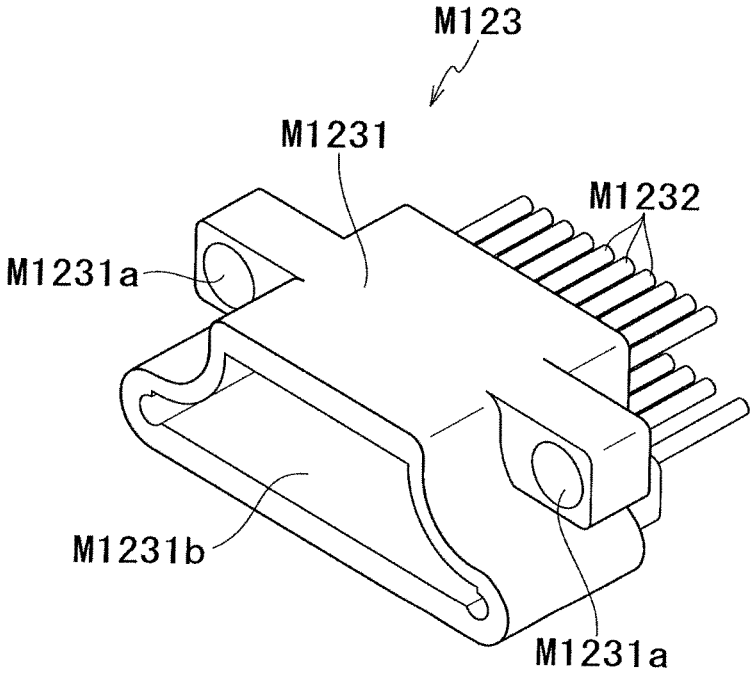
FIG. 14 is a perspective view of a second connector.

Each connector fitting hole M1214*c* is, as shown in FIG. 12, provided with a second connector M123. The second connector M123 is a female connector. The second connector M123 has, as show in FIG. 14, a connector fitting portion M1231 and pin terminals M1232. The pin terminals M1232 are electrically connectable to a main body PCB 110 shown in FIG. 38 via unillustrated signal lines.

Figure 18:
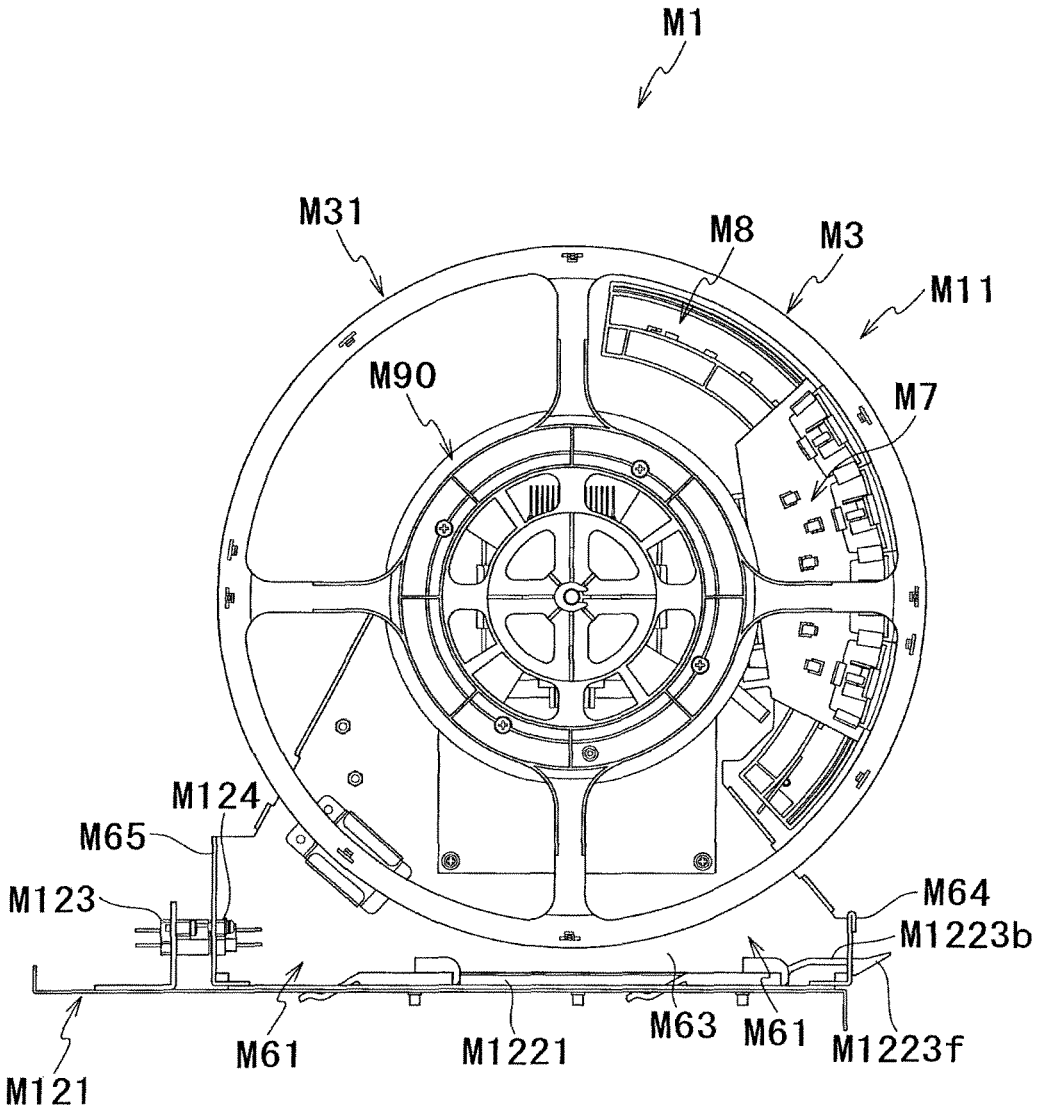
FIG. 18 is a profile of the reel device.

The connector fitting portion M1231 has attaching portions M1231*a* and M1231*a* formed at the edges in the width directions and a connector inserting portion M1231*b* which is open on the front surface side. As shown in FIG. 12, the attaching portions M1231*a* and M1231*a* are fixed by screws to the vertical portion M1214*b* of the connector support member M1214. Furthermore, as shown in FIG. 18, the second connector M123 is electrically connected to the first connector M124 such that, when the reel device M11 is attached to the reel unit supporting plate M121, the first connector M124 which is a male connector of the reel device M11 is inserted to the second connector M123.

(Reel Unit Supporting Mechanism M12: Sliding-Supporting Mechanism M122)

In front of the second connector M123 arranged as above, as shown in FIG. 12, the sliding-supporting mechanism M122 is provided. The sliding-supporting mechanism M122 has a sliding-supporting component M1221. The sliding-supporting component M1221 is formed to be symmetrical in the left-right directions about the center line extending in the front-rear directions. The sliding-supporting component M1221 has a sliding main body portion M1222, a first sliding-fixing portion M1223 provided in front of the sliding main body portion M1222, and a second sliding-fixing portion M1224 provided at the rear of the sliding main body portion M1222.

The sliding main body portion M1222 is a flat plate whose upper and lower surfaces are flat. The upper surface of the sliding main body portion M1222 is arranged to be able to extensively support the reel supporting mechanism M6. On the other hand, the lower surface of the sliding main body portion M1222 extensively contacts the flat plate portion M1211 of the reel unit supporting plate M121, with the result that the reel supporting mechanism M6 is extensively supported by the reel unit supporting plate M121.

Figure 15:
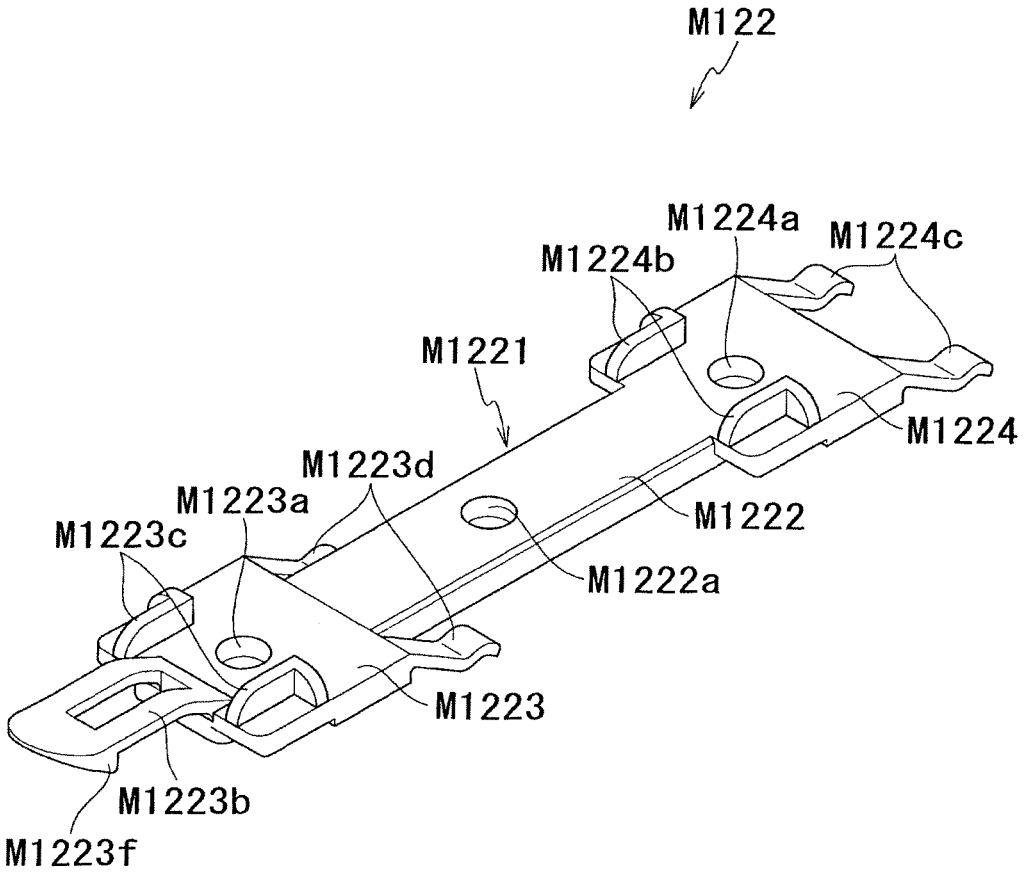
FIG. 15 is a perspective view of a sliding-supporting mechanism.

The sliding main body portion M1222 is, as shown in FIG. 15, formed to have a rectangular shape in plan view and to be long in the front-rear directions. At the central part of the sliding main body portion M1222, a through hole M1222*a* is formed. This through hole M1222*a* makes it possible to, as shown in FIG. 12, fixation by screwing to the reel unit supporting plate M121.

On the other hand, as shown in FIG. 15, the first sliding-fixing portion M1223 provided in front of the sliding main body portion M1222 is arranged to be flush with the sliding main body portion M1222. The first sliding-fixing portion M1223 is formed to be square-shaped in plan view and to be wider than the sliding main body portion M1222 in the width directions. In other words, the crosswise edges of the first sliding-fixing portion M1223 are arranged to protrude as compared to the crosswise edges of the sliding main body portion M1222.

At the central portion of the first sliding-fixing portion M1223 is formed a through hole M1223*a*. The through hole M1223*a* allows fixation to the reel unit supporting plate M121 by screwing. Furthermore, at the front edge of the first sliding-fixing portion M1223 is formed a fixing protrusion M1223*b*. This fixing protrusion M1223*b* is formed to protrude backward and obliquely upward from the first sliding-fixing portion M1223. At the leading edge of the fixing protrusion M1223*b* is formed a protrusion M1223*f* which protrudes downward. The fixing protrusion M1223*b* fixes the reel units M11 in the vertical directions and prevents the reel units M11 from moving in the front-rear directions.

On the upper surface of the first sliding-fixing portion M1223, stop-sliding portions M1223*c* are symmetrically provided on the left and right. The stop-sliding portions M1223*c* are walls forming a space which is open on the front surface side and on the upper surface side, i.e. walls each of which protrudes upward and L-shaped in plan view. The stop-sliding portion M1223*c* has a function to stop a reel device M11, which is sliding from the front side, at a predetermined position in the front-rear directions. On the other hand, on the lower surface of the first sliding-fixing portion M1223, insertion portions M1223*e* are symmetrically formed to form a space which is open on the front side.

Figure 16:
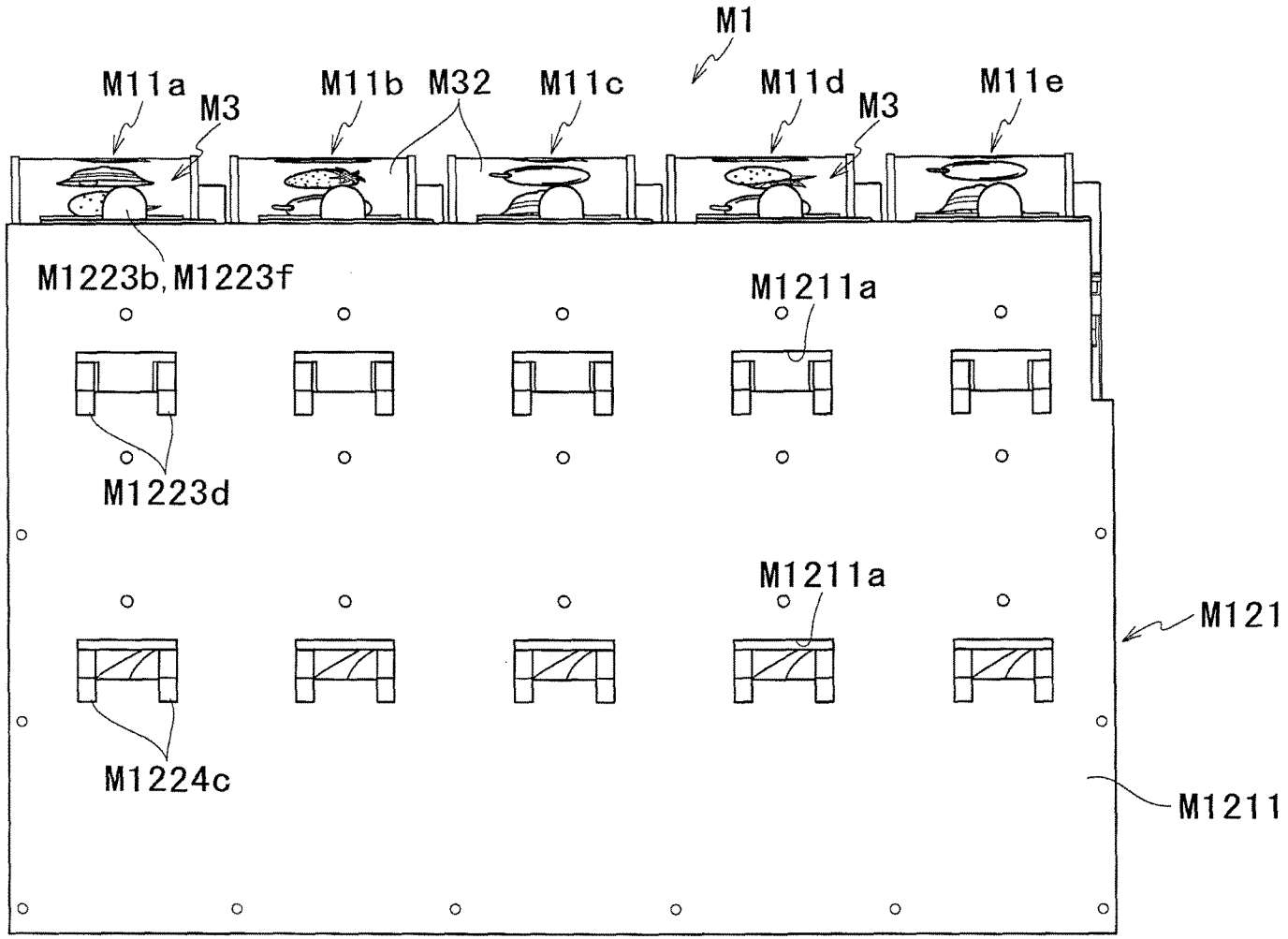
FIG. 16 is a rear view of a reel device.
Figure 17:
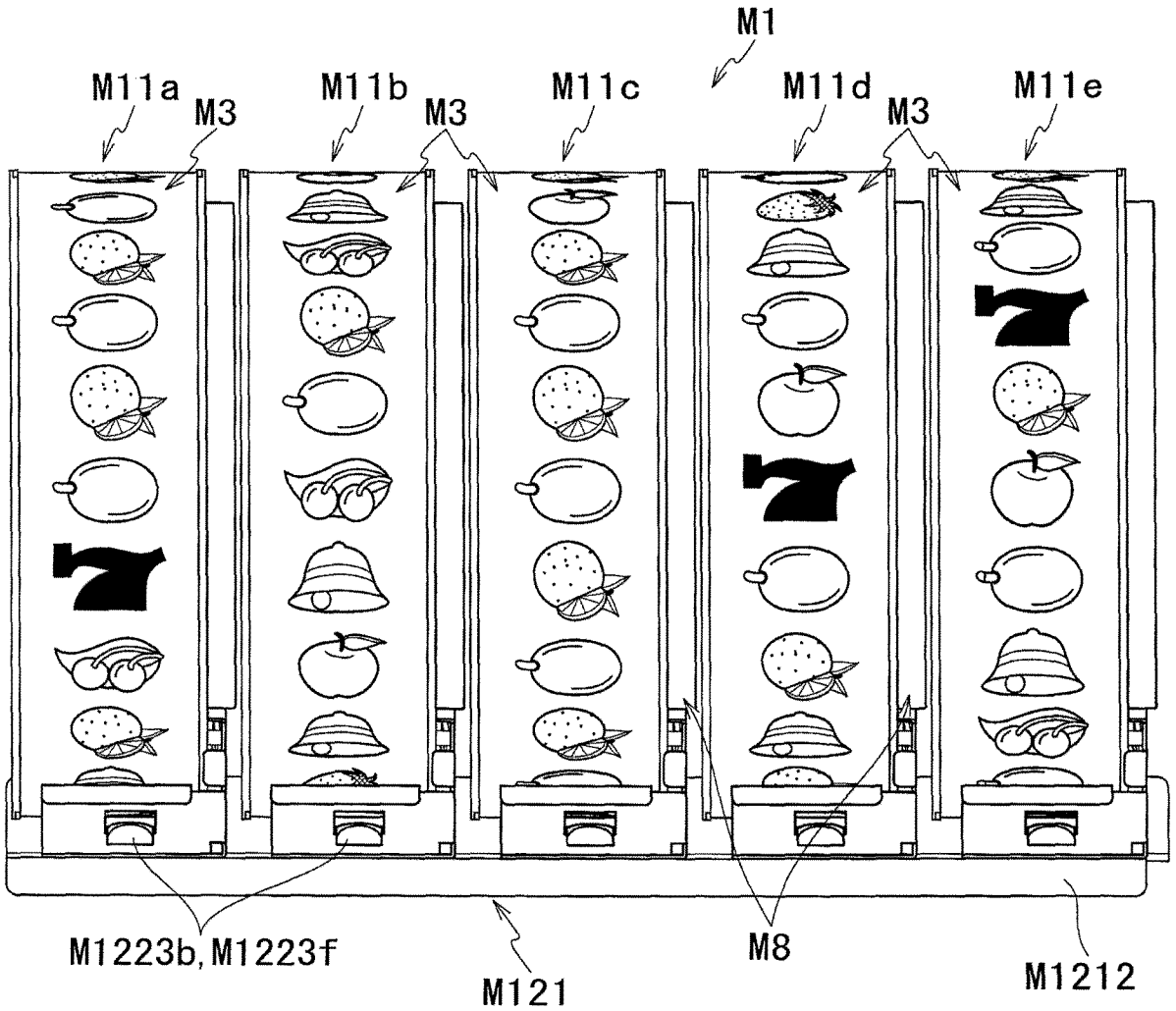
FIG. 17 is a front elevation of the reel device.

At the rear edge of the first sliding-fixing portion M1223 are formed connecting portions M1223*d*. The connecting portions M1223*d* are formed to protrude backward and obliquely downward from the first sliding-fixing portion M1223. The connecting portions M1223*d* have, as shown in FIG. 16, a function to fix the sliding-supporting component M1221 to the reel unit supporting plate M121 in the vertical directions, by being obliquely fitted into the fixing hole M1211*a* at the front side of the flat plate portion M1211.

In the meanwhile, as shown in FIG. 15, the second sliding-fixing portion M1224 provided at the rear of the sliding main body portion M1222 is flush with the sliding main body portion M1222. The second sliding-fixing portion M1224 is square-shaped in plan view and wider than the sliding main body portion M1222 in the width directions. In other words, the crosswise edges of the second sliding-fixing portion M1224 are arranged to protrude as compared to the crosswise edges of the sliding main body portion M1222.

At the central portion of the second sliding-fixing portion M1224, a through hole M1224*a* is formed. This through hole M1224*a* allows the reel unit supporting plate M121 to be fixed by screwing. On the upper surface of the second sliding-fixing portion M1224, stop-sliding portions M1224*b* are symmetrically formed on the left and right. These stop-sliding portions M1224*b* are walls forming a space which is open on the front surface side and on the upper surface side, i.e., walls each of which protrudes upward and L-shaped in plan view. The stop-sliding portion M1224*b* has a function to stop a reel device M11, which is sliding from the front side, at a predetermined position in the front-rear directions. On the lower surface of the second sliding-fixing portion M1224, insertion portions M1224*d* are symmetrically formed to form a space which is open on the front side.

At the rear edge of the second sliding-fixing portion M1224 are formed connecting portions M1224*c*. The connecting portions M1224*c* are formed to protrude backward and obliquely downward from the second sliding-fixing portion M1224. The connecting portions M1224*c* have, as shown in FIG. 16, a function to fix the sliding-supporting component M1221 to the reel unit supporting plate M121 in the vertical directions, by being obliquely fitted into the fixing hole M1211*a* at the front side of the flat plate portion M1211.

(Reel device M11)

The reel unit supporting mechanism M12 structured as above makes it possible, as shown in FIG. 10, to detachably support the reel units M1. Each reel device M11 has the reel M3 having the outer circumferential surface on which the symbols 501 are lined up and the reel supporting mechanism M6 supporting the reel M3.

(Reel Device M11: Reel Supporting Mechanism M6)

Figure 19:
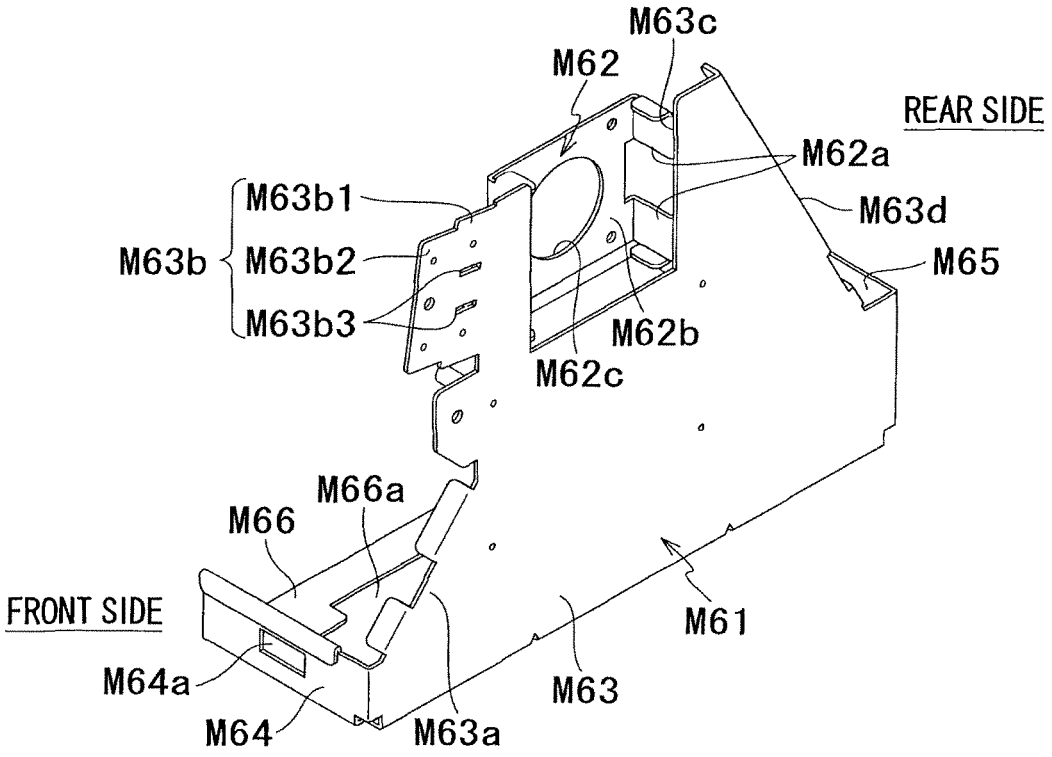
FIG. 19 is a perspective view of a reel supporting mechanism.

The reel supporting mechanism M6 has, as shown in FIG. 19, a reel supporting member M61 and a motor supporting member M62. The reel supporting member M61 has a lateral vertical portion M63, a front vertical portion M64, a rear vertical portion M65, and a supporting bottom portion M66. These portions M63 to M66 are formed by folding a flat plate. The supporting bottom portion M66 is formed to be flat and extensively contact the reel unit supporting plate M121. The supporting bottom portion M66 has a bottom insertion hole M66*a*.

Figure 20:
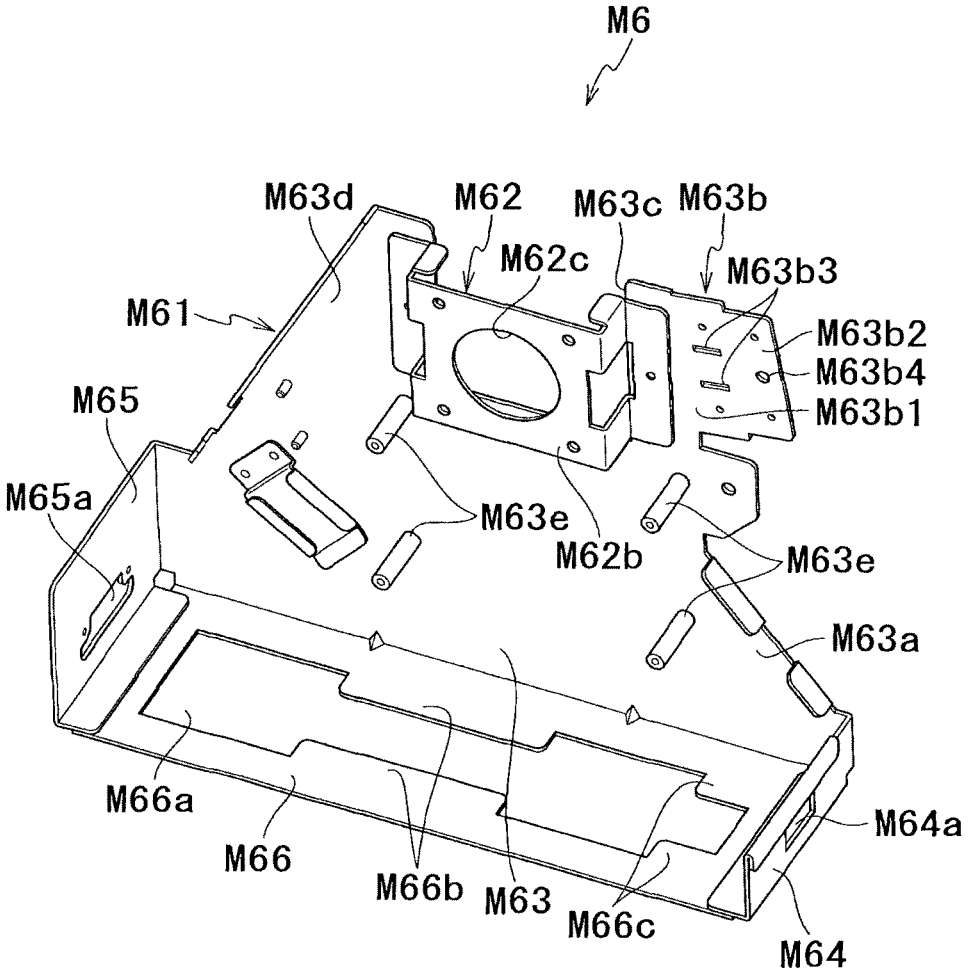
FIG. 20 is a perspective view of a reel supporting mechanism.

The bottom insertion hole M66*a* is, as shown in FIG. 20, rectangular in shape. The bottom insertion hole M66*a* has central protrusions M66*b* at the central portion and front protrusions M66*c* on the front side. More specifically, the bottom insertion hole M66*a* is shaped to be slightly larger in size but similar to the above-described sliding-supporting component M1221, and allows the sliding-supporting component M1221 to be inserted from above.

As such, the reel supporting member M61 is fixed to the reel unit supporting plate M121 in the vertical directions in such a way that, after the sliding-supporting component M1221 is inserted to the bottom insertion hole M66*a* of the supporting bottom portion M66, the central protrusions M66*b* are fitted to the gaps formed between the insertion portions M1223*e* formed on the lower surface of the first sliding-fixing portion M1223 shown in FIG. 15 and the reel unit supporting plate M121 and the front protrusions M66*c* are fitted to the gaps between the insertion portions M1224*d* formed on the lower surface of the second sliding-fixing portion M1224 shown in FIG. 15 and the reel unit supporting plate M121.

In front of the supporting bottom portion M66, a front vertical portion M64 is provided. This front vertical portion M64 is provided to be vertical with respect to the supporting bottom portion M66. The supporting bottom portion M66 has a front insertion hole M64*a*. This front insertion hole M64*a* allows, as shown in FIG. 18, the fixing protrusion M1223*b* to be inserted thereto and causes the protrusion M1223*f* to contact the front surface side of the front vertical portion M64. As a result, as shown in FIG. 16 and FIG. 18, the reel supporting member M61 is fixed to the reel unit supporting plate M121 in the vertical directions and the front-rear directions without using a screw.

On the rear side of the supporting bottom portion M66 is provided a rear vertical portion M65. This rear vertical portion M65 has a connector fitting hole M65*a*. The connector fitting hole M65*a* is formed to oppose the connector fitting hole M1214*c* shown in FIG. 13. Into the connector fitting hole M65*a*, the above-described first connector M124 shown in FIG. 18 is inserted. With these arrangements, as shown in FIG. 16 and FIG. 18, the first connector M124 is connected to the second connector M123 as the reel supporting member M61 is slid backward on the reel unit supporting plate M121.

In addition to the above, as shown in FIG. 19 and FIG. 20, to the right of the supporting bottom portion M66 when viewed from the front, a lateral vertical portion M63 is provided. This lateral vertical portion M63 has a front inclined portion M63*a* which inclines upward and backward from the upper end of the front vertical portion M64, an illumination attaching portion M63*b* provided above the front inclined portion M63*a*, an attaching notch portion M63*c* provided at the rear of the illumination attaching portion M63*b*, and a rear inclined portion M63*d* which inclines from the rear side of the attaching notch portion M63*c* toward the upper end of the rear vertical portion M65.

Figure 21:
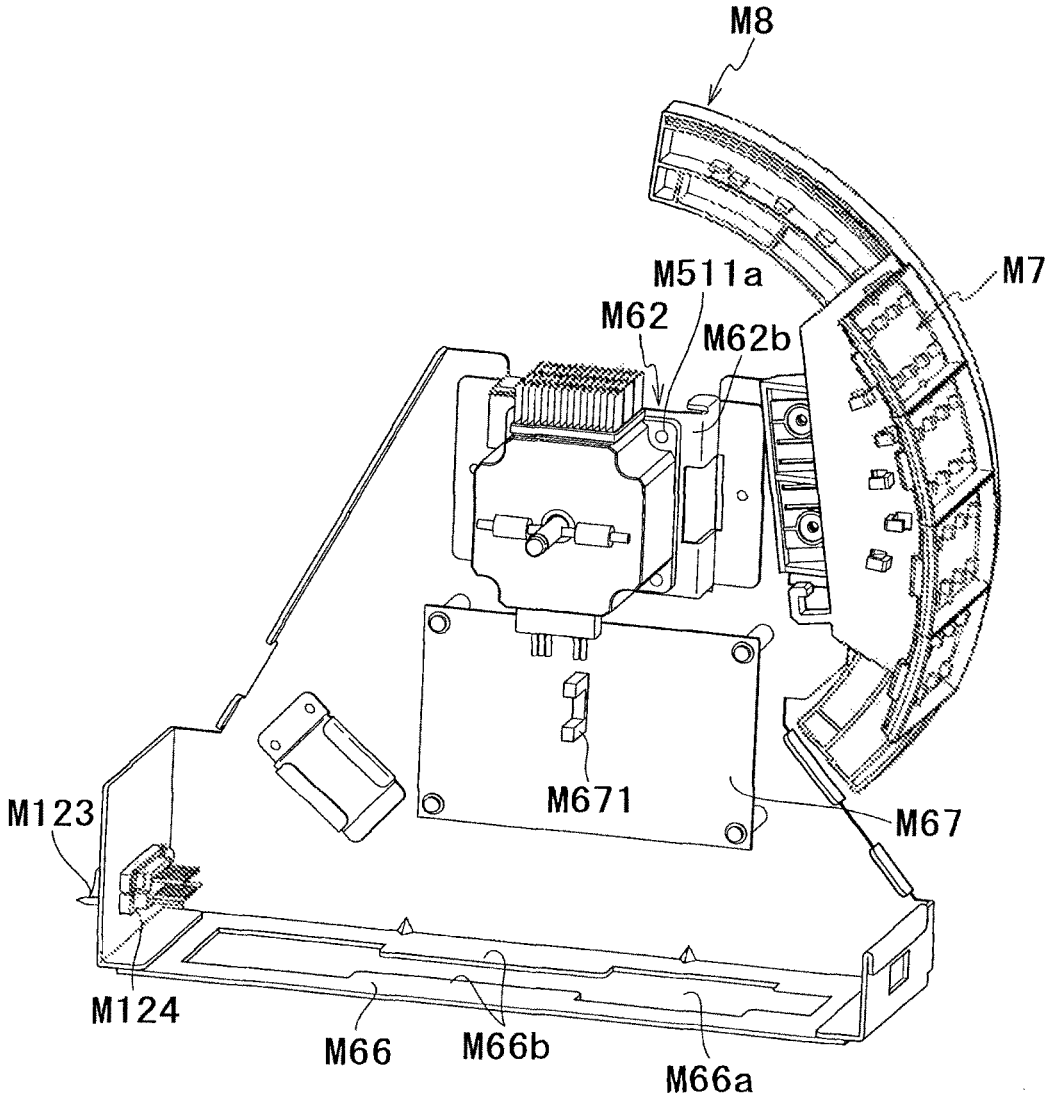
FIG. 21 is a perspective view of a reel supporting mechanism and an effect-light emitter.

On the left surface of the lateral vertical portion M63 are formed, as shown in FIG. 20, four board attaching portions M63*e*. The board attaching portions M63*e* are horizontally formed to, as shown in FIG. 21, support the reel board M67 to be horizontal with respect to the lateral vertical portion M63. The reel board M67 has a function of controlling the reel device M1, and is electrically connected to the first connector M124 by an unillustrated signal line. On the surface of the reel board M67 on the reel M3 side is provided a home position sensor M671. This home position sensor M671 is a part of the reel home position detecting mechanism which outputs a reel home position signal.

On the other hand, the illumination attaching portion M63*b* has, as shown in FIG. 19 and FIG. 20, a backlight attaching portion M63*bl* supporting the backlight apparatus M7 and an effecter attaching portion M63*b*2 supporting the effect-light emitter M8. The backlight attaching portion M63*bl* and the illumination attaching portion M63*b* are provided on the rear side and on the front side, respectively. The length of the backlight attaching portion M63*bl* in the vertical directions is longer than the length of the effecter attaching portion M63*b*2 in the vertical directions. At the central portion of the effecter attaching portion M63*b*2 is formed an effect light fixing hole M63*b*4. Furthermore, the illumination attaching portion M63*b* has two backlight fixing holes M63*b*3. These backlight fixing holes M63*b*3 have a function to maintain the mounting posture of the backlight apparatus M7.

In addition to the above, the attaching notch portion M63*c* is provided with a motor supporting member M62. This motor supporting member M62 is vertically provided on the left side when viewed from the front, and includes vertical portions M62*a* which are symmetrical in the front-back directions and a flat surface attaching portion M62*b* which is provided crosswise between the vertical portions M62*a*. On the left surface of the flat surface attaching portion M62*b*, a reel motor M51 shown in FIG. 11 is provided. At the central part of the flat surface attaching portion M62*b*, a circle-shaped insertion hole M62*c* is formed to cause the end face of the reel motor M51 to expose on the attaching notch portion M63*c* side. The space enclosed by the insertion hole M62*c* and the vertical portions M62*a* houses, as shown in FIG. 11, an encoder unit M21 provided on the end face of the reel motor M51.

(Reel Device M11: Reel Driving Mechanism M5 and Reel Angle Detection Mechanism M2)

The above-described reel motor M51 is a part of the reel driving mechanism M5. The reel driving mechanism M5 is arranged to rearrange the symbols 501 by rotating the reel M3. More specifically, the reel driving mechanism M5 includes a reel motor M51 imparting the rotational force to the reel M3 and a heat sink M52 which dissipates heat by enlarging the size of the surface of the reel motor M51.

Figure 22:
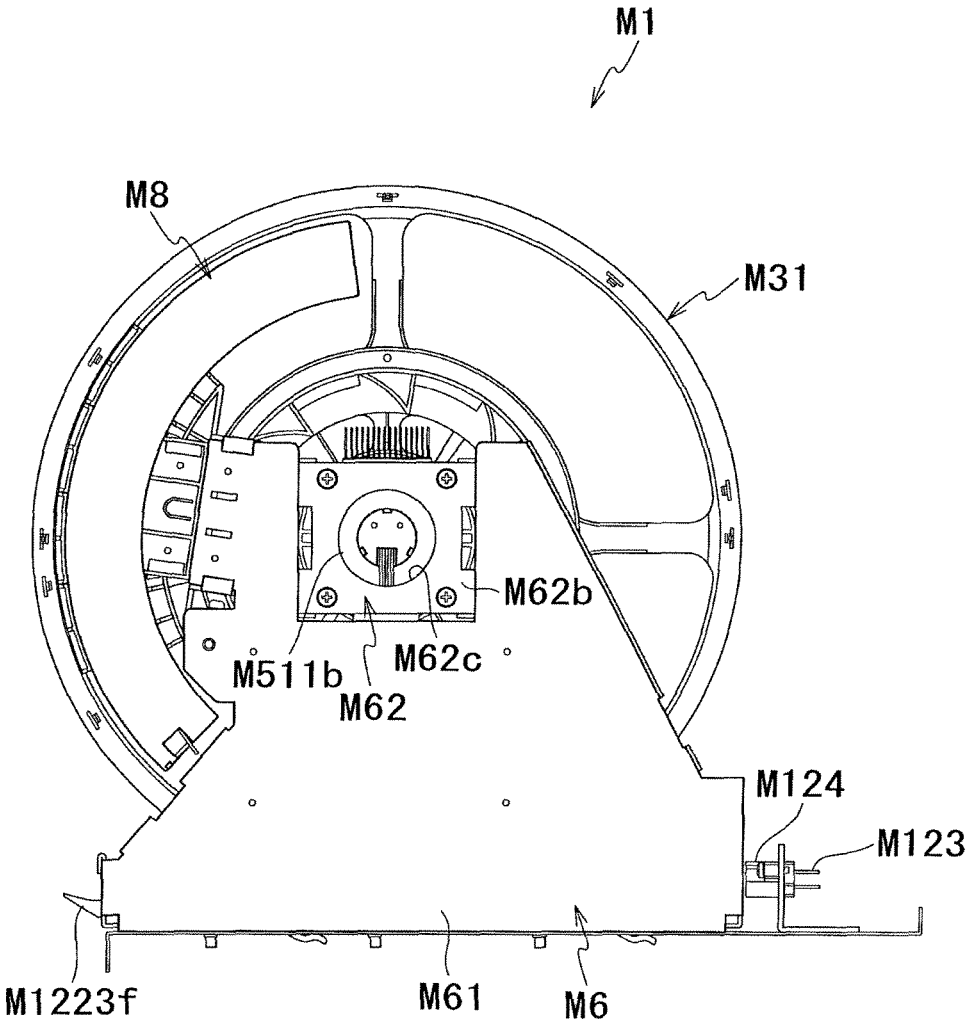
FIG. 22 is a profile of a reel device.

The reel motor M51 is, for example, a stepping motor with 200 steps, and the rotation speed of the rotating shaft M512 is controllable with a speed range between a high speed such as 200 rpm and a low speed such as 12.5 rpm. The reel motor M51 has, as show in FIG. 23 and FIG. 24, motor partition walls M511 forming a hollow rectangular column. At one side of the motor partition walls M511, a flange portion M511*a* is formed. This flange portion M511*a* is, as shown in FIG. 21, fixed to the flat surface attaching portion M62*b* of the motor supporting member M62 by screwing. Furthermore, at the central portion of the flange portion M511*a*, a circular and protruding positioning portion M511*b* is provided. This positioning portion M511*b* is, as shown in FIG. 22, fitted into the insertion hole M62*c* so as to facilitate the positioning of the rotating shaft M512 to be coaxial with the rotation axis of the reel M3, and prevent positional errors during the operation.

Figure 23:
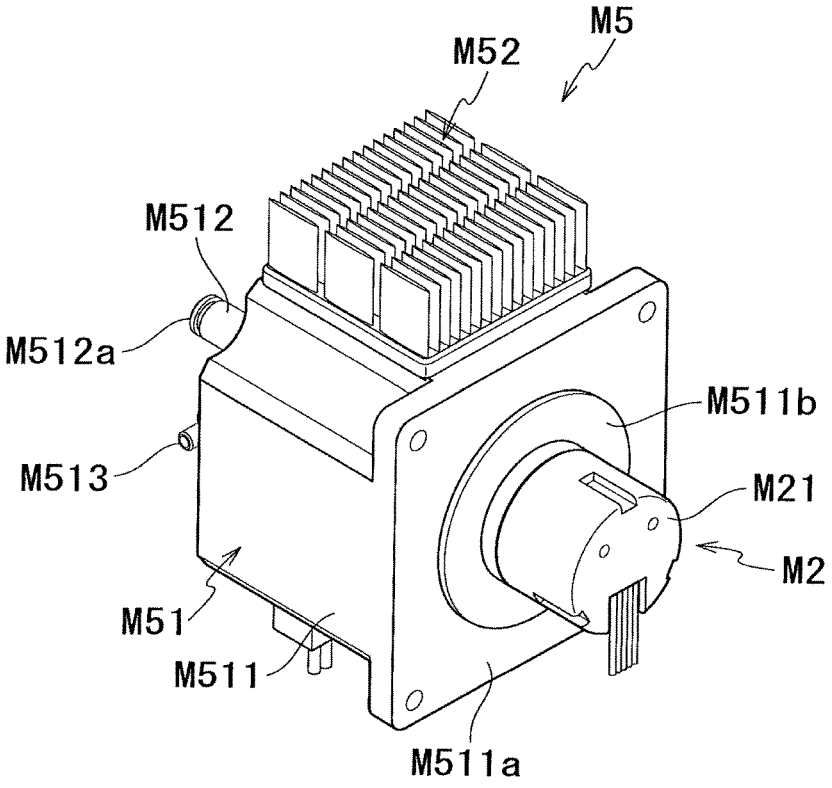
FIG. 23 is a perspective view of a reel driving mechanism.

In addition to the above, at the central portion of the positioning portion M511*b*, as shown in FIG. 23, an end portion of the rotating shaft M512 protrudes. This end portion of the rotating shaft M512 is connected to the encoder unit M21. The encoder unit M21 is a part of the reel angle detection mechanism M2. The encoder unit M21 has an unillustrated reel-interlocked shaft connected to the rotating shaft M512 which is coaxial with the rotation center of the reel M3 and a signal output unit which outputs a magnetic force detection signal, a position pulse signal, a home position pulse signal, and a phase difference pulse signal by magnetically detecting the rotation of the reel-interlocked shaft.

On the upper surface of the motor partition walls M511 is provided a heat sink M52. This heat sink M52 is made of a metal having high heat conductivity, such as aluminum and copper. The heat sink M52 has a flat supporting portion M522 extensively connected to the motor partition walls M511 and fins M521 vertically provided on the upper surface of the supporting portion M522. By increasing the surface area of the reel motor M51, the heat sink M52 cools the reel M3 without needing any dedicated electrical lines.

Figure 24:
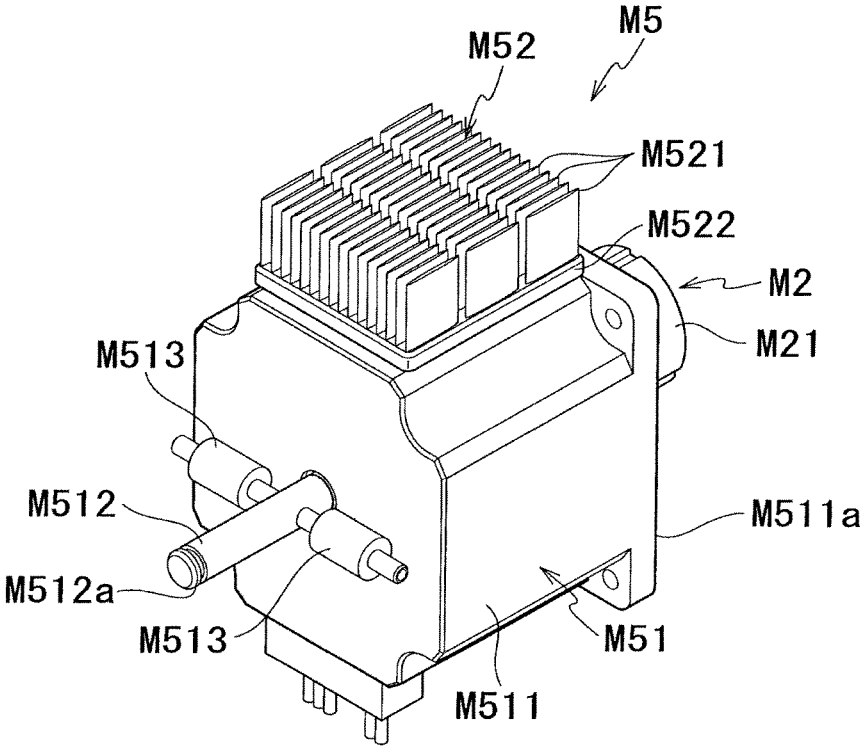
FIG. 24 is a perspective view of a reel driving mechanism.

From the other end of the motor partition walls M511, the other end portion of the rotating shaft M512 protrudes. At the leading end portion of the rotating shaft M512 is formed a fitting annular portion M512*a*. This fitting annular portion M512*a* is, as shown in FIG. 11, fitted with a stopper M514 to fix the blade mechanism M4 and the driving force transfer mechanism M9 in the axial directions. On the other hand, as shown in FIG. 24, at the root portion of the rotating shaft M512, two fixing components M513 are provided to be symmetrical about the rotating shaft M512 on the left and right. The fixing component M513 is vertically provided with respect to the rotating shaft M512. The fixing component M513 fixes the blade mechanism M4 and the driving force transfer mechanism M9 in the rotational direction, and keeps the rotation angle of the reel M3 to be identical with the rotation angle of the rotating shaft M512 by fixing, in the rotational direction, the reel M3 which is connected to the driving force transfer mechanism M9.

(Reel Device M11: Blade Mechanism M4 and Driving Force Transfer Mechanism M9)

Figure 25:
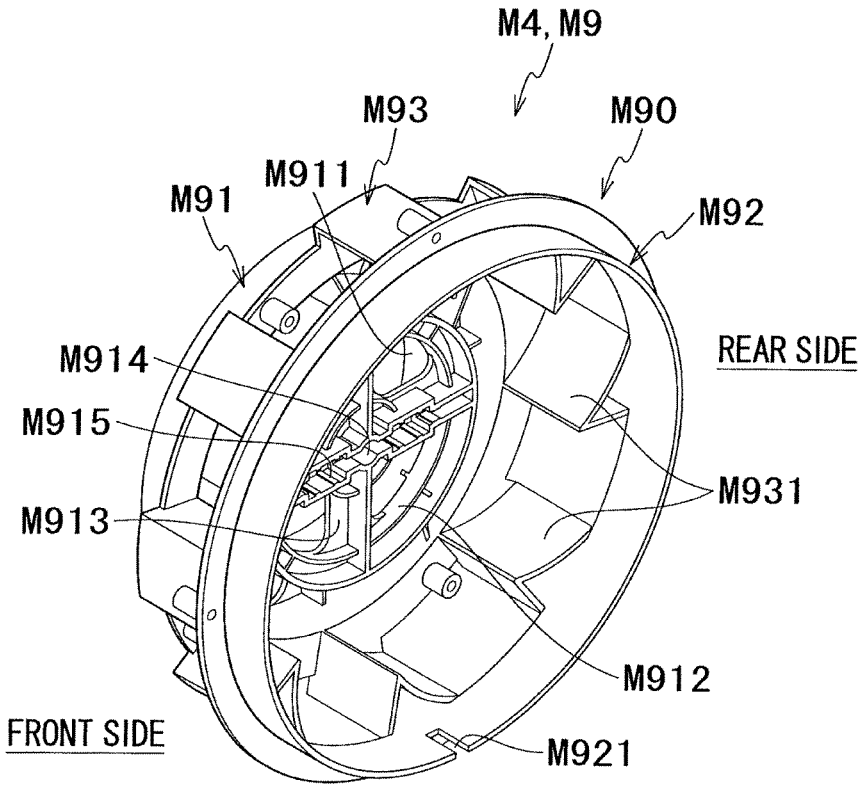
FIG. 25 is a perspective view of a blade mechanism and a driving force transfer mechanism.
Figure 26:
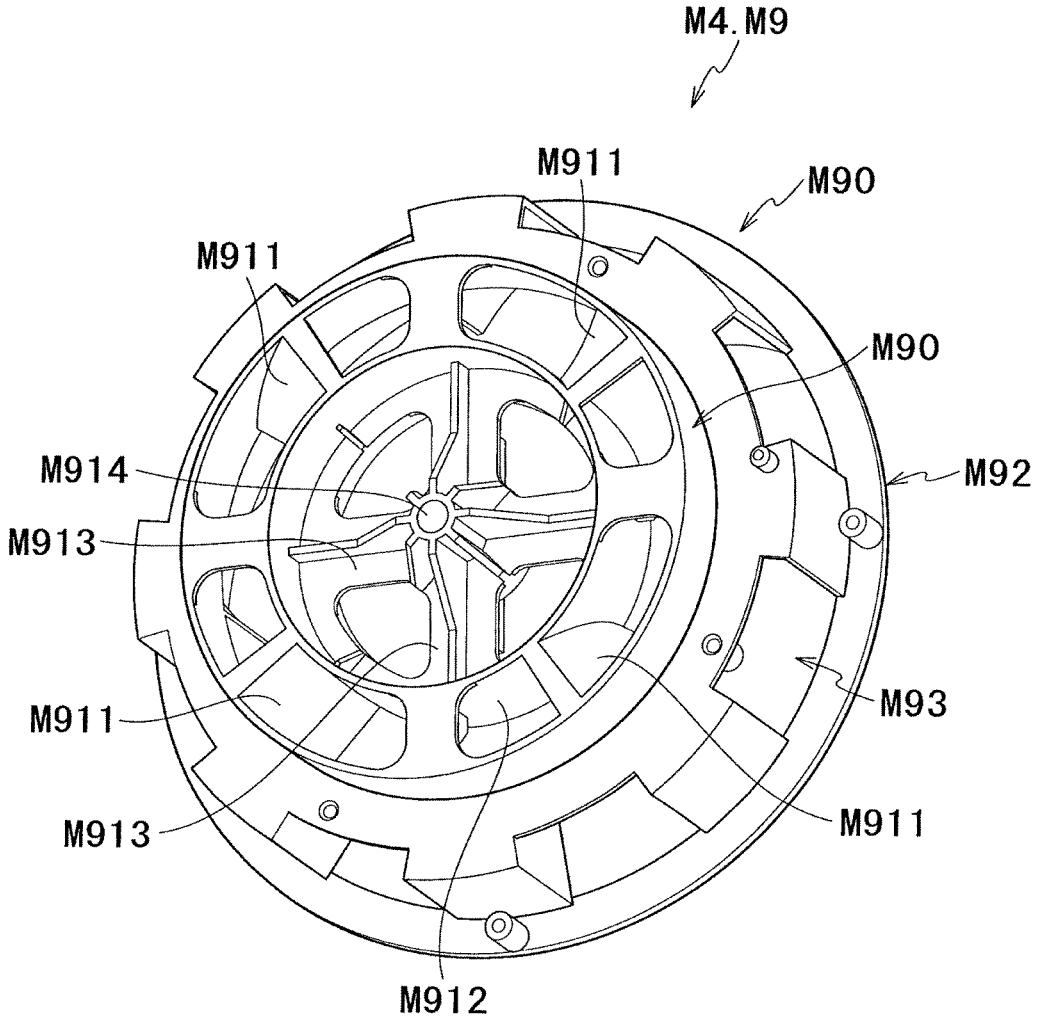
FIG. 26 is a perspective view of a blade mechanism and a driving force transfer mechanism.

The blade mechanism M4 and the driving force transfer mechanism M9 connected to the reel motor M51 arranged as above are, as shown in FIG. 25 and FIG. 26, embodied by a rotating body M90 which is integrally formed by resin. This rotating body M90 has a first annular portion M91 which is provided at the left edge portion when viewed from the front, a second annular portion M92 provided at the other edge portion, and a third annular portion 93 provided between the first annular portion M91 and the second annular portion M92. Each of the first annular portion M91, the second annular portion M92, and the third annular portion 93 is annular in shape, and its central axis is coaxial with the rotation center of the reel M3. On the inner circumference side of the second annular portion M92 and the third annular portion 93, components such as the reel motor M51 of the reel driving mechanism M5 of FIG. 11 are provided.

The second annular portion M92 has a notched portion M921 as a part thereof. This notched portion M921 and the home position sensor M671 shown in FIG. 21 constitute the reel home position detecting mechanism. The notched portion M921 is detected by the home position sensor M671 and a reel home position signal is output a result of the detection. The third annular portion 93 has first blade portions M931 (blade mechanism M4) on its inner circumferential surface. The first blade portions M931 are formed to be corrugated from the outer circumference side toward the inner circumference side. With this, the first blade portions M931 causes air to flow toward the rotation center when rotated about the rotation center, so as to cool the reel driving mechanism M5.

On the inner circumference side of the first annular portion M91 is provided an inner annular portion M912. Between the first annular portions M91 and the inner annular portion M912 are formed second blade portions M911 (blade mechanism M4). The second blade portions M911 are formed to incline from the end faces of the first annular portions M91 toward the third annular portion 93. With this, the second blade portions M911 is rotated about the rotation center so as to move the air outside the end faces of the first annular portions M91 toward the inner circumference side of the third annular portion 93, thereby cooling the reel driving mechanism M5.

In addition to the above, on the inner circumference side of the inner annular portion M912, a cross-shaped inner circumference supporting portion M913 and an insertion hole M914 which is formed at the central portion of the inner circumference supporting portion M913. The insertion hole M914 corresponds to the rotation center of the reel M3. The insertion hole M914 is arranged to allow the rotating shaft M512 of the reel motor M51 shown in FIG. 24 to be inserted thereto. At the inner circumference supporting portion M913, a fixing fitting portion M915 is formed on the inner circumferential wall surface of the third annular portion 93. This fixing fitting portion M915 is fitted to the fixing component M513 shown in FIG. 24 to fix the rotating shaft M512 to the rotating body M90 in the rotational direction.

(Reel Device M11: Reel M3)

Figure 27:
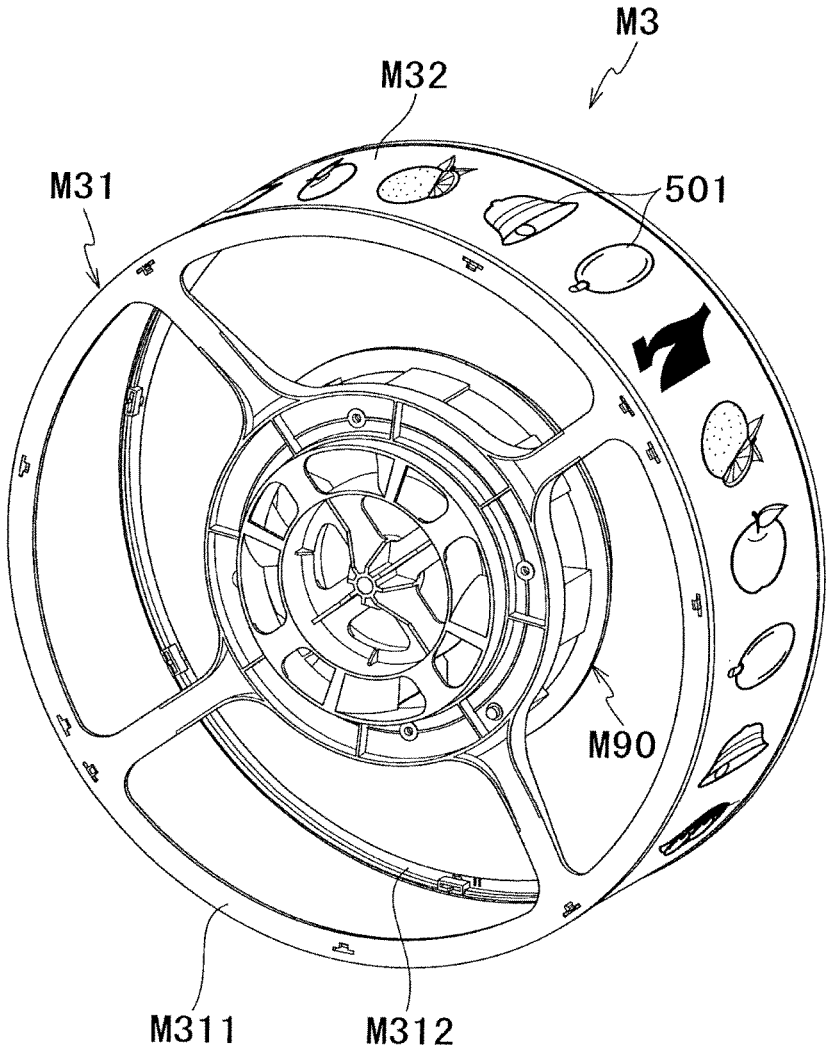
FIG. 27 is a perspective view of a reel.

The rotating body M90 is provided with, as shown in FIG. 27, the reel M3. The reel M3 has an annular reel band M32 on which one or more symbols 501 is lined up and a reel frame M31 which has the reel band M32 on its outer circumferential surface and the blade mechanism M4 of the rotating body M90 on its inner circumferential surface. As such, the reel M3 is arranged so that the blade mechanism M4 is attached to the inner circumference side of the reel frame M31, and hence a function of cooling the reel motor M51 is implemented without requiring upsizing.

Figure 28:
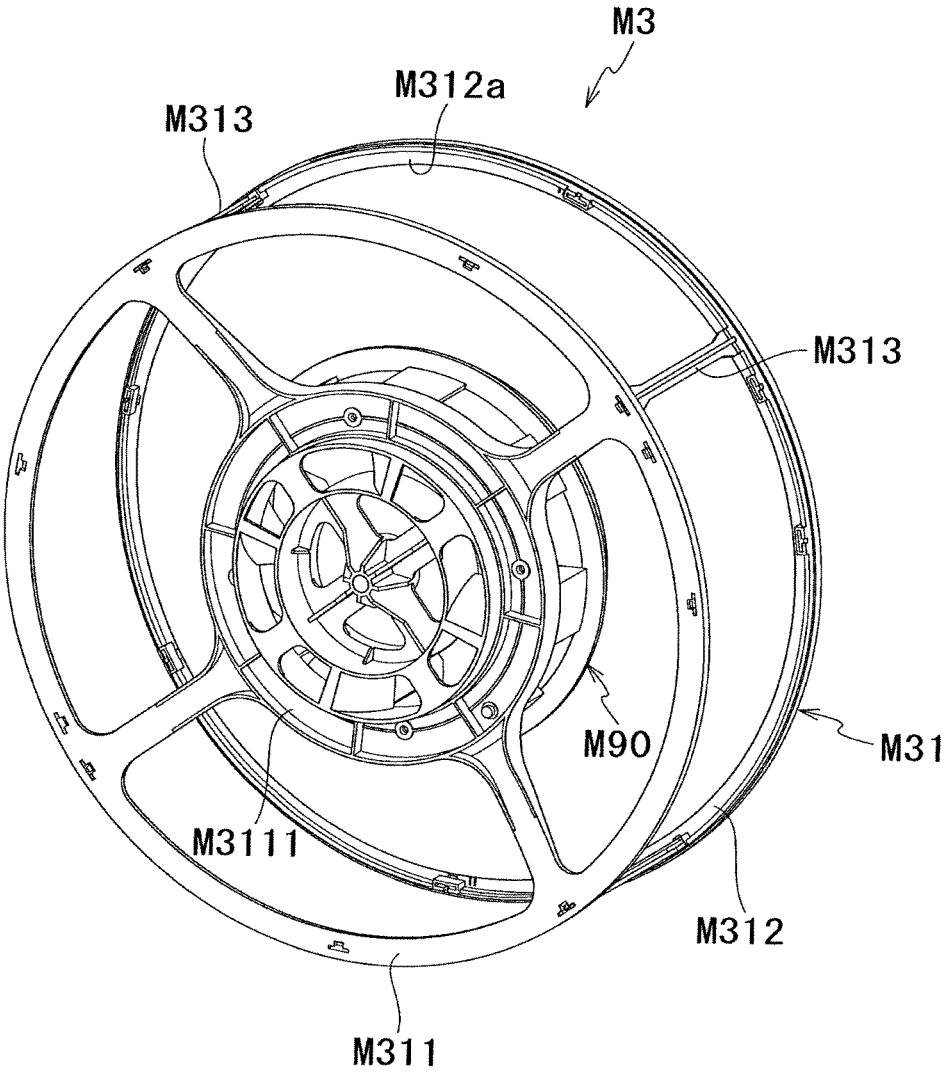
FIG. 28 is a perspective view of a reel.

The above-described reel frame M31 includes, as shown in FIG. 28, a drive-side reel frame M311 supporting one end portion of the reel band M32, a driven-side reel frame M312 supporting the other end portion of the reel band M32, and a frame connecting member M313 which connects the outer circumferential portions of the drive-side reel frame M311 and the driven-side reel frame M312 with each other. The reel frame M31 constituted by these components is made of a light transmissive material.

Because of the above, since the reel M3 is arranged so that the reel frame M31 is constructed by connecting the drive-side reel frame M311 with the driven-side reel frame M312 by the frame connecting member M313, the width of the reel frame M31, i.e., the width of the reel M3 having the reel frame M31 and the reel band M32 is easily changeable only by changing the length of the frame connecting member M313.

The drive-side reel frame M311 has an inner annular portion M3111. This inner annular portion M3111 is fitted to and fixed to the outer circumferential surface of the first annular portion M91. As such, the reel M3 is connected to be coaxial with the rotation center of the rotating body M90.

Figure 29:
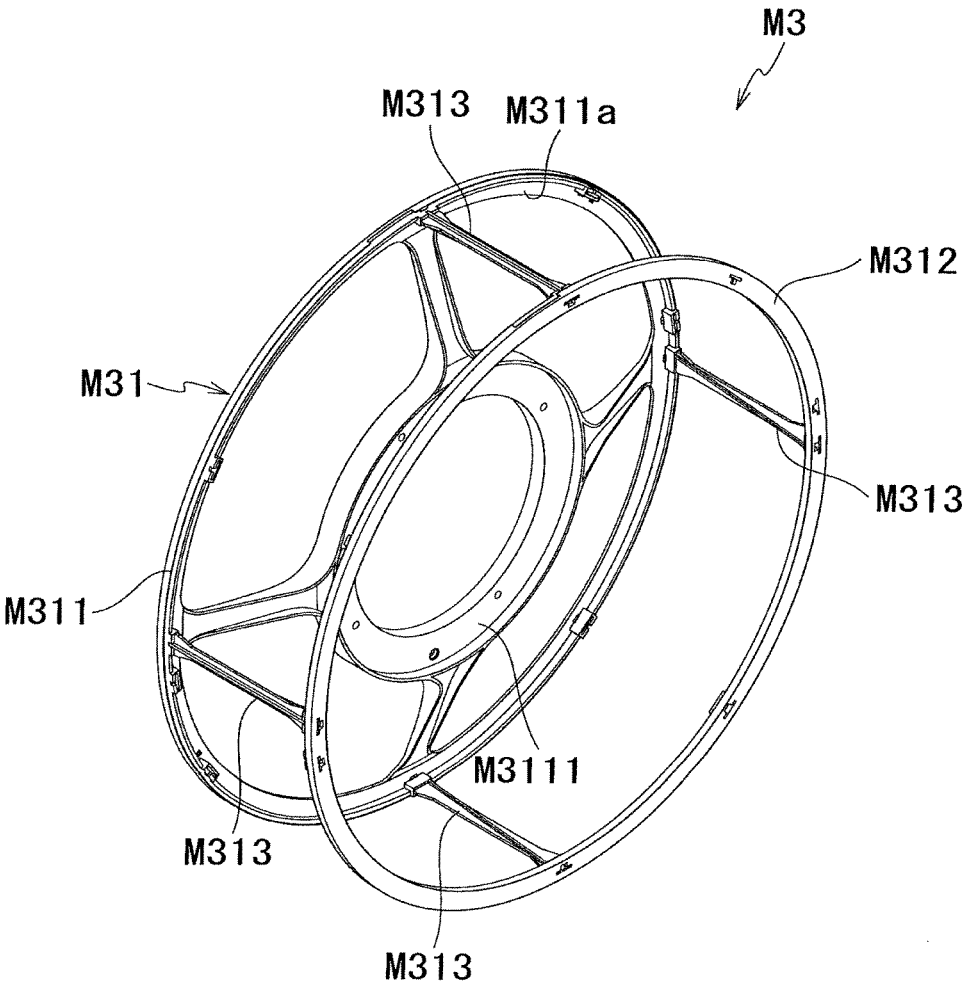
FIG. 29 is a perspective view of a reel frame.

On the other hand, the driven-side reel frame M312 has a reel band fitting portion M312*a* fitted to an end portion of the reel band M32. In a similar manner, the drive-side reel frame M311 has, as shown in FIG. 29, a reel band fitting portion M311*a* fitted to an end portion of the reel band M32. With these components, the reel M3 is arranged so that, during the construction of the reel frame M31 by connecting the drive-side reel frame M311 with the driven-side reel frame M312 by the frame connecting member M313, the reel band M32 is easily attached to the reel frame M31 by sandwiching the end portions of the reel band M32 from the respective sides by the reel band fitting portions M311*a* and M312*a* of the drive-side reel frame M311 and the driven-side reel frame M312.

Figure 30:
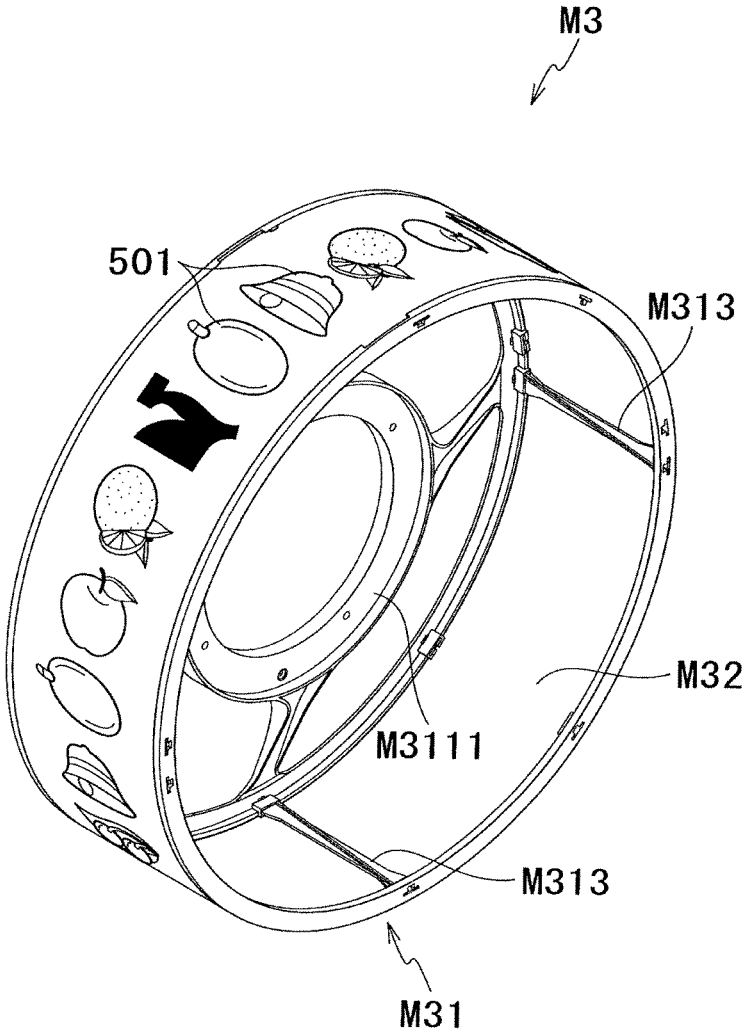
FIG. 30 is a perspective view of the reel frame and a reel band.

The above-described reel band fitting portions M311*a* and M312*a* are, as shown in FIG. 30, formed to fit to the whole circumference of the reel band M32. As the reel frame M31 supports the whole circumference of the reel band M32, the shape of the reel band M32 is more properly maintained by the reel frame M31.

In addition to the above, the frame connecting member M313 is provided to be able to support the back surface of the reel band M32. This further facilitates the maintenance of the shape by the reel frame M31. The reel band M32 is made of a material transmissive to illumination light, such as acrylic resin.

(Reel Device M11: Backlight Apparatus M7)

Figure 31:
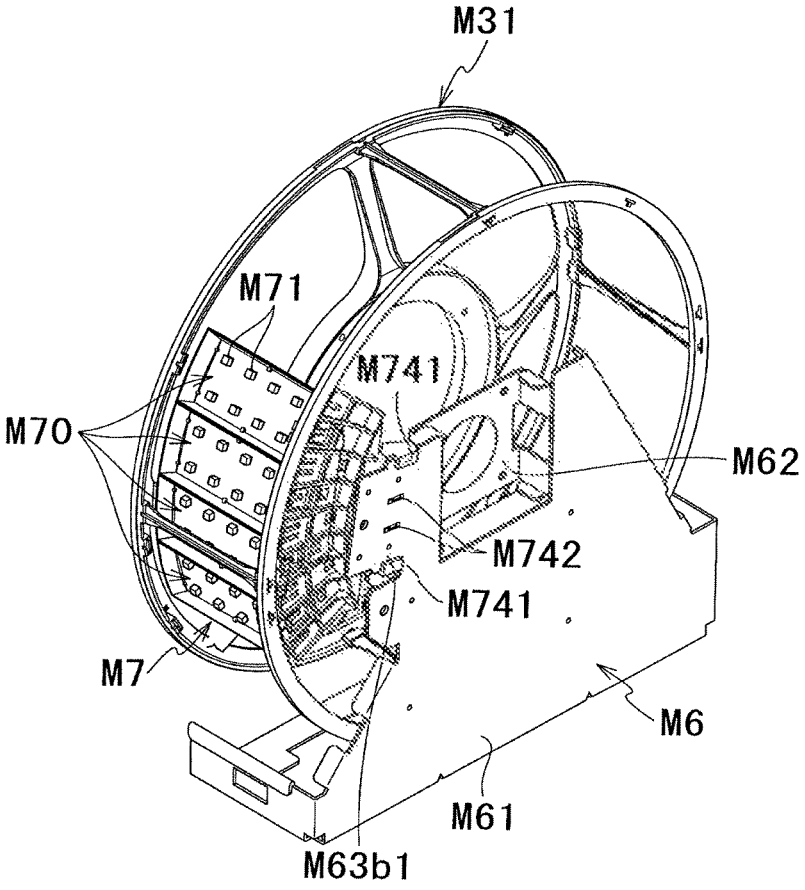
FIG. 31 is a perspective view of the reel frame and a backlight apparatus.
Figure 32:
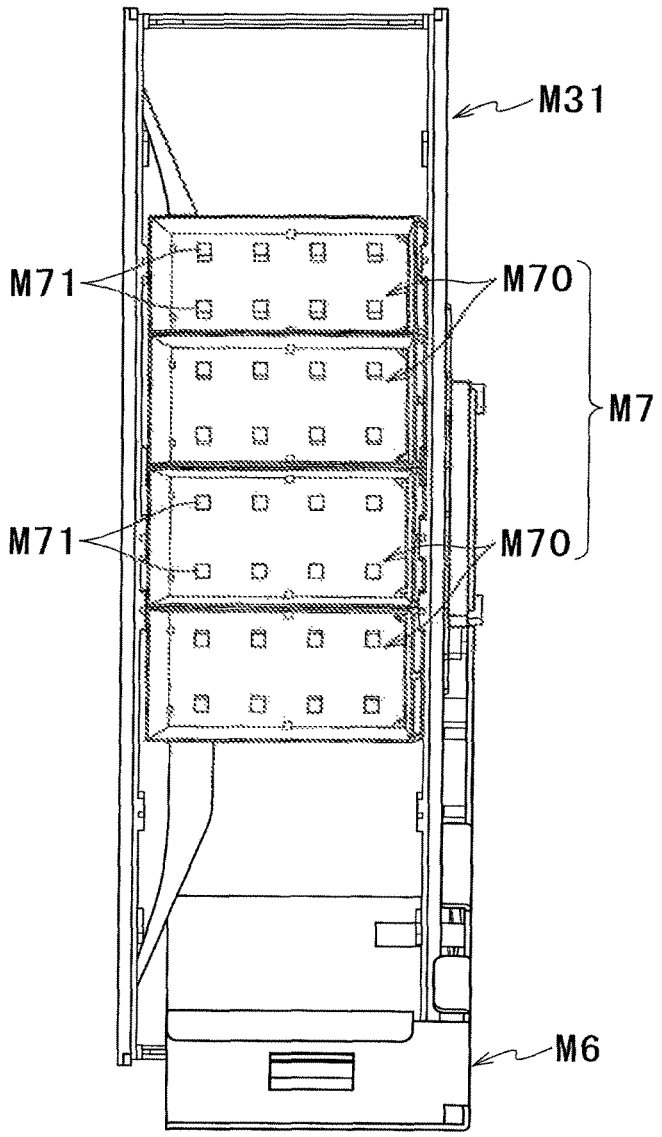
FIG. 32 is a front elevation of the reel frame and the backlight apparatus.

As shown in FIG. 31 and FIG. 32, on the inner circumference side of the reel M3 constructed as above, a backlight apparatus M7 is provided. This backlight apparatus M7 is provided so as to emit illumination light from the inner circumference side of the reel M3 toward the reel band M32, thereby allowing the light having passed through the reel band M32 to be seen from the outside of the slot machine 10.

Figure 33:
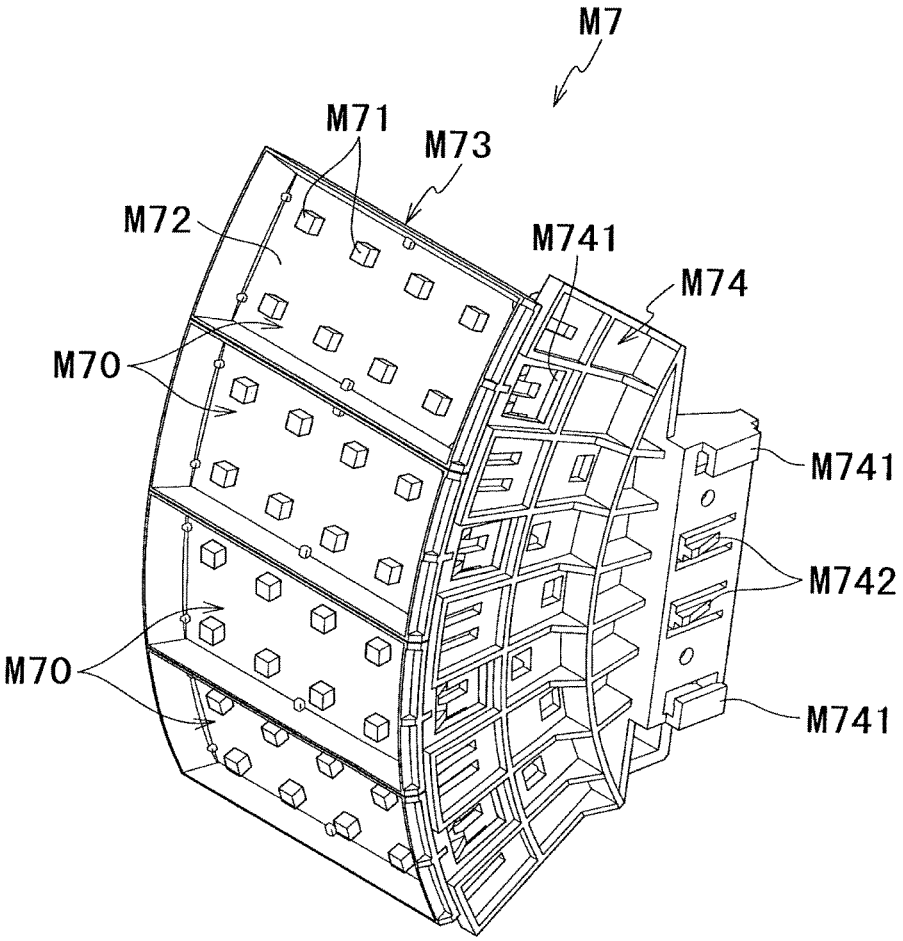
FIG. 33 is a perspective view of the backlight apparatus.
Figure 34:
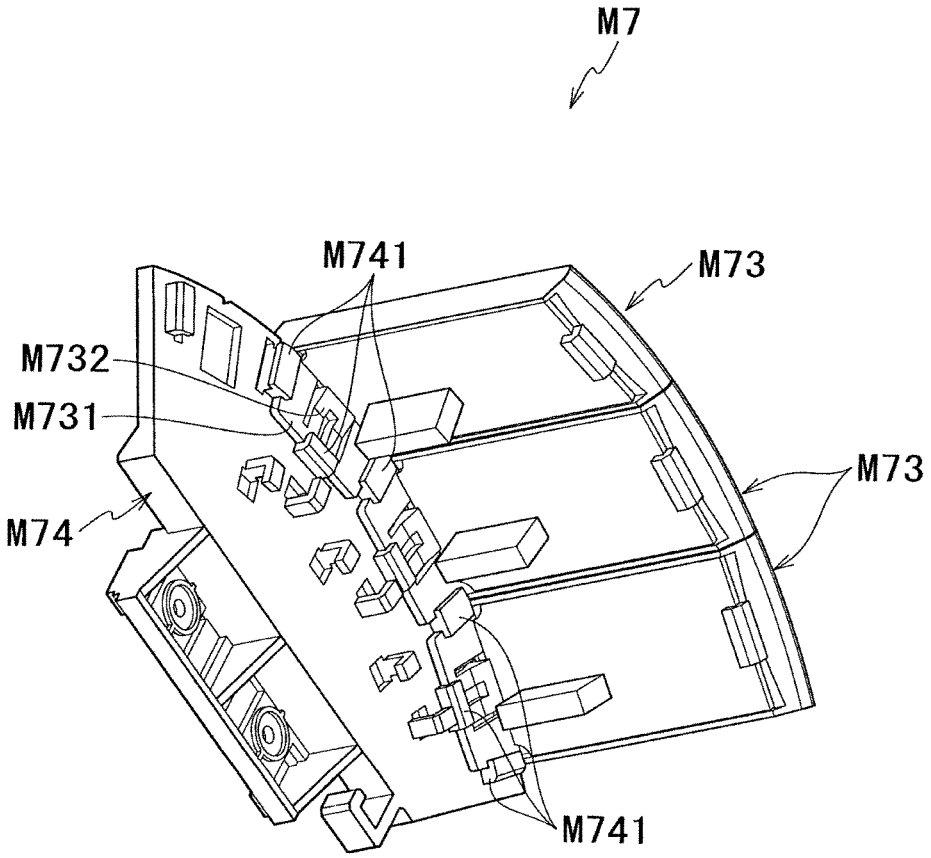
FIG. 34 is a perspective view of the backlight apparatus.

More specifically, as shown in FIG. 33 and FIG. 34, the backlight apparatus M7 includes backlight source units M70 and a board case supporting member M74 which is provided on the reel supporting mechanism M6 to detachably support the backlight source units M70. The number of the backlight source units M70 is four, and they are provided in the vertical directions. The intervals of the units are determined so that the backlight source units M70 oppose the respective symbols 501. In other words, the positional relation between the backlight source units M70 and the symbols 501 is determined so that the units and the symbols exist on lines which extend in the direction orthogonal to the rotation center of the reel M3. This arrangement makes it possible to cause the backlight source units M70 to illuminate the respective opposing symbols 501, while the light transmits the reel band M32 and the light-transmissive reel frame M31.

The backlight source units M70 have backlight apparatuses M71 which are aligned along the width directions and the longitudinal directions of the reel band M32 and can change the light amount of illumination light stepwise. This allows the backlight apparatus M7 to individually control the emission states of illumination light at each illumination light source M71, and hence the freedom of effects using illumination light is enhanced.

The backlight source unit M70 includes a backlight board M72 having an illumination light source M71 and opposing the reel band M32 and a backlight board case M73 which supports the backlight board M72. The backlight board case M73 is detachably supported by the board case supporting member M74. In other words, the reel device M1 includes the backlight board M72, the backlight board case M73, and the board case supporting member M74 detachably supporting the backlight board case M73.

As such, the backlight apparatus M7 is arranged so that the backlight board case M73 supporting the backlight board M72 is detachable to the board case supporting member M74. Therefore, when, for example, it is necessary to change the size of the backlight board M72 in accordance with a change in the reel width of the reel band M32, a size change in accordance with the change in the reel width is achieved only by changing the backlight source unit M70 (backlight board M72 and the board case supporting member M74), without changing the entirety of the backlight apparatus M7. In other words, the backlight apparatus M7 allows an operation of changing the size of the backlight board M72 to be easily done in a short time.

In addition to the above, the board case supporting member M74 has a fitting portion M741 and a protrusion M742, at the root side which is opposite to the position where the backlight source unit M70 is attached. The fitting portion M741 and the protrusion M742 are, as shown in FIG. 31, fitted to the backlight attaching portion M63*bl* of the reel supporting member M61, so that detachable connection is established.

Figure 35:
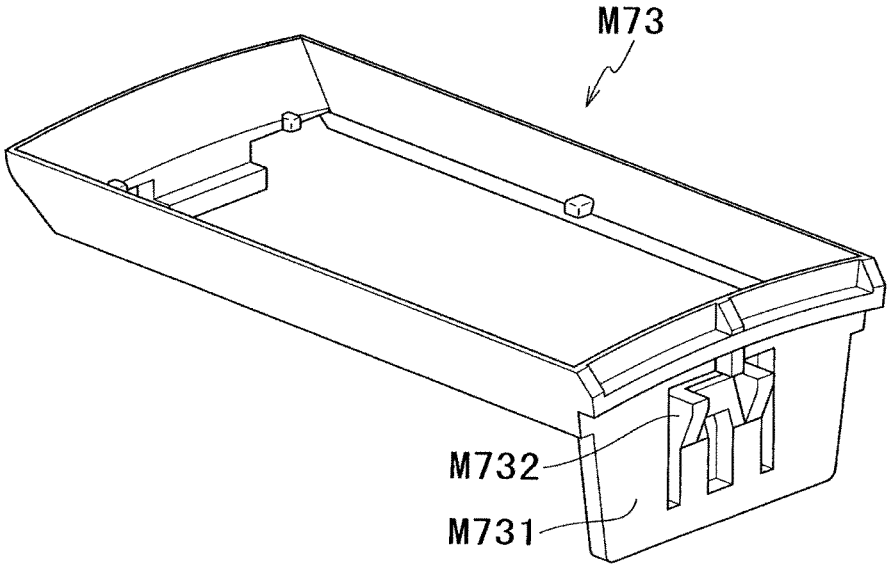
FIG. 35 is a perspective view of a backlight board case.

The backlight board case M73 detachably supported by the board case supporting member M74 includes, as shown in FIG. 34 and FIG. 35, a plate portion M731 which is provided at one edge in the reel width directions to extensively contact the board case supporting member M74 and a tooth portion M732 which is elastic and protrudes from the plate portion M731 toward the board case supporting member M74. In the meanwhile, the board case supporting member M74 includes a fitting portion M741 which slidably fits the edge portions of the plate portion M731 when the plate portion M731 extensively contact the fitting portion M741 and a fitting hole M742 with which the tooth portion M732 is fitted when the plate portion M731 is fitted with the fitting portion M741.

As such, the backlight apparatus M7 is arranged so that the edge portions of the plate portion M731 are slidably fitted with the fitting portion M741 when the plate portion M731 extensively contacts, and the backlight board case M73 is connected to the board case supporting member M74 by the fitting portion M741 and the fitting hole M742 as the tooth portion M732 of the plate portion M731 is fitted with the fitting hole M742. Furthermore, the backlight apparatus M7 is arranged so that the backlight board case M73 is detached from the board case supporting member M74 when a force elastically deforming the tooth portion M732 is applied to the backlight board case M73. As a result, the backlight apparatus M7 allows the backlight source unit M70 to be easily detachable from the board case supporting member M74.

(Reel Device M11: Effect-Light Emitter M8)

In addition to the above, as shown in FIG. 11, on the side of the reel M3 is provided an effect-light emitter M8. This effect-light emitter M8 is arranged to emit a plurality of types of effect light to be visible from the outside of the slot machine 10. With this, the effect-light emitter M8 enhances the effects and the freedom of the effects during the rotation of the reel M3 and the rearrangement of the symbols 501.

Figure 36:
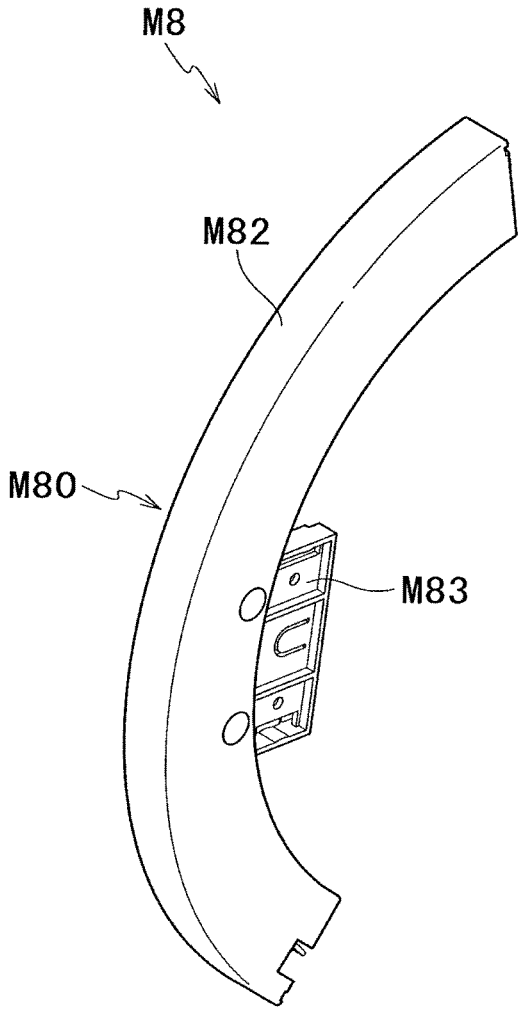
FIG. 36 is a perspective view of an effect-light emitter.
Figure 37:
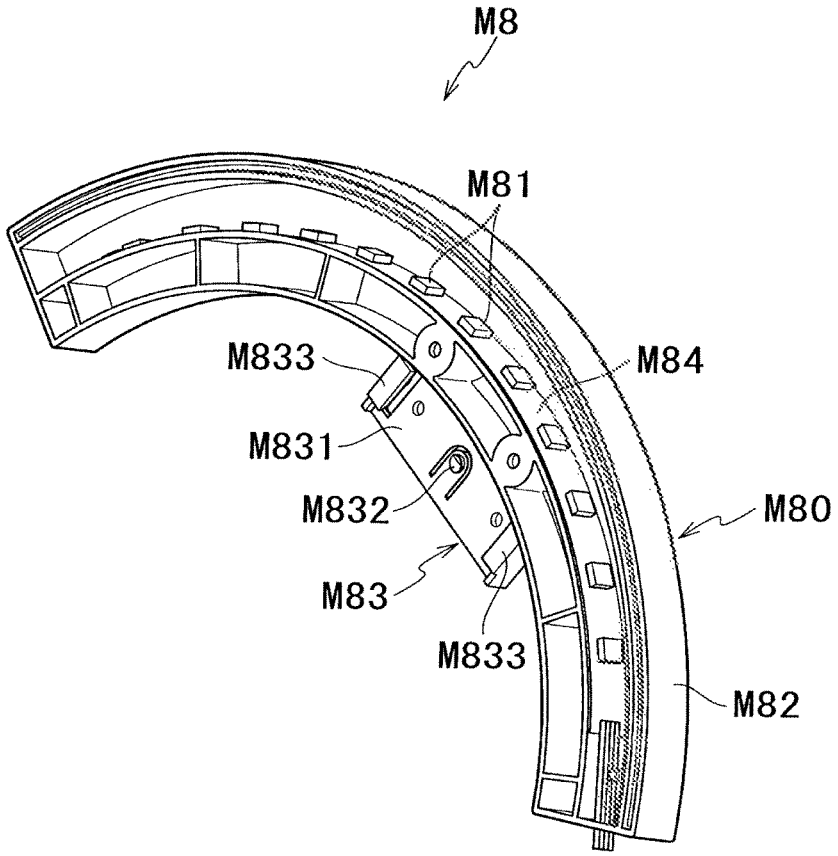
FIG. 37 is a perspective view of the effect-light emitter.

The effect-light emitter M8 includes, as shown in FIG. 36 and FIG. 37, a plurality of effect light source M81 aligned at least along the length of the reel band M32. These effect light sources M81 are individually controllable and a light amount of the effect light is changeable stepwise. With this, the effect-light emitter M8 enhances the effects and the freedom of the effects during the rotation of the reel M3 and the rearrangement of the symbols 501.

More specifically, the effect-light emitter M8 includes an effect light source unit M80 and a unit supporting member M83 which is provided in the reel supporting mechanism M6 to detachably support the effect light source unit M80. The effect light source unit M80 includes a hollow board case M82, an effect light board M84 housed in the board case M82, and effect light sources M81 provided on the upper surface of the effect light board M84 to form a line.

The board case M82 is fan-shaped to have the same curved surface as the outer circumferential surface of the annular reel M3. At least the front side of the board case M82 is made of a light-transmissive material. The effect light board M84 is curved with the same curvature radius as the board case M82. With this, the effect light sources M81 on the effect light board M84 are equidistant from the upper surface of the board case M82.

At the edge portion of the board case M82 on the inner circumference side, the unit supporting member M83 is provided. This unit supporting member M83 is detachably provided at the lateral vertical portion M63 of the reel supporting mechanism M6. More specifically, the unit supporting member M83 includes a plate portion M831 formed to extensively contact the effecter attaching portion M63*b*2, fitting portions M833 which cause the end portions of the effecter attaching portion M63*b*2 to be slidably fitted therewith when the plate portion M831 extensively contacts, and a tooth portion M832 which is elastic, protrudes from the plate portion M831 toward the effecter attaching portion M63*b*2, and is able to be fitted with the effect light fixing hole M63*b*4.

With this, the effect-light emitter M8 is arranged so that the edge portions of the effecter attaching portion M63*b*2 are slidably fitted with the fitting portions M833 when the plate portion M831 extensively contacts the effecter attaching portion M63*b*2, and the effect-light emitter M8 is connected to the reel supporting member M61 by fitting the tooth portion M832 with the effecter attaching portion M63*b*2. Furthermore, the effect-light emitter M8 is arranged so that the effect-light emitter M8 is detached from the reel supporting member M61 as an external force elastically deforming the tooth portion M832. As a result, the effect-light emitter M8 is easily detachable with respect to the reel supporting member M61 of the reel supporting mechanism M6.

(Electrical Structure of Slot Machine)

Figure 38:
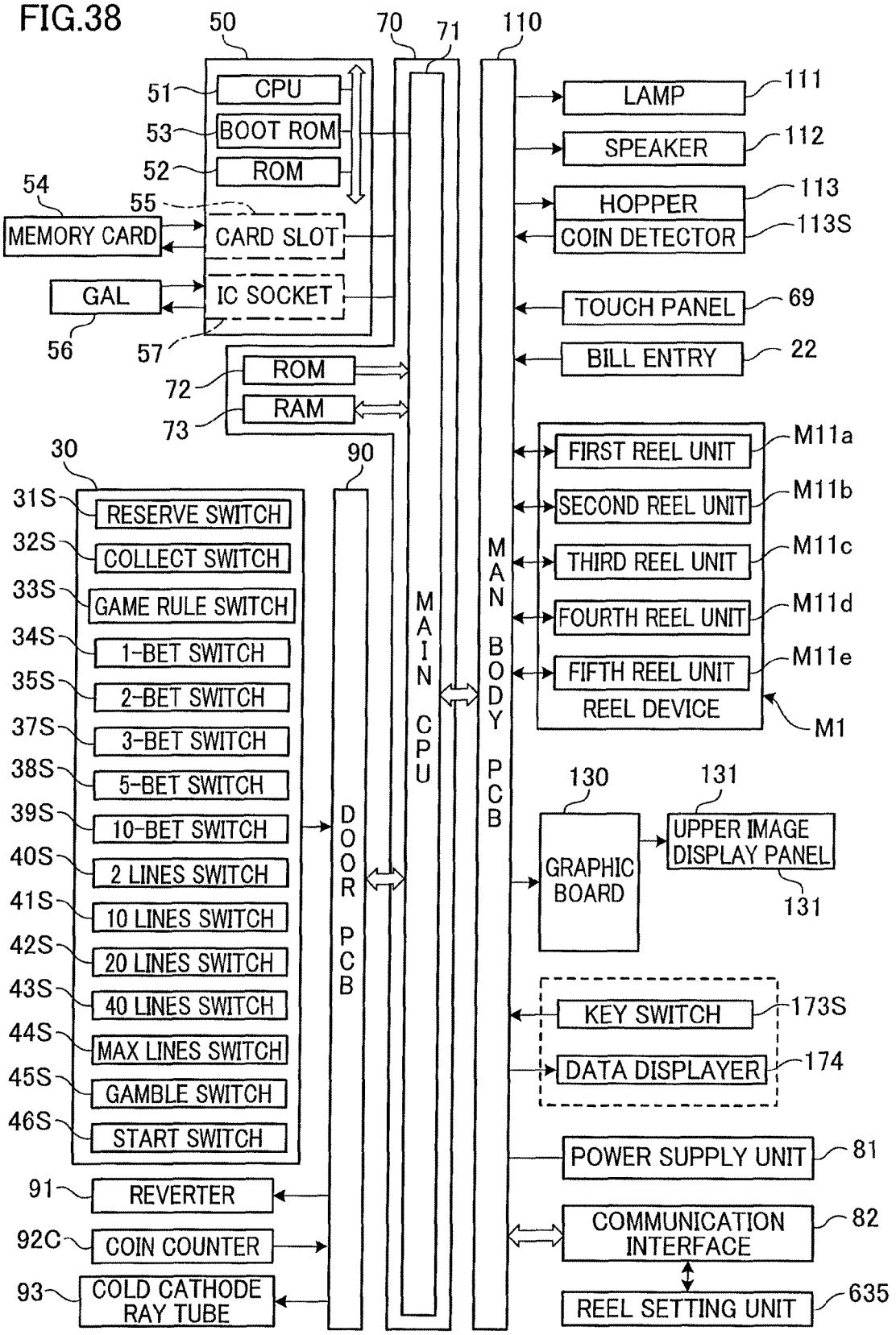
FIG. 38 is an electrical block diagram of the slot machine.

The following describes a circuitry structure of the slot machine 10, with reference to FIG. 38.

The gaming board 50 has a CPU 51, a ROM 52, a boot ROM 53 which are connected via an internal bus, a card slot 55 corresponding to the memory card 54, and an IC socket 57 corresponding to a GAL (Generic Array Logic) 56.

The memory card 54 is constituted by a non-volatile memory, and stores game programs and a game system program. The game programs include a program concerning the progress of a game and a program for executing image and sound effects. The game programs further includes a symbol determining program. This symbol determining program is a program for determining how symbols 501 are rearranged.

Further, the game program includes: a base game symbol table data showing a base game symbol table showing each symbol of each symbol column of the display blocks in association with a code number and a random number; a bonus game symbol table data showing a bonus game symbol table showing each symbol of each symbol column of the display blocks in association with a code number and a random number; symbol number determination table data showing a symbol column determination table; a code number determination table data showing a code number determination table; additional wild symbol count determination table data showing a additional wild symbol count determination table; additional trigger symbol count determination table data showing a additional trigger symbol count determination table; odds data showing the number and types of symbols to be rearranged on a payline in association with a payout amount; and the like.

In addition to the above, the card slot 55 is arranged to be receivable the memory card 54, and is connected to a motherboard 70 via an IDE bus. Thus, it is possible to remove a memory card 54 from the card slot 55, write another game program onto the memory card 54, and insert the memory card 54 back into the card slot 55 to change the type or content of a game to be run at the slot machine 10.

The GAL 56 is a type of PLD (Programmable Logic Device) having a fixed OR array structure. This GAL 56 has a plurality of input ports and output ports. When a predetermined input is received by an input port, corresponding data is output from an output port.

The IC socket 57 is arranged so that the GAL 56 is detachable, and is connected to the motherboard 70 via a PCI bus. The content of a game to be run at the slot machine 10 can be changed by replacing a memory card 54 with another one having another program written thereon, or replacing the program written onto the memory card 54 with another program.

The CPU 51, the ROM 52, and the boot ROM 53 connected with one another by the internal bus are connected to the motherboard 70 via the PCI bus. The PCI bus transmits signals between the motherboard 70 and the gaming board 50 and supplies power from the motherboard 70 to the gaming board 50.

The ROM 52 stores an authentication program. The boot ROM 53 stores a preliminary authentication program, a program (boot code) for the CPU 51 to boot the preliminary authentication program, and the like.

The authentication program is a program (falsification check program) for authenticating the game program and the game system program. The preliminary authentication program is used for authenticating the authentication program. The authentication program and the preliminary authentication program are written in line with the steps (authentication steps) of authenticating that a target program is not falsified.

The motherboard 70 is constituted by a motherboard for market use (printed circuit board with fundamental parts of a personal computer built thereon), and includes a main CPU 71, a ROM (Read Only Memory) 72, a RAM (Random Access Memory) 73, and a communication interface 82. The motherboard 70 is equivalent to the game controller 100 of the present embodiment.

The ROM 72 is constituted by a memory device such as a flash memory, and stores programs and permanent data such as a BIOS (Basic Input/Output System) run by the main CPU 71. As the main CPU 71 runs the BIOS, a predetermined peripheral is initialized. Furthermore, via the gaming board 50, a process to read out a game program and a game system program from the memory card 54 starts. In the present invention, the ROM 72 may be rewritable or read-only.

The RAM 73 stores data used for the operation of the main CPU 71 and programs such as a symbol determining program. For example, the aforesaid game program, the game system program, and the authentication program are stored after being read out. The RAM 73 has a workspace for running the programs above. For example, a space which stores counters for managing the number of games, a betted amount, the number of payout, and a credit amount and a space which stores symbols (code numbers) which are randomly determined are provided.

The communication interface 82 is provided for communications with an external controller 621 such as a server via a communication line 301. The motherboard 70 is connected to a later described door PCB (Printed Circuit Board) 90 and main body PCB 110 via USB. The motherboard 70 is further connected to a power supply unit 81. Furthermore, the motherboard 70 is connected to a PTS terminal 700 by USB.

When power is supplied from the power supply unit 81 to the motherboard 70, the main CPU 71 of the motherboard 70 is booted, and power is supplied to the gaming board 50 via the PCI bus and the CPU 51 is booted.

The door PCB 90 and the main body PCB 110 are connected to an input device such as a switch and a sensor, and peripheral devices whose operations are controlled by the main CPU 71.

The door PCB 90 is connected to the control panel 30, a reverter 91, a coin counter 92C and a cold cathode tube 93.

The control panel 30 is provided with a reserve switch 31S, a collect switch 32S, a game rule switch 33S, a 1-bet switch 34S, a 2-bet switch 35S, a 3-bet switch 37S, a 5-bet switch 38S, a 10-bet switch 39S, a play 2 lines switch 40S, a play 10 lines switch 41S, a play 20 lines switch 42S, a play 40 lines switch 43S, a max lines switch 44S, a gamble switch 45S, and a start switch 46S, respectively corresponding to the buttons described above. Each switch outputs a signal to the main CPU 71 when the switch detects that a player presses the associated button.

In the coin entry 36 are provided a reverter 91 and a coin counter 92C. The reverter 91 checks the genuineness of each coin inserted into the coin entry 36, and ejects non-genuine coins through a coin outlet. The coin counter 92C detects the received genuine coins and counts the number thereof.

The reverter 91 operates based on a control signal output from the main CPU 71, and distributes valid coins determined by the coin counter 92C into a hopper 113 or an unillustrated cash box. The coins are distributed to the hopper 113 when the hopper 113 is not full, or to the cash box when the hopper 113 is full.

The cold cathode tube 93 functions as a backlight provided at a back of the upper image display panel 131. The cold cathode tube 93 lights based on a control signal from the main CPU 71.

The main body PCB 110 is connected to the lamp 111, the speaker 112, the hopper 113, the coin detector 113S, the bill entry 22, the graphic board 130, the key switch 173S, and the data displayer 174.

The lamp 111 is turned on based on a control signal output from the main CPU 71. The speaker 112 outputs a sound such as background music, based on a control signal output from the main CPU 71.

The hopper 113 operates based on a control signal output from the main CPU 71, and pays out the number of coins determined to be paid out to an unillustrated coin tray through the coin outlet. The coin detector 113S detects the coins to be paid out through the hopper 113 and outputs a signal to the main CPU 71.

A touch panel may be provided on the front surface of the reel device M1. The touch panel detects a position touched by a player with a finger, and outputs a signal corresponding to the position detected to the main CPU 71.

The bill entry 22 checks the genuiness of bills and receives genuine bills into the cabinet 11. The bills accepted into the cabinet 11 are converted into coins, and credits corresponding to the number of coins calculated are added as credits that the player has.

The graphic board 130 controls image display on the upper image display panel 131 based on a control signal output from the main CPU 71. The graphic board 130 includes components such as a VDP (Video Display Processor) generating image data and a video RAM storing the image data generated by the VDP. Image data used for generating image data by the VDP is included in a game program which has been read out from the memory card 54 and stored in the RAM 73.

Further, the graphic board 130 includes components such as a VDP (Video Display Processor) generating image data based on a control signal output from the main CPU 71 and a video RAM temporarily storing the image data generated by the VDP. Image data used for generating image data by the VDP is included in a game program which has been read out from the memory card 54 and stored in the RAM 73.

The key switch 173S is provided to the keypad 173. The key switch 173 outputs a predetermined signal to the main CPU 71 when the player operates the keypad 173.

Based on a control signal output from the main CPU 71, the data displayer 174 displays data read by the card reader 172, or data input through the keypad 173 by the player.

(Electrical Structure of Slot Machine: Reel Device M1)

Figure 39:
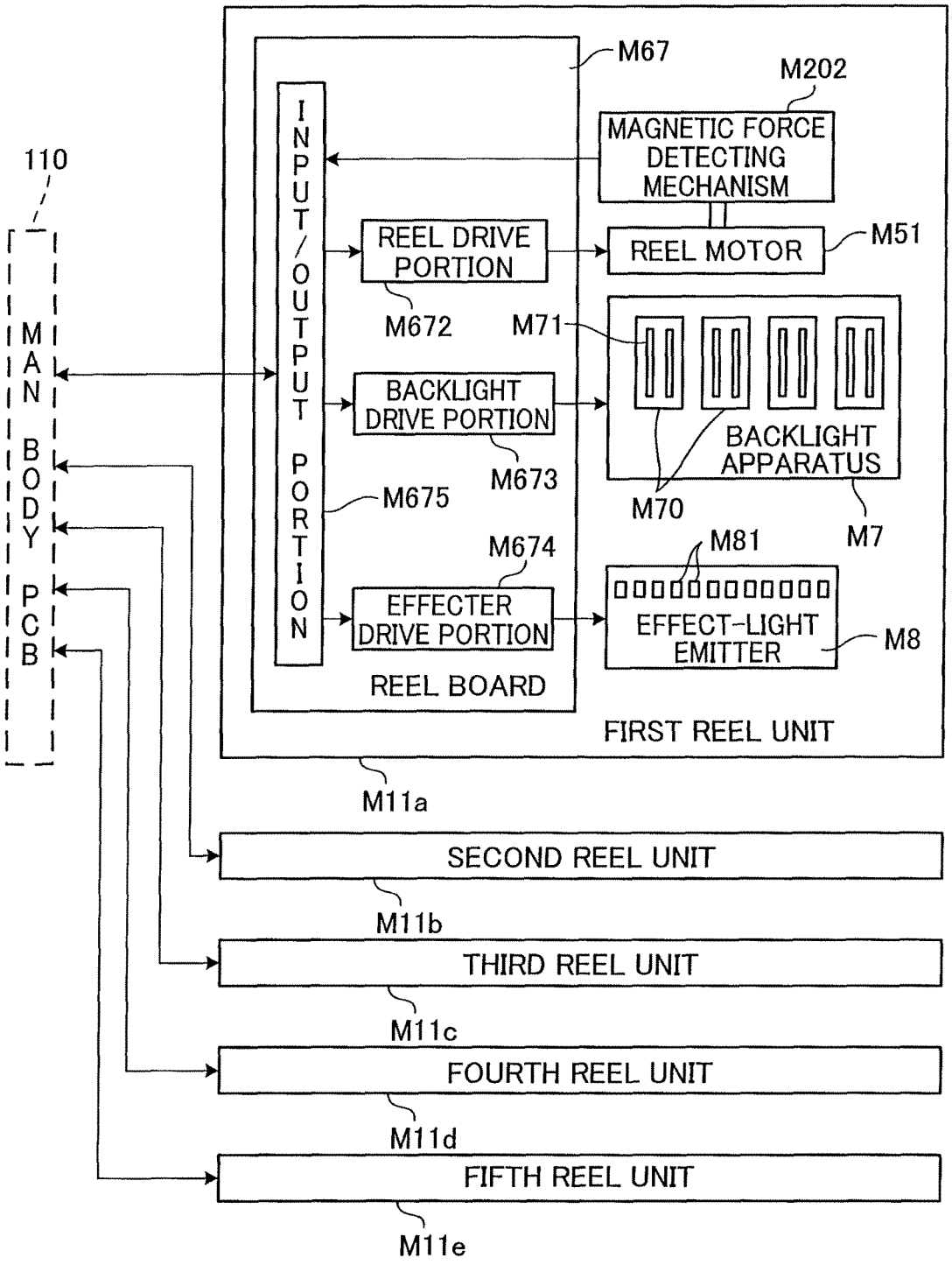
FIG. 39 is an electrical block diagram of the reel board.

The above-described main body PCB 110 is connected to the reel device M1. The reel device M1 includes, as shown in FIG. 11, first to fifth reel units M11*a*-M11*e*. As shown in FIG. 39, each of the first to fifth reel units M11*a*-M11*e* has a reel board M67. This reel board M67 includes an input/output portion M675 connected to the main body PCB 110 to be able to perform data communication therewith and a reel drive portion M672, a backlight drive portion M673, and an effecter drive portion M674 connected to the input/output portion M675.

The input/output portion M675 is connected to a magnetic force detecting mechanism M202. The magnetic force detecting mechanism M202 includes a magnetic force sensor which outputs, in accordance with a magnetic force, a magnetic force detection signal indicating an output intensity and a sensor fixing mechanism which fixes this magnetic force sensor at a predetermined position. The magnetic force detecting mechanism M202 is connected to the rotation axis of the reel motor M51, and outputs a magnetic force detection signal on detection of a magnetic force of an external magnetic field generated by a magnet M201 of FIG. 1 which rotates in accordance with the rotation of the reel M3.

The reel drive portion M672 is connected so as to supply a drive power to the reel motor M51. The backlight drive portion M673 is connected to the illumination light sources M71 of the backlight apparatus M7 to supply a drive power to each illumination light source M71. The effecter drive portion M674 is connected to the effect light sources M81 of the effect-light emitter M8 to supply a drive power to each effect light source M81.

(Electrical Structure of PTS Terminal)

Figure 40:
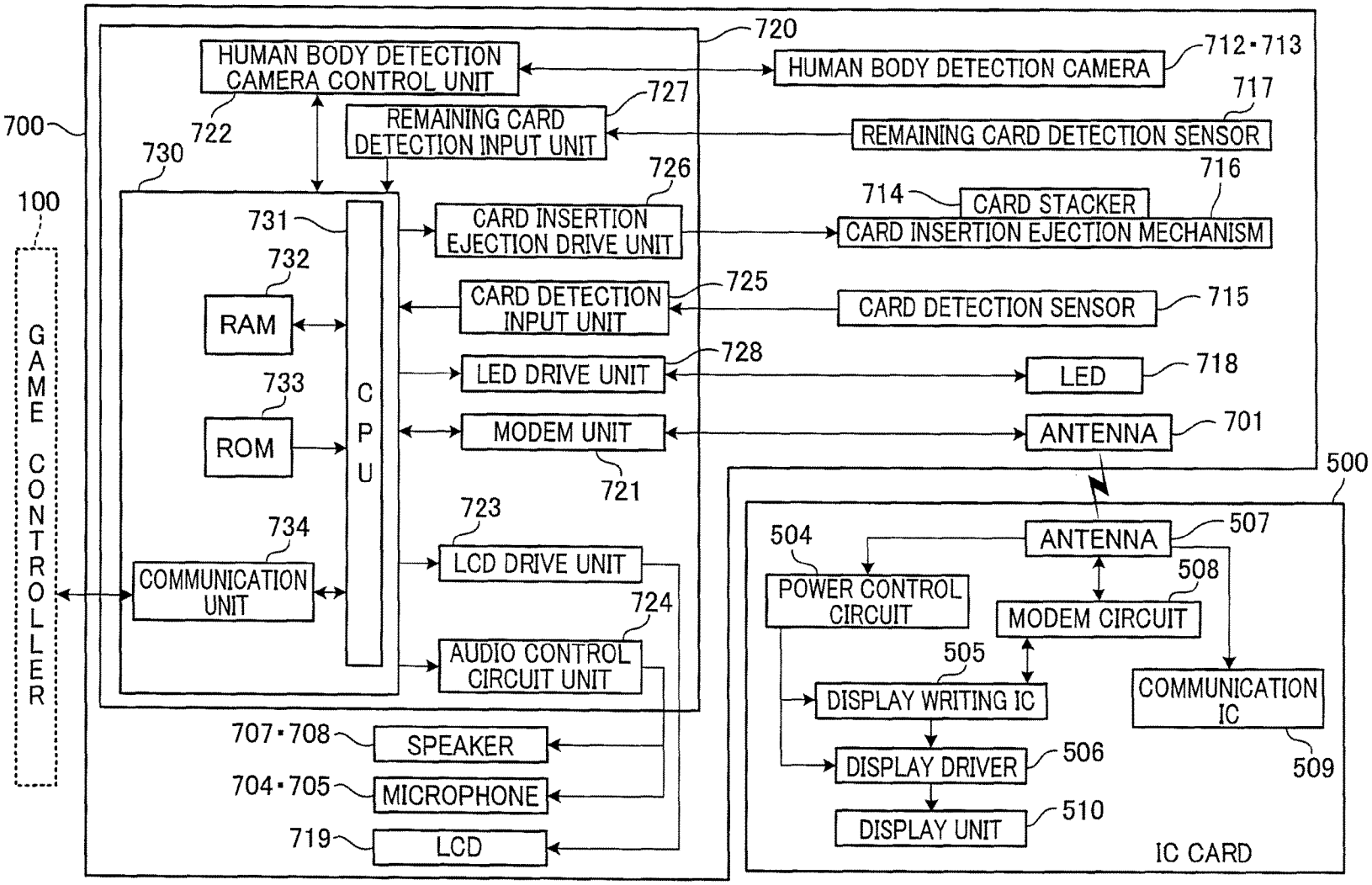
FIG. 40 is an electrical block diagram of a PTS terminal.

The following describes a structure of a circuitry provided to the PTS terminal 700, with reference to FIG. 40.

A PTS controller 720 which controls the PTS terminal 700 is connected to various functional parts as a unit controller 730 its main part. The PTS controller 720 has a CPU 731, a communication unit 734, a ROM 733, and a RAM 732.

The CPU 731 runs and computes various programs stored in a later-described ROM 733. Specifically, the CPU 731 runs a credit update program and converts credit data retrieved from the game controller 100 into cash data, adds the cash data to broken number cash data in the management server 800, and transmits the data to the IC card 500.

Further, the CPU 731 runs a human body detection operation program. When the credit amount based on the credit data retrieved by the game controller 100 does not equal to "0," the CPU 731 determines whether to accept the IC card 500 into the card stacker 714, with the human body detecting cameras 712 and 713.

Further, the CPU 731 runs the authentication program to cross verify an identification code on the IC card 500 and the identification code in the management server 800.

In addition to the above, the CPU 731 runs an audio control program so as to control a later-described audio control circuit 724 based on the authentication result. The audio control in this case is a control operation carried out in such a way that, when the authentication is not successful, the CPU 731 controls the later-described audio control circuit 724 to notify the authentication failure by the speakers 707 and 708. The communication unit 734 realizes communications with the game controller 100.

In addition to the above, the CPU 731 runs a device program to control the operations of the LCD 719, the microphones 704 and 705, and the speakers 707 and 708. Furthermore, the CPU 731 runs a LED control program to turn on or off the LED 718 in accordance with the remaining credits in the IC card 500.

The ROM 733 is constituted by a memory device such as flash memory, and stores permanent data to be executed by the CPU 731. For example, the ROM 733 stores therein a credit update program which re-writes credit data stored on the IC card 500 on the basis of an instruction from the game controller 100, a human body detection operation program, an authentication program, an audio control program, a device program, and an LED control program.

The RAM 732 temporarily stores data necessary for running various programs stored in the ROM 733. For example, the RAM 732 stores credit data to be updated, based on a signal from the game controller 100. The RAM 732 also stores a time when a player is detected by the human body detecting cameras 712 and 713 and a time elapsed therefrom.

Further, the unit controller 730 is connected to a human body detecting camera control unit 722, an LCD drive unit 723, an audio control circuit unit 724, a remaining card detection input unit 727, a card insertion ejection drive unit 726, a card detection input unit 725, an LED drive unit 728, and a modulator-demodulator unit 721.

The human body detecting camera control unit 722 controls the operations of the human body detecting cameras 712 and 713, on the basis of an instruction from the unit controller 730.

The LCD drive unit 723 controls operations of the LCD 719, on the basis of an instruction from the unit controller 730.

The audio control circuit unit 724 controls operations of the microphones 704 and 705, and the speakers 707 and 708, on the basis of an instruction from the unit controller 730.

The remaining card detection input unit 727 inputs, to the unit controller 730, a signal determining the remaining number of IC cards 500 stacked in the card stacker 714, which is detected by a remaining card recognition sensor 717. The remaining card recognition sensor 717 has a function of determining the remaining number of IC cards 500 stacked in the card stacker 714 by using, for example, an unillustrated infrared sensor mechanism.

The card insertion ejection drive unit 726 controls a card insertion ejection mechanism 716 based on an instruction from the unit controller 730. The card insertion ejection mechanism 716 includes a mechanism of introducing an IC card 500 therein and a mechanism of ejecting a card to the outside.

The card detection input unit 725 inputs a signal from the card sensor 715 to the unit controller 730. In response to this, the card sensor 715 obtains various types of data such as cash data and an identification code from the inserted IC card 500.

The LED drive unit 728 controls operations of the LED 718 on the basis of an instruction from the unit controller 730, to light the LED 718.

The modulator-demodulator unit 721 converts a high frequency signal from the antenna 701 to a signal controllable by the unit controller 730, and converts a signal from the unit controller 730 to a signal transmittable to the IC card 500 through the antenna 701.

Note that the unit controller 730, the card insertion ejection drive unit 726, the card detection input unit 725, and the modulator-demodulator unit 721 are also referred to as a card unit controller as a unit.

(Electrical Structure of IC Card)

Figure 41:
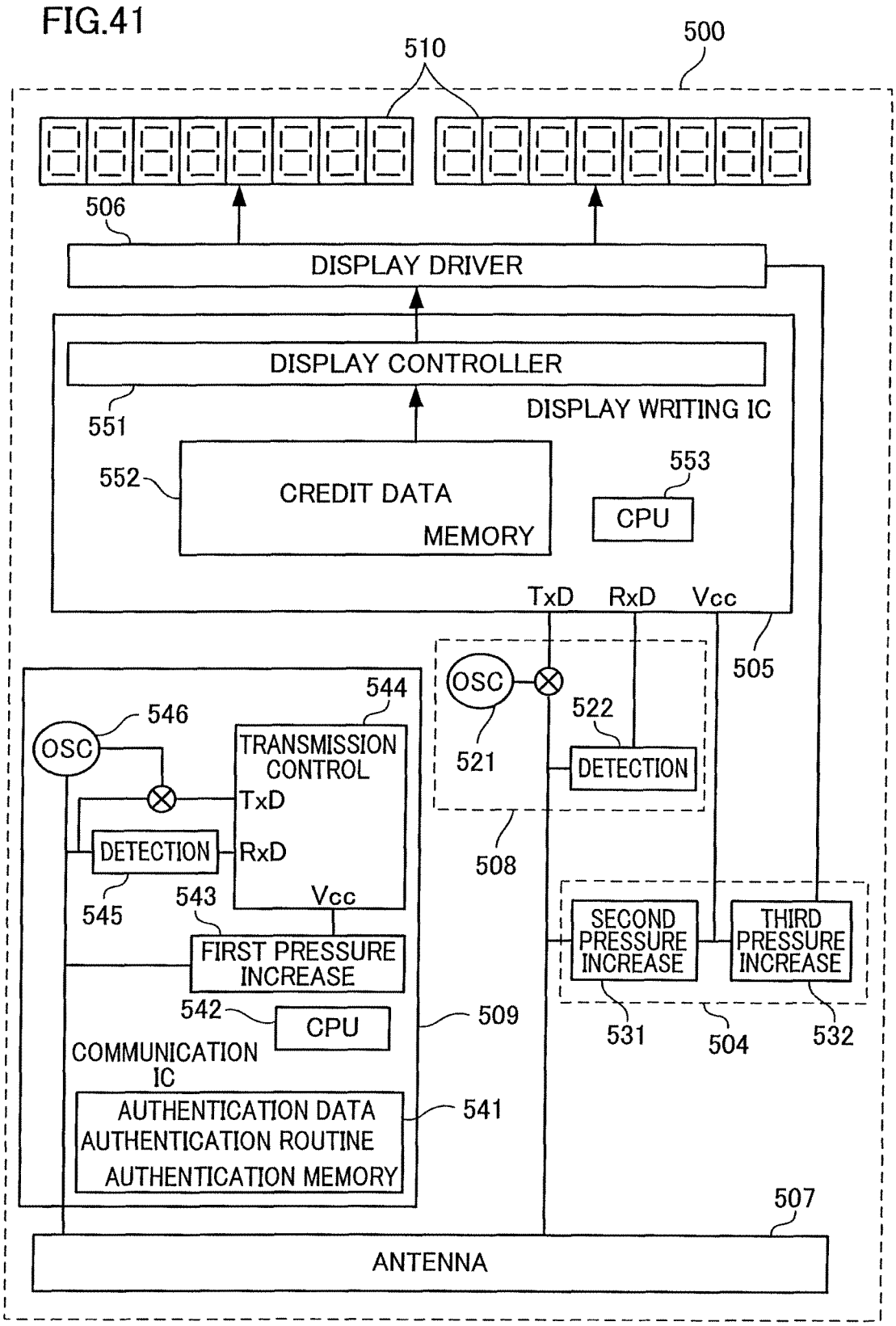
FIG. 41 is an electrical block diagram of an IC card.

The following describes a circuit of the IC card 500, with reference to FIGS. 40 and 41.

The IC card 500 has an antenna 507, a power control circuit 504, a modulator-demodulator circuit 508, a display writing IC 505, a display driver 506, and a display portion 510.

The antenna 507 transmits and receives various signals which belong to the PTS terminal 700, via the antenna 701.

The power control circuit 504 includes a second booster circuit 531 and a third booster circuit 532. The second booster circuit 531 boosts the voltage of a signal from the antenna 507 to a voltage that a later-described modulator-demodulator circuit 508 can deal with. The third booster circuit 532 boosts the voltage from the power source to a voltage by which a later-described display driver 506.

The modulator-demodulator circuit 508 includes a transmitter 521 and a detector 522. The transmitter 521 outputs a signal having a specific frequency, and converts the signal to a signal which a later-described display writing IC 505 can handle, by mixing the signal with a signal received from the antenna 507. The detector 522 detects the signal received from the antenna 507.

The display writing IC 505 has a CPU 553, a credit data memory 552, and a display controller 551.

The CPU 553 runs a cash data rewrite and update program to rewrite and update cash data stored in the credit data memory 552, based on cash data retrieved from the PTS terminal 700.

Further, the CPU 553 controls the display controller 551 so as to cause the display controller 551 to use the cash data stored in the credit data memory 552 as data for displaying cash data, and to display the cash data on the display portion 510 through the later-described display driver 506.

The credit data memory 552 stores therein the cash data rewrite and update program, and credit-related data such as cash data, an identification code and cash data for display. The credit-related data stored in the credit data memory 552 is used for both calculation and display.

The display controller 551, based on a control signal from the CPU 553, retrieves credit data for display stored in the credit data memory 552, and displays it on the display portion 510 via the display driver 506.

The IC card 500 has a communication IC 509. The communication IC 509 has a first booster circuit 543, a transmitter 546, a detector 545, a transmission control unit 544, a CPU 542, and an authentication memory 541. The first booster circuit 543 increases the voltage of terminal-side authentication data retrieved from the PTS terminal 700 to a voltage that the CPU 542 can handle.

The transmitter 546 outputs a signal having a specific frequency, and converts it to a signal that the CPU 542 can handle, by mixing the signal with a signal received from the antenna 507. The detector 522 detects a signal received from the antenna 507.

The CPU 542 runs an authentication routine program and transmits an identification code stored in a later-described authentication memory 541 to the PTS terminal 700, when an authentication request is issued by the PTS terminal 700.

The authentication memory 541 stores therein an authentication routine program used by the CPU 542 and an identification code.

(Symbols, Combinations, and the Like)

The symbols 301 displayed in the display windows 7A to 7E of the slot machine 10 forms symbol columns, each of which having twenty-two symbols. As shown in FIG. 42, one of code numbers 0 to 21 is assigned to each of the symbols constituting each column. Each of the symbol columns is constituted with a combination of symbols of "JACKPOT 7," "BLUE 7," "BELL," "CHERRY," "STRAWBERRY," "PLUM," "ORANGE," and "APPLE."

Three successive symbols in each of the symbol columns are respectively displayed (arranged) on an upper stage 7*a*, a middle stage 7*b*, and a lower stage 7*c* of each of the display windows 7A, 7B, 7C, 7D, and 7E, to form a symbol matrix of five columns and three rows. When the start button is pressed to start a game after the bet button is pressed, the symbols forming a symbol matrix start scrolling. This scrolling of the symbols stops (rearrangement) after a predetermined period from the beginning of the scrolling (rearrange).

Various kinds of winning combinations are set in advance for each symbol. A winning combination is a combination of stopped symbols on the payline which puts the player in an advantageous state. Examples of an advantageous state include: a state where coins according to a winning combination is paid out, a state where the number of coins to be paid out is added to a credit, a state where a bonus game is started.

For example, a combination on the payline including an "APPLE" symbol serves as a bonus trigger which causes a transition of a gaming mode from a base game to a bonus game. Further, when a combination including a "CHERRY" symbol is formed on the payline in a base game, twenty coins (values) are paid out for one bet. When a combination including a "PLUM" symbol is formed on the payline in a base game, five coins are paid out for one bet.

Here, a bonus game is a gaming state which provides a larger advantage than a base game. Note that another bonus game may be employed in combination, provided that the other bonus game is advantageous to a player, i.e., the other bonus game is more advantageous than a base game. For example, a bonus game may be a state where more coins are possibly obtained than the base game, a state where the probability of obtaining coins is higher than in the base game, a state where fewer coins are consumed than the base game, free game, or the like.

(Payout Control Table)

FIG. 43 is a payout control table which controls a payout awarded in accordance to a winning combination. The payout control table is stored in the ROM 242 of the main control board 71, and a piece of information of a payout is assigned to a type of winning combination. For example, a payout for a winning combination including a "BELL" symbol is "10." A payout for a winning combination including a "BLUE 7" is "40." Note that payouts for a base game and a free game are set to be the same in the present embodiment.

(Free Game Quantity Table)

FIG. 44 is a table referred to when determining the number of free games to be played for the number of points acquired in a common game of a base game. The points awarded in a common game correspond to the number of free games to be played in the free game quantity table. For example, when the total number of accumulated points is 4, the free games are run 80 times. When the total number of accumulated points is 8, the free games are run 160 times. Thus, by succeeding in a common game in a base game and acquiring many points, it is possible to continue a free game for a long period of time.

(Reel Setting Table and Detected Magnetic Force Table)

FIG. 45 illustrates the relationship between a reel setting table and a detected magnetic force table when a symbol array, a reel home position, and a detected magnetic force are associated with one another. The reel setting table has a code number field, a symbol array field, and a detected magnetic force field. There are five types of reel setting tables for the first to fifth symbol arrays, respectively. FIG. 45 shows the reel setting table for the first symbol array. The reel setting table for the first symbol array indicates that, when the position of the reel M3 where a "BLUE7" symbol with a code number "08" is the reel home position, a detected magnetic force (reel home position magnetic force) at this reel home position is "ND78". The reel setting table also indicates a state in which detected magnetic forces of a magnetic force signal pattern for one rotation of the reel (i.e. one cycle) are assigned to the symbols of all code numbers. With this, the reel setting table makes it possible to specify a rearranged symbol by reading out each detected magnetic force of the magnetic force signal pattern.

In addition to the above, the detected magnetic force table is a table which stores, when a magnetic force detection signal is obtained by detecting a magnetic force of the external magnetic field after the rotation of the reel M3, a detected magnetic force numerically indicated by the magnetic force detection signal. In other words, the detected magnetic force table can store the detected magnetic forces of the magnetic force signal patterns of one or more cycle. Assume, for example, that a part of the reel M3 where a "BLUE7" symbol with the code number "08" is set or selected as the reel home position, and the detected magnetic force (reel home position magnetic force) when an external instruction signal is input is "ND78". In this case, a magnetic force signal pattern is stored in the detected magnetic force field in such a way that "ND78" is stored in the detected magnetic force field of the reel setting table, which field corresponds to the code number "08".

(Process Operation of Slot Machine 10: Boot Process)

Figure 46:
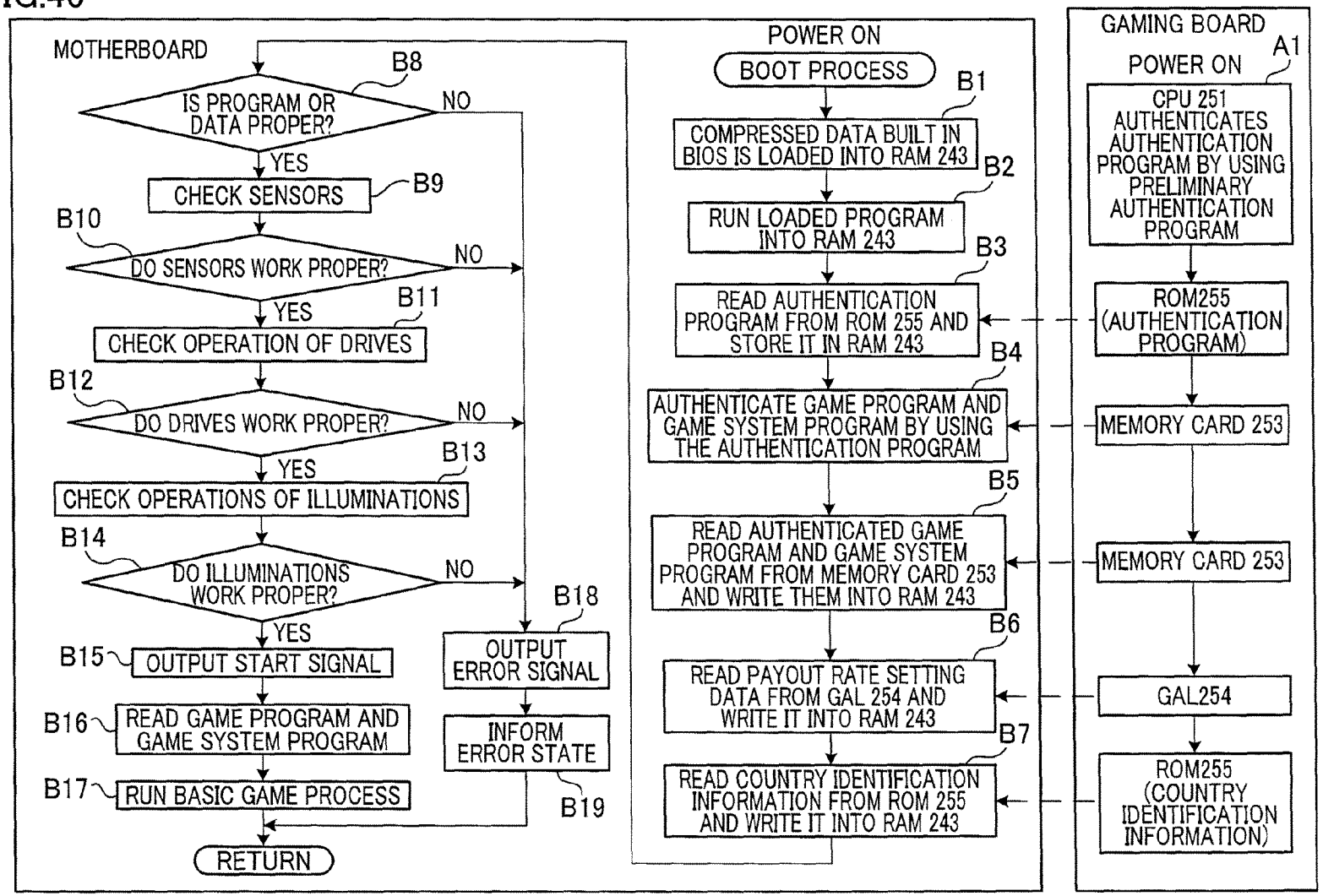
FIG. 46 is a flowchart of a boot process.

The following describes a boot process taking place in the slot machine 1. When power is supplied to the slot machine 10, a boot process routine shown in FIG. 46 takes place in the motherboard 240 and the gaming board 250. In the present embodiment, a memory card is inserted into the card slot 253S of the gaming board 250, and the GAL 254 is attached to the IC socket 254S.

First, when a power switch is turned on (power is supplied) in the power supply unit 245, the motherboard 240 and the gaming board 250 are booted. When the motherboard 240 and the gaming board 250 are booted, different processes are respectively carried out in parallel. That is, in the gaming board 250, the CPU 251 carries out processes of reading a preliminary authentication program stored in the boot ROM 252, and carrying out preliminary authentication by the preliminary authentication program. Note that the preliminary authentication is a process in which the preliminary authentication program is run to confirm and authenticate that authentication program is not modified in advance before importing the program into the motherboard 240 (A1).

Meanwhile, in the motherboard 240, the main CPU 241 runs BIOS stored in the ROM 242. As a result, the compressed data built in the BIOS is loaded into the RAM 243

(B1). Then, the main CPU 241 runs the BIOS loaded into the RAM 243, and diagnoses and initializes various kinds of peripheral devices (B2).

Afterwards, the main CPU 241 reads, via PCI bus, the authentication program stored in the ROM 255, and stores the read authentication program to the RAM 243 (B3). During this step, the main CPU 241 drives a checksum through an ADDSUM method (a standard check function) which is adopted in standard BIOS. Thus, it is confirmed whether or not the authentication program is stored in the RAM 243 without an error.

The main CPU 241 then confirms a component connected to the IDE bus. Then, the main CPU 241 accesses to the memory card 253 inserted into the card slot 253S via the IDE bus, to read the game program and the game system program from the memory card 253. In this case, data constituting the game program and the game system program are read in units of four bytes. Then, the main CPU 241 confirms and authenticates, according to the authentication program stored in the RAM 243, that the read game program and the game system program are not modified (B4).

When the authentication process ends properly, the main CPU 241 writes and stores the authenticated game program and the game system program in the RAM 243 (B5).

The main CPU 241 then accesses to the GAL 254 attached to the IC socket 254S to read payout rate setting data from the GAL 254, and stores the data in the RAM 243 (B6). Afterwards, the main CPU 241 reads the country identification information stored in the ROM 255 of the gaming board 250, and stores the information to the RAM 243 (B7).

With a result of the above authentication process, the main CPU 241 determines whether the program or data is proper (B8). When the program or data is not proper (B8, NO), an error signal including ID information to specify a slot machine 10 is output to a centralized control device (not shown). The centralized control device specifies a slot machine 10 in an error state based on the error signal. The centralized control device then instructs a staff standing by near the slot machine 10 to deal with the error, and stores an error history information containing a time and date and a place when/where the error has occurred, or the like (B18). Then, the error state is informed in the form of an audio output from the speaker 23 of the slot machine 10, and in the form of light emitted from the light emitting portion 20. Afterwards, the routine in the motherboard 240 ends.

On the other hand, when the program or data is proper (B8, YES), operations of sensors disposed to the slot machine 10 are checked successively (B9). Then, whether or not all the sensors operate properly is determined (B10). When an error is detected in at least one sensor (B10, NO), the above mentioned B18 and B19 are carried out, and the routine ends thereafter.

On the other hand, when all the sensors operate properly (B10, Yes), operations of all drive mechanisms are checked successively (B11). Then, it is determined whether or not all the drive mechanisms operate properly (B12). When an error is detected in at least one driving mechanism (B12, NO), the above mentioned B18 and B19 are carried out, and the routine ends thereafter. On the other hand, when all the drive mechanisms operate properly (B12, Yes), operations of all illuminations are checked successively (B13). Then, it is determined whether or not all the illuminations operate properly (B14). When an error is detected in at least one illumination (B14, No), the above mentioned B18 and B19 are carried out, and the routine ends thereafter.

On the other hand, when all the illuminations operate properly (B14, Yes), a boot signal indicating that all the illuminations have been booted properly is output to the centralized control device (not shown) or the like (B15). Afterwards, a base game process is carried out (B16), and this routine ends. The following describes a base game process in detail.

(Base Game Process)

Figure 47:
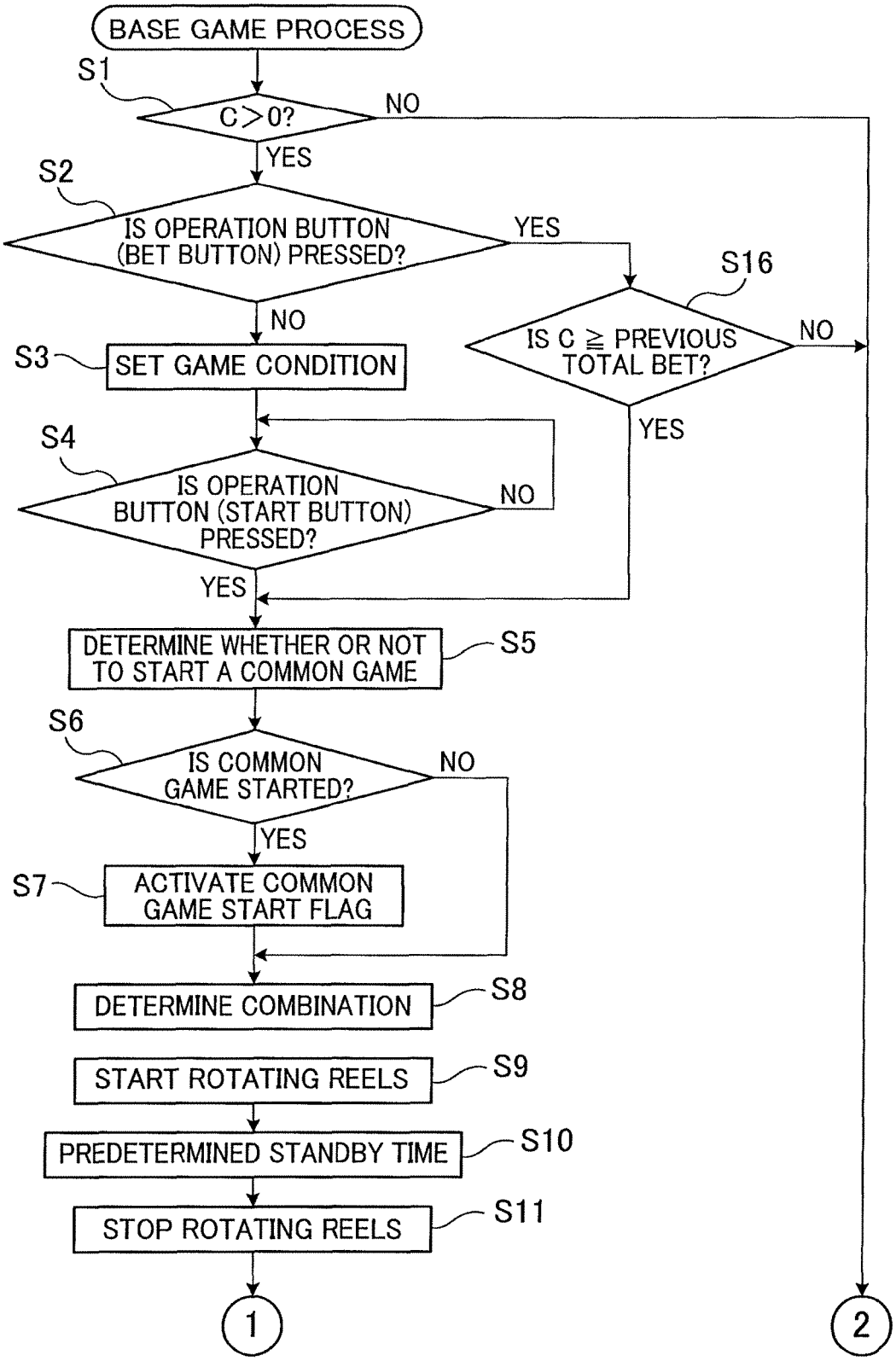
FIG. 47 is a flowchart showing another part of a base game process.
Figure 48:
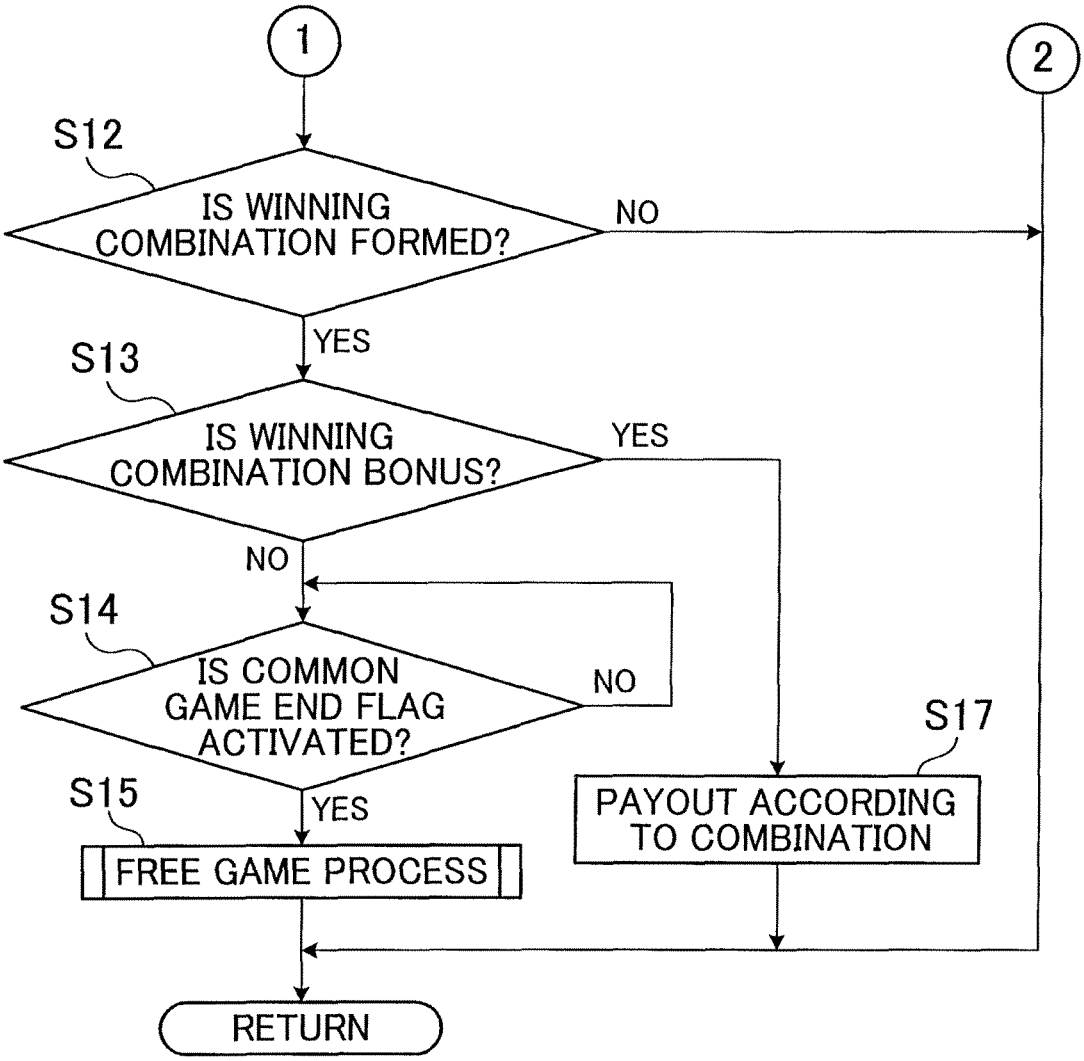
FIG. 48 is a flowchart showing another part of a base game process.

FIGS. 47 and 48 are flowcharts showing a process carried out by the main CPU 241 of the slot machine 10 during a base game of the slot machine 10. A unit game includes a routine shown in FIGS. 47 and 48. Note that the slot machine 10 is booted in advance, and a variable used in the CPU 241 on the game controller 1 side is initialized at a predetermined value. Accordingly, the slot machine 10 is constantly operated.

First, it is determined if there is a remaining credit, i.e., the remaining number of coins having been inserted by the player (S1). Specifically, a credit amount C stored in the RAM 243 is read, and a process according to the read credit amount C is carried out. When the credit amount C is zero (S1, NO), the routine ends without any operation of a process since a game cannot be started. Meanwhile, when the credit amount C is equal to or more than one (S1, Yes), it is determined that there is at least one credit remaining and the process moves to S2.

In S2, it is determined whether or not the operation button 11 (bet button) is pressed (S2). When the operation button 11 (bet button) is not pressed for a predetermined time (S2, NO), a game condition is set (S3). Specifically, the number of coins to be bet on the payline in the game is determined according to the operation of the operation button 11 (bet button). During this operation, an operation signal sent upon an operation of the operation button 11 is received. According to the number of times that the operation signal is received, the bet on the payline is stored in a predetermined memory area of the RAM 243. Then, the credit amount C written into the predetermined memory area of the RAM 243 is read. A total bet where the above bet is added is subtracted from the read credit C. The resulting number is stored in the predetermined memory area of the RAM 243.

Afterwards, it is determined whether or not an operation button 11 (start button) is pressed (S4). When the operation button 11 (start button) is not pressed (S4, NO), S4 is repeated until the bet button 11 is pressed. When the operation button 11 (start button) is pressed (S4, YES), it is determined whether or not to start a common game (S5).

On the other hand, when the operation button 11 (bet button) is pressed in S2 (S2, YES), it is determined whether or not a value of the credit amount C is equal to or more than the value of the total bet in the previous game. In other words, it is determined whether or not it is possible to start a game with the operation button 11 (bet button) being pressed. Specifically, pressing of the operation button 11 (bet button) causes reading out of a bet on the payline in the previous game and a credit amount C written in a predetermined memory area of the RAM 243. According to a relation of the read credit amount C to the bet, a process branches as follows depending on whether the value of the credit amount C is equal to or more than the value of total bet in the previous game. When it is determined that the value of the credit amount C is less than the value of the total bet of the previous game (S16, NO), the routine ends without any operation of a process since a game cannot be started.

Meanwhile, when it is determined that the value of the credit amount C is equal to or more than the value of the total bet of the previous game (S16, YES), the value of the total bet of the previous game is subtracted from the value of the credit C. Then, the resulting value is stored in a predetermined memory area of the RAM 243. Afterwards, it is determined whether or not to start a common game (S5).

When it is determined to start a common game (S6, YES), a common game start flag is activated (S7). Specifically, data showing that the game start flag activated is written into a storage area of a common game start flag of the RAM 243. Meanwhile, when it is determined not to start a common game (S6, NO), a combination determination process is carried out (S8).

In the combination determination process, a combination of symbols to be stopped on the payline is determined first. Specifically, a command to generate a random number is sent to the random number generation circuit. Then, a random number within a predetermined range which is generated by the random number generation circuit, is sampled. The sampled random number is stored in a predetermined memory area of the RAM 243. Although a random number is generated in the random number generation circuit disposed outside the main CPU 241 in the present embodiment, a random number may be generated through an arithmetic process by the main CPU 241, without the random number generating circuit.

Afterwards, a winning combination table for awarding a payout and a random number table stored in the ROM 242 are read. Those read winning combination table and random number table are stored in a predetermined memory area of the RAM 243. Still-displaying of symbols is controlled for each reel in accordance with the random number table.

Then, the random number table and the winning combination table stored in the predetermined memory area of the RAM 243 are read. Then, the random number written into the predetermined memory area of the RAM 243 is used as a parameter to refer to the random number table. A combination of symbols to be stopped on the payline is then determined.

When a winning combination is determined, the winning combination table is stored into a predetermined memory area of the RAM 243. The random number and the winning combination table written in the predetermined memory area of the RAM 243 are read. In accordance with the random number and the winning combination table, a combination of symbols to be stopped and still-displayed are determined. During this process, the main CPU 241 reads out a symbol arrangement table stored from the ROM 242 and stores the table in a predetermined memory area of the RAM 243. The table is then used as a reference. The determined stop symbol data is stored in a predetermined memory area of the RAM 243. Alternatively, symbols to be stopped may be determined for each reel by using the random number table.

When a combination of symbols to be stopped on the payline is determined, it is determined whether or not the combination is a winning combination. When the combination of symbols to be stopped on the payline is a winning combination, a flag which indicates that a payout corresponding to the type of the winning combination will be awarded, is activated to generate the payout corresponding to the combination of symbols on the payline forming the determined winning combination. The activated flag indicating that a payout will be awarded is stored in a predetermined memory area of the RAM 243. To the contrary, when a combination of symbols to be stopped on the payline is another combination, that is, a losing combination, the flag indicating that a payout will be awarded is not activated.

After the above combination determination process is carried out, reels 30A to 30E rotate so as to move symbols 301 in the display windows 7A to 7E (S9). Then, the rotation continues for a predetermined time (S10). Then, the rotation of reels 30A to 30E automatically stops (S11).

Then, it is determined whether or not a winning combination is formed through the combination determination process in S8 (S12). Specifically, this is done based on a status of the flag stored in the predetermined memory area of the RAM 243, which flag indicates a prize according to a combination of symbols on the payline is awarded. When the flag is not activated (S12, NO), it is determined that a winning combination is not formed, and the routine ends.

Meanwhile, when the flag is activated (S12, YES), it is determined whether or not the winning combination formed in the combination determination process in S8 includes a "Blue 7." Specifically, when the winning combination includes a "Blue 7" (S13, YES), the routine ends after the number of coins are paid out in accordance to the winning combination (S17).

Meanwhile, when the winning combination does not include a "BLUE 7" (S13, NO), it is determined whether or not a common game end flag is activated (S14). Specifically, it is determined whether or not data showing that the common game end flag is activated is written into a common game end flag area of the RAM 243. S14 is repeated until the common game end flag is activated (S14 NO). When the common game end flag is activated (S14, YES), a free game process is carried out (S15). Then, the routine ends.

(Free Game Process)

Figure 49:
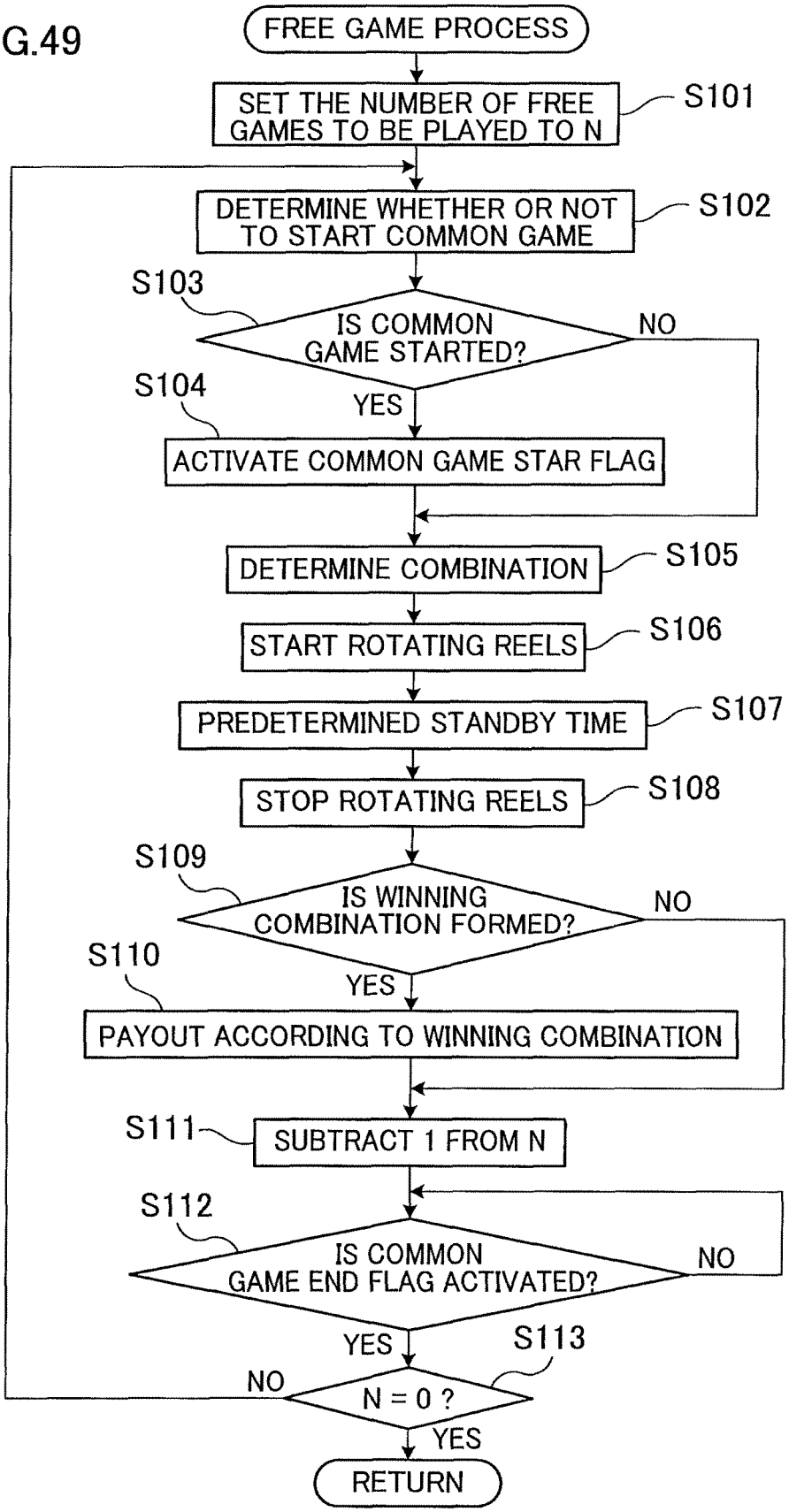
FIG. 49 is a flowchart showing a free game process.

The following describes a free game process with reference to FIG. 49.

First, N denotes the number of free games (S101). The number of free games is determined according to accumulated points acquired in a common game of a base game.

Then, whether or not to start a common game is determined (S102). When a common game is determined to start (S103, YES), a common game start flag is activated (S104). Specifically, data indicating that the common game start flag is activated is written into a storage area of the RAM 243 for storing the common game start flag. Afterwards, the process moves to S105.

Meanwhile, when a common game is determined not to start (S103, NO), the process immediately moves to S105. Thus, a combination determination process same as above is carried out (S105). A difference in this combination determination process is that the referred random number table is a free game random number table (not shown). Then, reels 30A to 30E start to rotate (S106). After a predetermined standby time (S107), an image of stopping the rotation of each of the reels 30A to 30E is displayed (S108).

Then, whether or not a winning combination is formed is determined (S109). When a winning combination is not formed (S109, NO), the process moves to Sill. Meanwhile, when a winning combination is formed (S109, YES), a game medium according to the winning combination is paid out (S110). Specifically, the number of coins to be paid out for the winning combination is calculated, referring to the payout control table. A credit amount stored in a predetermined memory area of the RAM 243 is then read out. The payout value calculated above is added to the credit. The sum is stored in a predetermined memory area of the RAM 243, and the stored value is displayed on the credit amount display unit 9.

In S111, 1 is subtracted from N (S111). Then, whether or not a common game end flag is activated is determined (S112). Specifically, it is determined whether or not data showing that the common game end flag is activated is written into the common game end flag area of the RAM 243. S112 is repeated when the common game end flag is not activated (S112, NO).

When the common game end flag is activated (S112, YES), whether N is 0 is determined (S113). When N is not 0 (S113, NO), the operation is carried out again from S102. On the other hand, when N is 0 (S113, YES), the routine ends.

(Common Game Process)

Figure 50:
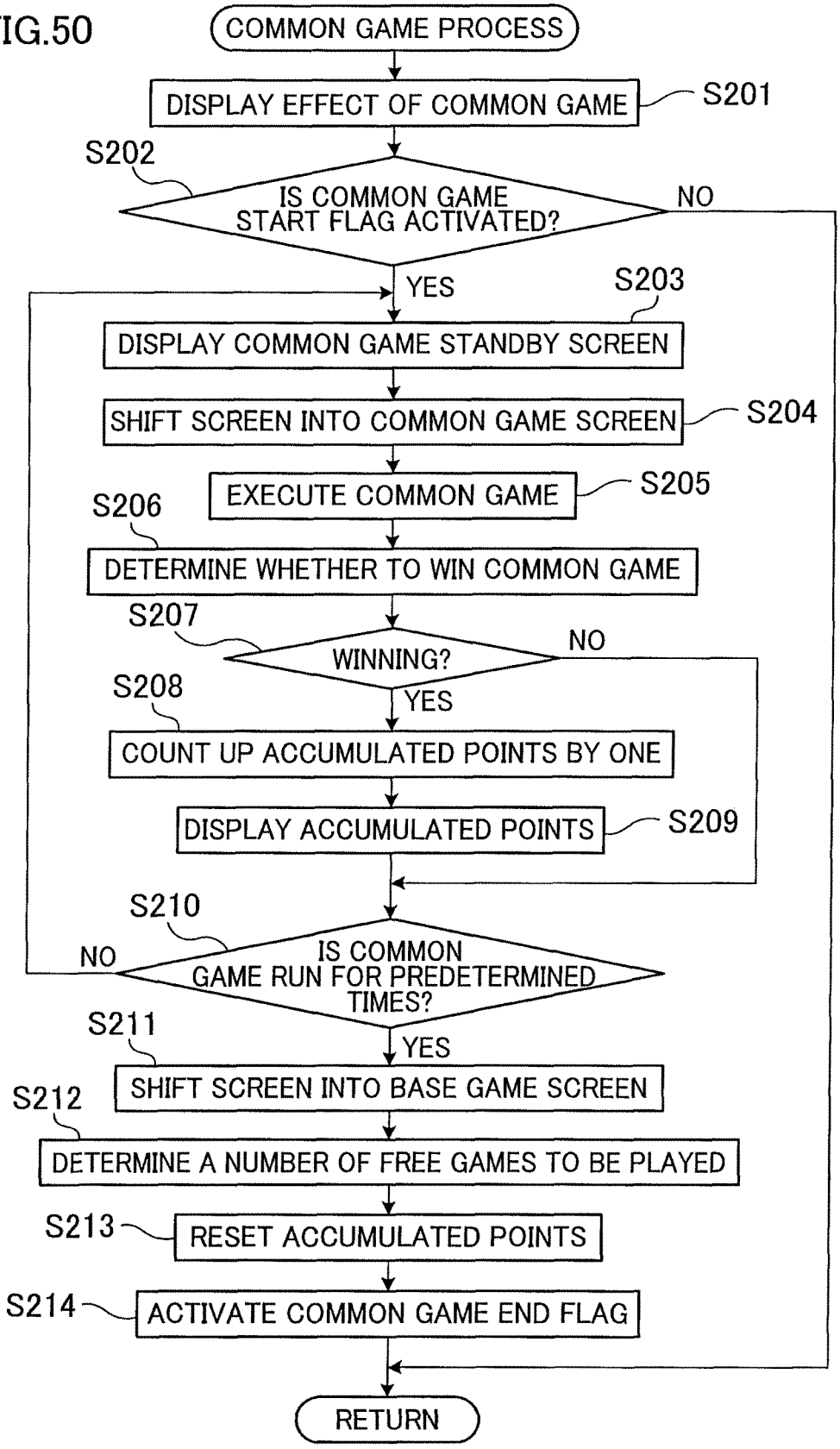
FIG. 50 is a flowchart showing a common game process.

The following describes a common game process with reference to FIG. 50.

First, a common game screen, which is an effect screen displayed when a common game is not run, is displayed on the upper liquid crystal panel 5A (S201). Then, whether or not the common game start flag is activated is determined. Specifically, it is determined whether data showing that the common game start flag is activated is written into the game start flag area of the RAM 243 (S202).

When the common game start flag is not activated (S202, NO), the routine is terminated. On the other hand, when the common game start flag is activated (S202, YES), an effect screen displayed when a common game is run is displayed on an upper liquid crystal panel 5A (S204).

Thereafter, a common game starts (S205), and whether the player has won in the common game (S206). More specifically, whether to succeed in a common game is determined by using a sampled random number.

Then, it is determined whether or not the player has won in the common game has been determined (S207). When successful (S207, YES), the total number of accumulated points is counted up by 1 (S208), and the total number of accumulated points is displayed (S209). Then, it is determined whether or not the common game is run a predetermined number of times (S210). Meanwhile, when the common game is unsuccessful (S207, NO), the total number of accumulated points is not counted up, and it is determined whether or not the common game is played for predetermined number of times (S210).

When the common game is not played for predetermined number of times (S210, NO), the process is carried out again from S203, and a next common game starts. When a common game is repeated for, for example, ten times (S210, YES), the screen switches to a base game screen (S211). After determining the number of times the free game is run (S212), the total number of accumulated points is reset (3213). Then, after activating the common game end flag (S214), this routine ends.

(First Reel Setting Process)

Figure 51:
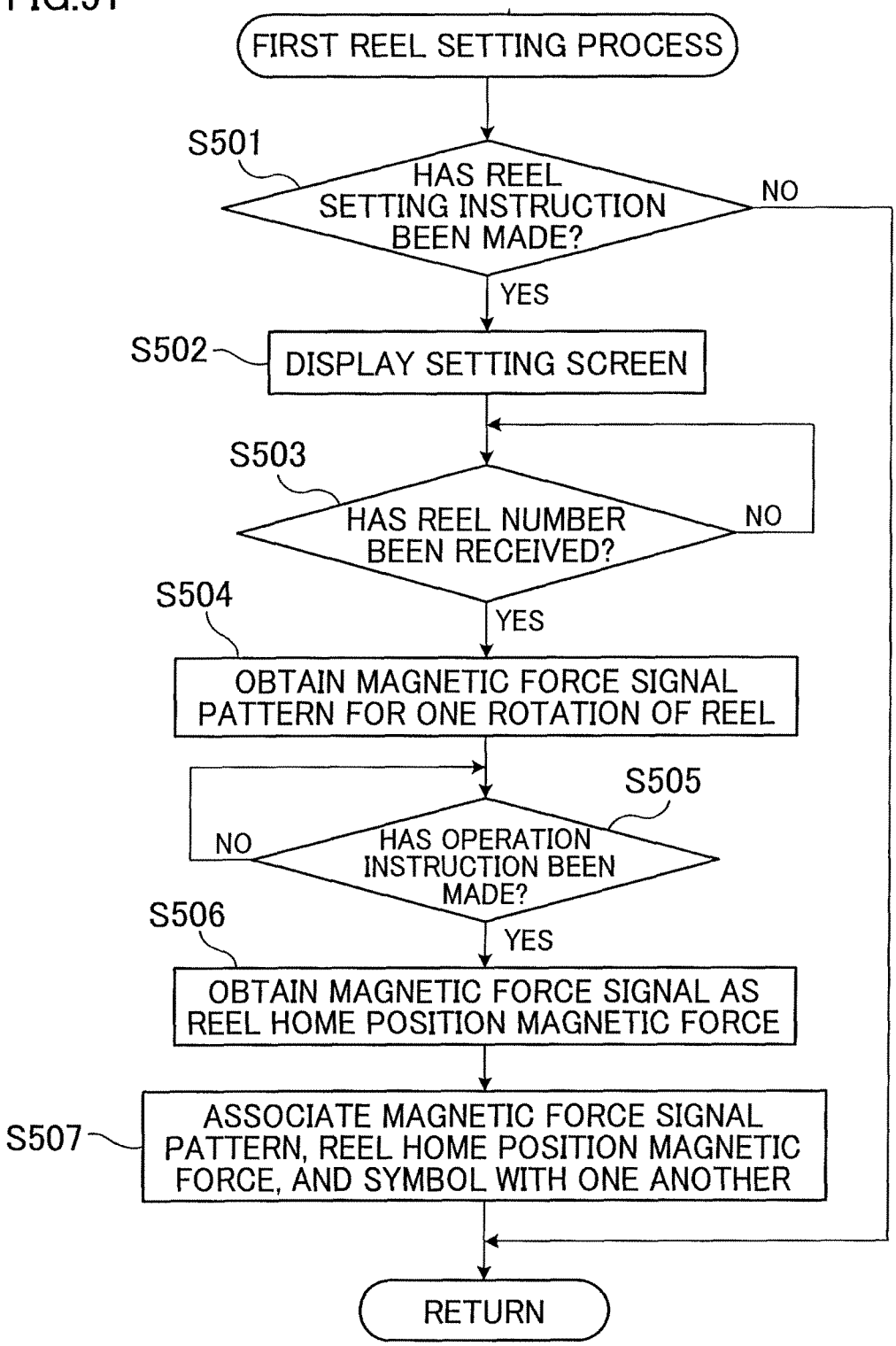
FIG. 51 is a flowchart of a first reel setting process.

Now, referring to FIG. 51, a first reel setting process will be described. First, whether a reel setting instruction has been made is determined (S501). When the reel setting instruction has not been made (S501, NO), the process is terminated. On the other hand, as shown in FIG. 1, as the reel setting unit 635 is connected to the slot machine 10 to be able to perform data communication therewith, the detection of this connection is recognized that the reel setting instruction has been made (S501, YES). Alternatively, the reel setting instruction may be done by sending a reel setting instruction signal to the main body PCB 110 of the slot machine 10 by operating a key of the reel setting unit 635. Thereafter, the slot machine 10 instructs the reel setting unit 635 to display a setting screen. As a result, the reel setting unit 635 displays a process and a manual of reel setting (S502).

Subsequently, as the operator operates a key of the reel setting unit 635, whether a data signal of a reel number has been received from the reel setting unit 635 is determined (S503). If not received (S503, NO), the signal is waited for as the step S503 is conducted again. On the other hand, if the data signal of the reel number has been received (S503, YES), the first to fifth reel units M11*a*-M11*e* corresponding to the reel number are selected as setting targets, and the following processes are carried out.

First, the operator who has specified the reel number manually rotates the reel M3 of the first to fifth reel units M11*a*-M11*e* corresponding to the reel number. A magnetic force signal pattern for at least one rotation is obtained as a result, and stored in the detected magnetic force table shown in FIG. 45 (S504). Thereafter, whether an operation instruction signal has been input is determined (S504). If not input (S504, NO), an input is waited for.

Provided that a specific position of a specific symbol 501 is a reel home position, the operation instruction signal is input to the slot machine 10 by operating a key of the reel setting unit 635 when the specific position has moved to a predetermined position (i.e., a rotation angle of a predetermined reel M3). As the operation instruction signal is input (S504, YES), a magnetic force detection signal is read at the timing of the input of the operation instruction signal, and the detected magnetic force of this magnetic force detection signal is obtained as a reel home position magnetic force (S506).

Thereafter, a magnetic force signal pattern, a reel home position magnetic force, and a symbol are associated with one another (S507). For example, as shown in FIG. 45, assume that the position of the reel M3 where the "BLUE7" symbol with the code number "08" is provided is set or selected as the reel home position, and a detected magnetic force (reel home position magnetic force) when an external instruction signal is input is "ND78". In this case, a magnetic force signal pattern is stored in the detected magnetic force field so that the "ND78" is stored in the detected magnetic force field corresponding to the code number "08" in the reel setting table.

As described above, the slot machine 10 of the present embodiment includes, as shown in FIG. 1, the reel M3 having an outer circumferential surface on which symbols 501 are lined up, the reel driving mechanism M5 which rearranges the symbols 501 by rotating the reel M3, the magnet M201 which is provided in the reel driving mechanism M5 to change the external magnetic field in accordance with the rotation of the reel M3, the magnetic force detecting mechanism M202 which detects the magnetic force of the external magnetic field so as to output a magnetic force detection signal, the reel setting unit (reel setting section 632 in FIG. 2) which associates the magnetic force detection signal with the position of each symbol 501, and a reel drive control unit (main body PCB 110 shown in FIGS. 38 and 39) which controls the reel driving mechanism M5 so that the symbols 501 are rearranged in a predetermined arrangement based on the magnetic force detection signal and the arrangement positions of the symbols 501.

With this, the slot machine 10 makes it possible to reduce the workload required for lining up the symbols 501 on the outer circumferential surface of the reel M3, as compared to the case where the symbols 501 are lined up while the positions thereof are determined based on a predetermined position (home position) of the reel M3.

Second Embodiment

According to First Embodiment, the reel control is realized in an analogous way by associating a symbol array with a magnetic force signal pattern of changes in a magnetic force in a single rotation of a reel M3. Now, the following will describe an arrangement of realizing the reel control in a digital way by forming digital signals in accordance with the changes in the magnetic force.

(Gaming Machine Overview)

Figure 52:
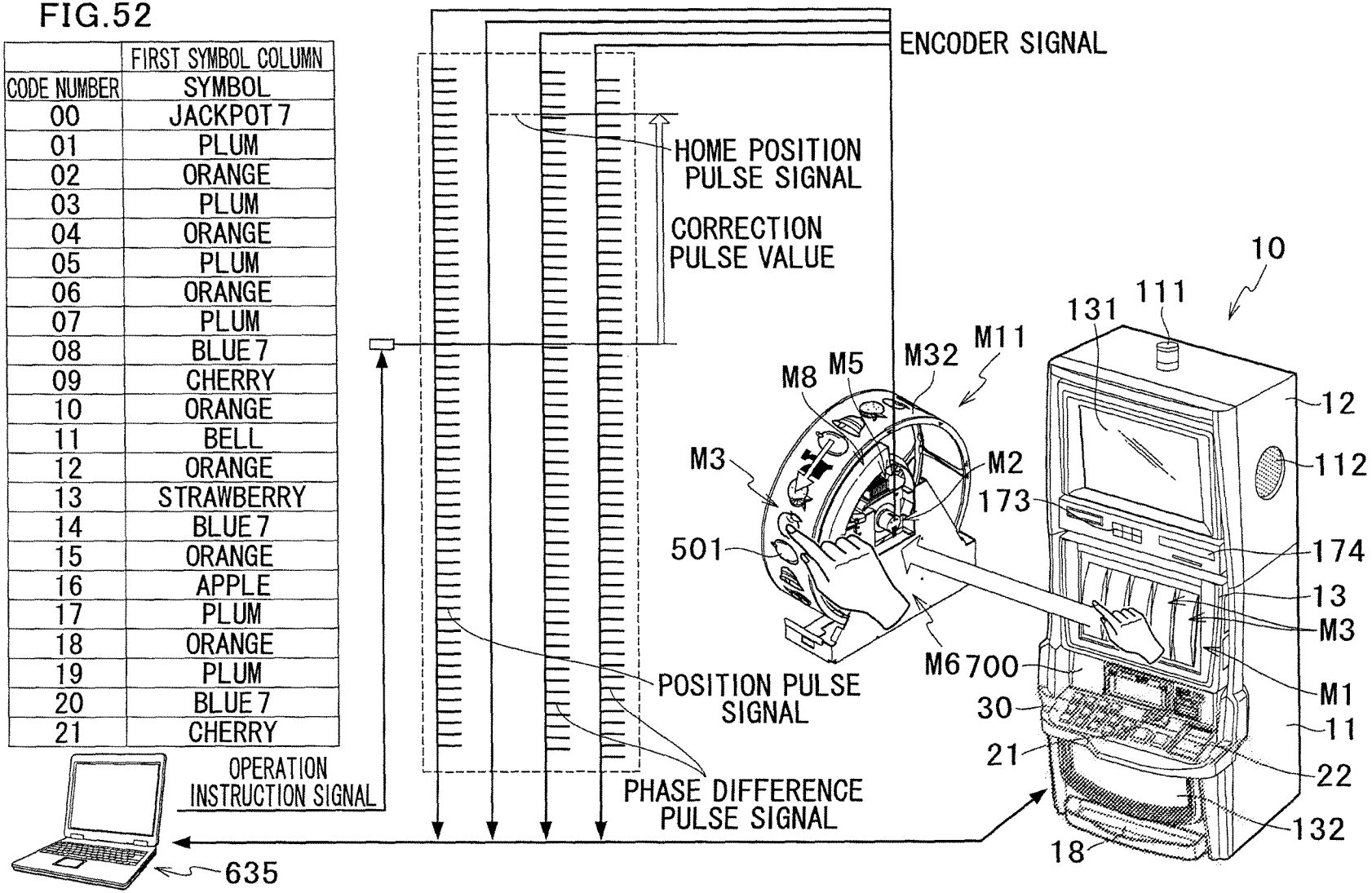
FIG. 52 is an explanatory drawing showing a method of setting a reel of a gaming machine.

As shown in FIG. 52, a gaming machine of Second Embodiment includes a slot machine 10 which is constructed with a focus on the fact that an encoder signal includes a home position pulse signal and a position pulse signal. The encoder signal can be formed in such a way that magnetic force detecting mechanisms M202 of FIG. 1 are provided to be, for example, point-symmetric with respect to the rotation center, so that a plurality of magnetic force detection signals having phase differences of, for example, 90 degrees are formed.

The slot machine 10 includes a mechanical-type reel device M1 which makes it possible to rearrange symbols 501 by using only an encoder signal which is output in accordance with the rotation of the reel M3, by associating a home position pulse signal with arrangement positions of the symbols 501 by means of a correction pulse value based on a position pulse signal.

Figure 53:
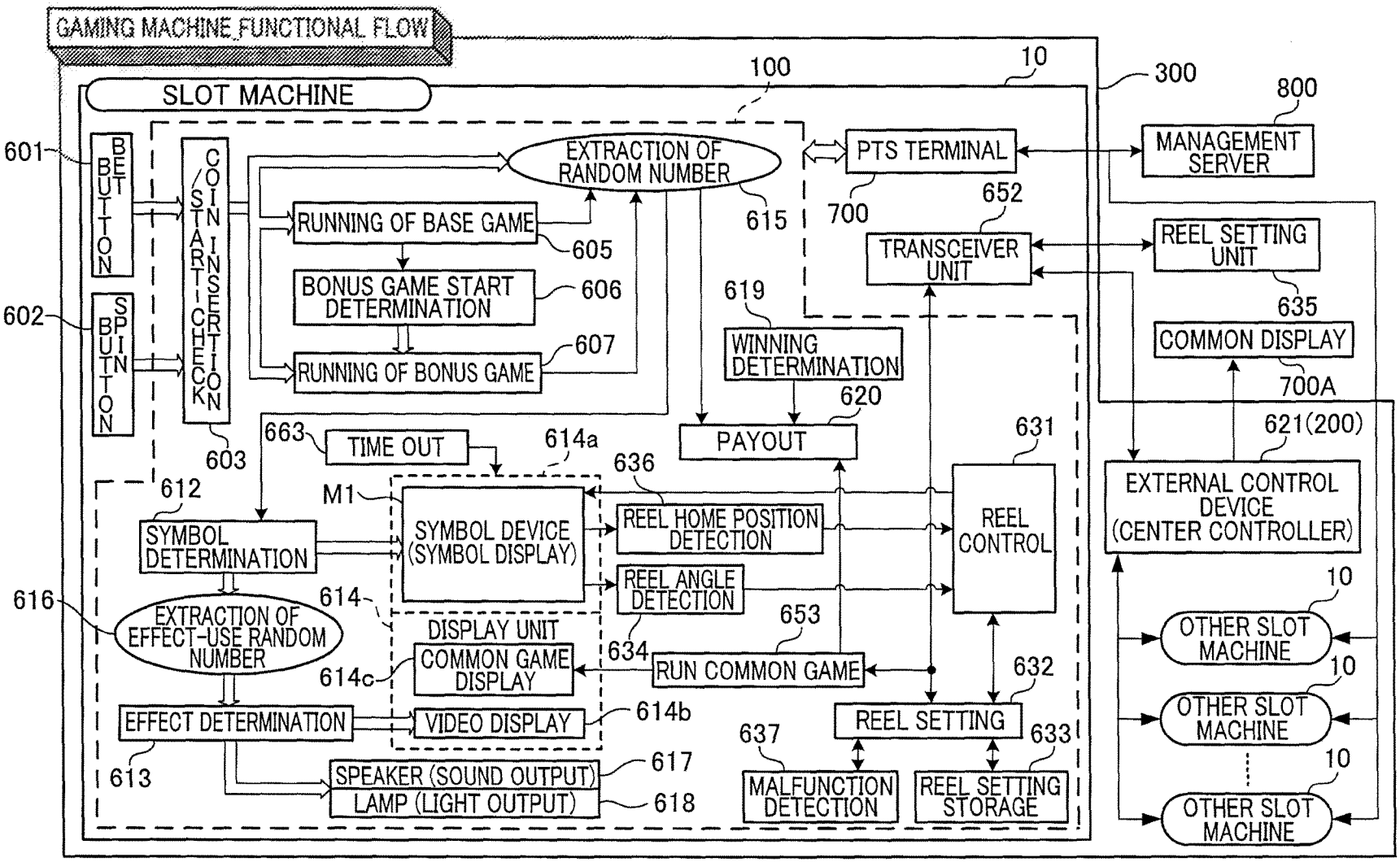
FIG. 53 is an explanatory diagram of a functional flow of the gaming machine.

More specifically, the slot machine 10 includes a reel device M1 having reels M3 and a reel control unit 631 shown in FIG. 53, which controls the reel device M1. The reel device M1 includes the reels M3 each having an outer circumferential surface on which the symbols 501 are lined up, a reel driving mechanism M5 which rearranges the symbols 501 by rotating the reel M3, a reel angle detection mechanism M2 which outputs a position pulse signal each time the reel M3 rotates for a predetermined angle and a home position pulse signal for one rotation of the reel M3, and a reel setting unit (reel setting section 632 of FIG. 53) which associates the home position pulse signal with the arrangement positions of the symbols 501 by means of a correction pulse value based on the position pulse signal.

The reel control unit 631 shown in FIG. 53 has, as a reel drive control unit, a function of controlling the reel driving mechanism M5 so that the symbols 501 are rearranged in a predetermined arrangement based on the home position pulse signal, the correction pulse value, the phase difference pulse signal, and the arrangement positions of the symbols 501.

With this, by associating the home position pulse signal with the arrangement positions of the symbols 501 by using the correction pulse value generated based on the position pulse signal output in units of the predetermined angle, the slot machine 10 can indirectly detect the arrangement positions of the symbols 501 based on the home position pulse signal, the correction pulse value, and the phase difference pulse signal, even if the arrangement positions of the symbols 501 are not directly detected by a sensor or the like. For this reason, even if the positional relation between the symbols 501 and the reel M3 is not determined in advance, the symbols 501 arranged on the reel M3 are specified, with the result that the symbols 501 are rearranged in the predetermined arrangement. As a result, it is possible to reduce the workload required for lining up the symbols 501 on the outer circumferential surface of the reel M3, as compared to the case where the symbols 501 are lined up while the positions thereof are determined based on a predetermined position (home position) of the reel M3.

(Functional Flow of Gaming Machine 300: Slot Machine)

The gaming machine 300 arranged as above includes a slot machine 10 and an external controller 621 (center controller 200) which is connected to the slot machine 10 to be able to communicate therewith. The slot machine 10 is arranged to be connectable with a reel setting unit 635 via a transceiver unit 652. The reel setting unit 635 functions as an external operation unit which outputs an operation instruction signal in response to an external operation.

In addition to the above, the slot machine 10 includes a reel control unit 631, a reel setting section 632, a reel setting storage unit 633, a reel angle sensor 634, and a reel home position sensor 636. The reel home position sensor 636 has a function of outputting the reel home position signal when the home position of the reel M3 is detected. In the meanwhile, the reel angle sensor 634 has a function of outputting the position pulse signal, the home position pulse signal, and the phase difference pulse signal.

More specifically, the reel angle sensor 634 is an encoder unit which outputs the position pulse signal, the home position pulse signal, and the phase difference pulse signal by magnetically detecting the rotation of the reel M3. The position pulse signal is output each time the reel M3 rotates at the predetermined angle. The home position pulse signal is output for one rotation of the reel M3. The phase difference pulse signal is output at a phase difference of 90 degrees or the like, to make it possible to detect the positive and negative rotations of the reel M3.

The reel setting storage unit 633 stores various types of data required for setting the reel, such as the correction pulse value based on the position pulse signal. The reel control unit 631 has a function of controlling the reel device M1 so that the symbols 501 are rearranged in the predetermined arrangement based on the home position pulse signal, the correction pulse value, the phase difference pulse signal, and the arrangement positions of the symbols 501.

The reel setting section 632 has a function of associating the home position pulse signal with the arrangement positions of the symbols 501 by using the correction pulse value generated based on the position pulse signal. More specifically, the reel setting section 632 starts to count the phase difference pulse signals when the operation instruction signal is output, and the value when the counting is stopped at the timing of the output of the home position pulse signal is set as the correction pulse value. With this, since the operation instruction signal is output in response to an external operation, the symbols 501 are easily positioned at predetermined positions (home position) of the reel M3, as the operator only operates the reel setting unit 635 when the predetermined arrangement is achieved, by visually checking the arrangement positions of the symbols 501. As a result, the reel setting section 632 makes it possible to easily start the operation to set the positional relation between the symbols 501 and the reel M3 by the operation of the reel setting unit 635.

In addition to the above, the reel setting section 632 has a function of detecting whether the reel M3 rotates positively or negatively by the phase difference pulse signals and canceling out the phase difference pulse signals in the positive rotation with the phase difference pulse signals in the negative rotation, when the phase difference pulse signals are counted. The reel setting section 632 can therefore precisely obtain the correction pulse values even if the reel does not rotate in one direction, by cancelling out the phase difference pulse signals in the positive rotation with the phase difference pulse signals in the negative rotation.

In addition the above, the slot machine 10 has a malfunction detection unit 637. This malfunction detection unit 637 has a function of detecting malfunction of the reel angle sensor 634 based on the relationship between the home position of the reel M3 detected by the reel home position sensor 636 and the home position pulse signal. With this, as the malfunction detection unit 637 detects malfunction of the reel angle sensor 634, it is possible to prevent a trouble that the symbols 501 are not rearranged in the predetermined arrangement. The slot machine 10 of the present embodiment is identical with that of First Embodiment except this arrangement.

(Electrical Structure of Slot Machine: Reel Device M1)

Figure 54:
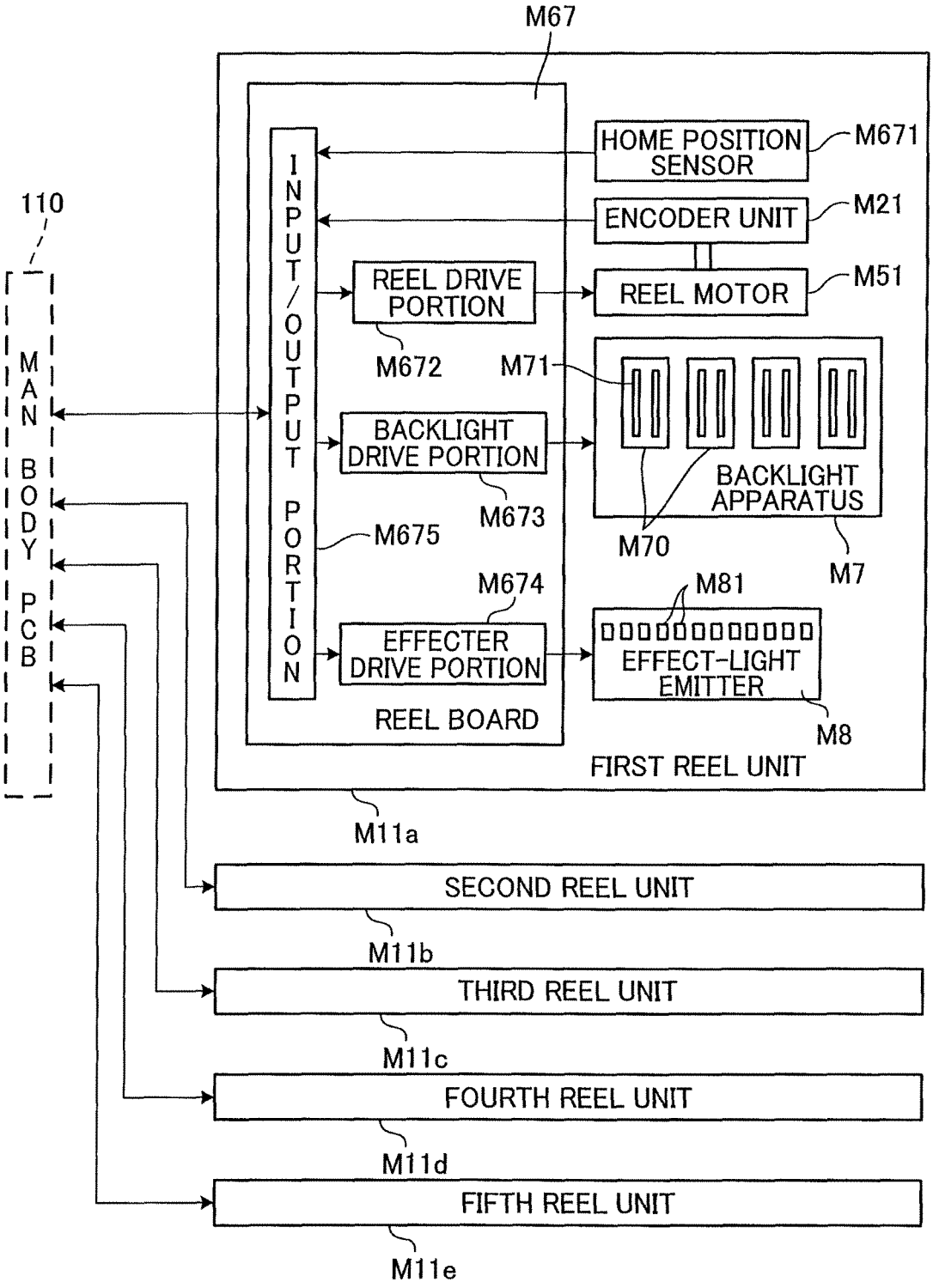
FIG. 54 is an electrical block diagram of a reel board.

A main body PCB 110 is connected to the reel device M1. As shown in FIG. 54, each of first to fifth reel units M11*a*-M11*e* has a reel board M67. The reel board M67 includes an input/output portion M675 connected to the main body PCB 110 to be able to exchange data therewith and a reel drive portion M672, a backlight drive portion M673, and an effecter drive portion M674 which are connected to the input/output portion M675. The input/output portion M675 is connected to a home position sensor M671 and an encoder unit M21.

(Reel Setting Table)

FIG. 55 shows an example of a data table used for calculating a correction symbol center value. This data table has an item field which stores items required for calculating the correction symbol center value, a calculation formula field which stores calculation formulas for items requiring calculations, an item value field which stores specific values of the items, and a symbol data field which stores calculation values of respective symbols.

The item field has "reel number", "number of symbols N", "code number", "number of pulses in cycle EP", "number of pulses for each symbol UP", "symbol boundary value Pn", "symbol center value SPn", "correction pulse value AP", and "correction symbol center value ASPn".

The "reel number" is data for specifying one of the first to fifth reel units M11*a*-M11*e*. For example, when an "item value" corresponding to the "reel number" is "1", the selection of the first reel device M11*a* is indicated. That is to say, reel numbers "1" to "5" are assigned to the first to fifth reel units M11*a*-M11*e*, respectively, to allow the operator to specify one of the reel units.

The "number of symbols N" is data for specifying the number of symbols 501 lined up on the reel M3. For example, when an "item value" corresponding to the "number of symbols N" is "22", 22 sets of number data "00" to "21" are input in the symbol data field corresponding to the "code number". The "number of pulses in cycle EP" indicates the number of pulses output during a single rotation of the reel M3, and a "200" is input thereto, for example. In this case, the encoder unit M21 is a 200 pulse per revolution encoder.

The "number of pulses for each symbol UP" stores a calculation result of the number of pulses as a result of cycle EP/the number of symbols N. In short, this field stores "18". When "18" is stored, the width of a single symbol 501 is equivalent to 18 pulses. The "symbol boundary value Pn" indicates boundary values of the symbols 501 having the code numbers "00" to "21". When n=N−1, i.e., in the case of the symbols 501 having the code numbers "00" to "20", the symbol boundary values Pn are calculated by a calculation formula Pn=UPn×n. On the other hand, when n=N, i.e., in the case of the symbols 501 having the code numbers "00" to "20", the symbol boundary values Pn are calculated by a calculation formula Pn=EP. As a result, the boundary value between the code numbers "00" and "01" is "18", whereas the boundary value between the code numbers "01" and "02" is "36".

The "symbol center value SPn" indicates an approximation of the center value of the boundary between the symbols 501. More specifically, a symbol center value SPn is calculated by a calculation formula Spn≈Pm−Upn/2. For example, the symbol center value is "9" when the "code number" is "00", or is "27" when the "code number" is "01".

The "correction pulse value AP" indicates the total sum of the position pulse signals generated from the start of the counting of the position pulse signals at the actual home position of the reel M3 instructed by the operator to the input of the home position signal. Therefore, when the reel M3 rotate positively, AP=AP. When the reel M3 is negatively rotates, AP=EP−AP. In other words, the correction pulse value AP is calculated by performing conversion to the positive rotation by subtracting the correction pulse value from "200" which is the number of pulses in cycle EP. For example, when the "correction pulse value AP" is "70", 70 pulses of the position pulse signals are generated from the home position of the reel M3 (reel band M32) to the input of the home position pulse signal from the encoder unit M21.

The "correction symbol center value ASPn" indicates the relation between the home position pulse signal corrected by the correction pulse value AP and the position pulse signals of the symbol 501. That is to say, by a calculation formula ASPn=SPn+AP, the relation between the home position pulse signal and the central position of the symbol 501 is detectable by the position pulse signals. For example, when the "code number" is "00", the correction symbol center value ASPn is "79", indicating that the 79th position pulse signal from the output of the home position pulse signal is the central point of the symbol 501 with the code number "00".

Such a data table is provided for each of the first to fifth reel units M11*a*-M11*e*, and hence it is possible to arrange the reel specification for each of the first to fifth reel units M11*a*-M11*e*, such as the number of symbols.

(Process Operation of Slot Machine 10)

The operation of the slot machine 10 will be described on the premise of the arrangement above. It is noted that the processes below are identical with those of First Embodiment except that a second reel setting process is executed in place of the first reel setting process of First Embodiment.

(Second Reel Setting Process)

Figure 56:
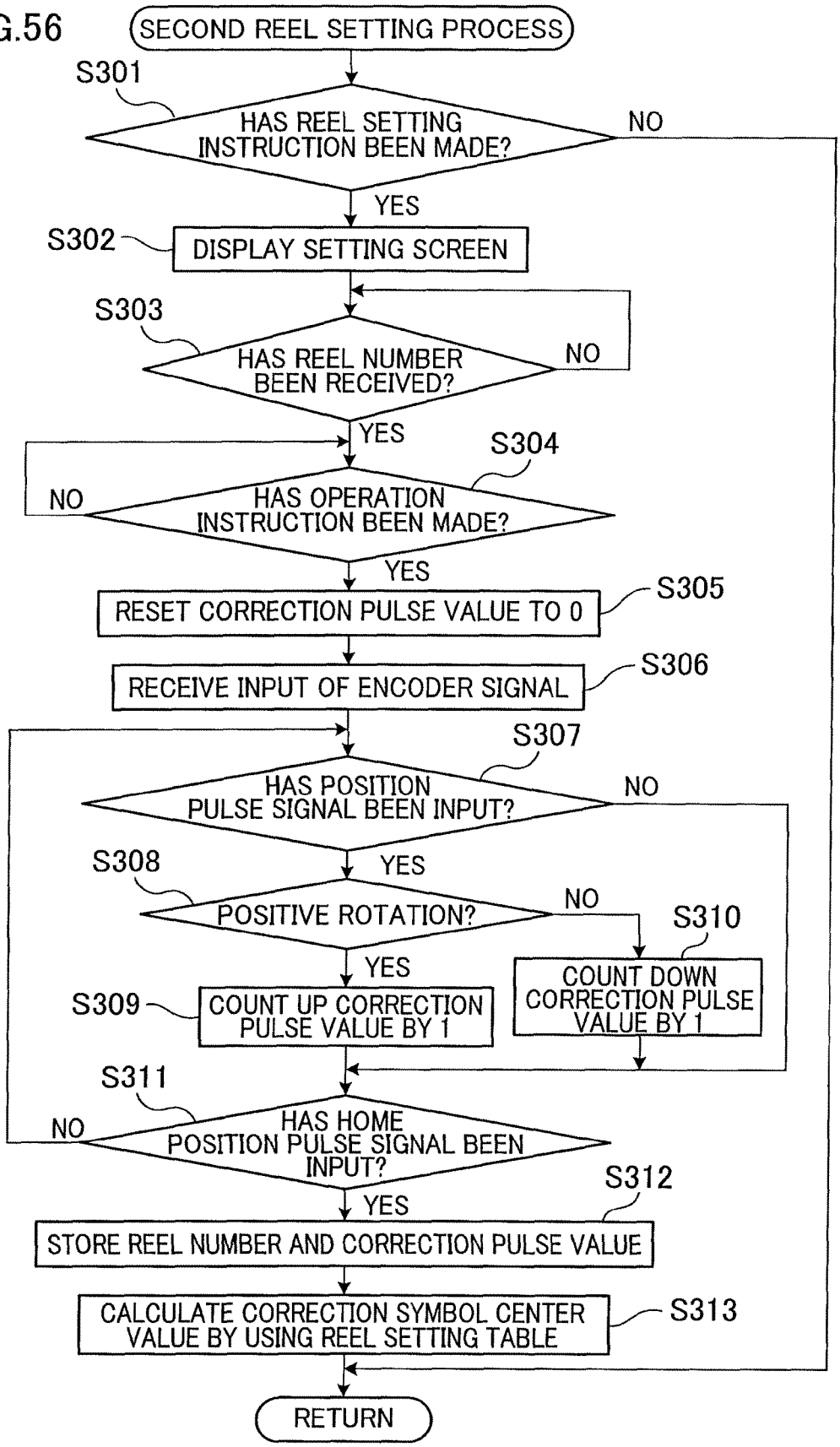
FIG. 56 is a flowchart of a second reel setting process.

Referring to FIG. 56, a second reel setting process will be described. First, whether a reel setting instruction has been made is determined (S301). When the reel setting instruction has not been made (S301, NO), the process is terminated. On the other hand, as shown in FIG. 52, when the reel setting unit 635 is connected to the slot machine 10 to be able to exchange data therewith, it is determined that the reel setting instruction has been made, on the detection of this connection (S301, YES). Alternatively, it may be determined that the reel setting instruction has been made when the reel setting instruction signal is sent to the main body PCB 110 of the slot machine 10 in response to a key operation of the reel setting unit 635. Thereafter, the slot machine 10 instructs the reel setting unit 635 to display a setting screen. The reel setting unit 635 displays a process and a manual of reel setting (S302).

Subsequently, whether the data signal of a reel number, which is output in response to a key operation of the reel setting unit 635 by the operator, has been received from the reel setting unit 635 (S303). If not received (S303, NO), the data signal is waited for while repeating 3303. On the other hand, when the data signal of the reel number is received (S303, YES), the following steps are executed with the first to fifth reel units M11*a*-M11*e* corresponding to the reel number being selected as setting targets.

First, whether an operation instruction signal has been received is determined (S304). If not received (3304, NO), the signal is waited for while repeating S304. In this waiting state, the operator who has specified the reel number manually rotates the reels M3 of the first to fifth reel units M11*a*-M11*e* corresponding to the reel number. When a predetermined part of the reel M3, such as a specific symbol 501, reaches the reel home position, an operation instruction signal is output to the slot machine 10 as a key of the reel setting unit 635 is operated. When the operation instruction signal is input (S304, YES), this operation instruction signal is dealt with as a reel home position signal. Then the correction pulse value is reset to "0" (S305).

Thereafter, an encoder signal constituted by a position pulse signal, a phase difference pulse signal, and a home position pulse signal is received from the reel angle detection mechanism M2 (S306). As the reel M3 is positively or negatively rotated by the operator, whether the position pulse signal has been input is determined (S307). When no position pulse signal is input (S307, NO), then whether the home position pulse signal has been input is determined (S311). When no home position pulse signal has been input (S311, NO), S307 is repeated and the input of the position pulse signal is waited for.

In the meanwhile, if the position pulse signal has been input (S307, YES), then, whether the rotational direction of the reel M3 is positive or negative is determined based on the phase difference pulse signal (5308). When the rotational direction is positive (5308, YES), the correction pulse value is counted up by 1 (S309), and then whether the home position pulse signal has been input is determined (S311). On the other hand, when the rotation is not positive (3308, NO), the correction pulse value is counted down by one (S310), and then whether the home position pulse signal has been input is determined (S311). This makes it possible to precisely calculate the correction pulse value, even if the rotational direction of the reel M3 is not fixed to one direction or the reel M3 is vibrated when manually rotated.

Thereafter, when the home position pulse signal is input (S311, YES), the correction pulse value which has been counted up or down is stored in the reel setting table of FIG. 55, along with the reel number (S312). Then the correction symbol center value is calculated by using the reel setting table (S313).

As described above, the slot machine 10 of Second Embodiment includes, as shown in FIG. 52, a reel M3 having an outer circumferential surface on which symbols 501 are lined up, a reel driving mechanism M5 which rearranges the symbols 501 by rotating the reel M3, a reel angle detection mechanism M2 which outputs a position pulse signal each time the reel M3 rotates for a predetermined angle and a home position pulse signal for one rotation of the reel M3, a reel setting unit (reel setting section 632 of FIG. 53 or first reel setting process shown in FIG. 51) by which the home position pulse signal and the arrangement positions of the symbols 501 are associated with one another by means of a correction pulse value based on the position pulse signal, and a reel drive control unit (main body PCB 110 shown in FIG. 54) which controls the reel driving mechanism M5 so that the symbols 501 are rearranged in a predetermined arrangement based on the home position pulse signal, the correction pulse value, the phase difference pulse signal, and the arrangement positions of the symbols 501.

With this, the slot machine 10 makes it possible to reduce the workload required for lining up the symbols 501 on the outer circumferential surface of the reel M3, as compared to the case where the symbols 501 are lined up while the positions thereof are determined based on a predetermined position (home position) of the reel M3.

(Malfunction Detection)

In addition to the above, the slot machine 10 of Second Embodiment can detect malfunction of the reel angle detection mechanism M2. The following will detail this with reference to FIG. 57 to FIG. 59.

Figure 58:
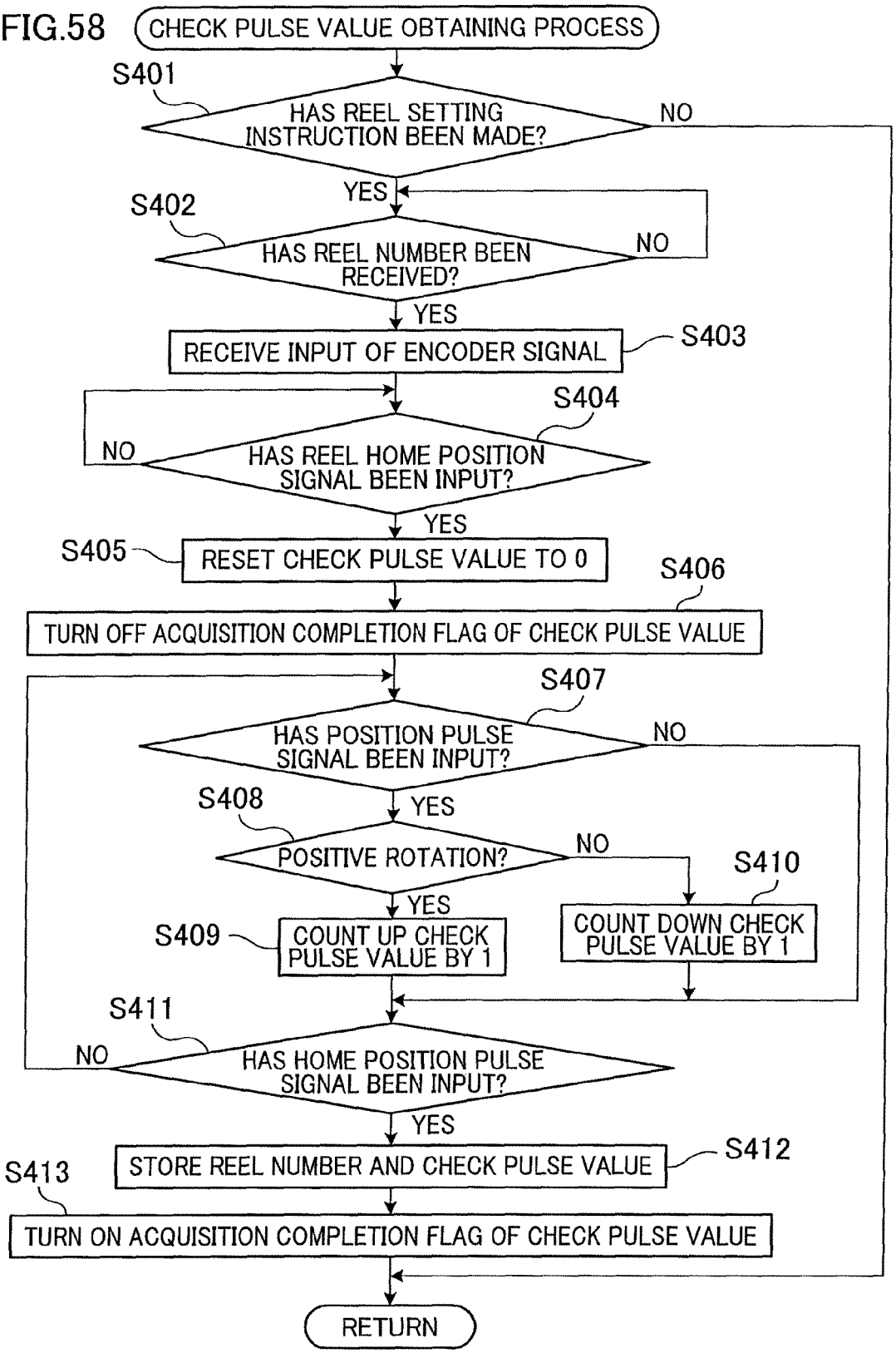
FIG. 58 is a flowchart of a check pulse value obtaining process.
Figure 59:
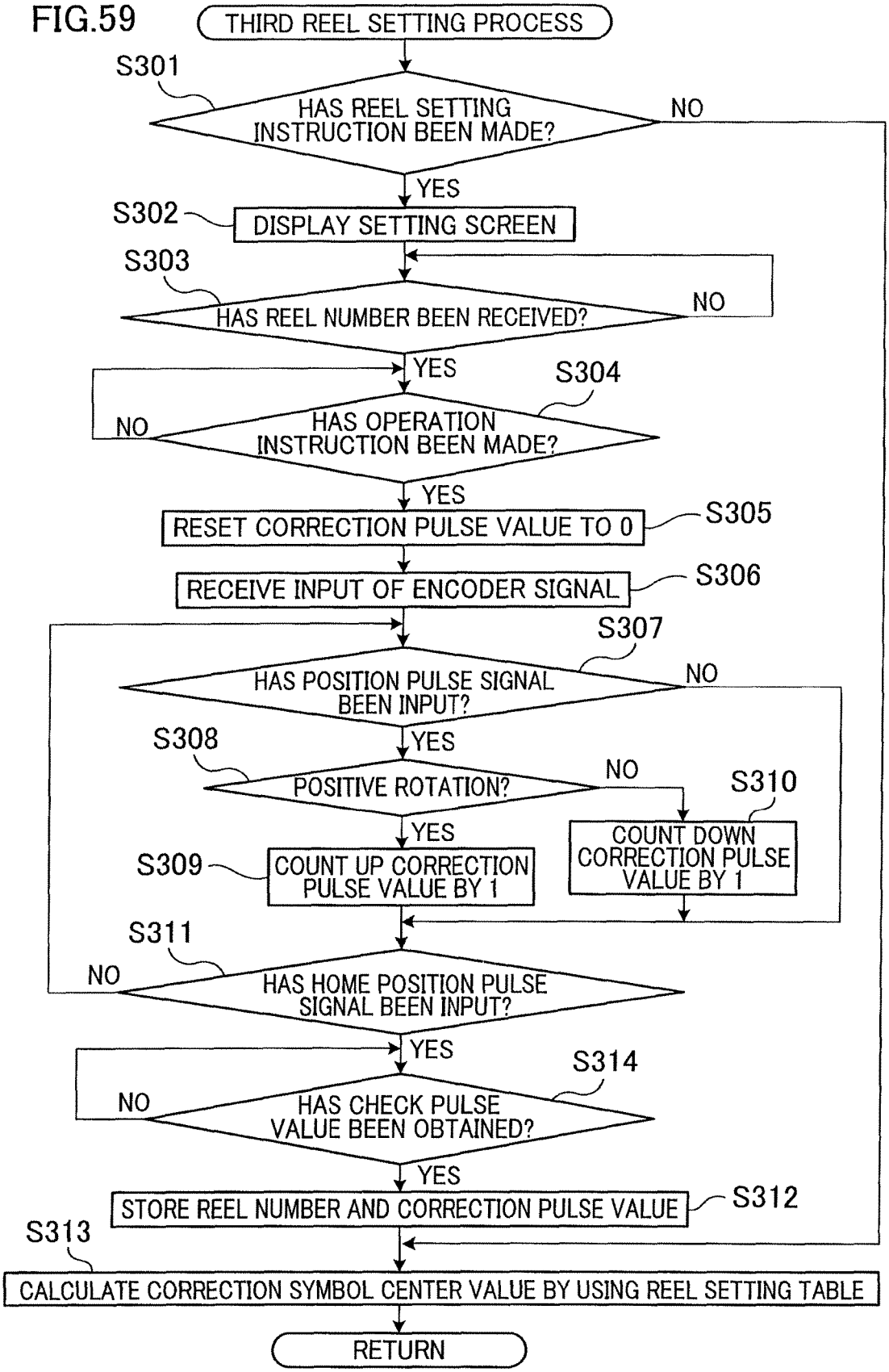
FIG. 59 is a flowchart of a third reel setting process.

A check pulse value obtaining process of FIG. 58 and a third reel setting process of FIG. 59 are executed. In the check pulse value obtaining process of FIG. 58, whether a reel setting instruction has been made is determined (S401). When no reel setting instruction has been made (S401, NO), this process is terminated. On the other hand, as shown in FIG. 53, when the reel setting unit 635 is connected to the slot machine 10 to be able to exchange data therewith, it is determined that the reel setting instruction has been made, on the detection of the connection (S401, YES).

Subsequently, as the operator operates a key of the reel setting unit 635, whether a data signal of a reel number has been received from the reel setting unit 635 is determined (S402). If not received (S402, NO), the signal is waited for while repeating S402. On the other hand, when the data signal of the reel number is received (S402, YES), the following steps are executed with the first to fifth reel units M11*a*-M11*e* corresponding to the reel number being selected as setting targets.

First, the input of an encoder signal is received (S403). Then whether a reel home position signal has been input from the home position sensor M671 shown in FIG. 21 is determined (S404). When no reel home position signal has been input (S404, NO), the signal is waited for while repeating S404. On the other hand, if it is determined that the reel home position signal has been input on the detection of the notched portion M921 shown in FIG. 25 by the home position sensor M671 shown in FIG. 21 (S404, YES), the check pulse value is reset to "0" (S405). Thereafter, an acquisition completion flag indicating that the acquisition of the check pulse value is completed is turned off (S406).

Subsequently, whether a position pulse signal has been input is determined (S407). If no position pulse signal has been input (3407, NO), then whether a home position pulse signal has been input is determined (S411). If no home position pulse signal has been input (S411, NO), S407 is repeated to wait for the position pulse signal. If the position pulse signal has been input (S407, YES), then whether the rotational direction of the reel M3 is positive or negative is determined based on the phase difference pulse signal (S408). If the rotational direction is positive (S408, YES), the check pulse value is counted up by one (S409), and then whether the home position pulse signal has been input is determined (S410). On the other hand, if the rotational direction is not positive (S408, NO), the check pulse value is counted down by one (S410), and then whether the home position pulse signal has been input is determined (S411). When the home position pulse signal is input (S411, YES), the correction pulse value which has been counted up or down is stored along with the reel number (5412).

In the third reel setting process shown in FIG. 59, after the input of the home position pulse signal (S311, YES), the acquisition completion flag is checked and the process is on standby until the check pulse value is obtained. This makes it possible to obtain the check pulse value during the operation of obtaining the correction pulse value. The steps other than this are identical with those of first reel setting process shown in FIG. 51.

When the check pulse value is obtained as above, whether the relation (total sum of the position pulse signals) between the home position of the reel M3 and the home position pulse signal matches the check pulse value, during the operation of the slot machine 10. It is determined that the mechanism operates properly when matched, whereas a malfunction occurs in the mechanism when not matched. As such, malfunction of the reel angle detection mechanism M2 is detected.

Figure 57:
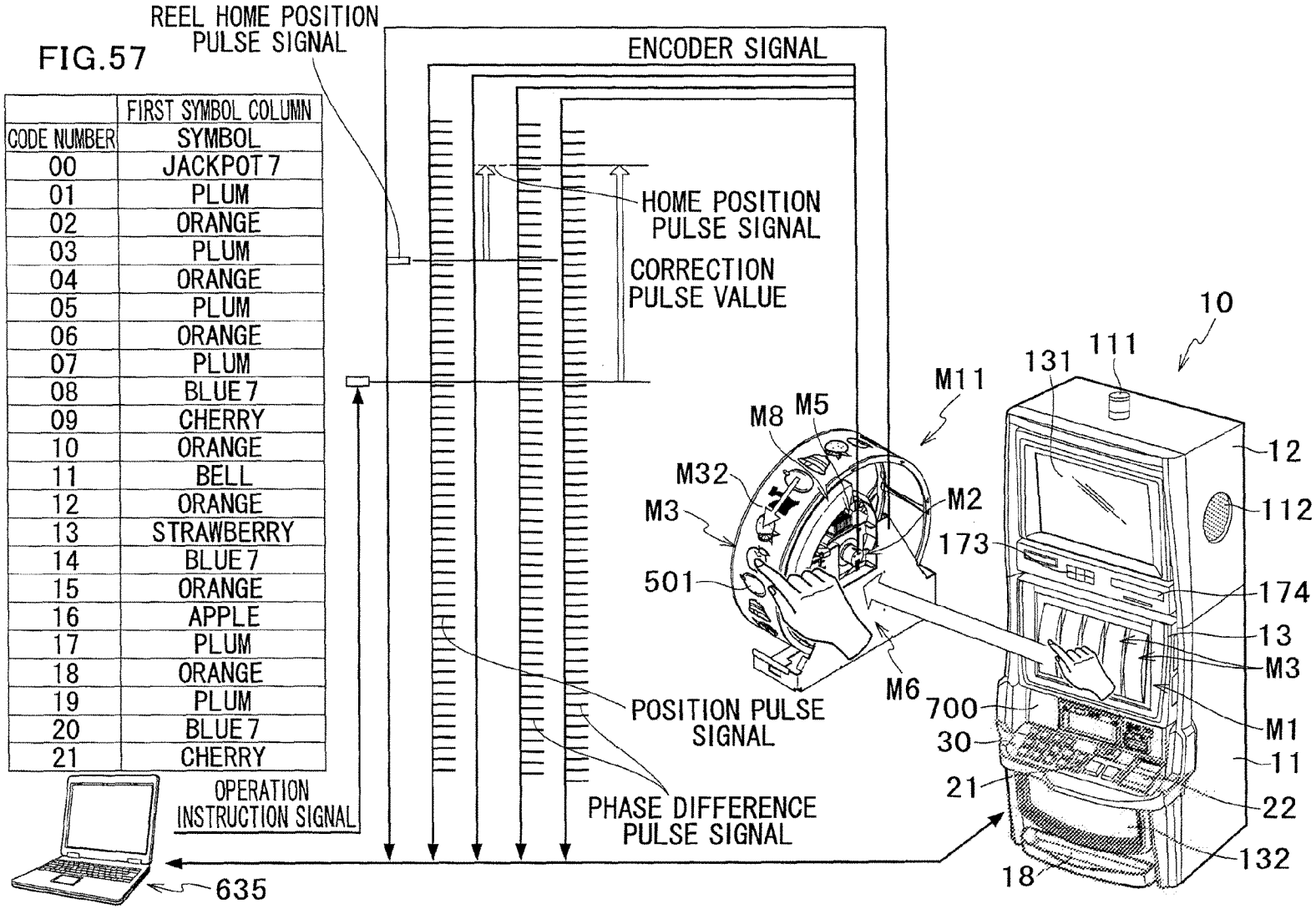
FIG. 57 is an explanatory drawing showing a method of setting a reel of a gaming machine.

As described above, the slot machine 10 of Second Embodiment includes, as shown in FIG. 57, a reel M3 having an outer circumferential surface on which symbols 501 are lined up, a reel driving mechanism M5 which rearranges the symbols 501 by rotating the reel M3, a reel angle detection mechanism M2 which outputs a position pulse signal each time the reel M3 rotates for a predetermined angle and a home position pulse signal for one rotation of the reel M3, a reel setting unit (reel setting section 632 of FIG. 53 or third reel setting process shown in FIG. 59) by which the home position pulse signal and the arrangement positions of the symbols 501 are associated with one another by means of a correction pulse value based on the position pulse signal, a reel drive control unit (main body PCB 110 shown in FIG. 54) which controls the reel driving mechanism M5 so that the symbols 501 are rearranged in a predetermined arrangement based on the home position pulse signal, the correction pulse value, the phase difference pulse signal, and the arrangement positions of the symbols 501, a reel home position detecting mechanism (home position sensor M671 in FIG. 21 and a notched portion M921 in FIG. 25) which detects the home position of the reel M3, and a malfunction detection unit (such as main body PCB 110) which detects a malfunction of the reel angle detection mechanism based on the relation between the home position of the reel M3 and the home position pulse signal. With this, the slot machine 10 can prevent a malfunction that the reel drive control unit cannot rearrange the symbols 501 in a predetermined arrangement from occurring, by detecting a malfunction of the reel angle detection mechanism M2.

(Reel Effect by Backlight Apparatus M7)

The slot machine 10 of First and Second Embodiments is arranged so that the illumination light sources M71 of the backlight apparatus M7 are individually controllable.

More specifically, the slot machine 10 includes a reel M3 having a reel band M32 which is arranged to be able to transmit illumination light and on which symbols 501 are lined up, a reel driving mechanism M5 which rearranges the symbols 501 by rotating the reel M3, a backlight apparatus M7 which emits illumination light from the inner circumference side of the reel M3 toward the reel band M32 to allow the illumination light having passed through the reel band M32 to be visible from the outside, and a backlight control unit (main body PCB 110 of FIG. 54) which controls the emission states (light amount, color, emission interval, emission timings, or the like) of the illumination light emitted from the backlight apparatus M7. The backlight apparatus M7 is provided with a plurality of illumination light sources M71 which are in parallel to the width directions and the longitudinal directions of the reel band M32 and can change the amount of illumination light stepwise, and the backlight control unit is individually controllable the illumination light sources M71.

Since the slot machine 10 can control the emission states of the illumination light at each light source, the effects and the freedom of the effects during the rotation of the reel M3 and the rearrangement of the symbols 501 are enhanced by using the illumination light.

More specifically, the backlight control unit is individually controllable the illumination light source M71 so that the emission states of the illumination light correspond to the rotation of the reel M3. Since the emission states of the illumination light correspond to the rotation of the reel M3, the slot machine 10 can enhance the freedom of the effects during the rotation of the reel M3.

In addition to the above, the backlight control unit controls the illumination light sources M71 to increase or decrease the light amounts stepwise from the inside to the outside of the reel band M32 in the width directions and the longitudinal directions. By this stepwise increase or decrease in the light amounts, the slot machine 10 can produce gradation effects for the symbols 501 and the reel band M32 through which the illumination light passes.

In addition to the above, the backlight control unit controls the emission states of the illumination light sources M71 in accordance with the rotational direction of the reel M3. This makes it possible to produce effects in accordance with the rotational direction of the reel M3.

In addition to the above, the backlight control unit controls the illumination light sources M71 so that the direction of increase or decrease in the light amounts is changed in accordance with the rotational direction of the reel M3. This allows the slot machine 10 to produce an effect in accordance with the rotational direction of the reel M3.

In addition to the above, the backlight control unit controls the illumination light sources M71 so that the speed of increase or decrease in the light amounts is changed in accordance with the rotation speed of the reel M3. This allows the slot machine 10 to produce effects in accordance with the rotation speed of the reel M3.

In addition to the above, the backlight control unit controls the emission states of the illumination light sources in accordance with a combination of the rearranged symbols 501. This allows the slot machine 10 to produce effects in accordance with combinations of rearranged symbols 501.

The control by the backlight control unit is easily realized by storing mode data in a illumination mode setting table shown in FIG. 60. This illumination mode setting table has reel operation fields of "reel positive rotation", "reel negative rotation", "reel rotation speed", "reel rotation stop", "bonus win", "common game win", "lose", "riichi", "common game winning", and "common game losing".

The field "riichi" indicates a state immediately before a winning combination is established by the rearrangement of symbols 501 in a unit game. For example, when symbols 501 are rearranged one by one, the state before the last symbol 501 is rearranged is the state immediately before a winning combination is established.

These reel operation fields are associated with operation fields "gradation", "flickering", "light amount", and "movement". The field "gradation" is set to either Yes (1) or No (0). For example, the "reel positive rotation" is set at Yes (1), whereas the "reel negative rotation" is set at No (0). In this case, the backlight apparatus M7 illuminates the symbols 501 with gradation, when the reel M3 positively rotates. On the other hand, the gradation illumination is not carried out when the reel M3 negatively rotates.

The field "flickering" allows a flickering interval to be set at one of six steps 0 to 5. When the flickering interval is "0", the light is kept turned on without flickering. The flickering interval is the longest when the flickering interval is "1", and the flickering interval is shortened in the order of "2" to "5".

For example, the "reel positive rotation" is set at "3", whereas the "reel negative rotation" is set at "1". In this case, the backlight apparatus M7 flickers with relatively short intervals, when the reel M3 rotates positively. On the other hand, the backlight apparatus M7 flickers with relatively long intervals when the reel M3 rotates negatively.

The "light amount" is set at one of light amount levels in a range of "5" to "16". That is to say, provided that the light amount level is adjustable in 16 steps from "1" indicating virtually no light to "16" indicating the maximum light amount, the light amount level is adjustable within a range of "5" or more. This is for sufficiently illuminating the symbols 501 with a light amount level of "5" or higher. However, the range of the light amount levels may be 0 or higher. For example, "reel positive rotation" is set at "13", whereas "reel negative rotation" is set at "10". In this case, the illumination on the symbols 501 is bright when the reel M3 positively rotates, as compared to the case where the reel M3 negatively rotates.

The "movement" is set at one of three types: Yes (1), No (0), or Interlocking (2). For example, the "reel positive rotation" is set at Yes (1), the "reel negative rotation" is set at No (0), and the "reel rotation speed" is set at Interlocking (2). In this case, when the reel M3 rotates positively, the movement of illumination in an arbitrary direction is interlocked with the rotation speed of the reel, whereas the illumination is fixed when the reel M3 rotates negatively.

(Reel Effect by Effect-Light Emitter M8)

In addition to the above, the slot machine 10 of First and Second Embodiments is arranged to be able to individually control each of the effect light sources M81 of the effect-light emitter M8.

More specifically, the slot machine 10 includes a reel device M1 including a reel M3 having an outer circumferential surface on which symbols 501 are lined up, a reel driving mechanism M5 which rearranges the symbols 501 by rotating the reel M3, a reel device M1 having an effect-light emitter M8 emitting a plurality of sets of effect light to be visible from the outside, and the slot machine 10 further includes a reel effect control unit (main body PCB 110 shown in FIG. 54) which controls the emission states (light amount, color, emission interval, emission timings, or the like) of the illumination light emitted from the reel device M1. The effect-light emitter M8 is disposed along at least the longitudinal directions of the reel band M32 and has a plurality of effect light sources M81 each of which can change the light amount of effect light stepwise, and the reel effect control unit can control each effect light source M81 to change the emission states of the effect light in accordance with the rotation of the reel M3.

Since this allows the slot machine 10 to individually control the emission states of effect light at each light source, the effects and the freedom of the effects during the rotation of the reel M3 and the rearrangement of the symbols 501 are enhanced by the effect light.

In addition to the above, the reel effect control unit controls the emission states of the effect light source M81 in accordance with the rotation of the reel M3. With this, the slot machine 10 can produce an effect in accordance with the rotation of the reel M3.

In addition to the above, the reel effect control unit controls the effect light sources M81 so that the direction of increase or decrease in the light amount is changed in the same or reverse direction as the rotational direction of the reel M3. With this, the slot machine 10 can produce an effect in accordance with the rotation of the reel M3.

In addition to the above, the reel effect control unit controls the effect light sources M81 so that the speed of increase or decrease in the light amount is changed in accordance with the rotation speed of the reel M3. With this, the slot machine 10 can produce an effect in accordance with the rotation speed of the reel M3.

In addition to the above, the reel effect control unit controls the emission states of the effect light sources M81 in accordance with combinations of rearranged symbols 501. With this, the slot machine 10 can produce an effect in accordance with the combinations of rearranged symbols 501.

The above-described control operations by the reel effect control unit are easily realized by using an effect mode setting table which is identical with the illumination mode setting table FIG. 60 except that the field "gradation" is omitted. The remaining fields in the table are identical with the illumination mode setting table shown in FIG. 60.

(Brightness Adjustment of Backlight Apparatus M7)

In addition to the above, the slot machine 10 of First and Second Embodiments is arranged so that the brightness of the illumination light sources M71 of the backlight apparatus M7 is adjustable. Alternatively, the slot machine 10 may be arranged so that the brightness of the effect light sources M81 of the effect-light emitter M8 is adjustable, and this arrangement can be realized by the same method as the brightness adjustment of the backlight apparatus M7.

Figure 61:
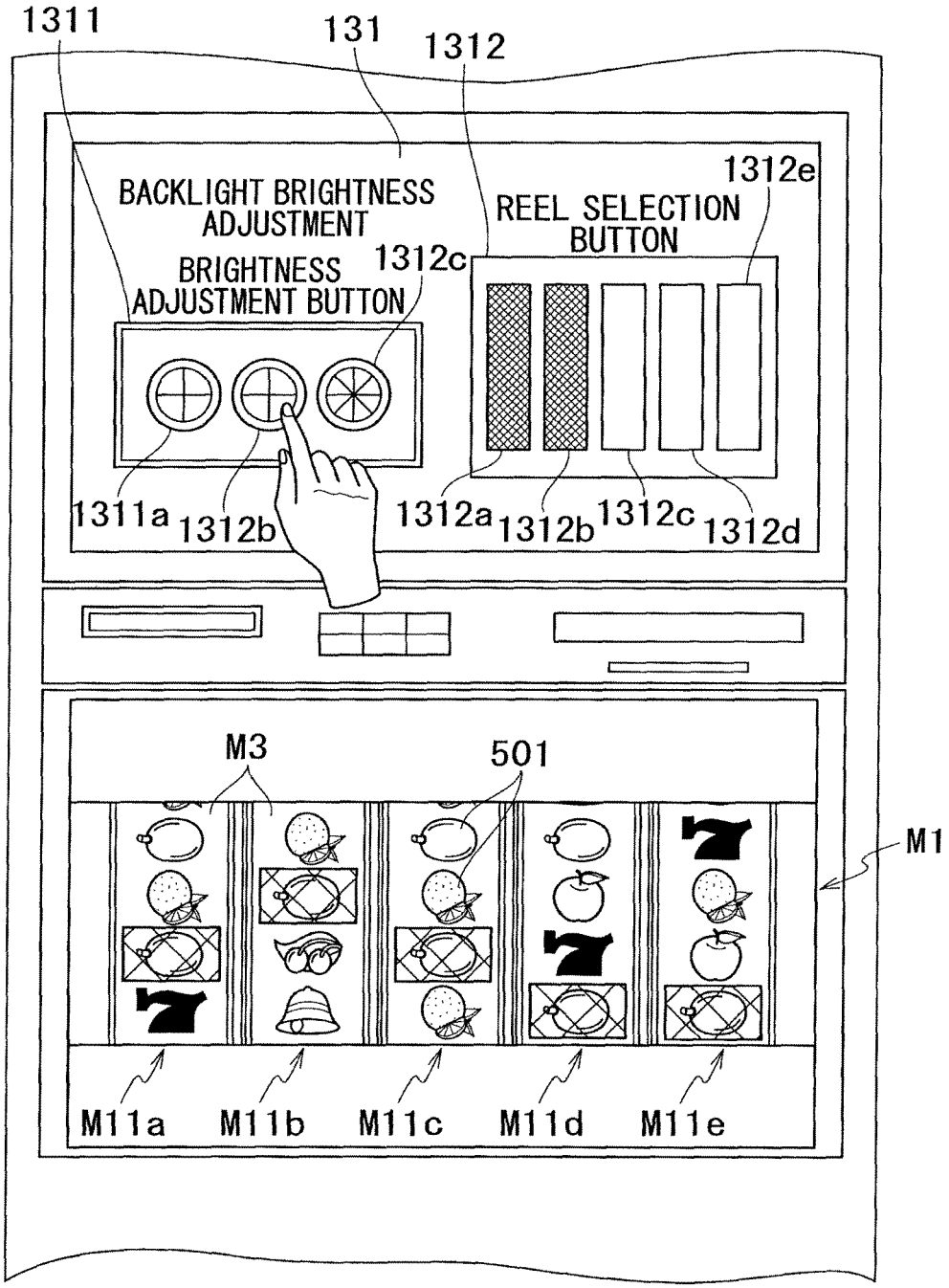
FIG. 61 is an explanatory diagram of backlight brightness adjustment.

More specifically, the slot machine 10 is provided with, as shown in FIG. 61, a touch panel on the upper image display panel 131. The upper image display panel 131 is arranged to be able to display a backlight brightness adjustment screen. This backlight brightness adjustment screen may be displayed by an operation by a player or an administrator, or may be displayed by an operation only by the administrator. An operation executable only by the administrator is realized by using, for example, "AUDIT menu".

The backlight brightness adjustment screen has a brightness adjustment button area 1311 and a reel selection button area 1312. The brightness adjustment button area 1311 has, for example three brightness adjustment buttons 1311*a*, 1311*b*, and 1311*c*. These brightness adjustment buttons 1311*a*, 1311*b*, and 1311*c* allow the brightness to be adjustable in, for example, three steps.

On the other hand, the reel selection button area 1312 includes five reel selection buttons 1312*a* to 1312*e*. These reel selection buttons 1312*a* to 1312*e* allow each of the first to fifth reel units M11*a*-M11*e* to be selectable.

Figure 62:
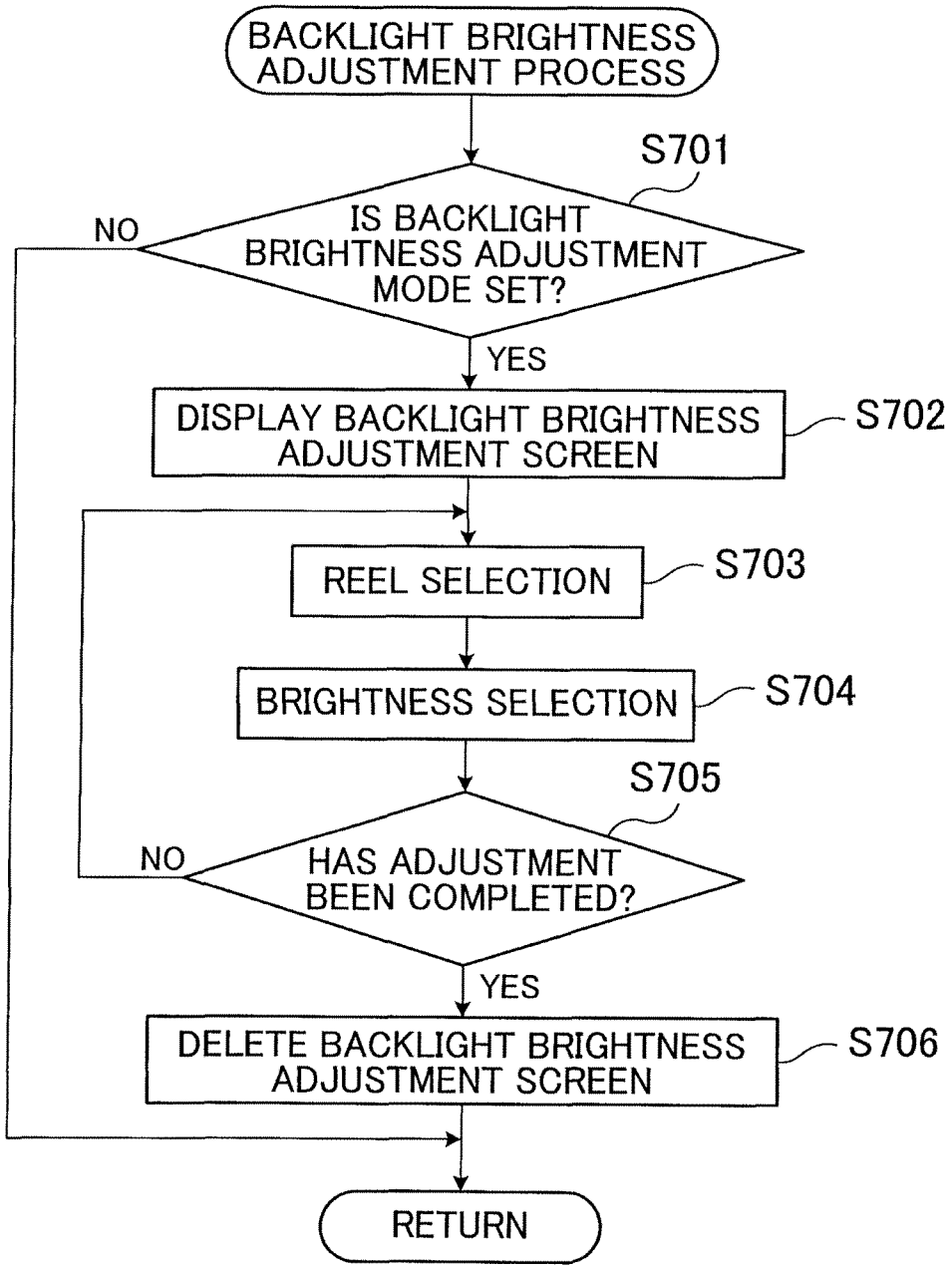
FIG. 62 is a flowchart of a backlight brightness adjustment process.

The brightness adjustment of the backlight apparatus M7 is realized by a backlight brightness adjustment process routine shown in FIG. 62. More specifically, when a game is being executed or stopped, the backlight brightness adjustment process routine is periodically executed as one of various routines. As the backlight brightness adjustment process routine is executed, first, whether a backlight brightness adjustment mode is set is determined (S701). When the backlight brightness adjustment mode is not set (S701, NO), the routine is terminated. On the other hand, when a backlight brightness adjustment button is pressed in a mode selection screen on the upper image display panel 131, it is determined that the backlight brightness adjustment mode is set (S701, YES). Subsequently, in place of the mode selection screen, the backlight brightness adjustment screen is displayed on the upper image display panel 131 (S702).

Thereafter, a reel selection process is executed (3703). As shown in FIG. 61, for example, when one of the reel selection buttons 1312*a* to 1312*e* in the reel selection button area 1312 is pressed, the color of said one of the reel selection buttons 1312*a* to 1312*e* is changed, and it is emphasized that the backlight apparatus M7 of one of the first to fifth reel units M11*a*-M11*e* corresponding to said one of the reel selection buttons 1312*a* to 1312*e* is selected as a target of brightness adjustment. When said one of the reel selection buttons 1312*a* to 1312*e* corresponding to the target of brightness adjustment is pressed again, the color of the button returns to the color before the change to indicate that the corresponding reel unit is no longer the target of brightness adjustment. Repeating such an operation to press a button, one or more reel selection buttons 1312*a* to 1312*e* (first to fifth reel units M11*a*-M11*e*) is selected as a target of brightness adjustment.

Thereafter, when one of the brightness adjustment buttons 1311*a*, 1311*b*, and 1311*c* in the brightness adjustment button area 1311 is pressed, the backlight apparatus M7 of one or more of the first to fifth reel units M11*a*-M11*e* having been selected as a target of brightness adjustment emits illumination light, with the brightness associated with said one of the brightness adjustment buttons 1311*a*, 1311*b*, and 1311*c* (S704). As such, for the backlight apparatus M7 of each of the first to fifth reel units M11*a*-M11*e*, the brightness of illumination light is adjusted at once or one by one, while the operator visually checks the brightness.

Thereafter, whether the adjustment is completed is determined (S705). This determination is carried out by checking whether a pressing operation has not been carried out for a predetermined time or checking whether an unillustrated adjustment completion button is pressed. When not completed (S705, NO), the process is carried out again from 3703. On the other hand, when completed (S705, YES), the backlight brightness adjustment screen is deleted and, for example, various screens such as a mode selection screen and a demo-screen are displayed (S706). The routine is then finished.

(Payline Effect)

Figure 63:
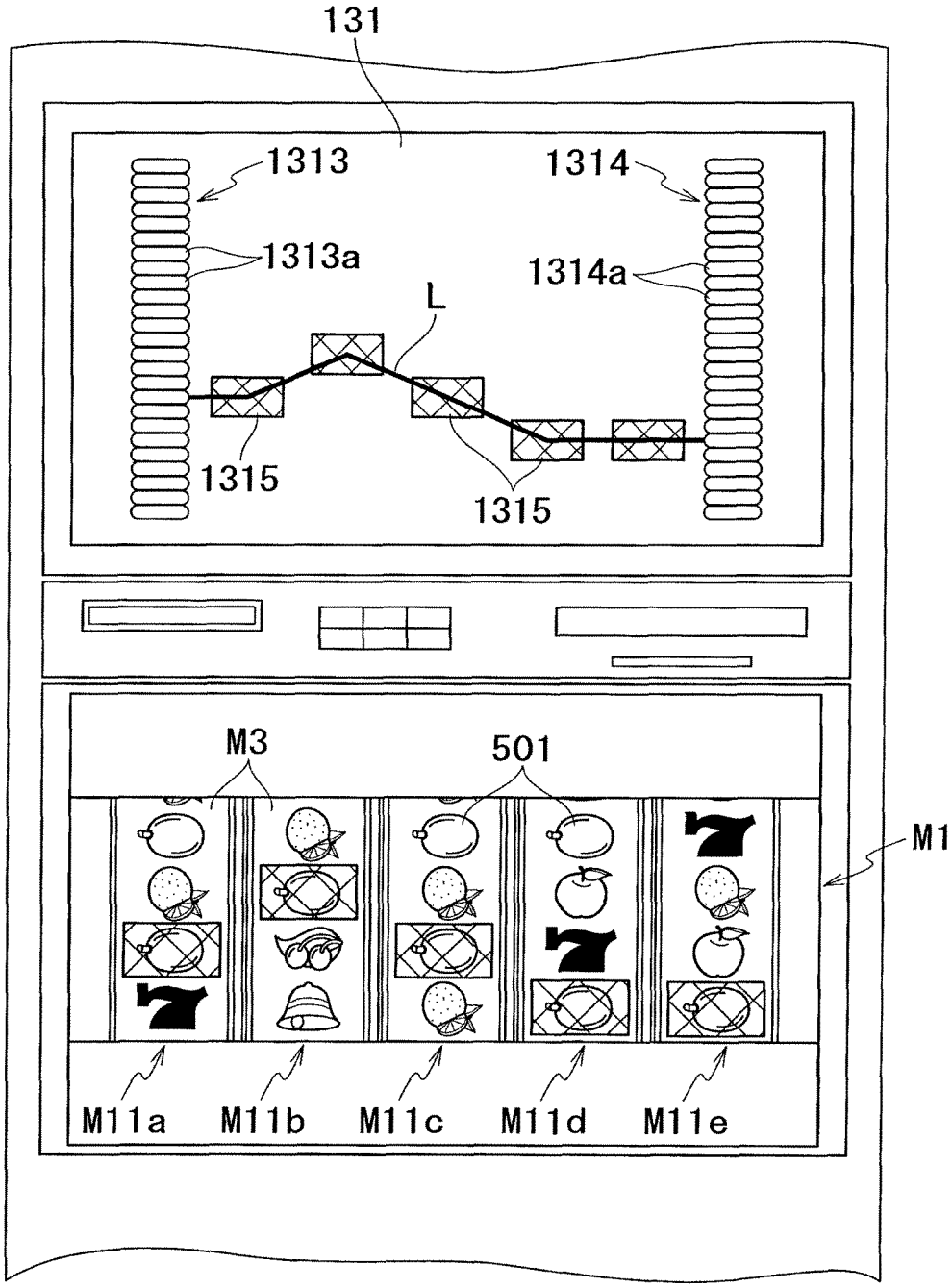
FIG. 63 is an explanatory diagram of payline display.

In addition to the above, the slot machine 10 according to First and Second Embodiments is, as shown in FIG. 63, arranged to be able to display paylines L on the upper image display panel 131. The paylines L are displayed on the upper image display panel 131 when switched to a payline display screen.

The payline display screen is arranged to correspond to the paylines L of the display window 150 provided on the front surface of the reel device M1. More specifically, payline occurrence columns 1313 1314 are symmetrically provided on the left and right. The left payline occurrence column 1313, which is on the left side when viewed from the player, has 25 payline occurrence parts 1313*a*. The right payline occurrence column 1314, which is on the right side when viewed from the player, has 25 payline occurrence parts 1314*a*. A payline L is activated when left and right payline occurrence parts 1313*a* and 1314*a* are connected with each other.

The payline display screen is displayed when a combination of rearranged symbols 501 achieves winning. For example, when winning is achieved by a combination of "PLUM" symbols 501, an winning effect is produced for the "PLUM" symbols 501 of the winning combination by different brightness, color, and flickering pattern from the remaining parts, by the illumination light of the backlight apparatus M7. Linking with the winning effect produced by the backlight apparatus M7, a payline effect is carried out on the payline display screen. The term "link" indicates that a winning effect by the backlight apparatus M7 is associated with a payline effect.

Figure 64:
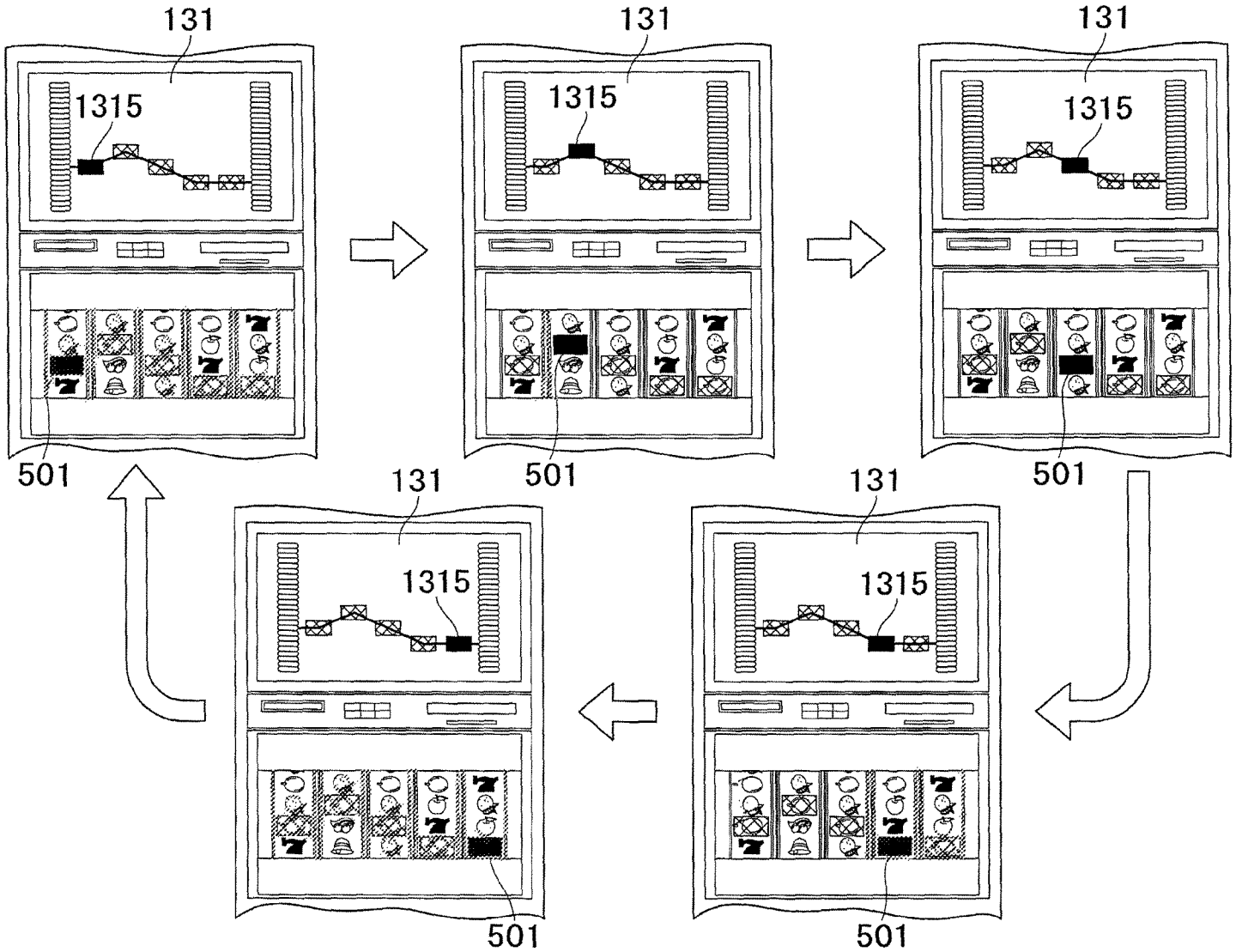
FIG. 64 is an explanatory diagram of payline effect.

More specifically, pseudo winning symbols 1315 are displayed in the same arrangement as symbols forming a winning combination. Thereafter, a payline L is displayed on these pseudo winning symbols. When, for example, as shown in FIG. 64, a winning effect is arranged to emphasize the symbols 501 in order by the backlight apparatus M7, a payline effect arranged to emphasize the pseudo winning symbols 1315 in order at the same timings as the winning effect is carried out.

Third Embodiment

Gaming Machine Overview

Figure 65:
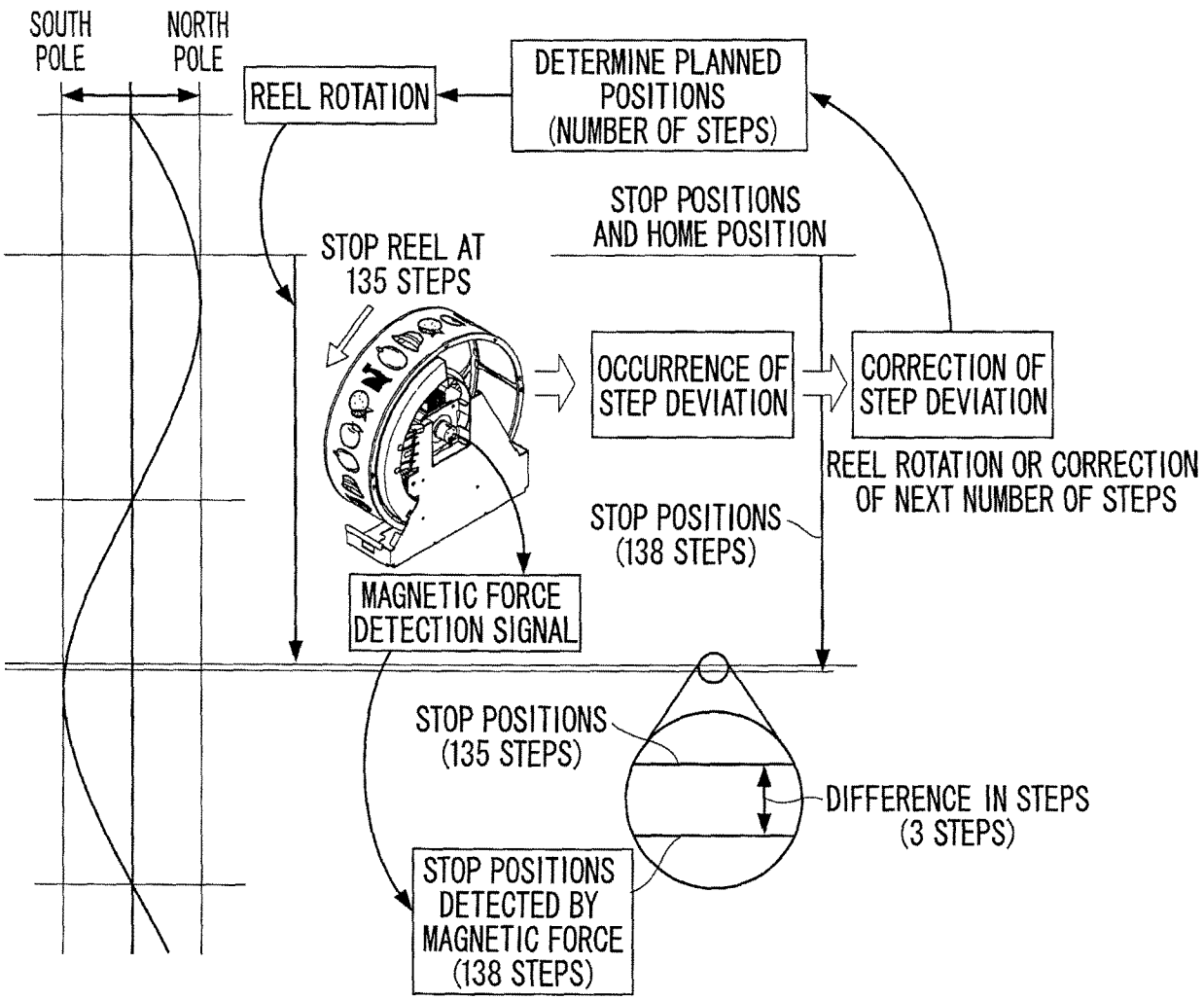
FIG. 65 illustrates the operation of a gaming machine.

As shown in FIG. 65. a gaming machine of Third Embodiment includes a slot machine 10 in which symbol 501 are rearranged by being rotated and then stopped in accordance with the magnetic force of an external magnetic field changing in line with the rotation of the reel M3 and a reel home position. Note that the following descriptions predominantly deal with arrangements different from those described in First Embodiment.

The slot machine 10 has a mechanical reel unit M1. The reel unit M1 has a home position rearrangement function of enabling symbols 501 to be rearranged based on a reel home position signal which is output when the reel M3 is at a predetermined rotational angle and indicates a reel home position, and also has a stop position detection function of detecting the stop positions of the symbols 501 based on the magnetic force of a external magnetic field changing in line with the rotation of the reel M3. In other words, when rearranging the symbols 501 at the planned positions by the home position rearrangement function, the slot machine 10 can check, by the stop position detection function, whether the symbols 501 are precisely rearranged at the planned positions.

It is noted that the term "rearrangement" means that the symbols 501 are rotated and then stopped. In other words, the arrangement of the symbols 501 is dismissed and then the symbols 501 are arranged again. The term "arrangement" means a state in which a player is able to visually recognize the symbols 501.

Figure 67:
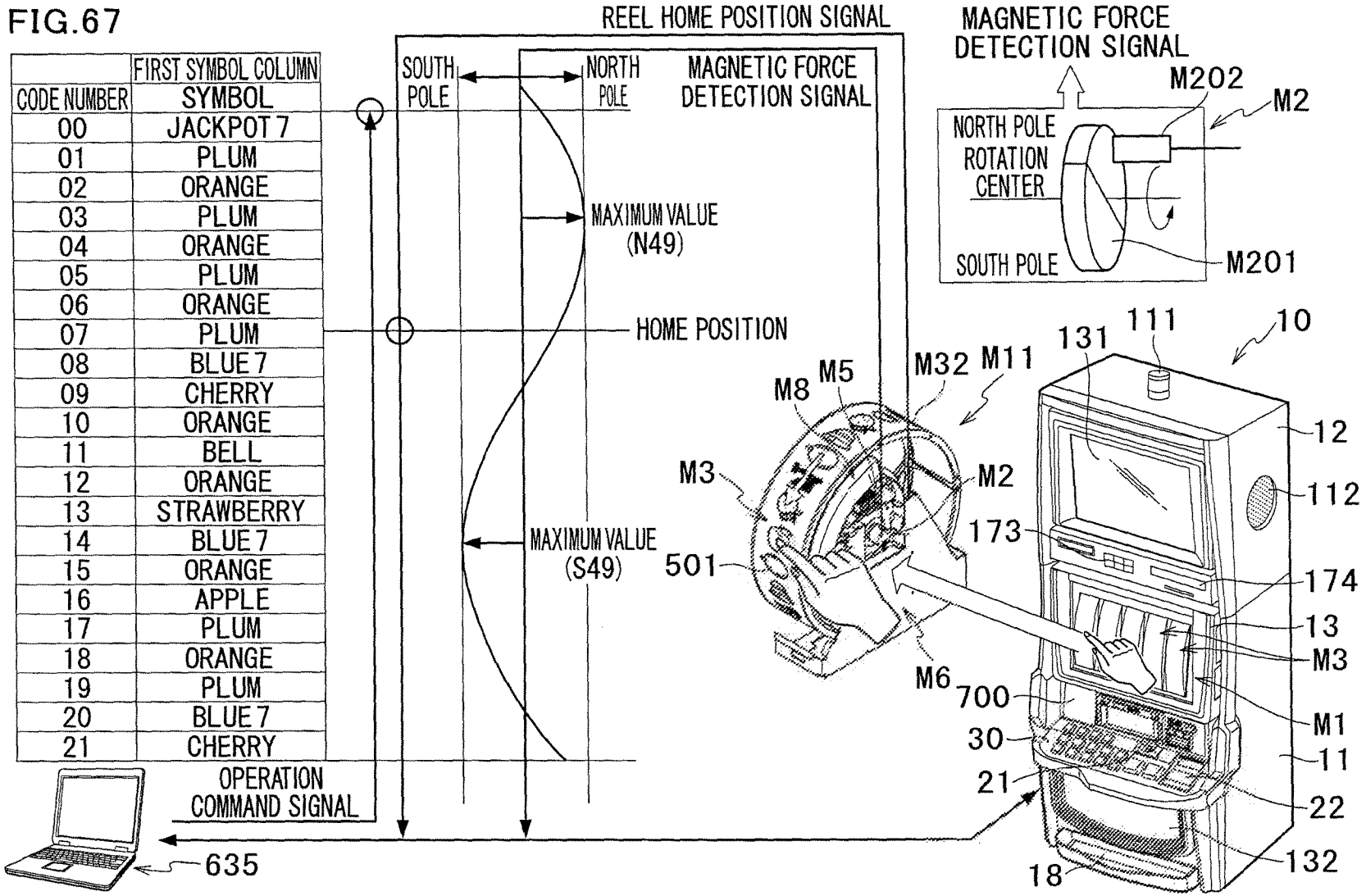
FIG. 67 is an explanatory drawing showing a method of setting a reel of a gaming machine.
Figure 68:
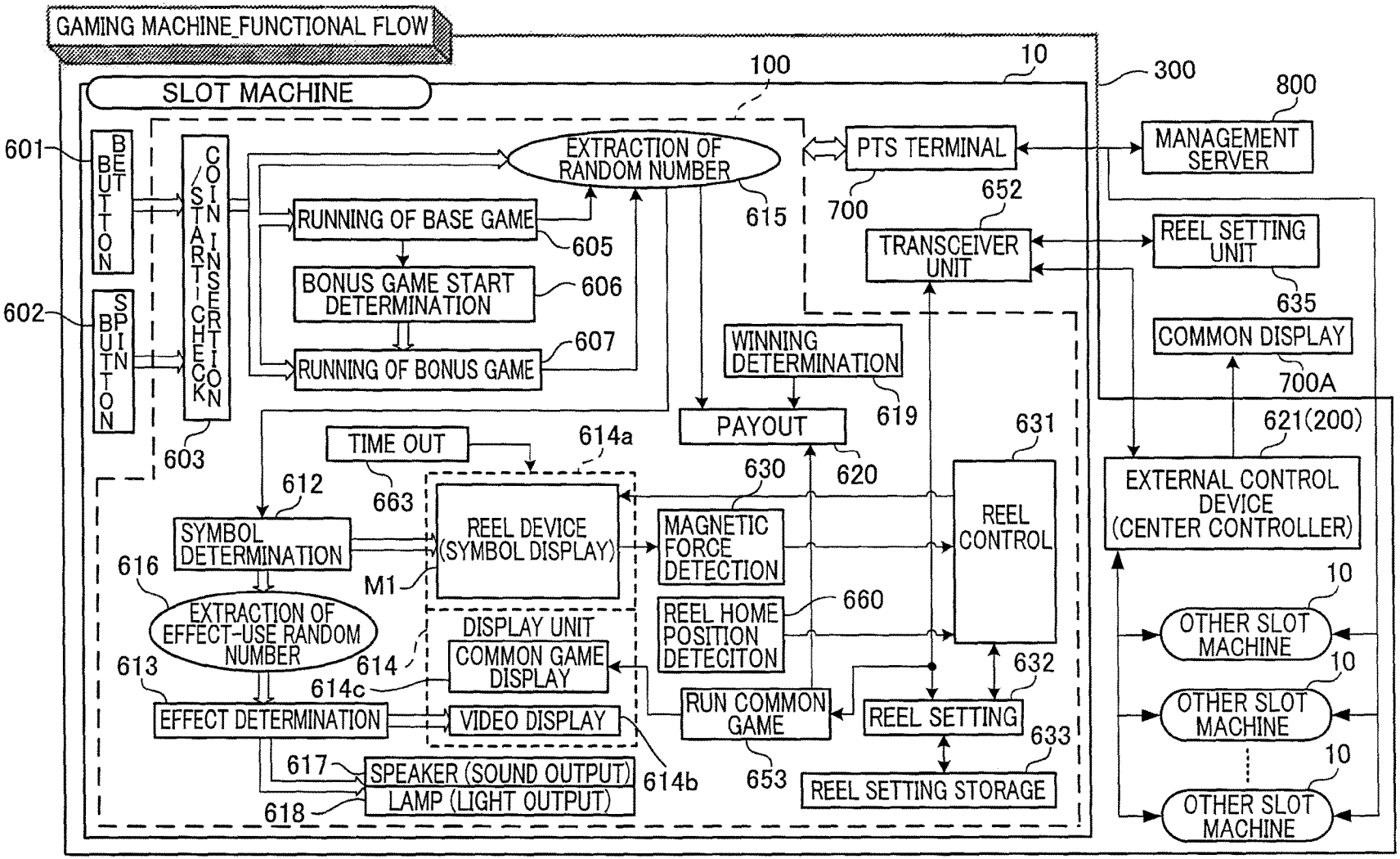
FIG. 68 is an explanatory diagram of a functional flow of the gaming machine.

More specifically, as shown in FIG. 67, the slot machine 10 includes a reel unit M1 having reels M3 and a reel control unit 631 which controls the reel unit M1 and is shown in FIG. 68. The reel unit M1 includes the reels M3 each having an outer circumferential surface on which symbols 501 are lined up, a reel home position detecting mechanism (a reel home position sensor 660 shown in FIG. 68) which detects a reel home position of the reel M3, a reel driving mechanism M5 which rearranges the symbols 501 by rotating the reel M3, a magnet M201 provided in the reel driving mechanism M5 to change an external magnetic field by the rotation of the reel M3, a magnetic force detecting mechanism M202 which outputs magnetic force detection signals in response to the detection of the magnetic force of the external magnetic field, and a reel setting unit (a reel setting table shown in FIG. 66 and a reel setting section 632 shown in FIG. 68) which associates the magnetic force detection signals with the arrangement positions of the symbols 501.

In addition to the above, as shown in FIG. 68, the reel control unit 631 has, as a reel drive control unit, a function of controlling the reel driving mechanism M5 so that the reel M3 is rotated and stopped at a desired rotational angle based on the reel home position, and also has, as a stop position detecting unit, a function of detecting the stop positions of the rearranged symbols 501 based on the magnetic force detection signals output from the magnetic force detecting mechanism in accordance with the rotation of the reel M3 and the magnetic force detection signal associated with the arrangement positions of the symbols 501 by the reel setting unit.

As such, because the magnetic force detection signals obtained by detecting the magnetic force of the external magnetic field changing in accordance with the rotation of the reel M3 are associated with the arrangement positions of the symbols, the slot machine 10 can indirectly detect the arrangement positions of the symbols 501 based on the magnetic force detection signals, even if the arrangement positions of the symbols 501 are not directly detected by a sensor or the like. With this, the stop positions of the rearranged symbols 501 are detected based on the magnetic force detection signals associated with the arrangement positions of the symbols 501 and the magnetic force detection signals which are detected real time by the magnetic force detecting mechanism M202.

In connection with the above, the external magnetic field of the magnet M201 used for detecting the stop positions of the symbols 501 is an analog value which continuously changes between the north pole and the south pole. For this reason, as compared to the conventional mechanical detection, the stop positions are easily and precisely detected on account of high resolution. As a result, it is possible, for example, to control the reel with an effect such that the reel is finely rotated and stopped with a rotational angle of not passing the reel home position of the reel.

In addition to the above, even if the positional relationship between the symbols 501 and the reel home position is not determined in advance, the slot machine 10 can set the positional relationship between the symbols 501 lined up on the reel M3 and the reel home position, based on the magnetic force detection signals and the reel home position. As a result, it is possible to reduce the workload required for lining up the symbols 501 on the outer circumferential surface of the reel M3, as compared to the case where the symbols 501 are lined up while the positions thereof are determined based on a predetermined position (home position) of the reel M3. Except this, the slot machine 10 is identical with the gaming machine described in First Embodiment.

(Functional Flow of Gaming Machine 300: Slot Machine)

The gaming machine 300 having the above structure has slot machines 10 and an external controller 621 (center controller 200) connected to the slot machines 10 so as to allow data communication therebetween. The external controller 621 are connected to the slot machines 10 installed in the hall so that data communication is possible therebetween.

The slot machine 10 has a BET button 601, a spin button 602, and a display 614, and also has a game controller 100 which controls these components. The BET button 601 and the spin button 602 are input devices. The slot machine 10 further has a transceiver unit 652 which allows data communication with the external controller 621.

The BET button 601 has a function to receive a bet amount from a player. The spin button 602 has a function to receive an instruction from a player to start a game such as the base game. The display 614 has a function to display still images such as various symbols 501, numbers, and marks and moving images such as effect images. The display 614 has a symbol display region 614*a*, a video display region 614*b*, and a common game display region 614*c*.

The symbol display region 614*a* has the reel device M1 and displays the symbols 501 of FIG. 67. The video display region 614*b* displays various types of effect image information executed during the game, as moving images or still images. The common game display region 614*c* displays a common game such as a jackpot game.

The game controller 100 includes: a coin insertion/start-check unit 603; a base game running unit 605; a bonus game start determination unit 606; a bonus game running unit 607; a random number extraction unit 615; a symbol determination unit 612; an effect-use random number extraction unit 616; an effect determination unit 613; a speaker unit 617; a lamp unit 618; a winning determination unit 619; and a payout unit 620.

The base game running unit 605 has a function to run a base game when the BET button 601 is pressed. The bonus game start determination unit 606 determines whether to run a bonus game based on the combination of the symbols 501 rearranged in the base game. That is to say, the bonus game start determination unit 606 determines that a bonus game is awarded when the trigger symbols are rearranged in a predetermined condition, and shifts the process to the bonus game running unit 607 so that the bonus game is run from the next unit game.

Note that the "unit game" starts from a time of receiving a bet and includes a series of operations and continues until a win or loss is resulted. For example, a unit game of the base game includes a single bet time to receive a bet, a single game time to rearrange stopped symbols 501, and a single payout time of a payout process to award a payout. The unit game in the base game is referred to as a unit base game.

The bonus game running unit 607 has a function of running the bonus game which repeats a free game for a plurality of times, merely in response to an operation on the spin button 602.

The symbol determination unit 612 has functions of: determining symbols 501 to be rearranged based on a random number given from the random number extraction unit 615; rearranging the determined symbols 501 in the symbol display region 614*a* of the display 614; outputting information on rearrangement of the rearranged symbols 501 to the winning determination unit 619; and outputting an effect designation signal to the effect-use random number extraction unit 616, based on the rearrangement of the symbols 501.

The effect-use random number extraction unit 616 has functions of sampling an effect-use random number when receiving an effect instruction signal from the symbol determination unit 612 and outputting the effect-use random number to the effect determination unit 613. The effect determination unit 613 has functions of: determining an effect by using the effect-use random number; outputting video information on the determined effect in the video display region 614*b* of the display 614; and outputting audio and illumination information on the determined effect to the speaker unit 617 and the lamp unit 618.

The winning determination unit 619 has functions of determining whether a winning is achieved when rearrangement information of the symbols 501 rearranged on the display 614, calculating a payout amount based on a winning combination when it is determined that a winning is achieved, and outputting a payout signal based on the payout amount to the payout unit 620. The payout unit 620 has a function of paying out game values to the player in the form of coins, medals, and credits. The payout unit 620 has another function of adding credit data, which corresponds to the credits paid out, to credit data which is stored in an IC card 500 inserted into a later-descried PTS terminal 700.

In addition to the above, the game controller 100 includes an unillustrated storage unit which stores various types of bet amount data. The storage unit is a storage device which stores data in a rewritable manner, such as a hard disc and a memory.

The game controller 100 further has a common game running unit 653. The common game running unit 653 has functions of: outputting bet amount information to the external controller 621 for each unit base game, the bet amount information being based on a bet amount placed as a bet on a base game; running a common game in response to a game start command from the external controller 621; and accepting a bet input through the bet button unit 601 when the bet input corresponds to common game bet amount data indicating a bet amount bettable on the common game.

In addition to the above, the game controller 100 is connected to the PTS terminal 700. This PTS terminal 700 is a unit in which an LCD 719, microphones 704 and 705, and human body detecting cameras 712 and 713 are integrated, and has a function to, for example, produce an effect of a game by exchanging data with the game controller 100. In particular, the PTS terminal 700 has a card insertion slot 706 to receive an IC card 500. With this, a player can operate the slot machine 10 with the credits on an IC card 500, by inserting the IC card 500 into the card insertion slot 706. The mechanical structure of the PTS terminal 700 will be detailed later.

In addition to the above, the game controller 100 updates the credits displayed on the display 614 when receiving credit data from the PTS terminal 700. Furthermore, the game controller 100 outputs settled credit data to the PTS terminal 700 when the game is settled.

The PTS terminal 700 of each of the slot machines 10 constituting the gaming machine 300 is connected in communication with a management server 800, which performs central management of image downloading, IC cards 500, and credits.

In addition to the above, the slot machine 10 is connectable to a reel setting unit 635 via a transceiver unit 652. The reel setting unit 635 has a function to operate as an external operation unit which inputs an operation command in response to an external operation and outputs an operation command signal. The operation command signal is a signal which triggers the detected magnetic force to be stored in a reel setting table shown in FIG. 66. With this, the relationship between the detected magnetic force and the symbols 501 is determined as the operator issues an instruction to output the operation command signal while a predetermined symbol 501 is displayed at a predetermined position. For example, if it has been determined in advance that an operation command is issued when "JACKPOT7" stops at a predetermined display position, an operation command signal is output in the arrangement area 5011 of the "JACKPOT7" to indicate that the detected magnetic forces NU27 to NU35 correspond to the arrangement area 5011 of the "JACKPOT7".

The reel setting unit 635 may be a dedicated setting unit or a personal computer shown in FIG. 67. For example, when the reel setting unit 635 is a personal computer, an operation command is input and an operation command signal is output at a timing of an operation of a specific key such as an enter key. As such, an operator who sets the reel device M1 can output the operation command signal by pressing a key, while checking the operating procedure displayed on the display of the personal computer.

Alternatively, the reel setting unit 635 may be a reel setting accepting unit such as an USB memory detachable to the transceiver unit 652 and an operation button such as the BET button 601 of the slot machine 10. In this case, the slot machine 10 starts to function as a part of the reel setting unit 635 when the reel setting accepting unit is connected to the transceiver unit 652. An operator who sets the reel device M1 can output an operation command signal by pressing an operation button, while checking the operation procedure displayed in, for example, the video display region 614*b* of the display 614 of the slot machine 10.

In addition to the above, the slot machine 10 includes a reel control unit 631, a reel setting section 632, a reel setting storage unit 633, and a magnetic force detection unit 630 (magnetic force detecting mechanism). The magnetic force detection unit 630 has a function of outputting the magnetic force detection signals by detecting the magnetic forces of the external magnetic field. The magnetic force detection unit 630 is, as shown in FIG. 66, arranged to output a plurality of detected magnetic forces (magnetic force detection signals) for the arrangement area 5011 of the symbol 501. In other words, the magnetic force detection unit 630 outputs plural magnetic force detection signals for the arrangement area 5011 of the symbol 501 when the reel M3 rotates.

The "arrangement areas 5011" are areas defined along the lining-up directions on the reel band M32, and a single symbol 501 is arranged in each area. For example, when there are 22 symbols 501, the reel band M32 is divided into 22 arrangement areas 5011. Therefore, with a single arrangement area 5011, there are a plurality of detected magnetic forces in the direction of the rotation of the symbol 501 (reel M3). For example, in the arrangement area 5011 where the "ORANGE" symbol 501 is provided, nine detected magnetic forces from the detected magnetic force ND18 to the detected magnetic force ND10 are associated along the rotational direction. As a result, the position detection by each magnetic force detection signal (detected magnetic force) is possible at plural positions in the rotational direction of the arrangement area 5011 of the symbol 501, and hence even a small deviation of the symbol 501 in the arrangement area 5011 is detectable and correctable.

The reel setting storage unit 633 stores various types of data required for the reel setting, such as the detected magnetic forces in the magnetic force detection signals which are successively detected in accordance with the rotation of the reel M3. For example, the reel setting storage unit 633 stores data in the data storage format of a reel setting table shown in FIG. 66.

The reel control unit 631 has a function of controlling the reel unit M1 so that the symbols 501 are rearranged in a predetermined arrangement based on the magnetic force detection signals and the arrangement positions of the symbols 501. Furthermore, the reel control unit 631 has a function (i.e., a reel drive control unit) of controlling the reel driving mechanism M5 so that the reel M3 is rotated and stopped at a desired rotational angle based on the reel home position.

The reel control unit 631 is connected to the reel home position sensor 660 which detects the reel home position of the reel M3. The reel control unit 631 has a function (i.e., stop position detection unit) of detecting the stop positions of the rearranged symbols 501, based on the magnetic force detection signals (detected magnetic forces) output from the magnetic force detection unit 630 in accordance with the rotation of the reel M3 and the magnetic force detection signals (detected magnetic forces) associated with the arrangement positions of the symbol 501 by the reel setting storage unit 633.

The reel setting section 632 has a function of associating the magnetic force detection signals with the arrangement positions of the symbol 501. More specifically, the reel setting section 632 has a function to store, at a timing to output the operation command signal, the detected magnetic force indicated by the magnetic force detection signal in the reel setting table, so as to associate the detected magnetic forces with the arrangement areas 5011 of the symbols 501. With this, in the slot machine 10, since the operation command signal is output in response to an external operation, the operation to arrange a predetermined symbol 501 on the reel M3 specified by the detected magnetic force only requires the operator to operate the reel setting unit 635 when the symbols are in a predetermined arrangement, while visually checking the arrangement of the symbols 501. As such, the reel setting section 632 makes it possible to easily start the operation to set the positional relation between the symbols 501 and the reel M3, by an operation of the reel setting unit 635.

In addition to the above, the reel control unit 631 has a function of calculating, based on the reel home position, a rotational angle (the number of steps of the reel motor M51) as the reel planned position for rearranging the symbols 501 determined by the symbol determining unit 612, and also has and a reel drive function of rotating and stopping the reel M3 at the calculated rotational angle. The reel control unit 631 further has a function (difference detection unit) of detecting the difference between the stop positions (reel planned position) of the symbols 501 when the reel M3 is stopped at the rotational angle based on the reel home position and the stop positions (reel stop position) of the symbols 501 detected by the function as the stop position detection unit, and also has a function (rotational angle correction unit) of rotating and stopping the reel M3 so that the reel M3 is at a rotational angle with the difference being corrected.

With this arrangement, each time the reel M3 stops, the difference between the reel planned position based on the reel home position and the reel stop position based on the magnetic force detection signals is detected and the rotational angle of the reel M3 is adjusted to cancel the difference. In this regard, when the positional relationship between the symbols 501 and the reel home position is changed for some reason, it has conventionally been impossible to correct this change in the positional relationship until the reel home position of the reel M3 is detected. According to the arrangement above, each time the reel M3 stops or when the reel stops under a predetermined condition, it is possible to carry out the reel control with an effect, for example, such that the reel is finely rotated and stopped with a rotational angle of not passing the reel home position.

(Reel Unit M1: Reel Driving Mechanism M5 and Reel Angle Detection Mechanism M2)

Figure 69:
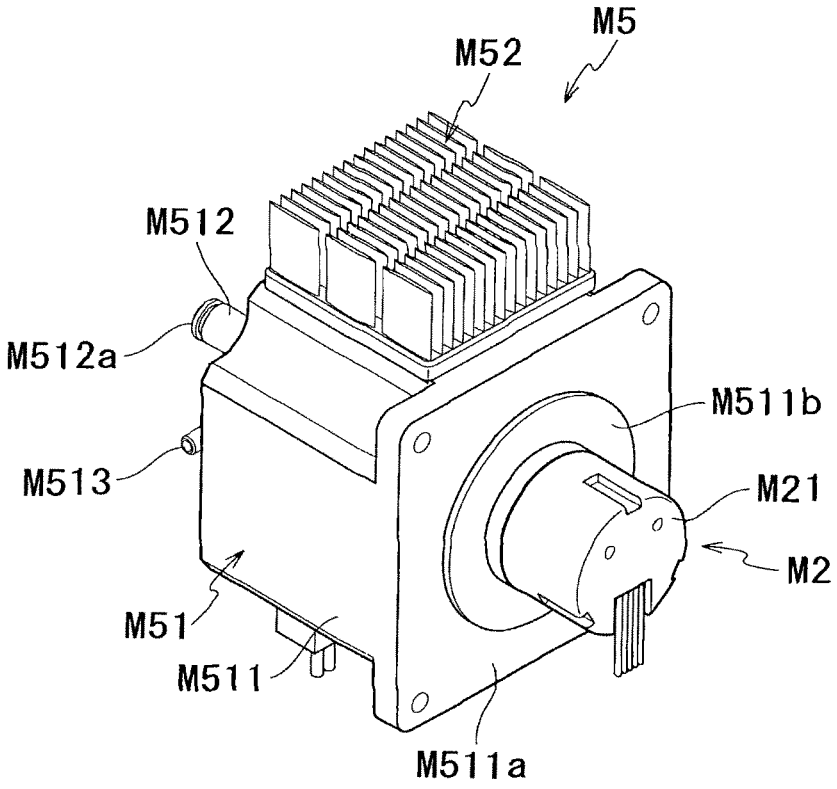
FIG. 69 is a perspective view of a blade mechanism and a driving force transfer mechanism.

As shown in FIG. 69, the encoder unit M21 is a part of the reel angle detection mechanism M2. The encoder unit M21 has an unillustrated reel-interlocked shaft connected to the rotating shaft M512 to be coaxial with the reel M3 and a signal output unit which magnetically detects the rotation of the reel-interlocked shaft so as to output a magnetic force detection signal, a position pulse signal, the home position pulse signal, and a phase difference pulse signal. More specifically, the encoder unit M21 has, as shown in FIG. 67, a magnet M201 which is provided on the reel-interlocked shaft to change the external magnetic field in accordance with the reel M3 and, as a part of the signal output unit, a magnetic force detecting mechanism M202 which detects the magnetic force of the external magnetic field so as to output the magnetic force detection signals.

(Electrical Structure of Slot Machine: Reel Device M1)

Figure 70:
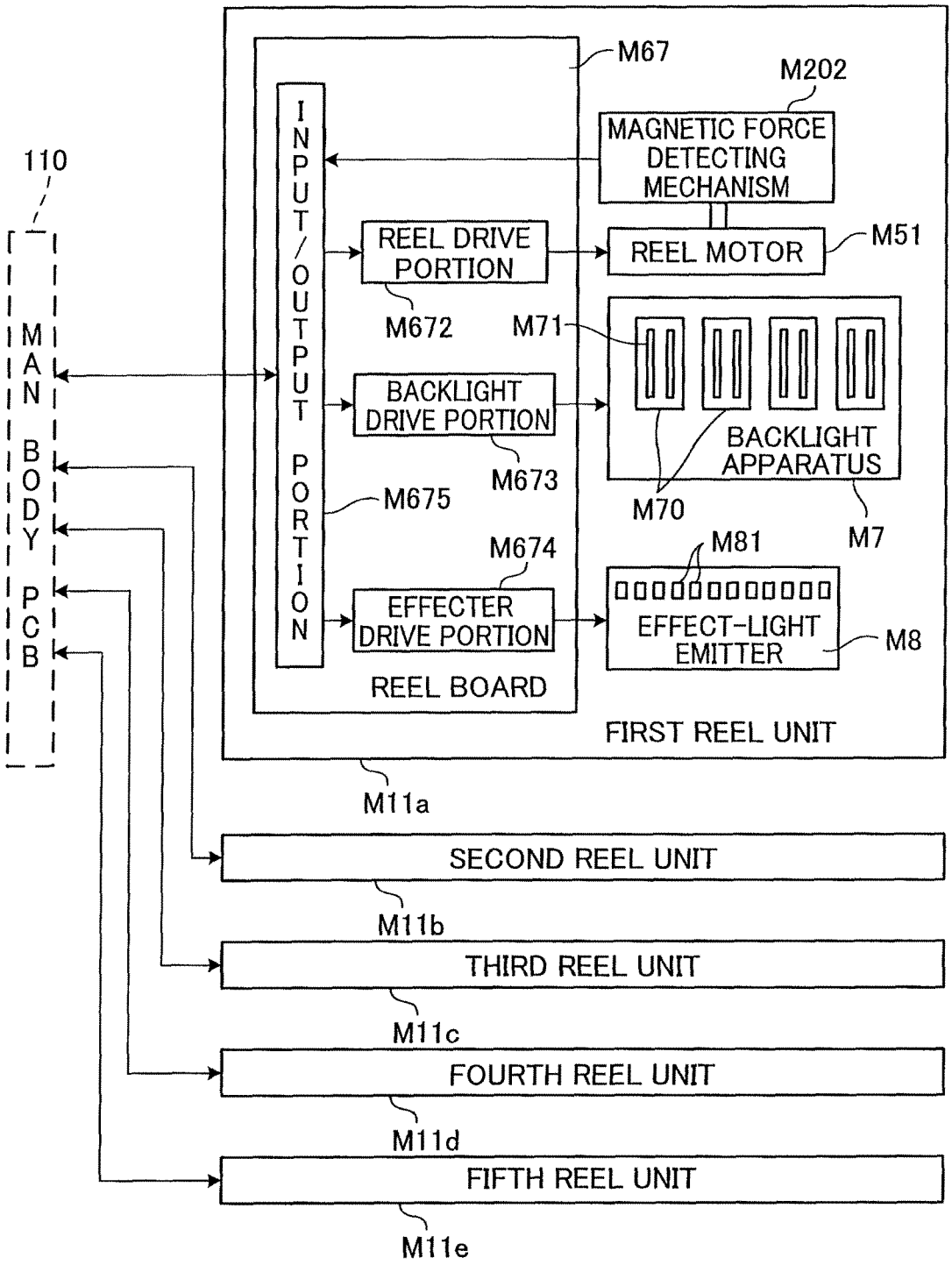
FIG. 70 is an electrical block diagram of an IC card.

As shown in FIG. 70, each of the first to fifth reel units M11*a* to M11*e* has a reel board M67. The reel board M67 includes an input/output portion M675 connected to the main body PCB 110 to be able to exchange data with the main body PCB 110, a reel drive portion M672 connected to the input/output portion M675, a backlight drive portion M673, and an effecter drive portion M674.

The input/output portion M675 is connected to a magnetic force detecting mechanism M202. The magnetic force detecting mechanism M202 includes a magnetic force sensor which outputs, in accordance with a magnetic force, a magnetic force detection signal indicating an output intensity and a sensor fixing mechanism which fixes this magnetic force sensor at a predetermined position. The magnetic force detecting mechanism M202 is connected to the rotation axis of the reel motor M51, and outputs a magnetic force detection signal on detection of a magnetic force of an external magnetic field generated by a magnet M201 of FIG. 67 which rotates in accordance with the rotation of the reel M3.

(Reel Setting Table)

Figure 71:
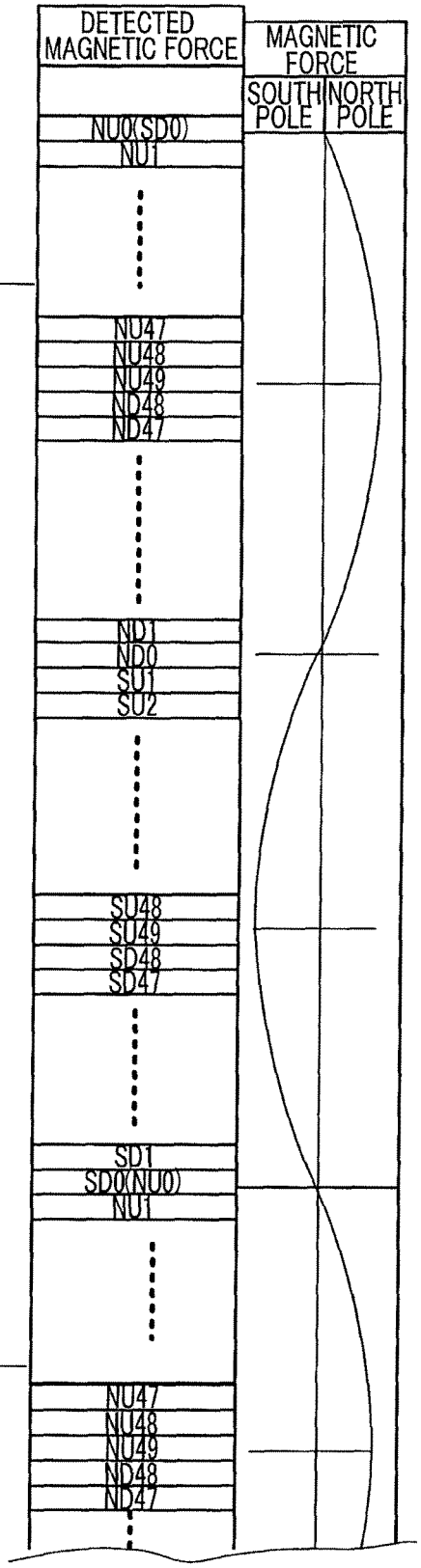
FIG. 71 shows the relationship between the reel setting table and the detected magnetic forces.

FIG. 71 illustrates the relationship between a reel setting table and magnetic force detection signals when a symbol column is associated with detected magnetic forces. The reel setting table has a code number field, a symbol array field, and a detected magnetic force field. There are five types of reel setting tables for the first to fifth symbol columns, respectively. FIG. 71 shows the reel setting table for the first symbol column.

The reel setting table for the first symbol column stores the arrangement position of the symbol 501 in association with plural sets of detected magnetic force data of the magnetic force detection signals which vary in the arrangement area 5011 of the symbol 501 in the rotational direction of the reel M3 (i.e., the rotational movement direction of the symbol 501). More specifically, when the resolution is arranged so that 200 detected magnetic forces are obtained during one rotation of the reel M3, the number of detected magnetic forces associated with an arrangement area 5011 corresponds to the occupancy rate of that arrangement area 5011 with respect to the total length of the reel M3 in the rotational movement direction.

For example, when 22 symbols 501 are evenly provided as a symbol column, nine or ten detected magnetic forces are associated with each arrangement area 5011. Therefore, in the arrangement area 5011 of the "JACKPOT7", nine detected magnetic forces from the detected magnetic force NU27 to the detected magnetic force NU35 are stored. With this, the slot machine 10 can detect a small positional deviation in the arrangement area 5011 when a desired symbol 501 such as "JACKPOT7" is stopped at a predetermined position by the detected magnetic forces, by using the detected magnetic force data of the magnetic force detection signals output in accordance with the rotation of the reel M3 and the detected magnetic force data in the reel setting table.

While the present embodiment deals with the case where 22 symbols 501 are lined up on the reel band M32, the disclosure is not limited to this arrangement. For example, a plurality of, e.g. eleven symbols 501 are lined up on the reel band M32. Furthermore, while in the present embodiment the arrangement areas 5011 in which the symbols 501 are displayed are evenly provided, the arrangement areas may be unevenly provided. In this case, the number of detected magnetic forces to be stored corresponds to the occupancy rate of the arrangement area 5011 with respect to the total length of the reel M32. Furthermore, while the present embodiment deals with a case where 200 detected magnetic forces are output during one rotation of the reel M3, the number of detected magnetic forces may exceed the number of lined-up symbols 501.

(Basic Game Process)

Figure 72:
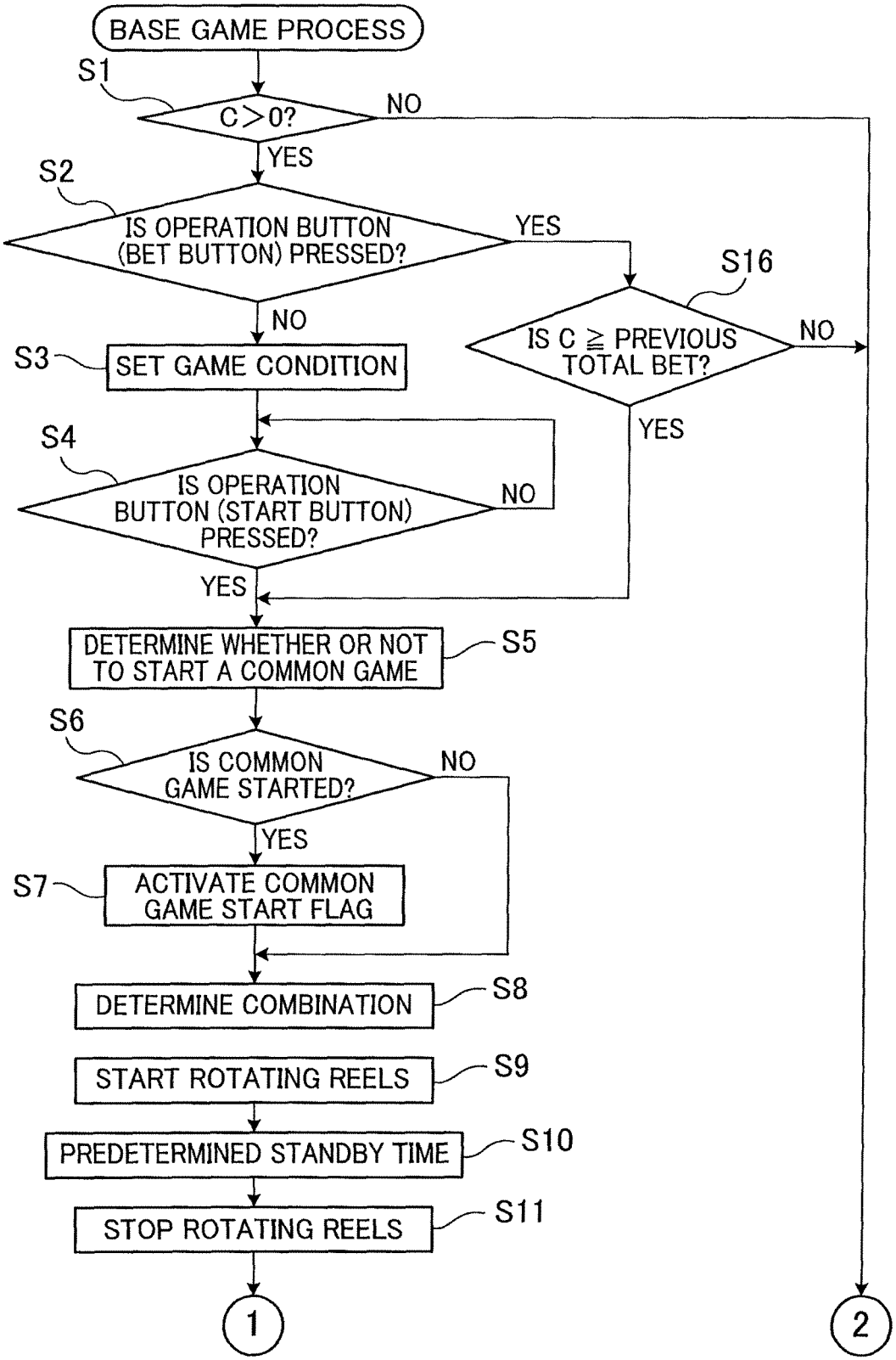
FIG. 72 is a flowchart showing another part of a base game process.
Figure 73:
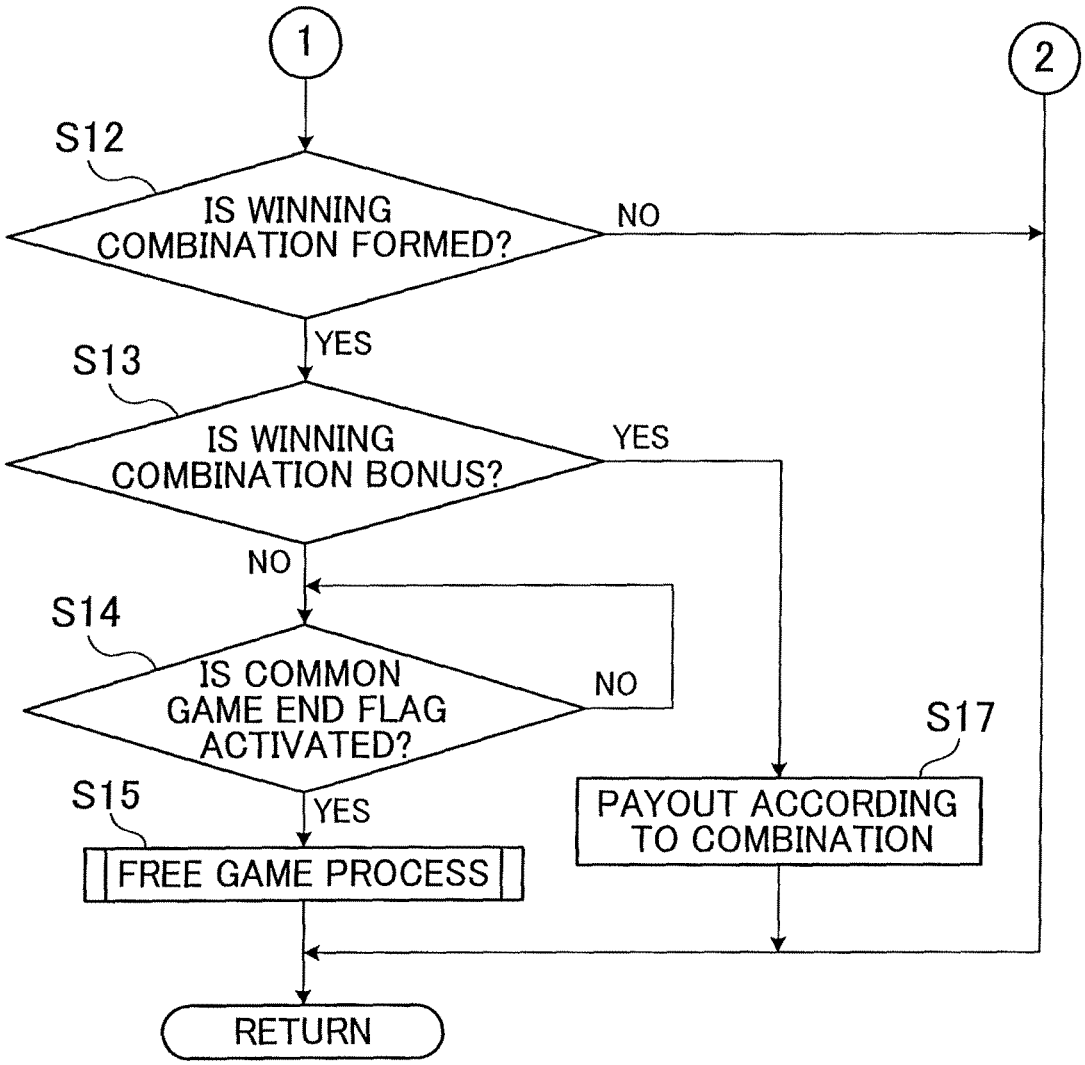
FIG. 73 is a flowchart showing another part of a base game process.

FIGS. 72 and 73 are flowcharts showing a process carried out by the main CPU 241 of the slot machine 10 during a base game of the slot machine 10. A unit game includes a routine shown in FIGS. 72 and 73. Note that the slot machine 10 is booted in advance, and a variable used in the CPU 241 on the game controller 1 side is initialized at a predetermined value. Accordingly, the slot machine 10 is constantly operated.

First, it is determined if there is a remaining credit, i.e., the remaining number of coins having been inserted by the player (S1). Specifically, a credit amount C stored in the RAM 243 is read, and a process according to the read credit amount C is carried out. When the credit amount C is zero (S1, NO), the routine ends without any operation of a process since a game cannot be started. Meanwhile, when the credit amount C is equal to or more than one (S1, Yes), it is determined that there is at least one credit remaining and the process moves to S2.

In S2, it is determined whether or not the operation button 11 (bet button) is pressed (S2). When the operation button 11 (bet button) is not pressed for a predetermined time (S2, NO), a game condition is set (S3). Specifically, the number of coins to be bet on the payline in the game is determined according to the operation of the operation button 11 (bet button). During this operation, an operation signal sent upon an operation of the operation button 11 is received. According to the number of times that the operation signal is received, the bet on the payline is stored in a predetermined memory area of the RAM 243. Then, the credit amount C written into the predetermined memory area of the RAM 243 is read. A total bet where the above bet is added is subtracted from the read credit C. The resulting number is stored in the predetermined memory area of the RAM 243.

Afterwards, it is determined whether or not an operation button 11 (start button) is pressed (S4). When the operation button 11 (start button) is not pressed (S4, NO), S4 is repeated until the bet button 11 is pressed. When the operation button 11 (start button) is pressed (S4, YES), it is determined whether or not to start a common game (S5).

On the other hand, when the operation button 11 (bet button) is pressed in S2 (S2, YES), it is determined whether or not a value of the credit amount C is equal to or more than the value of the total bet in the previous game. In other words, it is determined whether or not it is possible to start a game with the operation button 11 (bet button) being pressed. Specifically, pressing of the operation button 11 (bet button) causes reading out of a bet on the payline in the previous game and a credit amount C written in a predetermined memory area of the RAM 243. According to a relation of the read credit amount C to the bet, a process branches as follows depending on whether the value of the credit amount C is equal to or more than the value of total bet in the previous game. When it is determined that the value of the credit amount C is less than the value of the total bet of the previous game (S16, NO), the routine ends without any operation of a process since a game cannot be started.

Meanwhile, when it is determined that the value of the credit amount C is equal to or more than the value of the total bet of the previous game (S16, YES), the value of the total bet of the previous game is subtracted from the value of the credit C. Then, the resulting value is stored in a predetermined memory area of the RAM 243. Afterwards, it is determined whether or not to start a common game (S5).

When it is determined to start a common game (S6, YES), a common game start flag is activated (S7). Specifically, data showing that the game start flag activated is written into a storage area of a common game start flag of the RAM 243. Meanwhile, when it is determined not to start a common game (S6, NO), a combination determination process is carried out (S8).

In the combination determination process, a combination of symbols to be stopped on the payline is determined first. Specifically, a command to generate a random number is sent to the random number generation circuit. Then, a random number within a predetermined range which is generated by the random number generation circuit, is sampled. The sampled random number is stored in a predetermined memory area of the RAM 243. Although a random number is generated in the random number generation circuit disposed outside the main CPU 241 in the present embodiment, a random number may be generated through an arithmetic process by the main CPU 241, without the random number generating circuit.

Afterwards, a winning combination table for awarding a payout and a random number table stored in the ROM 242 are read. Those read winning combination table and random number table are stored in a predetermined memory area of the RAM 243. Still-displaying of symbols is controlled for each reel in accordance with the random number table.

Then, the random number table and the winning combination table stored in the predetermined memory area of the RAM 243 are read. Then, the random number written into the predetermined memory area of the RAM 243 is used as a parameter to refer to the random number table. A combination of symbols to be stopped on the payline is then determined.

When a winning combination is determined, the winning combination table is stored into a predetermined memory area of the RAM 243. The random number and the winning combination table written in the predetermined memory area of the RAM 243 are read. In accordance with the random number and the winning combination table, a combination of symbols to be stopped and still-displayed are determined. During this process, the main CPU 241 reads out a symbol arrangement table stored from the ROM 242 and stores the table in a predetermined memory area of the RAM 243. The table is then used as a reference. The determined stop symbol data is stored in a predetermined memory area of the RAM 243. Alternatively, symbols to be stopped may be determined for each reel by using the random number table.

When a combination of symbols to be stopped on the payline is determined, it is determined whether or not the combination is a winning combination. When the combination of symbols to be stopped on the payline is a winning combination, a flag which indicates that a payout corresponding to the type of the winning combination will be awarded, is activated to generate the payout corresponding to the combination of symbols on the payline forming the determined winning combination. The activated flag indicating that a payout will be awarded, is stored in a predetermined memory area of the RAM 243. To the contrary, when a combination of symbols to be stopped on the payline is another combination, that is, a losing combination, the flag indicating that a payout will be awarded is not activated.

After the combination determining process above, the reels 30A, 30B, 30C, 30D, and 30E are rotated so that a plurality of symbol 301 are moved on a plurality of display windows 7A to 7E (S9). Thereafter, the process is on standby until a predetermined time elapses (S10). Then the rotation of the reels 30A, 30B, 30C, 30D, and 30E is automatically stopped (S11). These steps S9 and S10 are executed in a reel rotation stop process shown in FIG. 75. Details of this will be given later.

Then, it is determined whether or not a winning combination is formed through the combination determination process in S8 (S12). Specifically, this is done based on a status of the flag stored in the predetermined memory area of the RAM 243, which flag indicates a prize according to a combination of symbols on the payline is awarded. When the flag is not activated (S12, NO), it is determined that a winning combination is not formed, and the routine ends.

Meanwhile, when the flag is activated (S12, YES), it is determined whether or not the winning combination formed in the combination determination process in S8 includes a "Blue 7." Specifically, when the winning combination includes a "Blue 7" (S13, YES), the routine ends after the number of coins are paid out in accordance to the winning combination (S17).

Meanwhile, when the winning combination does not include a "BLUE 7" (S13, NO), it is determined whether or not a common game end flag is activated (S14). Specifically, it is determined whether or not data showing that the common game end flag is activated is written into a common game end flag area of the RAM 243. S14 is repeated until the common game end flag is activated (S14 NO). When the common game end flag is activated (S14, YES), a free game process is carried out (S15). Then, the routine ends.

(Reel Setting Mode Process)

Figure 74:
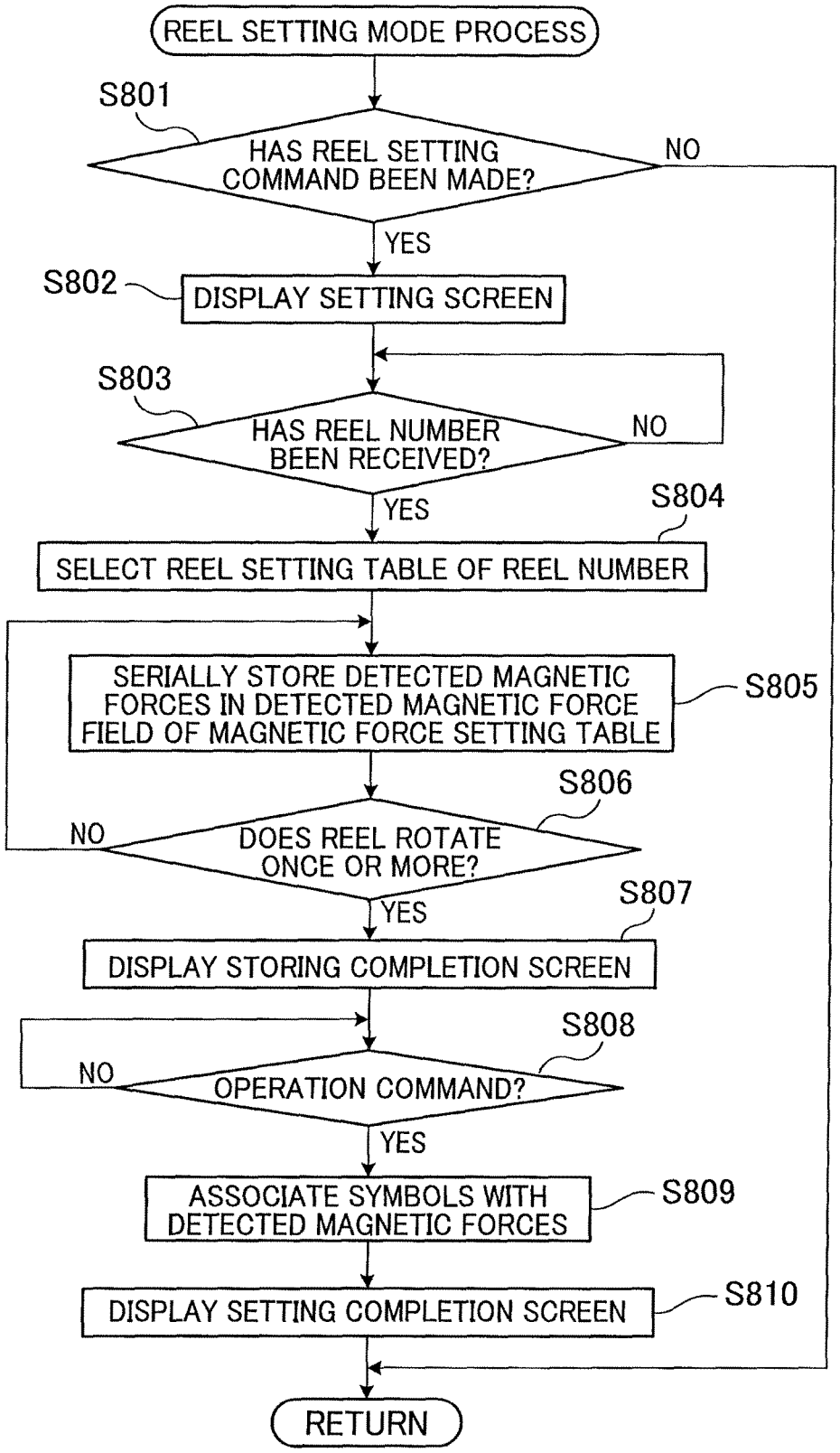
FIG. 74 is a flowchart of a reel setting mode process.

Referring to FIG. 74, a reel setting mode process will be described.

First, whether a reel setting command has been made is determined (S801). When the reel setting command has not been made (S801, NO), the process is terminated. On the other hand, as shown in FIG. 67, as the reel setting unit 635 is connected to the slot machine 10 to be able to perform data communication therewith, the detection of this connection is recognized that the reel setting command has been made (S801, YES). Alternatively, the reel setting command may be done by sending a reel setting command signal to the main body PCB 110 of the slot machine 10 by operating a key of the reel setting unit 635. Thereafter, the slot machine 10 instructs the reel setting unit 635 to display a setting screen. As a result, the reel setting unit 635 displays a process and a manual of reel setting (S802).

Subsequently, as the operator operates a key of the reel setting unit 635, whether a data signal of a reel number has been received from the reel setting unit 635 is determined (S803). If not received (S803, NO), the signal is waited for as the step S803 is conducted again. On the other hand, if the data signal of the reel number has been received (S803, YES), the first to fifth reel units M11*a*-M11*e* corresponding to the reel number are selected as setting targets, and the following processes are carried out.

The operator who has specified the reel number manually rotates the reels M3 of the first to fifth reel units M11*a* to M11*e* corresponding to the reel number. Along with this, whether the reel M3 has rotated once or more is determined (S806). When the reel M3 is not rotated once or more (S806: NO), the rotation of the reel M3 is continued. On the other hand, when it is determined that the reel M3 is rotated once or more (S806: YES), it is indicated that a plurality of, e.g., 200 detected magnetic forces for at least one rotation have been stored in a detected magnetic force field of a magnetic force setting table shown in FIG. 71, and a storing completion screen is displayed (S807). This screen notifies the operator that the rotation of the reel M3 may be stopped, and hence the operator stops the operation of storing the detected magnetic forces generated in accordance with the rotation of the reel M3.

Subsequently, a symbol specifying operation is carried out. That is to say, whether an operation command has been made is determined (S808). If no operation command has been made (S808: NO), the process is on standby. During this standby time, the reel M3 is rotated forward or backward. When a predetermined symbol 501 such as "JACKPOT7" reaches a predetermined position, the operation command is made. When it is determined that the operation command has been made (S808: YES), the type of the symbol 501 at the timing of the operation command is specified and all symbols 501 are associated with the detected magnetic forces (S809). Then a setting completion screen is displayed (S810) and the routine is completed.

Therefore, even if the positional relationship between the symbols 501 and the reel home position is not determined in advance, it is possible to set, by specifying the relation between the symbols and the detected magnetic values of the magnetic force detection signals, the positional relationship between the symbols 501 lined up on the reel M3 and the reel home position, based on the magnetic force detection signals and the reel home position. As a result, it is possible to reduce the workload required for lining up the symbols 501 on the outer circumferential surface of the reel M3, as compared to the case where the symbols 501 are lined up while the positions thereof are determined based on a predetermined position (home position) of the reel M3.

(Reel Rotation Stop Process)

Figure 75:
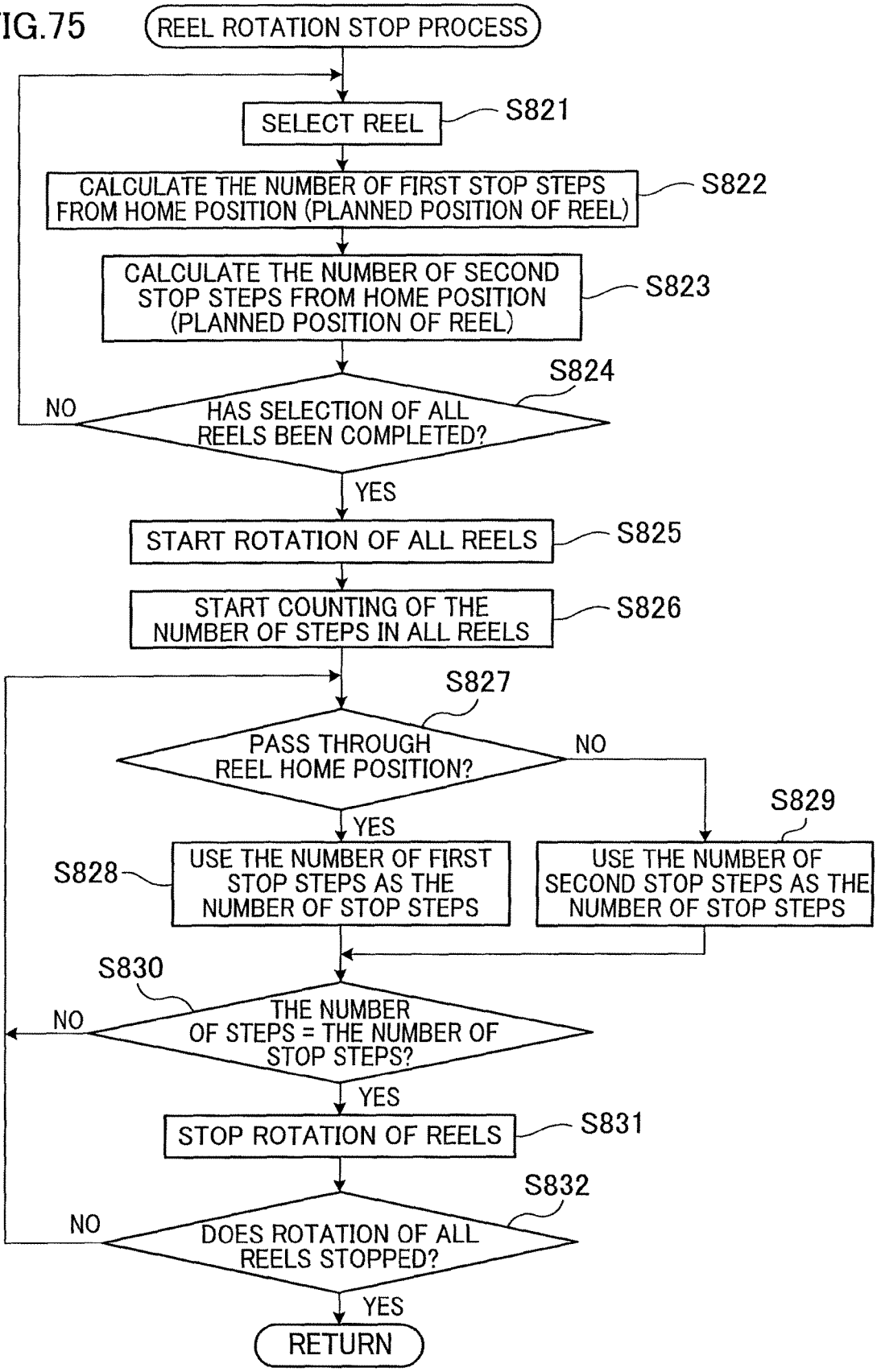
FIG. 75 is a flowchart of a reel rotation stop process.

In the base game process shown in FIG. 72, the steps 39 to S11 are, as shown in FIG. 75, executed in the reel rotation stop process. It is noted that the reel rotation stop process may be executed each time a unit game which is not a base game, such as a free game is executed, or may be executed each time the reel M3 is stopped.

First, a reel M3 is selected (S821). Then planned position is determined so that the symbols 501 of the determined combination are rearranged and stopped. That is to say, the number of first stop steps from the reel home position of the selected reel M3 is calculated (S822). Furthermore, the number of second stop steps is calculated by subtracting the number of previously-counted steps from the number of first stop steps (S823).

Figure 77:
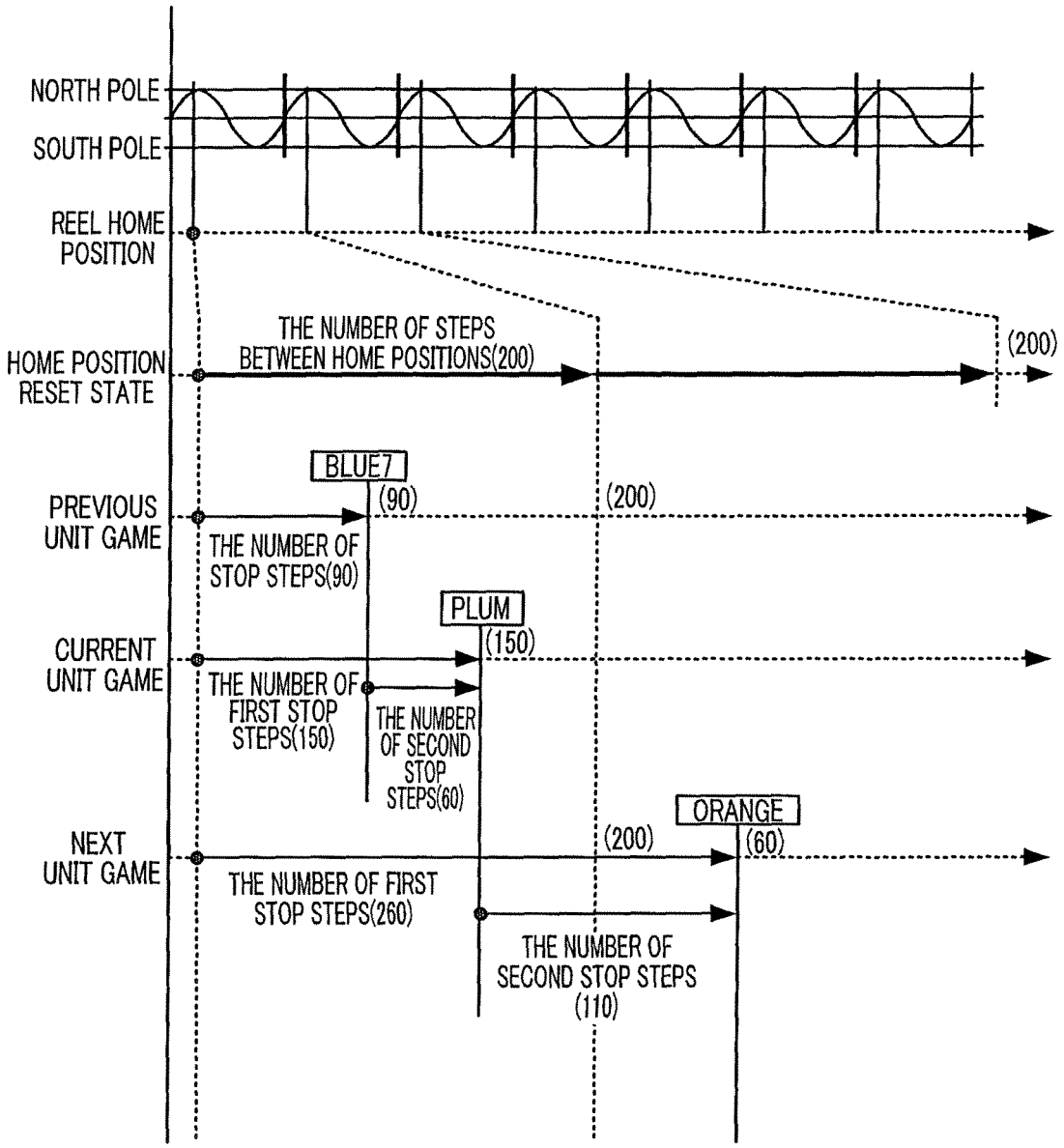
FIG. 77 illustrates the reel rotation stop process.

For example, as shown in FIG. 77, when in the previous unit game the "BLUE7" symbol 501 has been rearranged and the "PLUM" symbol 501 is to be rearranged in the current unit game, the number of first stop steps is determined to be "150" which is the number from the reel home position to "PLUM". Then the number of stop steps of the "BLUE7" of the previous game, i.e., "90" is subtracted from the number "150" of the first stop steps, so that "60" is the number of second stop steps from the "BLUE7" to the "PLUM" is calculated. Furthermore, if the "ORANGE" symbol is to be stopped and displayed in the subsequent unit game, the number of first stop steps from the reel home position is "260" and the number of second stop steps from the "PLUM" is "110".

While in the present embodiment the number of second stop steps is calculated by subtracting the number of previous stop steps from the number of first stop steps which is the total number of steps, the number of second stop steps may be calculated such that the current stop position is set as the home position and the number of steps from this home position to the planned position is added.

Whether the selection has been completed for all reels M3 is determined (S825), and the planned position of each reel M3 is determined. When the planned positions are determined for all reels M3 (3824: YES), the rotation of all reels M3 starts (S825). Also, the counting of the number of steps in all reels M3 starts (S826).

Whether to pass through the reel home position during the rotation of the reel M3 is determined (S827). If passing through the reel home position (S827: YES), the number of first stop steps is used as the number of stop steps (3828). This is because the position determination from the reel home position is carried out by resetting the number of steps to zero when passing through the reel home position. This makes it possible to set the planned position within the number of stop steps in one rotation of the reel M3 (e.g., within 200 stop steps) even if the reel M3 is rotated more than once.

On the other hand, when not passing through the reel home position (S827: NO), the number of second stop steps is used as the number of stop steps (3829). This is because there is a case where a symbol must be stopped at the reel planned position while the reel home position has not bee reset, such as an effect of slightly rotating the reel M3.

Thereafter, whether the number of steps is identical with the number of stop steps is determined (S830). If not identical (S830: NO), the steps are executed from S827 and the rotation of the reel M3 is continued. If identical (S830: YES), the rotation of the reel is stopped (S831). Whether the rotation of all reels M3 has been stopped is determined (S832), and the steps are executed again from S827 if the rotation of at least one of the reels M3 has not been stopped (S832: NO). When the rotation of all reels M3 is stopped (3832: YES), the routine finishes.

Figure 78:
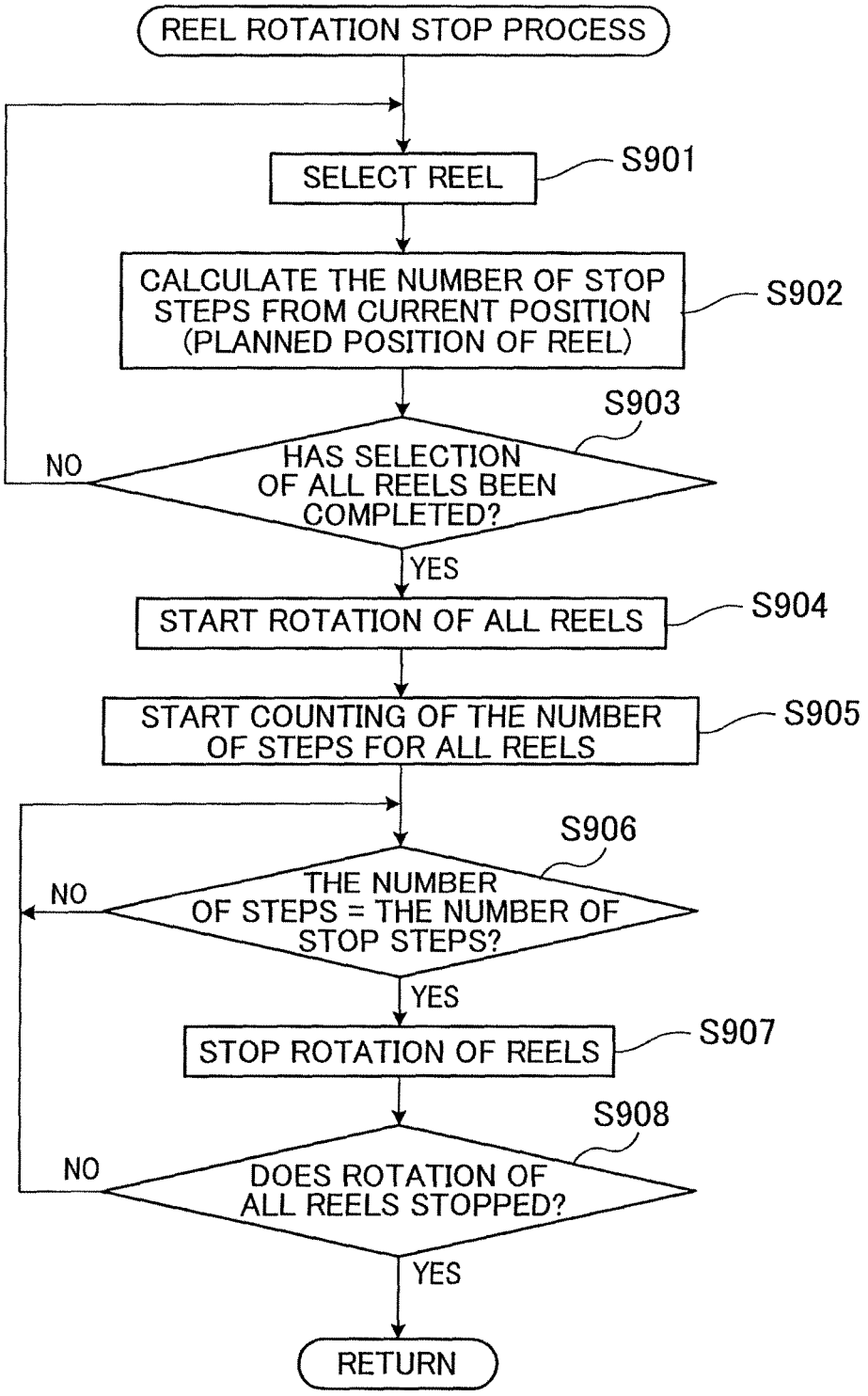
FIG. 78 is a flowchart of a reel rotation stop process.

While in the reel rotation stop process above the reels M3 are stopped with reference to the number of first stop steps and the number of second stop steps, the disclosure is not limited to this arrangement. That is to say, as shown in FIG. 78, after a reel M3 is selected (S901), the planned position is determined so that the symbols 501 of the determined combination are stopped and rearranged. In other words, the number of stop steps from the current position of the selected reel M3 is calculated (S902). For example, in FIG. 77, until the reel home position is reset at a predetermined trigger timing, the progress of the unit game relies solely on "the number of second stop steps". More specifically, after the reel home position is reset at the predetermined trigger timing and the number of stop steps of the "BLUE7" is determined to be "90" and the symbol is stopped, the number of the steps from the "BLUE7" to the "PLUM", which is "60", is determined as the number of stop steps, as the planned position of the "PLUM" in the current unit game. Furthermore, as the planned position of the "ORANGE" in the subsequent unit game, the number of steps from the "PLUM" to the "ORANGE", which is "110", is determined as the number of stop steps.

Whether the selection has been completed for all reels M3 is determined (S903), and the planned position of each reel M3 is determined. When the planned positions of all reels M3 are determined (S903: YES), the rotation of all reels M3 is started (S904) and the counting of the steps in all reels M3 is started (S905).

Thereafter, whether the number of steps is identical with the number of stop steps or not is determined (S906). If not identical (S906: NO), the step S906 is executed and the rotation of the reels M3 is continued. If identical (S906: YES), the rotation of the reels is stopped (S907). Whether the rotation of all reels M3 is stopped is determined (S908), and the steps are executed again from S906 if the rotation of at least one of the reels M3 is not stopped (S908: NO), S906. When the rotation of all reels M3 is stopped (S908: YES), the routine finishes.

(Step Deviation Correction Process)

Figure 76:
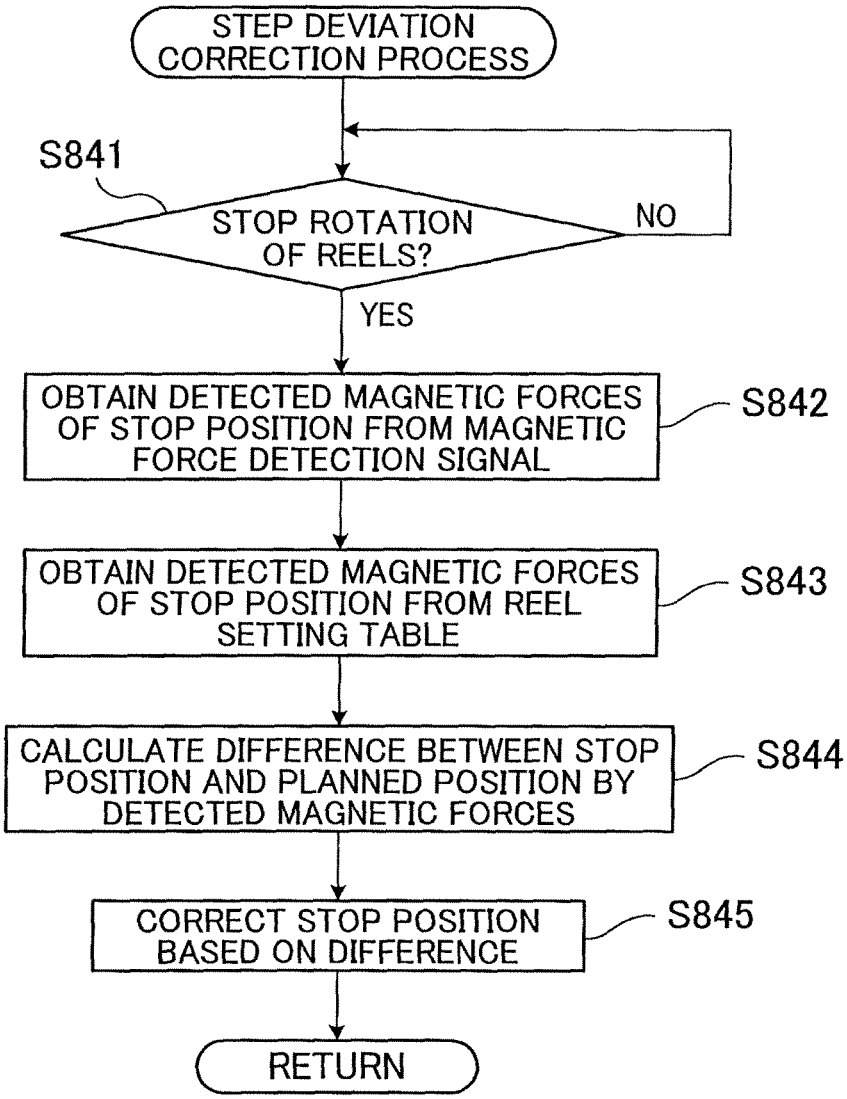
FIG. 76 is a flowchart of a step deviation correction process.

While the reel rotation stop process is being executed as above, as shown in FIG. 76, the step deviation correction process is also being executed. More specifically, whether the rotation of each reel M3 is stopped is determined (S841). If not stopped (S841: NO), the step S841 is executed again. On the other hand, if the reel M3 is stopped (S841: YES), the detected magnetic forces of the stop position are obtained from the magnetic force detection signal (S842). Then the detected magnetic forces of the planned position is obtained from the reel setting table (S843), and the difference between the stop position and the planned position is calculated based on the detected magnetic forces (S844). Thereafter, the stop position is adjusted based on the difference. In other words, the difference is used as a correction value of the number of second stop steps, when the planned position is calculated next time (S845). Then the routine finishes. The adjustment of the stop positions may be carried out by rotating the reel M3 by the difference. In such a case, operations such as the correction of the number of second stop steps are unnecessary.

The above embodiment thus described solely serves as a specific example of the present invention, and the present invention is not limited to such an example. Specific structures and various means may be suitably designed or modified. Further, the effects of the present invention described in the above embodiment are not more than examples of most preferable effects achievable by the present invention. The effects of the present invention are not limited to those described in the embodiments described above.

The detailed description of the present invention provided hereinabove mainly focused on characteristics thereof for the purpose of easier understanding; however, the scope of the present invention shall be construed as broadly as possible, encompassing various forms of other possible embodiments, and therefore the present invention shall not be limited to the above description. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process executed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes executed in the steps or blocks, these processes are essentially executed by various devices. Further, the other structures necessary for the steps or blocks are obvious from the above descriptions. The detailed description of the present invention provided hereinabove includes a process executed on a computer. The above descriptions and expressions are provided to allow the one skilled in the art to most efficiently understand the present invention. A process executed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes executed in the steps or blocks, these processes are essentially executed by various devices. Further, the other structures necessary for the steps or blocks are obvious from the above descriptions.

The detailed description above includes First and Second Embodiments. The arrangements disclosed in these embodiments are properly combined with one another. By combining the arrangements, it is possible to provide a gaming machine and a control method thereof, which realizes better entertainment characteristics.

What is claimed is:

1. A reel device comprising:

a reel having an outer circumferential surface on which symbols are lined up; and a reel driving mechanism which is provided on an inner circumference side of the reel and rotates the reel to rearrange the symbols, the reel including a blade mechanism surrounding at least a portion of the reel driving mechanism, which causes air on the inner circumference side of the reel to flow toward a center of rotation of the reel so as to cool the reel driving mechanism.

2. The reel device according to claim 1, wherein, the reel driving mechanism includes:

a reel motor which exerts a rotational force to the reel; and a heat sink which dissipates heat by enlarging the size of a surface of the reel motor.

3. The reel device according to claim 1, wherein, the reel includes:

an annular reel band on which the symbols are lined up; and a reel frame which has the annular reel band on the outer circumferential side and the blade mechanism on the inner circumference side.

4. The reel device according to claim 3, wherein, the reel frame includes:

a drive-side reel frame supporting one end of the annular reel band;

a driven-side reel frame supporting the other end of the annular reel band; and a reel supporting member which is connected to the drive-side reel frame and receives a rotational force from the reel driving mechanism, the blade mechanism having a plurality of plate portions provided on the reel supporting member to flow air forward or backward with respect to a position where the reel driving mechanism is provided.

5. A gaming machine comprising:

a reel having an outer circumferential surface on which symbols are lined up; and a reel driving mechanism which is provided on an inner circumference side of the reel and rotates the reel to rearrange the symbols, the reel including a blade mechanism surrounding at least a portion of the reel driving mechanism, which causes air on the inner circumference side of the reel to flow toward a center of rotation of the reel so as to cool the reel driving mechanism.

* * * * *